US006140985A

United States Patent [19]

Kanai et al.

[11] Patent Number: 6,140,985

[45] **Date of Patent: *Oct. 31, 2000**

[54] IMAGE DISPLAY APPARATUS

[75] Inventors: Izumi Kanai, Atsugi; Hidetoshi Suzuki, Fujisawa; Hideaki Mitsutake, Yokohama; Kohei Inamura, Zama; Noritake Suzuki, Atsugi; Masaaki Iwane, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/658,080

[22] Filed: Jun. 4, 1996

[30] Foreign Application Priority Data

| | | | |
|---|---|---|---|
| Jun. 5, 1995 | [JP] | Japan | 7-137930 |
| Jun. 5, 1995 | [JP] | Japan | 7-137931 |
| Jan. 12, 1996 | [JP] | Japan | 8-003802 |
| Jan. 12, 1996 | [JP] | Japan | 8-003872 |
| Jan. 26, 1996 | [JP] | Japan | 8-012291 |
| Feb. 1, 1996 | [JP] | Japan | 8-016724 |
| Feb. 27, 1996 | [JP] | Japan | 8-039881 |
| Feb. 27, 1996 | [JP] | Japan | 8-039882 |
| Apr. 6, 1996 | [JP] | Japan | 8-141674 |

[51] Int. Cl.[7] ..... G09G 3/22

[52] U.S. Cl. ..... 345/74; 345/75

[58] Field of Search ..... 345/74, 75

[56] References Cited

U.S. PATENT DOCUMENTS

| | | | |
|---|---|---|---|
| 4,780,755 | 10/1988 | Knierim | 358/10 |
| 4,958,104 | 9/1990 | Suzuki et al. | 313/495 |
| 5,066,883 | 11/1991 | Yoshioka et al. | 313/309 |

(List continued on next page.)

FOREIGN PATENT DOCUMENTS

| | | |
|---|---|---|
| 0288168 | 10/1988 | European Pat. Off. . |
| 0404182 | 12/1990 | European Pat. Off. . |
| 0456923 | 11/1991 | European Pat. Off. . |

(List continued on next page.)

OTHER PUBLICATIONS

W.P. Dyke, et al., "Field Emission", Advances in Electronics and Electron Physics, vol. VIII, pp. 89–185 (1956).

C.A. Spindt, et al., "Physical Properties of Thin–Film Field Emission Cathodes with Molybdenum Cones", Journal of Applied Physics, vol. 47, No. 12, pp. 5248–5263 (Dec. 1976).

C.A. Mead, "Operation of Tunnel–Emisson Devices", Journal of Applied Physics, vol. 32, No. 4, pp. 646–652 (Apr. 1961).

M.I. Elinson, et al., "The Emission of Hot Electrons and the Field Emission of Electrons From Tin Oxide", Radio Engineering and Electronic Physics, No. 7, pp. 1290–1296 (Jul. 1965).

(List continued on next page.)

*Primary Examiner*—Amare Mengistu
*Assistant Examiner*—Ricardo Osorio
*Attorney, Agent, or Firm*—Fitzpatrick, Cella, Harper & Scinto

[57] ABSTRACT

In an image display apparatus including a multi-electron beam source having a plurality of electron-emitting devices (51) wired in a matrix using a plurality of column wiring layers and a plurality of row wiring layers, and a plurality of phosphors which are excited to emit light upon irradiation of electron beams, a delta arrangement of phosphors is realized with the simple arrangement of the multi-electron beam source. The column and row wiring layers are straight layers, the plurality of phosphors (R, G, and B) are arranged in a delta arrangement, and the multi-electron beam source is adjusted such that a plurality of electron beams emitted therefrom reach the phosphors. For this reason, the directions of electrons emitted from the devices on an odd ((2p−1)th) row and an even (2pth) row along orbits are reversed.

12 Claims, 83 Drawing Sheets

U.S. PATENT DOCUMENTS

| | | | |
|---|---|---|---|
| 5,100,222 | 3/1992 | Minoura et al. | 359/455 |
| 5,132,809 | 7/1992 | Kikuchi et al. | 358/403 |
| 5,146,365 | 9/1992 | Minoura et al. | 359/619 |
| 5,155,416 | 10/1992 | Suzuki et al. | 315/366 |
| 5,185,554 | 2/1993 | Nomura et al. | 313/495 |
| 5,191,472 | 3/1993 | Kurematsu et al. | 359/619 |
| 5,208,620 | 5/1993 | Mitsutake et al. | 353/74 |
| 5,262,759 | 11/1993 | Moriconi et al. | 345/30 |
| 5,298,892 | 3/1994 | Shapiro et al. | 340/784 |
| 5,455,597 | 10/1995 | Nakamura et al. | 345/75 |
| 5,500,743 | 3/1996 | Sakaegi et al. | 358/403 |
| 5,505,647 | 4/1996 | Sato et al. | 445/25 |
| 5,593,335 | 1/1997 | Suzuki et al. | 445/50 |
| 5,594,296 | 1/1997 | Mitsutake et al. | 313/309 |

FOREIGN PATENT DOCUMENTS

| | | | |
|---|---|---|---|
| 0537428 | 4/1993 | European Pat. Off. . | |
| 0591683 | 4/1994 | European Pat. Off. . | |
| 0605881 | 7/1994 | European Pat. Off. . | |
| 0619595 | 10/1994 | European Pat. Off. . | |
| 0631295 | 12/1994 | European Pat. Off. . | |
| 0663660 | 7/1995 | European Pat. Off. . | |
| 0708433 | 4/1996 | European Pat. Off. . | |
| 64-31332 | 2/1989 | Japan . | |
| 2257551 | 10/1990 | Japan . | |
| 3-64046 | 10/1991 | Japan . | |
| 364046 | 10/1991 | Japan . | |
| 6-233131 | 8/1994 | Japan . | |
| 0158366 | 1/1990 | United Kingdom | G02F 1/133 |

OTHER PUBLICATIONS

G. Dittmer, "Electrical Conduction and Electron Emission of Discontinuous Thin Films", Thin Solid Films, vol. 9, pp. 317–328 (1972).

M. Hartwell, et al., "Strong Electron Emission From Patterned Tin–Indium Oxide Thin Films", International Electron Devices Meeting, pp. 519–521 (1975).

H. Araki, et al., "Electroforming and Electron Emission of Carbon Thin Films", Journal of the Vacuum Society of Japan, vol. 26, No. 1, pp. 22–29 (Sep. 24, 1956).

R: RED PHOSPHOR
G: GREEN PHOSPHOR
B: BLUE PHOSPHOR

IMAGE DISPLAY APPARATUS

BACKGROUND OF THE INVENTION

1. Field of the Invention

The present invention relates to an image display apparatus for performing a fluorescent display operation by using a multi-electron beam source having a plurality of electron-emitting devices wired in the form of a matrix and, more particular, to an image display apparatus using a surface-conduction type electron-emitting device as an electron-emitting device.

2. Related Background Art

Conventionally, two types of devices, namely hot and cold cathode devices, are known as electron-emitting devices. Examples of cold cathode devices are surface-conduction type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

Known examples of the FE type electron-emitting devices are described in W. P. Dyke and W. W. Dolan, "Field Emission", Advance in Electron Physics, 8, 89 (1956) and C. A. Spindt, "Physical Properties of thin-film field emission cathodes with molybdenum cones", J. Appl. Phys., 47, 5248 (1976). FIG. 71 is a sectional view of an FE type electron-emitting device. Referring to FIG. 71, reference numeral 81 denotes a substrate; 101, an emitter wiring layer made of a conductive material; 102, an emitter cone; 103, an insulating layer; and 104, a gate electrode. In the FE type, a voltage is applied between the emitter cone 102 and the gate electrode 104 to emit electrons from the distal end portion of the emitter cone 102.

A known example of the MIM type electron-emitting devices is described in C. A. Mead, "Operation of Tunnel-Emission Devices", J. Appl. Phys., 32,646 (1961). FIG. 72 is a sectional view of an MIM type electron-emitting device. Referring to FIG. 72, reference numeral 105 denotes a lower electrode made of a metal; 106, a thin insulating layer having a thickness of about 100 Å; and 107, an upper electrode made of a metal and having a thickness of about 80 to 300 Å. In the MIM type, a voltage is applied between the upper electrode 107 and the lower electrode 105 to emit electrons from the surface of the upper electrode 107.

A known example of the surface-conduction type electron-emitting devices is described in, e.g., M. I. Elinson, "Radio Eng. Electron Phys.", 10, 1290 (1965) and other examples to be described later. The surface-conduction type electron-emitting device utilizes the phenomenon that electron emission is caused in a small-area thin film, formed on a substrate, by passing a current parallel to the film surface. The surface-conduction type electron-emitting device includes electron-emitting devices using an Au thin film (G. Dittmer, "Thin Solid Films", 9,317 (1972)), an $In_2O_3/SnO_2$ thin film (M. Hartwell and C. G. Fonstad, "IEEE Trans. ED Conf.", 519 (1975)), a carbon thin film (Hisashi Araki et al., "Vacuum", vol. 26, No. 1, p. 22 (1983), and the like, in addition to an $SnO_2$ thin film according to Elinson mentioned above.

FIG. 70 is a plan view of the surface-conduction type electron-emitting device according to M. Hartwell et al. as a typical example of the structures of these surface-conduction type electron-emitting devices. Referring to FIG. 70, reference numeral 81 denotes a substrate; 84, a conductive thin film made of a metal oxide formed by spattering.

This conductive thin film 84 has an H-shaped pattern, as shown in FIG. 70. An electron-emitting portion 83 is formed by performing an electrification process (referred to as a forming process to be described later) with respect to the conductive thin film 84. Referring to FIG. 70, an interval L is set to 0.5 to 1 mm, and a width W is set to 0.1 mm. The electron-emitting portion 83 is shown in a rectangular shape at the center of the conductive thin film 84 for the sake of illustrative convenience, however, this does not exactly show the actual position and shape of the electron-emitting portion.

In the above surface-conduction type electron-emitting devices by M. Hartwell et al., typically the electron-emitting portion 83 is formed by performing electrification process called the forming process for the conductive thin film 84 before electron emission. According to the forming process, electrification is performed by applying a constant DC voltage which increases at a very low rate of, e.g., 1 V/min., to both ends of the conductive film 84, so as to partially destroy or deform the conductive film 84, thereby forming the electron-emitting portion 83 with an electrically high resistance. Note that the destroyed or deformed part of the conductive thin film 84 has a fissure. Upon application of an appropriate voltage to the conductive thin film 84 after the forming process, electron emission is performed near the fissure.

The above surface-conduction type electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction type electron-emitting devices to, e.g., image forming apparatuses such as an image display apparatus and an image recording apparatus, charged beam sources and the like have been studied.

As an application to image display apparatuses, in particular, as disclosed in the U.S. Pat. No. 5,066,833 and Japanese Patent Laid-Open No. 2-257551 filed by the present applicant, an image display apparatus using the combination of an surface-conduction type electron-emitting device and a phosphor which emits light upon irradiation of an electron beam has been studied. This type of image display apparatus is expected to have more excellent characteristic than other conventional image display apparatuses. For example, in comparison with recent popular liquid crystal display apparatuses, the above display apparatus is superior in that it does not require a backlight since it is of a light emissive type and that it has a wide view angle.

A display apparatus preferably has a delta arrangement in which red (R), green (G), and blue (B) pixels are arranged in a triangular form, as shown in FIG. 73A, because this structure makes the vertical stripes inconspicuous unlike a stripe arrangement. As shown in FIG. 73A, the same color pixels on two lines vertically adjacent to each other are shifted a 1.5 pitch in the row direction. In order to manufacture a display apparatus having such a delta arrangement, column wiring layers 54 are arranged in zig-zag lines as shown in FIG. 73B (Japanese Patent Publication No. 3-64046). Referring to FIG. 73B, reference numeral 55 denotes a row wiring layer; and 86, a electron-emitting device.

In the display apparatus having the delta arrangement, the zig-zag arrangement of the column wiring layers makes the manufacturing process complicated as compared with the case wherein the column wiring layers are straight. In addition, disconnection of wiring layers tend to occur, and the wiring resistance increases.

SUMMARY OF THE INVENTION

The present invention, therefore, has been made in consideration of the above problems, and has as its object to provide an image display apparatus in which phosphors are arranged in a delta arrangement with column wiring layers of electron-emitting devices being kept straight.

In order to solve the above problems, the present inventors have made extensive studies to obtain the following invention. An image display apparatus of the present invention comprising a multi-electron beam source having a plurality of electron-emitting devices wired in a matrix using a plurality of column wiring layers and a plurality of row wiring layers, and a plurality of phosphors which are excited to emit light upon irradiation of electron beams is characterized in that the column and row wiring layers are straight layers, said phosphors have a delta arrangement, and said multi-electron beam source is adjusted such that a plurality of electron beams emitted therefrom reach the phosphors. In this case, a pulse width-modulated luminance signal is preferably supplied to the column wiring layer, and a scanning signal is preferably supplied to the row wiring layer to perform an image display operation. The number of the plurality of electron-emitting devices is preferably equal to a number of intersections between the plurality of column wiring layer and the plurality of row wiring layers. The electron-emitting device preferably has a pair of electrodes and an electron-emitting portion arranged side by side on a substrate surface, and the emitted electron beam preferably has an initial velocity component in the direction parallel to the surface.

In the present invention, the electron beam can propagate within a plane perpendicular to the column wiring layer. In this case, the electron-emitting devices on odd and even rows may emit electron beams in opposite directions. In addition, the ratio of the number of electron-emitting devices to the number of phosphor (pixels) is preferably 1:1. The electron-emitting devices on the odd and even rows are connected to the same column wiring layer in the same direction, and can emit electron beams in opposite directions upon application of voltages having opposite polarities. The voltages having opposite polarities are equal in absolute value. In this case, polarities of the luminance and scanning signals respectively supplied to the column and row wiring layers can be inverted at one-horizontal scanning intervals or one-field scanning. In this case, luminance signals of different colors may be switched and supplied to the same column wiring layer at the one-horizontal scanning intervals or one-field scanning intervals. This field scanning operation is performed in the interlaced scanning mode. Beside, luminance signals of the same color may be supplied to the same column wiring layer regardless of a row to be scanned.

In the present invention, when the electron beam is caused to propagate within a plane perpendicular to the column wiring layer, the direction of an electron beam emitted from the same electron-emitting device may be reversed in the second half of a one-horizontal scanning interval. In this case, a luminance signal of a color is supplied in the second half of the one-horizontal scanning interval with a shift from a signal of a color supplied in the first half of the one-horizontal scanning interval with respect to a column wiring layer. The shift may occur to the right by one bit when an odd row is scanned, and occur to the right by two bits when an even row is scanned. Alternatively, the shift may occur to the right by one bit when an even row is scanned, and occur to the right by two bits when an odd row is scanned. In addition, the shift may occur to the right by one bit only when an odd row is scanned, or may occur to the right by one bit only when an even row is scanned. The shifts may be switched at one-horizontal scanning intervals or one-field scanning intervals. The field scanning operation is performed in the interlaced scanning mode. In this case, the center of the phosphor of each color on an odd row may be located immediately above a point where an interval between electron-emitting portions of adjacent electron-emitting devices is divided at 1:1, and the center of the phosphor of each color on an even row may be located immediately above the electron-emitting portion of each electron-emitting device. Alternatively, the center of the phosphor of each color on an odd row may be located immediately above the electron-emitting portion of each electron-emitting device, and the center of the phosphor of each color on an even row may be located immediately above a point where an interval between electron-emitting portions of adjacent electron-emitting devices is divided at 1:1.

In the present invention, when the electron beam is caused to propagate within a plane perpendicular to the column wiring layer, the electron-emitting devices on the odd and even rows may be connected to the same column wiring layer in opposite directions, and may emit electron beams in opposite directions upon application of voltages having the same polarity. In this case, the electron-emitting devices may be caused to emit electron beams in directions to separate from the column wiring layer. Alternatively, the electron-emitting devices may be caused to emit electron beams in directions to approach the column wiring layer. When the electron beams are to be emitted in the directions to be apart from the column wiring layer, luminance signals of the same color are preferably supplied to the same column wiring layer regardless of a row to be scanned. In addition, it is preferable that a negative luminance signal be always supplied to the column wiring layer, and a positive scanning signal be always supplied to the row wiring layer. When the electron beams are emitted in the directions to approach the column wiring layer, luminance signals of different colors may be supplied to the same column wiring layer at one-horizontal scanning intervals or one-field scanning intervals. In this case, it is preferable that the positive signal be always output to the column wiring layer, and a negative scanning signal be always output to the row wiring layer. When the electron-emitting devices on odd and even rows are connected to the same column wiring layer in opposite directions to emit electron beams in opposite directions, the center of the phosphor of each color is located immediately above a point where an interval between electron-emitting portions of adjacent electron-emitting devices is divided at 3:1.

In the present invention, when the electron beam is caused to propagate within a plane perpendicular to the column wiring layer, the electron-emitting devices on the odd and even rows are connected to the same column wiring layer in the same direction, and voltages having the same polarity may be applied to the devices. In this case, a position where the electron beam reaches may be adjusted by changing a voltage of a luminance signal supplied to the column wiring layer depending on whether an odd or even row is to be scanned, or a position where the electron beam reaches may be adjusted by changing a voltage of a scanning signal depending on whether an odd or even row is to be scanned. Alternatively, a position where the electron beam reaches may be adjusted by changing a voltage applied between the electron-emitting device and the phosphor depending on whether an odd or even row is to be scanned. In this case, the brightness of the phosphor between an odd and even row should be corrected. The correction may be performed by using a multiplier, or correction may be performed on the basis of a clock count. In addition, the electron-emitting devices on the odd and even rows may be adjusted to emit electrons in different amounts even with the same applied voltage. In these cases, the center of the phosphor of each color on an odd row may be located immediately above a point where an interval between electron-emitting portions of adjacent electron-emitting devices is divided at 1:1, and the center of the phosphor of each color on an even row may be located immediately above the electron-emitting portion of each electron-emitting device. Alternatively, the center of the phosphor of each color on an odd row may be located immediately above the electron-emitting portion of each electron-emitting device, and the center of the phosphor of each color on an even row may be located immediately above a point where an interval between electron-emitting portions of adjacent electron-emitting devices is divided at 1:1. In these cases, odd and even rows may be scanned in the order named at one-horizontal scanning intervals, or luminance signals of different colors may be switched and supplied to the same column wiring layer at the one-horizontal scanning intervals. Alternatively, scanning signals may be sequentially supplied to only odd rows in a given one-field scanning interval, and scanning signals may be sequentially supplied to only even rows in the other one-field scanning interval.

The present invention described above includes an aspect in which the direction in which an electron-emitting device emits electrons upon application of a given voltage is preferably different from the direction in which the electron-emitting device emits electrons upon application of a voltage having an opposite polarity. In this case, a surface-conduction type electron-emitting device is preferably used. The present invention can also include an aspect in which an electron-emitting device emits electrons upon application of a given voltage, but emits no electrons upon application of a voltage having an opposite polarity. In this case, a preferable device includes a device such as a lateral field emission type electron-emitting device having a negative electrode also serving as an electron-emitting portion, as well as a surface-conduction type electron-emitting device. Some surface-conduction type electron-emitting device is capable of changing the electron emission amount by applying a memory voltage thereon in advance. The electron emission amount may be corrected by using this device. Alternatively, the electron emission amount may be corrected by changing the length of the electron-emitting portion. When a lateral field emission type electron-emitting device is used, the electron emission amount may be corrected by changing the number of electron-emitting portions.

In the present invention, the initial velocity of the electron beam may have the same component as that of the longitudinal axis of the column wiring layer. The angle defined by the direction of an electric field applied to the electron-emitting device and the axis of the row wiring layer is preferably equal to the angle defined by a line connecting a central portions of the adjacent phosphors and the row wiring layer. In this case, the angle may be 60° or 45°. A line having as the start point which is the center of the electron-emitting portion of the electron-emitting device and perpendicular to a plane of the multi-electron beam source preferably crosses the middle point of the adjacent phosphors at a right angle.

When the initial velocity of an electron beam has the same vector component as that of the longitudinal axis of the column wiring layer, the directions of electric fields applied to all the electron-emitting devices may be the same. In addition, the directions of electric fields applied to the electron-emitting devices on odd and even rows may be symmetrical about a plane parallel to the longitudinal axis of the row wiring layer and perpendicular to a plane of the multi-electron beam source, or directions of electric fields applied to the electron-emitting devices on odd and even columns may be symmetrical about a plane parallel to the longitudinal axis of the column wiring layer and perpendicular to a plane of the multi-electron beam source. Alternatively, the directions of electric fields applied to the electron-emitting devices on odd and even rows may be symmetrical about a plane parallel to the longitudinal axis of the row wiring layer and perpendicular to a plane of the multi-electron beam source, and directions of electric fields applied to the electron-emitting devices on odd and even columns may be symmetrical about a plane parallel to the longitudinal axis of the column wiring layer and perpendicular to a plane of the multi-electron beam source.

When the directions of electric fields applied to all the electron-emitting devices are the same, the ratio of the number of electron-emitting devices to the number of phosphors (pixels) is preferably about 1:2, and the electron-emitting devices on one row may emit electron beams onto the phosphors on two rows. When the directions of electric fields respectively applied to the electron-emitting devices on odd and even rows are symmetrical about a plane parallel to the longitudinal axis of the row wiring layer and perpendicular to a plane of the multi-electron beam source, the ratio of the number of electron-emitting devices to the number of phosphors (pixels) is preferably about 1:1. In this case, the electron-emitting devices on two rows may emit electron beams onto the phosphors on one row, or the electron-emitting devices on one row may emit electron beams onto the phosphors on one row. When the directions of electric fields respectively applied to the electron-emitting devices on odd and even rows are symmetrical about a plane parallel to the longitudinal axis of the column wiring layer and perpendicular to a plane of the multi-electron beam source, the angle defined by a line connecting central portions of the adjacent phosphors and the row wiring layer is preferably 60°, and the angle defined by the direction of an electric field applied to the electron-emitting device and the row wiring layer is preferably 45°. In addition, the electron-emitting device is preferably located immediately below a contact point between three phosphors. In this case, the ratio of the number of electron-emitting devices to the number of phosphors (pixels) is preferably about 1:1. The electron-emitting devices on two columns may emit electron beams onto the phosphors on one column, or the electron-emitting devices on one column may emit electron beams onto the phosphors on one column. A negative luminance signal may always be supplied to the column wiring layer, and a positive scanning signal may always be supplied to the row wiring layer. In addition, a positive luminance signal may always be supplied to the column wiring layer, and a negative scanning signal may always be supplied to the row wiring layer.

Assume that the directions of electric fields applied to the electron-emitting devices on odd and even rows are symmetrical about a plane parallel to the longitudinal axis of the row wiring layer and perpendicular to a plane of the multi-electron beam source, and directions of electric fields applied to the electron-emitting devices on odd and even columns are symmetrical about a plane parallel to the longitudinal axis of the column wiring layer and perpendicular to a plane of the multi-electron beam source. In this case, the ratio of the number of electron-emitting devices to the number of phosphors is preferably about 2:1, and the electron-emitting devices (4 devices) on two rows and two columns preferably emit electron beams onto one phosphor. In this case, the polarities of a luminance signal supplied to the column wiring layer and a scanning signal supplied to the row wiring layer may be switched at one-horizontal scanning intervals or one-field scanning intervals. In addition, luminance signals of different colors may be switched and supplied to the same column wiring layer at the one-horizontal scanning intervals or one-field scanning intervals. These field scanning operations are preferably performed in the interlaced scanning mode.

As an electron-emitting device used in the present invention, a device having the following characteristics is used. In a driven state (in which a device voltage is applied to the electron-emitting device to emit an electron beam), a potential distribution asymmetrical about a plane passing through an electron-emitting portion and extending to a phosphor surface perpendicular to the flat surface of a substrate 59 is produced in a space around the electron-emitting portion of the electron-emitting device.

This device will be described in detail below with reference to FIGS. 74A and 74B. FIG. 74A is a sectional view for explaining the electron-emitting device used in the present invention. Referring to FIG. 74A, reference numeral 59 denotes a substrate on which an electron-emitting device is formed; 57, the positive electrode of the electron-emitting device; 56, the negative electrode of the electron-emitting device; 53, the electron-emitting portion of the electron-emitting device; and 66, a target for an electron beam. Reference symbol Vf denotes a power supply for applying a device voltage Vf [V] to the electron-emitting device; and Va, a power supply for applying a target voltage Va [V] to the target 66. In an actual image display apparatus, the target 66 is a phosphor. In general, Va>Vf.

The electron-emitting device used in the present invention includes at least the positive electrode 57, the negative electrode 56, and the electron-emitting portion 53 as constituent members. These constituent members are formed side by side on the upper surface of the substrate 59.

The FE type electron-emitting device in FIG. 71 or the MIM type electron-emitting device in FIG. 72 has the constituent members stacked vertically on the substrate 59, and hence does not correspond to the electron-emitting device having the constituent members arranged side by side on the flat surface of the substrate, but the electron-emitting device in FIG. 70 corresponds thereto.

In such an electron-emitting device, an electron beam emitted from the electron-emitting portion 53 generally has an initial velocity component in the direction from the negative electrode 56 to the positive electrode 57. The electron beam does not therefore propagate vertically from the flat surface of the substrate.

Furthermore, in this electron-emitting device, since the positive electrode 57 and the negative electrode 56 are arranged side by side on the flat surface of the substrate 59, a potential distribution produced in a space above the electron-emitting portion 53 upon application of a device voltage Vf is asymmetrical about a plane a solid line in FIG. 74A passing through the electron-emitting portion 53 and extending normal to the flat surface of the substrate 59. FIG. 74A shows the potential distribution, in dotted lines, between the electron-emitting device and the target 66. As shown in FIG. 74A, the equipotential planes are almost parallel to the flat surface of the substrate near the target 66, but are inclined near the electron-emitting portion owing to the effect of the device voltage Vf [V]. For this reason, an electron beam emitted from the electron-emitting portion 53 simultaneously receives a force based on the inclined potential in the Z direction and a force in the X direction while it propagates in the space. As a result, the electron beam propagates along a curved orbit.

For the above two reasons, the position where the electron beam irradiated on the target 66 is shifted from the position immediately above the electron emitting portion 53 by a distance Lef in the X direction. FIG. 74B is a plan view showing the target 66 when viewed from above. Referring to FIG. 74B, reference numeral 95 denotes an electron beam irradiation position on the lower surface of the target (FIG. 74A is a sectional view taken along an alternate long and short dashed line J-J' in FIG. 74B).

For the sake of illustrative convenience, a vector Ef represents the direction and distance of the shift to generalize the manner in which the electron beam irradiation position on the target 66 is shifted from the position immediately above the electron-emitting portion 53.

First of all, the direction of the vector Ef coincides with the direction in which the negative and positive electrodes 56, 57 of the electron-emitting portion 53 are arranged on the flat surface of the substrate 59. For example, in the case shown in FIGS. 74A and 74B, since the negative and positive electrodes 56 and 57 of the electron-emitting portion 53 are arranged on the substrate 59 along the X direction, the direction of the vector Ef coincides with the X direction.

For the sake of illustrative convenience, FIGS. 75A and 75B schematically show the direction in which the electron-emitting device is formed on the substrate 59, and the direction of the vector Ef. FIG. 75A shows a case wherein the negative electrode, electron-emitting portion, and positive electrode of an electron-emitting device 96 are formed side by side on the flat surface of a substrate along the X direction. FIG. 75B shows a case wherein these constituent members are formed at an angle R with respect to the X direction.

The magnitude (i.e., Lef) of the vector Ef is determined by a distance Lh between the electron-emitting device and the target, a device voltage Vf applied to the electron-emitting device, a potential Va of the target, the type and shape of the electron-emitting device, and the like. However, this magnitude can be approximately calculated according to equation (1):

$$Lef = 2 \times K \times Lh \times \sqrt{\frac{Vf}{Va}} \tag{1}$$

where Lh [m] is the distance between the electron-emitting device and the target, Vf [V] is the device voltage applied to the electron-emitting device, Va [V] is the voltage applied to the target, and K is a constant determined by the type and shape of the electron-emitting device.

In obtaining an approximate value according to equation (1), if the type and shape of an electron-emitting device to be used are unknown, K=1 is substituted into the equation.

On the contrary, if the type and shape of the electron-emitting device are known, the constant K of the electron-emitting device is determined by an experiment or computer simulation. In order to obtain the magnitude Lef with higher precision, the value K is preferably used as a function of Vf instead of the constant. In many cases, however, it suffices to use the constant K for the precision required to design an image display apparatus.

The structure of an electron-emitting device and its manufacturing method will be described in detail next. As described above, the electron-emitting device used in the present invention comprises a positive electrode, a negative electrode, and an electron-emitting portion as constituent members, which are arranged side by side on the flat surface of a substrate (part of the negative electrode may also serve as an electron-emitting portion). As a device satisfying these requirements, a surface-conduction type electron-emitting device, a lateral field emission type electron-emitting device, or the like is available. A surface-conduction type electron-emitting device and a lateral field emission type electron-emitting device will be described in the order named.

Surface-conduction type electron-emitting devices include, for example, a device in the form shown in FIG. 70 and a device having fine particles near an electron-emitting portion. The former device includes known devices made of various materials, as described in "DESCRIPTION OF THE RELATED ART". All these devices are suitable as electron-emitting devices used in the present invention. Materials, structures, and manufacturing methods for devices associated with the latter device will be described in detail later in the first embodiment. All these devices are suitable for electron-emitting devices used in the present invention. That is, in practicing the present invention, when a surface-conduction type electron-emitting device is to be used, there are no limitations on materials, structures, manufacturing methods, and the like for the device.

As for a surface-conduction type electron-emitting device, FIGS. 76A and 76B show a vector Ef indicating the direction in which an electron beam is deflected. FIG. 76A is a sectional view. FIG. 76B is a plan view. Referring to FIGS. 76A and 76B, reference numeral 81 denotes a substrate; 97, a positive electrode; 98, a negative electrode; and 83, an electron-emitting portion. Reference symbol Vf denotes the voltage of a power supply for applying a device voltage to the device.

A lateral field emission type electron-emitting device, of field emission type electron-emitting devices, is a device having a negative electrode, an electron-emitting portion, and a positive electrode are arranged side by side along the flat surface of a substrate. For example, an FE type electron-emitting device like the one shown in FIG. 71 has a negative electrode, an electron-emitting portion, and a positive electrode are arranged in a direction perpendicular to the flat surface of a substrate 81, and hence is not categorized as a lateral type. FIGS. 77A to 77C are perspective views showing typical lateral type electron-emitting devices formed on the flat surfaces of substrates along the X direction. Referring to 77A to 77C, reference numeral 92 denotes a substrate; 38, a positive electrode; 37, a negative electrode, and 39, an electron-emitting portion. There are lateral type electron-emitting devices having various shapes other than those shown in FIGS. 77A to 77C. That is, as described with reference to FIG. 74, any device designed to deflect the orbit of an electron beam from the vertical direction is suitable for a device used in the present invention. Therefore, a device obtained by adding a modulation electrode for modulating the intensity of an electron beam to each of the aspects shown in FIGS. 77A to 77C may be used. In addition, part of the negative electrode 37 may also serves as the electron-emitting portion 39, or a member added to the negative electrode may be used as the electron-emitting portion 39. As a material for the electron-emitting portion of a lateral type electron-emitting device, a refractory metal (high melting temperature), diamond, or the like may be used. However, the present invention is not limited to these materials, and any material which allows proper emission of electrons can be used. FIGS. 78A and 78B show the direction Ef of an electron beam emitted from the actual lateral field emission type electron-emitting device. FIG. 78A is a sectional view. FIG. 78B is a plan view. A vector Ef indicates an electric field applied to an electron-emitting portion 39. As shown in FIGS. 78A and 78B, the vector Ef is parallel to a substrate 92.

According to the present invention, an image display apparatus having phosphors in a delta arrangement which allows a user to see a displayed image clearly without any conspicuous fringes can be realized by arranging column and row wiring layers in straight lines, instead of arranging them in zig-zag lines, in a multi-electron beam source. Compared with the zig-zag arrangement, this arrangement facilitates the manufacturing process. In addition, the wiring layers arranged in straight lines are not easily disconnected, not easily cause defect, and have small wiring resistances.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS (First Embodiment)

Figure 1A:
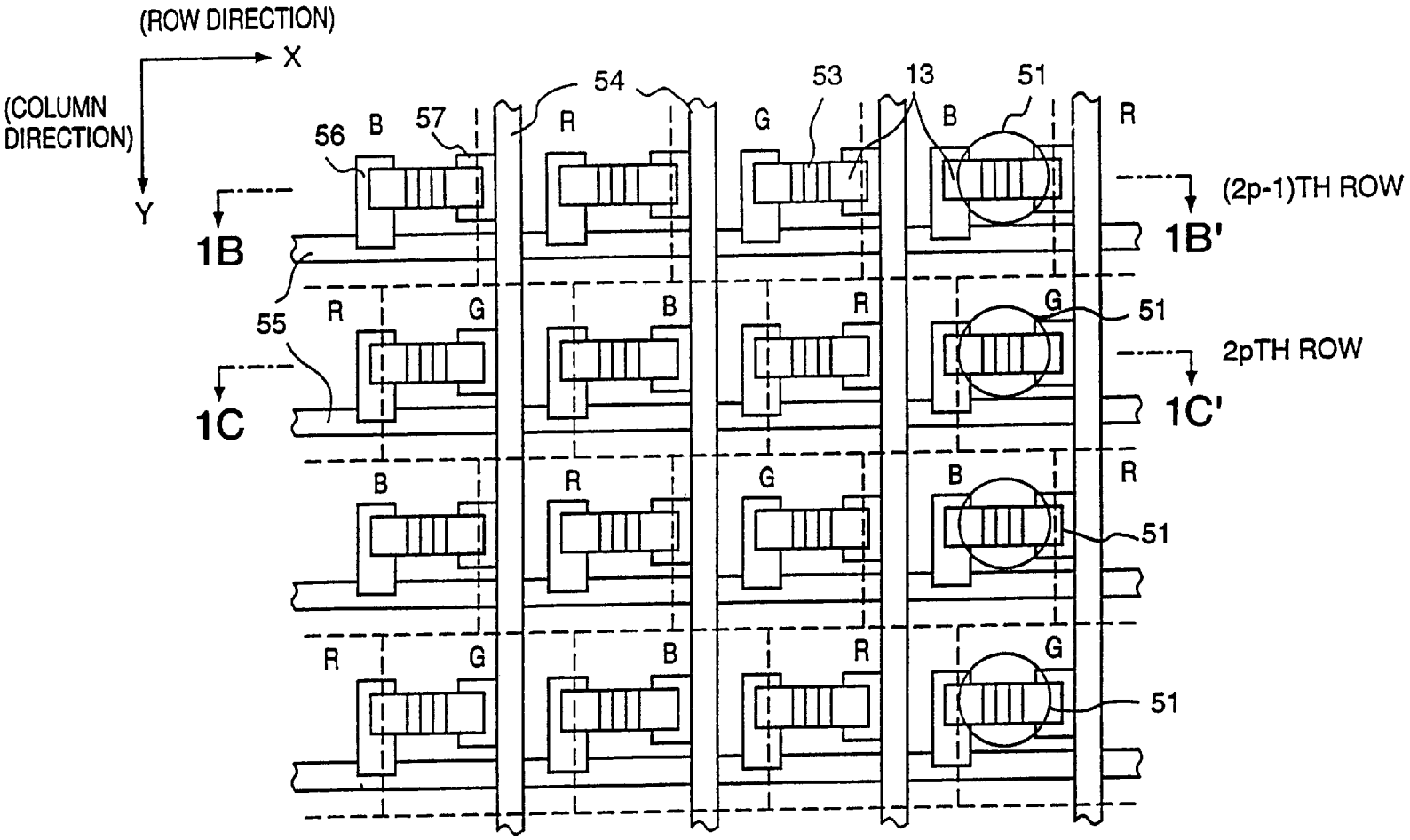
FIG. 1A is a plan view showing a multi-electron beam source in the first embodiment.
Figure 1B:
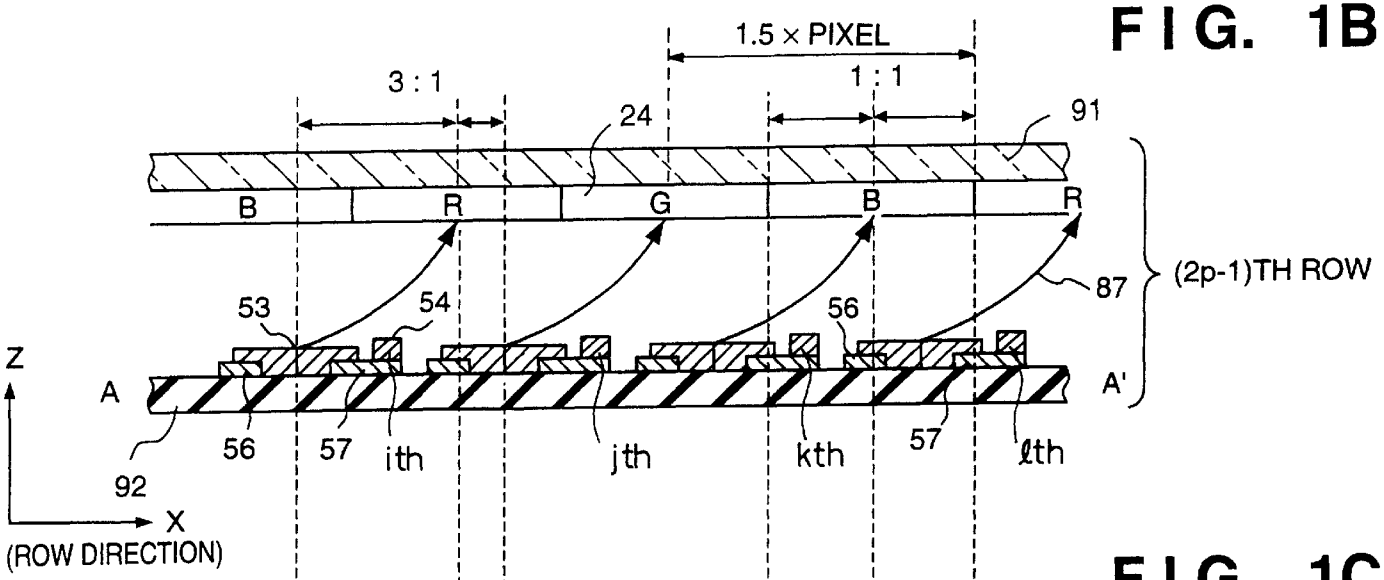
FIGS. 1B and 1C are sectional views showing the electron orbits of electrons emitted from the source.
Figure 1C:
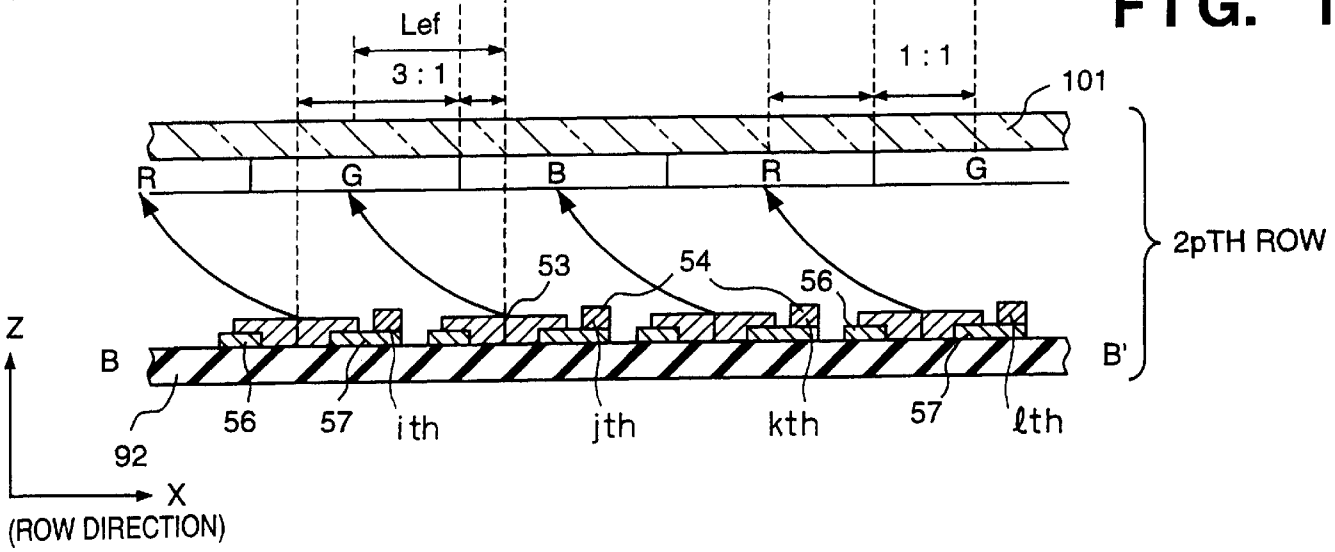

In the first embodiment, surface-conduction type electron-emitting devices are used, and the devices on odd and even rows are caused to emit electrons to the opposite directions. FIGS. 1A, 1B, and 1C are a plan view and sectional views, respectively, showing the multi-electron beam source and phosphors of a display panel according to this embodiment. FIG. 1B is a sectional view taken along the (2p−1)th (p is a natural number) row as an odd row of the multi-electron beam source in FIG. 1A, i.e., a line IB-IB'. FIG. 1C is a sectional view taken along the 2pth row as an even row of the multi-electron beam source in FIG. 1A, i.e., a line IC-IC'. Referring to FIGS. 1A to 1C, reference numeral 51 denotes an surface-conduction type electron-emitting device as an electron-emitting device; 56 and 57, device electrodes; 13, a conductive thin film; 24, a phosphor; 53, an electron-emitting portion; 54, a column wiring layer; 55, a row wiring layer; 87, an electron orbit; 91, a faceplate; and 92, a rear plate. The devices 51 on the (2p−1)th row in FIG. 1A emit electrons to the right, as shown in FIG. 1B. The devices 51 on the 2pth row emit electrons to the left, as shown in FIG. 1C. Similar to the devices 51 on the (2p−1)th and 2pth rows, the remaining devices 51 operate in the same manner although not shown. That is, the devices 51 on each odd row emit electrons to the right, and the devices 51 on each even row emit electrons to the left. The color phosphors 24 on the inner surface of the faceplate 91 are arranged in a delta arrangement, as indicated by the dotted lines in FIG. 1A. In the delta arrangement, the R, G, and B phosphors on adjacent rows are shifted from each other horizontally by 1.5 pixels. The vertical fringes are made inconspicuous as compared with the stripe arrangement. The delta arrangement therefore exhibits superior display characteristics at the same resolution. A multi-electron beam source having the row and column wiring layers arranged in straight lines, as shown in FIG. 1A, is disposed below the phosphors indicated by the dotted lines. The column and row wiring layers 54 and 55 arranged in straight lines are superior to wiring layers arranged in zig-zag lines because they are easy to manufacture, are not easily disconnected, and have small wiring resistances. Each of the devices 51 on all the rows is designed such that the right device electrode 57 is connected to the column wiring layer 54, and the left device electrode 56 is connected to the row wiring layer 55.

Figure 2:
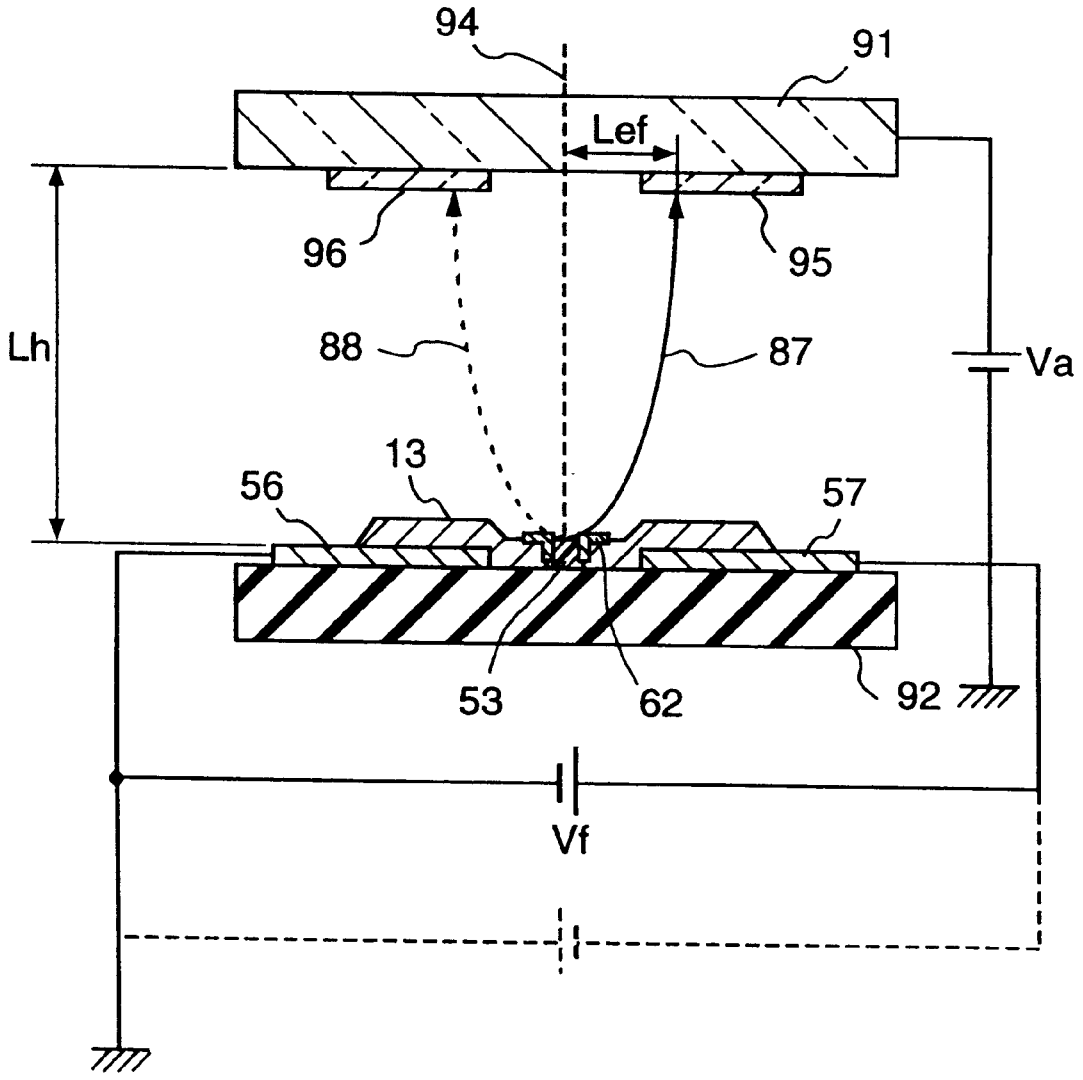
FIG. 2 is a sectional view showing the electron orbits of electrons emitted from a surface-conduction type electron-emitting device.

FIG. 2 is a sectional view showing the orbits of the electron beams. Upon application of a certain voltage (e.g., a voltage Vf [V]) or more, electrons are emitted from the electron-emitting portion 53. The electrons are accelerated toward the faceplate 91 by a voltage Va [V] applied to the faceplate 91 and are irradiated on the phosphor 95 or 96 on the faceplate 91. At this time, the electrons do not propagate vertically upward along a plane 94 perpendicular to a substrate surface plane, but propagate along an electron orbit 87 or 88. When the voltage Vf is applied such that the electrode 56 is negative and the electrode 57 is positive (the solid line in FIG. 2), the electrons emitted from the electron-emitting portion 53 propagate along the electron orbit 87 (solid line). In contrast to this, if the voltage Vf is applied such that the electrode 56 is positive and the electrode 57 is negative (the dotted line in FIG. 2), the electrons emitted from the electron-emitting portion 53 propagate along the electron orbit 88 (dotted line). In the surface-conduction type electron-emitting device as well, a distance Lef between the plane 94 and the landing position of the electrons can be calculated according to equation (1) in the same manner as described above.

$$Lef = 2 \times K \times Lh \times \sqrt{\frac{Vf}{Va}} \tag{1}$$

where Lh [m] is the distance between the electron-emitting portion 53 and the phosphor 95 or 96, and K is a constant determined by the type or shape of the electron-emitting device. The positions of the multi-electron beam source and each phosphor in the delta arrangement are determined by this distance Lef. In this embodiment, the center position of each phosphor in the x-axis direction in FIG. 1A is located above a position where the distance between the respective electron-emitting portions 53 is divided at 3:1.

The operation of the display apparatus of this embodiment will be described with reference to FIG. 3, which is a block diagram showing a driving circuit. An NTSC signal (s1) input from a TV reception circuit or the like is separated into a sync signal and a luminance signal by a synchronous separation circuit 14. The sync signal is sent to a timing control circuit 3, and the luminance signal is sent to a signal processing unit 1. The signal processing unit 1 performs demodulation of R, G, and B colors, A/D conversion, and the like, and sends the resultant digital luminance signal to a serial/parallel (S/P) conversion circuit 2. The S/P conversion circuit 2 performs serial/parallel-converts one-row data of the luminance signal sent from the signal processing unit 1 and outputs the resultant data to a pulse width modulation circuit 25. The pulse width modulation circuit 25 outputs a pulse width-modulated signals s4 to gates of MOS-FETS 11. Upon reception of the pulse width-modulated signal s4 at the gate, the MOS-FET 11 outputs a luminance signal s5 to a display panel 12.

A switching circuit 4 is a circuit for alternating the polarity of the luminance signal s5. A switching signal s2 is input from the timing control circuit 3 to a switch 10. Connection of the switch 10 is switched between terminals a and b in accordance with the switching signal s2. When the switch 10 is connected to the terminal a, the negative luminance signal s5 is sent to the display panel 12. When the switch 10 is connected to the terminal b, the positive luminance signal s5 is output. This switching operation between the positive and negative polarities is performed every one-horizontal scanning interval (1H).

A switching circuit 5 is a circuit for alternating the polarity of a scanning signal s6 supplied to the display panel 12 from a scanning circuit 7. A pulse generator 6 generates a pulse signal s7 having a period of 1H with the same polarity (e.g., the positive polarity). A switch 8 is switched at 1H intervals by a switching signal s3 from the timing control circuit 3. When the switch 8 is connected to a terminal c, the pulse signal s7 is directly input to the scanning circuit 7 through the switching circuit 5. When the switch 8 is connected to a terminal d, the polarity of the pulse signal s7 is inverted (to the negative polarity) by an inverter 9, and the resultant signal is sent to the scanning circuit 7. In this manner, the polarity of the scanning signal s6 is inverted at 1H intervals, and the scanning signal s6 is sent to a line of the display panel 12 which is selected by the scanning circuit 7. A voltage source 28 is a power supply for accelerating electrons emitted from the surface-conduction type electron-emitting device 51 toward a phosphor.

Figure 4:
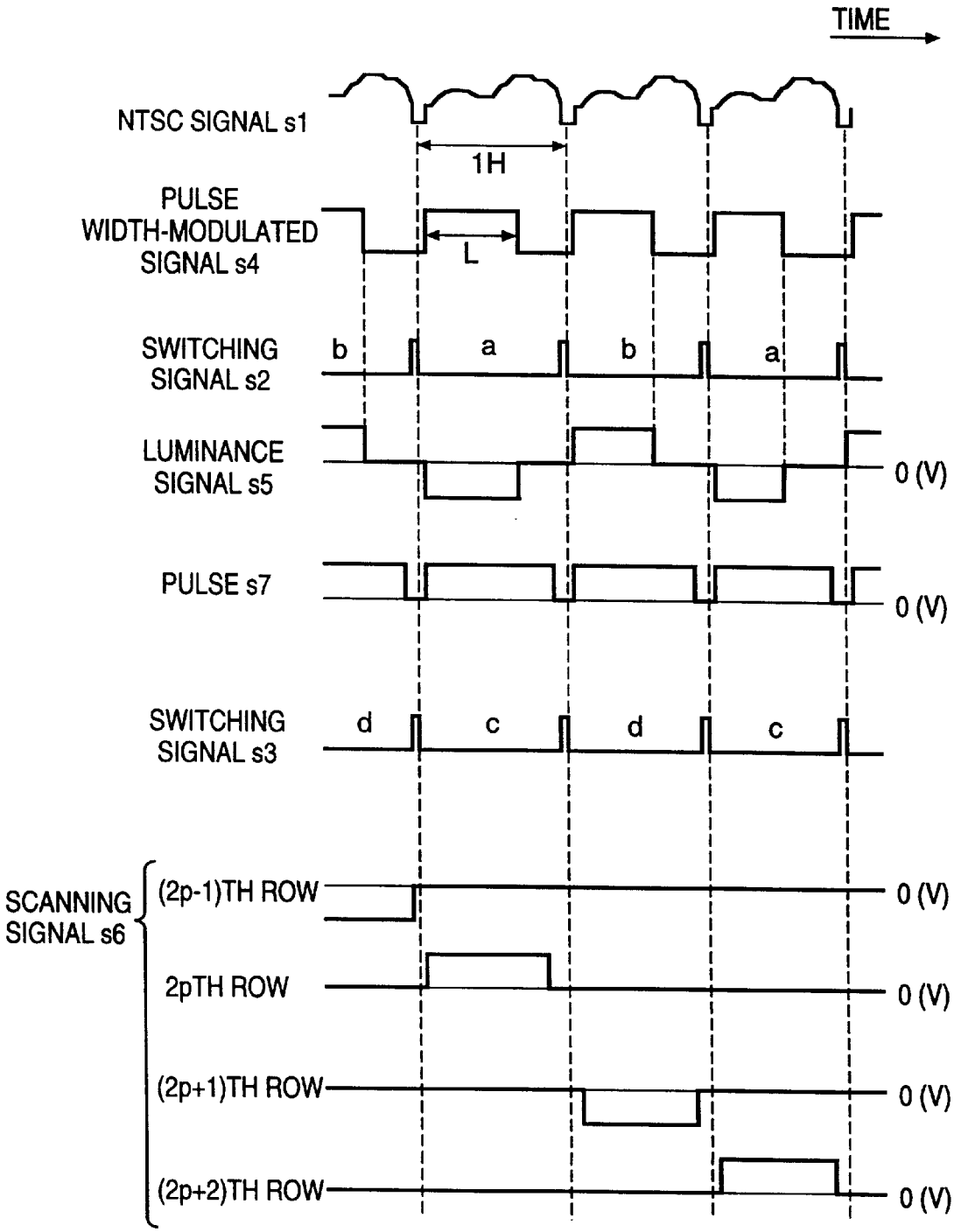
FIG. 4 is a timing chart in the first embodiment.

The operation of this embodiment will be described with reference to the timing chart of FIG. 4. The same reference numerals in FIG. 4 denote the same parts as in FIG. 1. An NTSC signal s1 is subjected to signal processing in the signal processing unit 1, the pulse width modulation circuit 25, and the like to become the pulse width-modulated signal s4. The pulse width-modulated signal s4 in FIG. 4 represents a signal flowing in a given column. As a width L of the pulse width-modulated signal s4 increases, the time during which electrons are emitted from the electron-emitting portion 53 is prolonged, and hence the pixel caused to emit light by the electrons becomes brighter. The switching signal s2 for switching the switching circuit 4 is generated at 1H intervals. The switch 10 is switched by the switching signal s2.

Portions a and b of the switching signal s2 in FIG. 4 represent the connection states of the switch 10 with respect to the terminals. More specifically, when the switch 10 is connected to the terminal a, the luminance signal s5 has the negative polarity. When the switch 10 is connected to the terminal b, the luminance signal s5 has the positive polarity. The luminance signal s5 in FIG. 4 shows these states. Note that each thin solid line representing the luminance signal s5 indicates the ground potential (=0 V). The pulse width of the luminance signal s5 is equal to the width L of the pulse width-modulated signal s4.

The pulse signal s7 is also generated by the pulse generator 6 at 1H intervals, as described above. In this embodiment, the pulse signal s7 has the positive polarity. The signal s3 for switching the switch 8 is also generated by the timing control circuit 3 at 1H intervals. In accordance with this signal s3, the switch 8 is alternately connected to the terminals c and d at 1H intervals. Portions c and d of the signal s3 in FIG. 4 represent the connection states of the switch 8 with respect to the terminals c and d. In accordance with the signal s3, the polarity of the scanning signal s6 is inverted at 1H intervals, as shown in FIG. 4.

Figure 5:
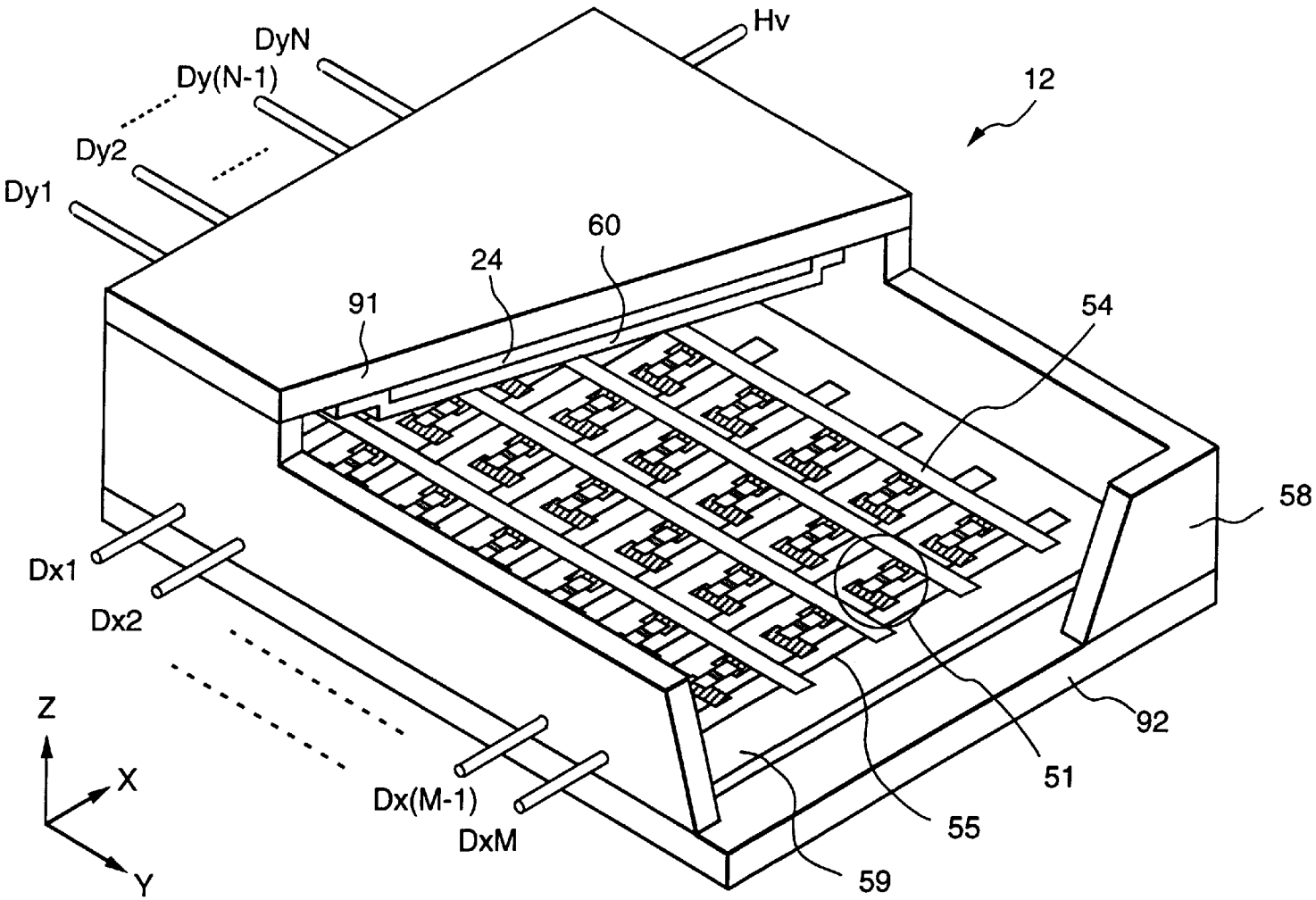
FIG. 5 is a perspective view showing a display panel.

FIG. 5 is a partially cutaway perspective view of the display panel, showing the internal structure of the panel. Referring to FIG. 5, reference numeral 92 denotes a rear plate; 58, a side wall; and 91, a faceplate. These parts form an airtight envelope for maintaining a vacuum in the display panel 12. To construct the airtight envelope, it is necessary to seal-connect the respective parts to allow their junction portions to hold a sufficient strength and airtight condition. For example, a frit glass is applied to the junction portions, and sintered at 400 to 500° C. in air or a nitrogen atmosphere for 10 minutes or more, thereby seal-connecting the parts. A method of evacuating the airtight envelope will be described later.

The rear plate 92 has a substrate 59 fixed thereon, on which N×M surface-conduction type electron-emitting devices 51 are formed (M, N=positive integer equal to 2 or more, approximately set in accordance with an object number of display pixels. For example, in a display apparatus for high-definition television display, preferably N=3,000 or more, M=1,000 or more. In this embodiment, N=3,072, M=1,024). The N×M surface-conduction type electron-emitting devices 51 are arranged in a simple matrix with M row wiring layers 55 and N column wiring layers 54. The portion constituted by these parts (59, 51, 54, and 55) will be referred to as a multi-electron beam source. Note that a manufacturing method and the structure of the multi-electron beam source will be described in detail later.

In this embodiment, the substrate 59 of the multi-electron beam source is fixed to the rear plate 92 of the airtight envelope. However, if the substrate 59 has sufficient strength, the substrate 59 of the multi-electron beam source itself may be used as the rear plate of the airtight envelope.

Figure 6:
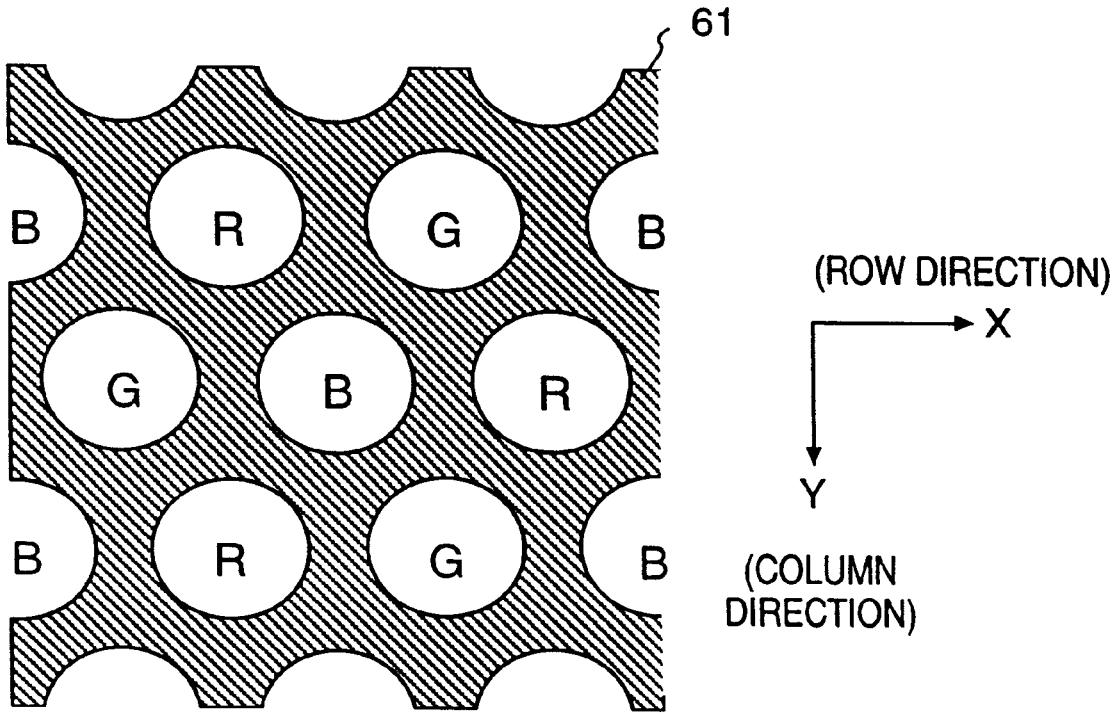
FIG. 6 is a view showing the arrangement of phosphors.

Furthermore, a phosphor film 24 is formed on the lower surface of the faceplate 91. As this embodiment is a color display apparatus, the phosphor film 24 is coated with red, green, and blue phosphors, i.e., three primary color phosphors. As shown in FIG. 6, R, G, and B phosphors are arranged in the delta arrangement. Black conductive material 61 is provided between the phosphors. The purpose of providing the black conductive material 61 is to prevent display color misregistration even if the electron-beam irradiation position is shifted to some extent, to prevent degradation of display contrast by shutting off reflection of external light, to prevent charge-up of the phosphor film by electron beams, and the like. The black conductive material 61 mainly consists of graphite, however, any other materials may be used as long as the above purpose can be attained.

Furthermore, a metal back 60, which is well-known in the CRT field, is provided on the rear-plate-side surface of the phosphor film 24. The purpose of providing the metal back 60 is to improve the light-utilization ratio by mirror-reflecting part of light emitted from the phosphor film 24, to protect the phosphor film 24 from collision with negative ions, to use the metal back 60 as an electrode for applying an electron-beam accelerating voltage, to use the metal back 60 as a conductive path for electrons which excited the phosphor film 24, and the like. The metal back 60 is formed by forming the phosphor film 24 on the faceplate 91, smoothing the front surface of the phosphor film, and depositing Al (aluminum) thereon by vacuum deposition. Note that when a phosphor material for a low voltage is used for the phosphor film 24, the metal back 60 is not used. Furthermore, for application of an accelerating voltage or improvement of the conductivity of the phosphor film, transparent electrodes made of, e.g., ITO may be provided between the faceplate 91 and the phosphor film 24.

Figure 3:
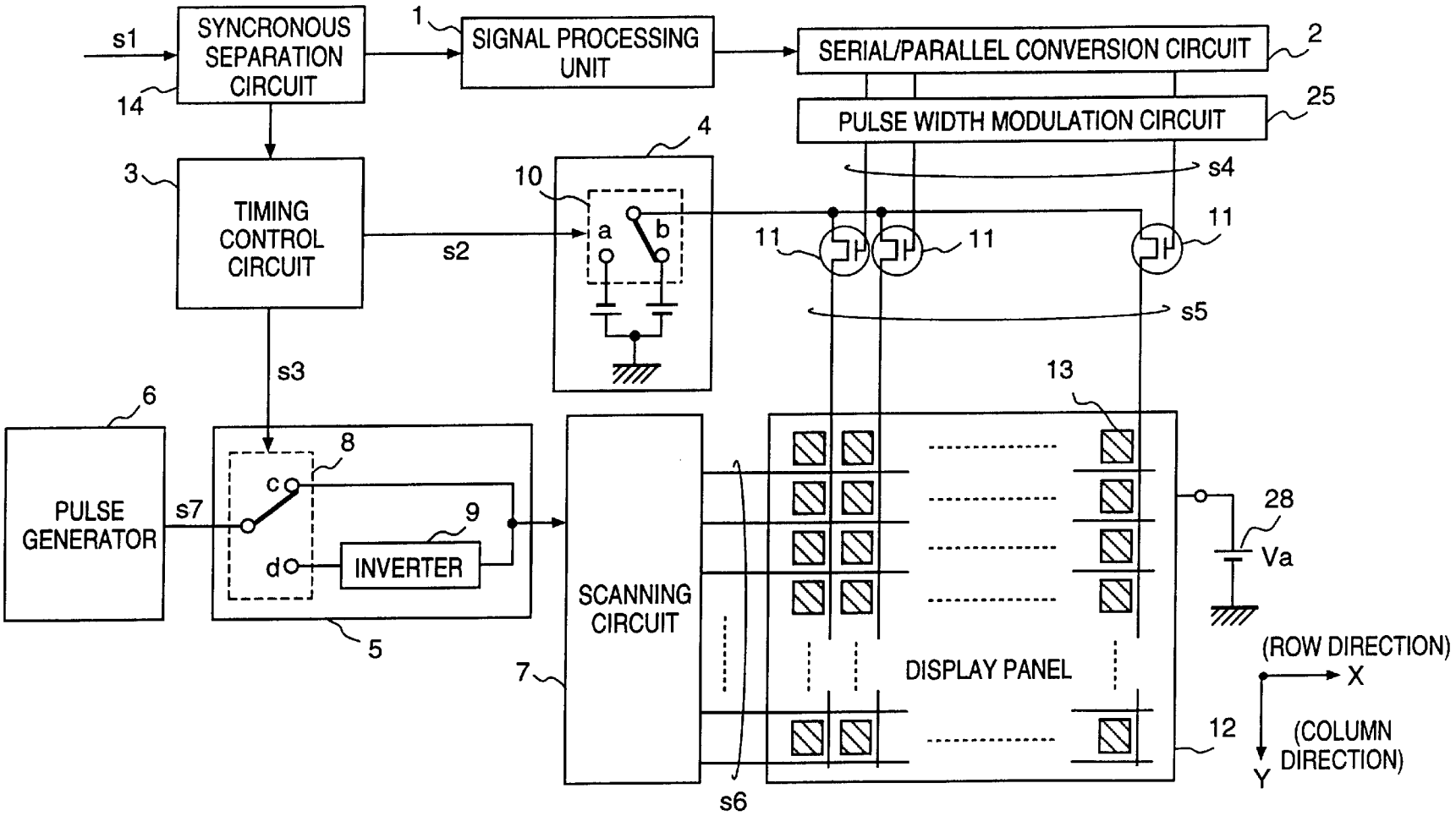
FIG. 3 is a block diagram showing a driving circuit in the first embodiment.

Referring to FIG. 5, reference symbols $D_{x1}$ to $D_{xM}$, $D_{y1}$ to $D_{yN}$, and $H_v$ denote electric connection terminals for an airtight structure provided to electrically connect the display panel 12 to the electric circuit shown in FIG. 3. The terminal $D_{x1}$ to $D_{xM}$ are electrically connected to the row wiring layers 55 of the multi-electron beam source; the terminals $D_{y1}$ to $D_{yN}$, to the column wiring layers 54; and the terminal $H_v$, to the metal back 60 of the faceplate 91.

To evacuate the airtight envelope, after forming the airtight envelope, an exhaust pipe and a vacuum pump (both not shown) are connected, and the airtight envelope is evacuated to a vacuum of about $10^{-7}$ Torr. Thereafter, the exhaust pipe is sealed. To maintain the vacuum in the airtight envelope, a getter film (not shown) is formed at a predetermined position in the airtight container immediately before/after the sealing. The getter film is a film formed by heating and evaporating a gettering material mainly consisting of, e.g., Ba, by heating or RF heating. The suction effect of the getter film maintains a vacuum of $1\times10^{-5}$ to $1\times10^{-7}$ Torr in the container.

A method of manufacturing the multi-electron beam source used in the display panel 12 according to this embodiment will be described next. In manufacturing the multi-electron beam source used in the image display apparatus of the embodiment, any material, shape, and manufacturing method for an surface-conduction type electron-emitting device may be employed so long as it is for manufacturing an electron beam source having surface-conduction type electron-emitting devices arranged in a simple matrix. However, the present inventors have found that among the surface-conduction type electron-emitting devices, an electron beam source having an electron-emitting portion or its peripheral portion consisting of a fine particle film is excellent in electron-emitting characteristic and can be easily manufactured. Accordingly, such a multi-electron beam source is the most appropriate electron beam source to be employed in a high-brightness, large-screen image display apparatus. In the display panel 12 of this embodiment, the surface-conduction type electron-emitting devices 51 each having an electron-emitting portion 53 or its peripheral portion made of a fine particle film are used. First, the basic structure, manufacturing method, and characteristic of the preferred surface-conduction type electron-emitting device will be described, and the structure of the multi-electron beam source having many devices wired in a simple matrix will be described later.

The typical structure of the surface-conduction type electron-emitting device having an electron-emitting portion or its peripheral portion made of a fine particle film includes a flat type structure.

Figure 7A:
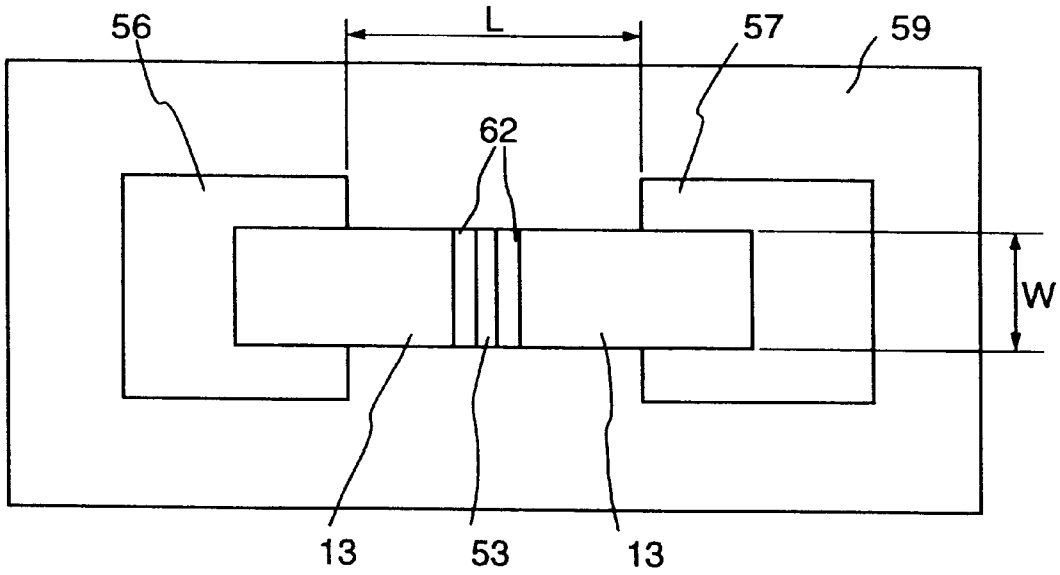
FIGS. 7A and 7B are a plan view and a sectional view, respectively, showing a surface-conduction type electron-emitting device.
Figure 7B:
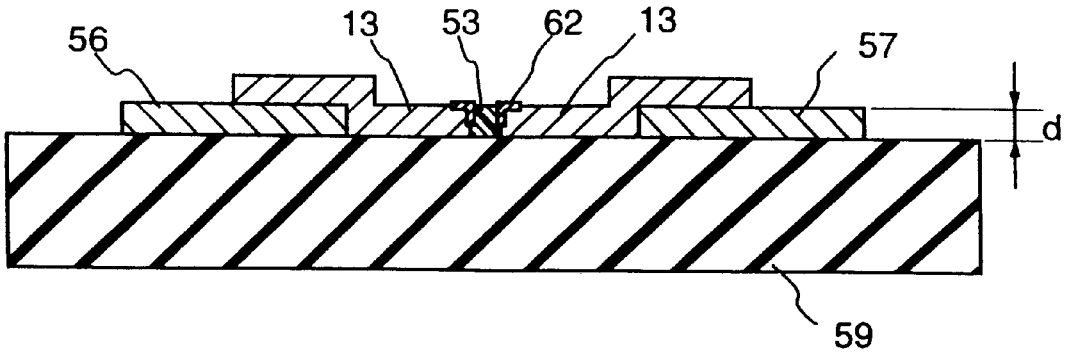

The flat type is most suitable for this embodiment. First, the structure of a flat surface-conduction type electron-emitting device and its manufacturing method will be described. FIG. 7A is a plan view for explaining the structure of the flat surface-conduction type electron-emitting device; and FIG. 7B, a cross-sectional view of the device. Referring to FIGS. 7A and 7B, reference numeral 59 denotes a substrate; 56 and 57, device electrodes; 13, a conductive thin film; 53, an electron-emitting portion formed by a electrification forming process; and 62, a thin film formed by an activation process. As the substrate 59, various glass substrates of, e.g., quartz glass and soda-lime glass, various ceramic substrates of, e.g., alumina, or any of those substrates with an insulating layer consisting of, e.g., $SiO_2$ and formed thereon can be employed.

The device electrodes 56 and 57 formed on the substrate 59 to be parallel to its surface and oppose each other are made of a conductive material. For example, one of the following materials may be selected and used: metals such as Ni, Cr, Au, Mo, W, Pt, Ti, Cu, Pd, and Ag, alloys of these materials, metal oxides such as $In_2O_3$-$SnO_2$, and semiconductors such as polysilicon. The electrodes 56 and 57 can be easily formed by the combination of a film-forming technique such as vacuum deposition and a patterning technique such as photolithography or etching, however, any other method (e.g., a printing technique) may be employed.

The shape of the electrodes 56 and 57 is appropriately designed in accordance with an application purpose of the electron-emitting device. Generally, the shape is designed by setting an interval L between electrodes to be an appropriate value in a range from several hundreds Å to several hundreds μm. The most preferable range for a display apparatus is from several μm to several tens μm. As for electrode thickness d, an appropriate value is selected from a range from several hundreds Å to several μm. The conductive thin film 13 is made of a fine particle film. The "fine particle film" is a film which contains a lot of fine particles. Microscopic observation of the fine particle film will reveal that the individual particles in the film are spaced apart from each other, adjacent to each other, or overlap each other.

One particle has a diameter within a range from several Å to several thousands Å. Preferably, the diameter falls within a range from 10 Å to 200 Å. The thickness of the film is appropriately set in consideration of the following conditions: a condition necessary for electrical connection to the device electrode 56 or 57, a condition for the forming process to be described later, a condition for setting the electric resistance of the fine particle film itself to an appropriate value to be described later. More specifically, the thickness of the film is set in a range from several Å to several thousands Å, more preferably, 10 Å to 500 Å.

For example, materials used for forming the fine particle film are metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, Zrc, HfC, TaC, SiC, and WC, nitrides such as TiN, ZrN, and HfN, semiconductors such as Si and Ge, and carbons. An appropriate material is selected from these materials. As described above, the conductive thin film 13 is formed using a fine particle film, and the sheet resistance of the film is set to fall within a range from $10^{-3}$ to $10^{-7}$ (Ω/sq).

As it is preferable that the conductive thin film 13 is electrically connected to the device electrodes 56 and 57, they are arranged so as to partly overlap each other. Referring to FIGS. 7A and 7B, the respective parts are stacked in the following order from the bottom: the substrate 59, the device electrodes 56 and 57, and the conductive thin film 13. This overlapping order may be: the substrate, the conductive thin film, and the device electrodes, from the bottom.

The electron-emitting portion 53 is a fissure portion formed at a part of the conductive thin film 13. The electron-emitting portion 53 has a resistance higher than that of a peripheral conductive thin film. The fissure portion is formed by the forming process to be described later on the conductive thin film 13. In some cases, particles, having a diameter of several Å to several hundreds Å, are arranged within the fissure portion. As it is difficult to exactly illustrate the actual position and shape of the electron-emitting portion, FIGS. 7A and 7B show the fissure portion schematically.

The thin film 62, which consists of a carbon or carbon compound material, covers the electron-emitting portion 53 and its peripheral portion. The thin film 62 is formed by the activation process to be described later after the forming process. The thin film 62 is preferably made of monocrystalline graphite, polycrystalline graphite, amorphous carbon, or a mixture thereof, and its thickness is 500 Å or less, and more preferably 300 Å or less. As it is difficult to exactly illustrate the actual position or shape of the thin film 62, FIGS. 7A and 7B show the film schematically. FIG. 7A shows the device in which a part of the thin film 62 is removed.

The preferred basic device structure is described above. In the embodiment, the following is the most preferable device.

That is, the substrate 59 consists of a soda-lime glass, and the device electrodes 56 and 57, an Ni thin film. The thickness d of the device electrodes 56 and 57 is 1000 Å and the electrode interval L is 2 μm. As the main material for the fine particle film, Pd or PdO is used. The thickness and width W of the fine particle film are respectively set to about 100 Å and 100 μm.

A method of manufacturing a preferred flat surface-conduction type electron-emitting device will be described next. FIGS. 8A to 8E are cross-sectional views showing the manufacturing process of the surface-conduction type electron-emitting device of this embodiment. Note that the same reference numerals denote the same parts as in FIGS. 7A and 7B.

Figure 8A:
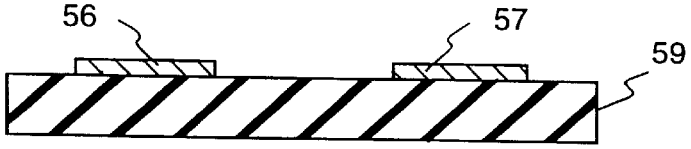
FIGS. 8A to 8E are sectional views showing the manufacturing process of the surface-conduction type electron-emitting device.

(1) First, as shown in FIG. 8A, the device electrodes 56 and 57 are formed on the substrate 59. In forming these electrodes, the substrate 59 is fully cleaned with a detergent, pure water, and an organic solvent, and a material for the device electrodes is deposited on the substrate 59. As a depositing method, a vacuum film-forming technique such as deposition and sputtering may be used. Thereafter, the deposited electrode material is patterned by a photolithographic etching technique. Thus, the pair of device electrodes 56 and 57 in FIG. 8A are formed.

Figure 8B:
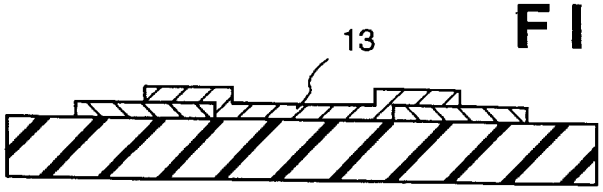

(2) Next, as shown in FIG. 8B, the conductive thin film 13 is formed. In forming the conductive thin film 13, an organic metal solution is applied to the substrate 59 first, and the applied solution is then dried and sintered, thereby forming a fine particle film. Thereafter, the fine particle film is patterned into a predetermined shape by the photolithographic etching method. The organic metal solution means an organic metal compound solution containing a material for fine particles, used for the conductive thin film, as main element. More specifically, in this embodiment, Pd is used as the main element. In the embodiment, application of an organic metal solution is performed by a dipping method, however, a spinner method or spraying method may be employed. As a method of forming the conductive thin film 13 made of the fine particles, the application of an organic metal solution used in the embodiment can be replaced with any other method such as a vacuum deposition method, a sputtering method, or a chemical vapor deposition method.

Figure 8C:
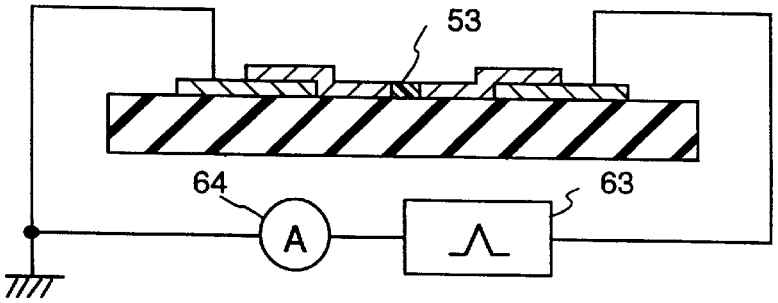

(3) As shown in FIG. 8C, an appropriate voltage is applied between the device electrodes 56 and 57, from a power supply 63 for the forming process, and the forming process is performed to form the electron-emitting portion 53.

The forming process here is a process of performing electric energization of the conductive thin film 13 made of a fine particle film to appropriately destroy, deform, or deteriorate a part of the conductive thin film, thereby changing the film into a structure suitable for electron emission. In the conductive thin film, the portion changed into the structure suitable for electron emission (i.e., the electron-emitting portion 53) has an appropriate fissure in the thin film. Comparing the thin film having the electron-emitting portion 53 with the thin film before the forming process, the electric resistance measured between the device electrodes 56 and 57 has greatly increased.

Figure 9A:
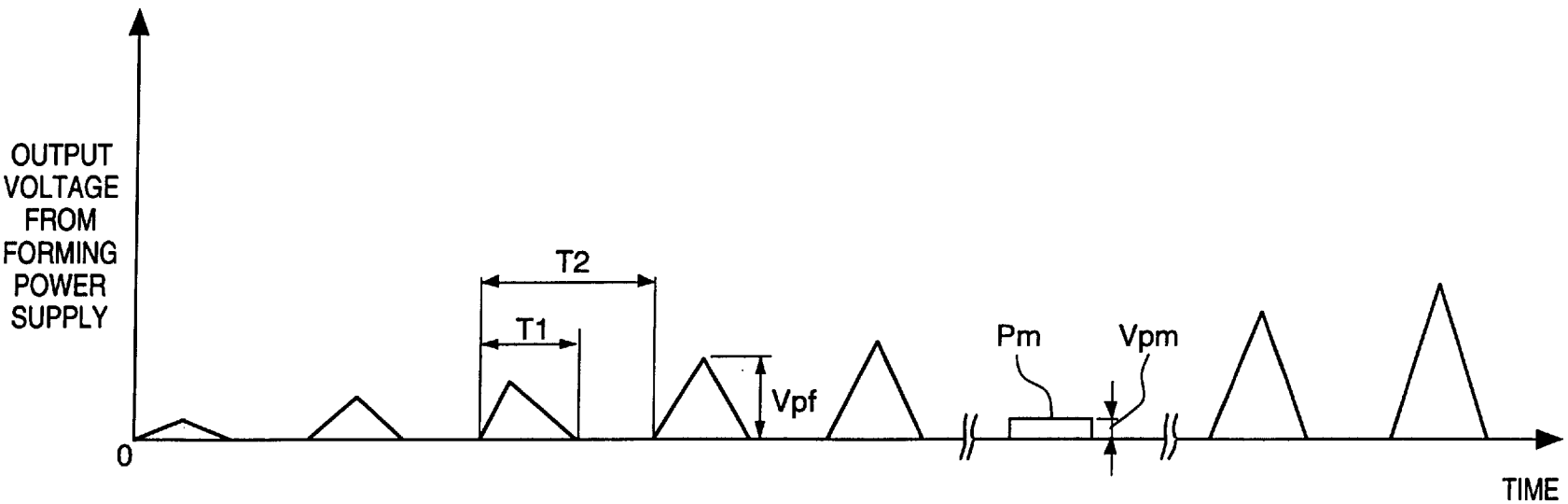
FIGS. 9A to 9C are graphs showing a forming pulse and an activation pulse.

An electric electrification method for the forming process will be described in detail with reference to FIG. 9A showing an example of the waveform of an appropriate voltage applied from the power supply 63. In forming process to the conductive thin film 13 made of a fine particle film, a pulse-like voltage is employed. In this embodiment, as shown in FIG. 9A, a triangular pulse having a pulse width T1 is continuously applied at a pulse interval T2. In this case, a peak value Vpf of the triangular pulse is sequentially increased. Furthermore, a monitor pulse Pm is inserted between the triangular pulses at appropriate intervals to monitor the formed state of the electron-emitting portion 53, and the current that flows at the insertion is measured by an ammeter 64 (FIG. 8C). In this example, in a $10^{-5}$ Torr vacuum atmosphere, the pulse width T1 is set to 1 msec; and the pulse interval T2, to 10 msec. The peak value Vpf is increased by 0.1 V, at each pulse. Each time five triangular pulses are applied, one monitor pulse Pm is inserted. To avoid adverse effects on the forming process, a voltage Vpm of the monitor pulse Pm is set to 0.1 V. When the electric resistance between the device electrodes 56 and 57 becomes $1\times10^{-6}$ Ω, i.e., the current measured by the galvanometer 64 upon application of the monitor pulse becomes $1\times10^{-7}$ A or less, the electrification for the forming process is terminated.

Note that the above method is preferable to the surface-conduction type electron-emitting device of this embodiment. In case of changing the design of the surface-conduction type electron-emitting device concerning, e.g., the material or thickness of the fine particle film, or the device electrode interval L, the conditions for electrification are preferably changed in accordance with the change in the device design.

Figure 8D:
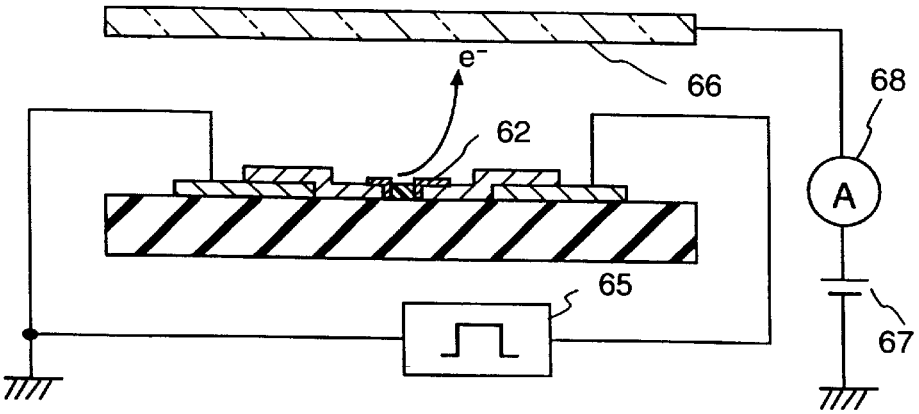

(4) As shown in FIG. 8D, an appropriate voltage is applied next, from an activation power supply 65, between the device electrodes 56 and 57, and the activation process is performed to improve the electron-emitting characteristic. The activation process here is a process of performing electrification of the electron-emitting portion 53, formed by the forming process, under appropriate conditions, to deposit a carbon or carbon compound around the electron-emitting portion 53. FIG. 8D shows the deposited material of the carbon or carbon compound as a material 62. Comparing the electron-emitting portion 53 with that before the activation process, the emission current at the same applied voltage can be increased typically 100 times or more. The activation process is performed by periodically applying a voltage pulse in a $10^{-4}$ to $10^{-5}$ Torr vacuum atmosphere to deposit a carbon or carbon compound mainly derived from an organic compound existing in the vacuum atmosphere. The deposition material 62 is any of monocrystalline graphite, polycrystalline graphite, amorphous carbon, and a mixture thereof. The thickness of the deposition material 62 is 500 Å or less, and more preferably, 300 Å or less.

Figure 9B:
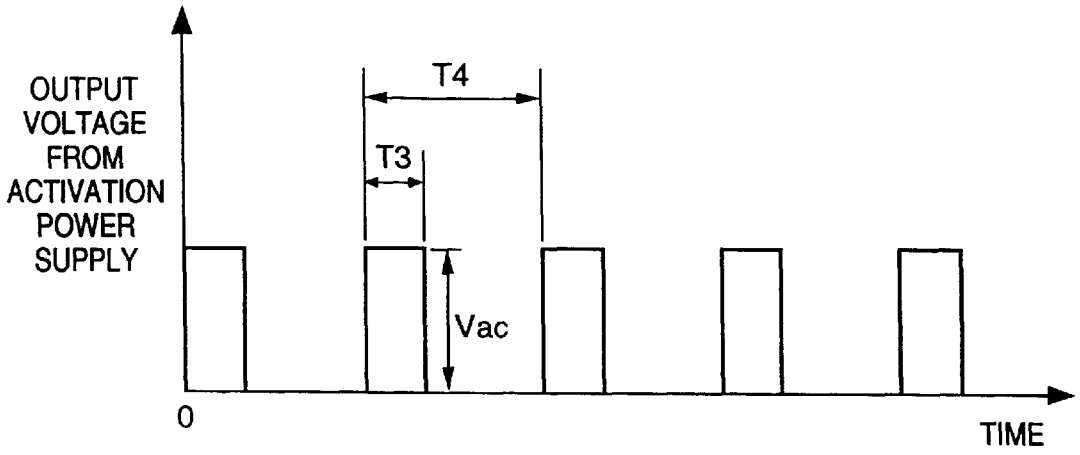

FIG. 9B shows an example of the waveform of an appropriate voltage applied from the activation power supply 65 to explain the energization method used for this operation. In this case, the activation process is performed by periodically applying a constant rectangular voltage. More specifically, a rectangular voltage Vac is set to 14 V; a pulse width T3, to 1 msec; and a pulse interval T4, to 10 msec. Note that the above electrification conditions are preferable for the surface-conduction type electron-emitting device of the embodiment. When the design of the surface-conduction type electron-emitting device is changed, the electrification conditions are preferably changed in accordance with the change in device design.

Referring to FIG. 8D, reference numeral 66 denotes an anode electrode, connected to a DC high-voltage power supply 67 and an ammeter 68, for capturing an emission current Ie emitted from the surface-conduction type electron-emitting device. Note that when the substrate 59 is incorporated into the display panel 12 before the activation process, the phosphor surface of the display panel 12 is used as the anode electrode 66. While applying a voltage from the activation power supply 65, the ammeter 68 measures the emission current Ie to monitor the progress of the activation process so as to control the operation of the activation power supply 65.

Figure 9C:
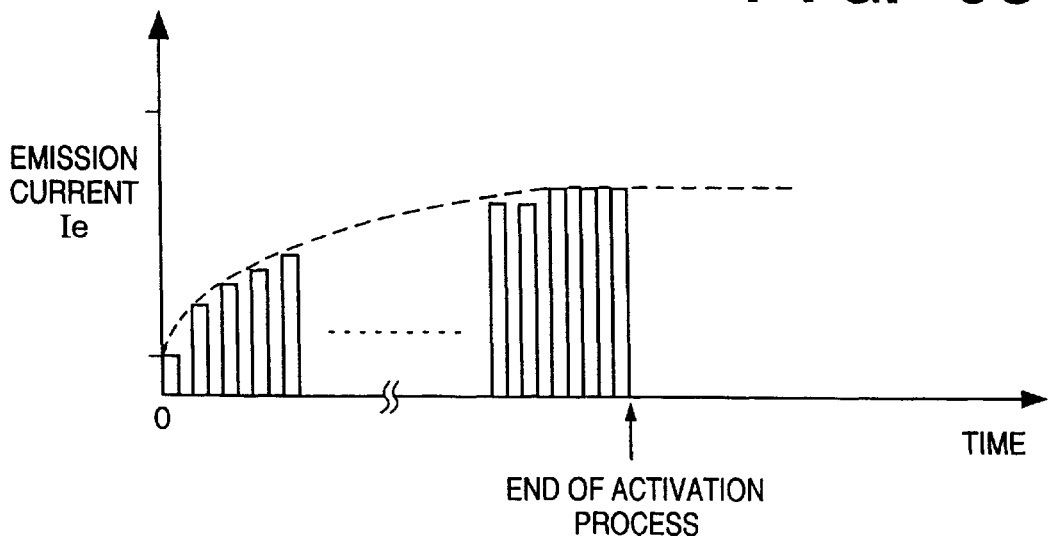

FIG. 9C shows an example of the emission current Ie measured by the ammeter 68. As application of a pulse voltage from the activation power supply 65 is started, the emission current Ie increases with the elapse of time, gradually reaches saturation, and rarely increases then. At the substantial saturation point, the voltage application from the activation power supply 65 is stopped, and the activation process is then terminated.

Figure 8E:
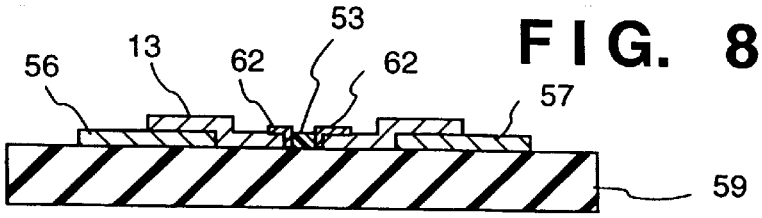

Note that the above electrification conditions are preferable for the surface-conduction type electron-emitting device of the embodiment. When the design of the surface-conduction type electron-emitting device is changed, the conditions are preferably changed in accordance with the change in device design. The flat surface-conduction emission type electron-emitting device shown in FIG. 8E is manufactured in the above manner.

The method of manufacturing the flat surface-conduction type electron-emitting device has been described above. The characteristics of the surface-conduction type electron-emitting device used in the display apparatus will be described below.

Figure 10:
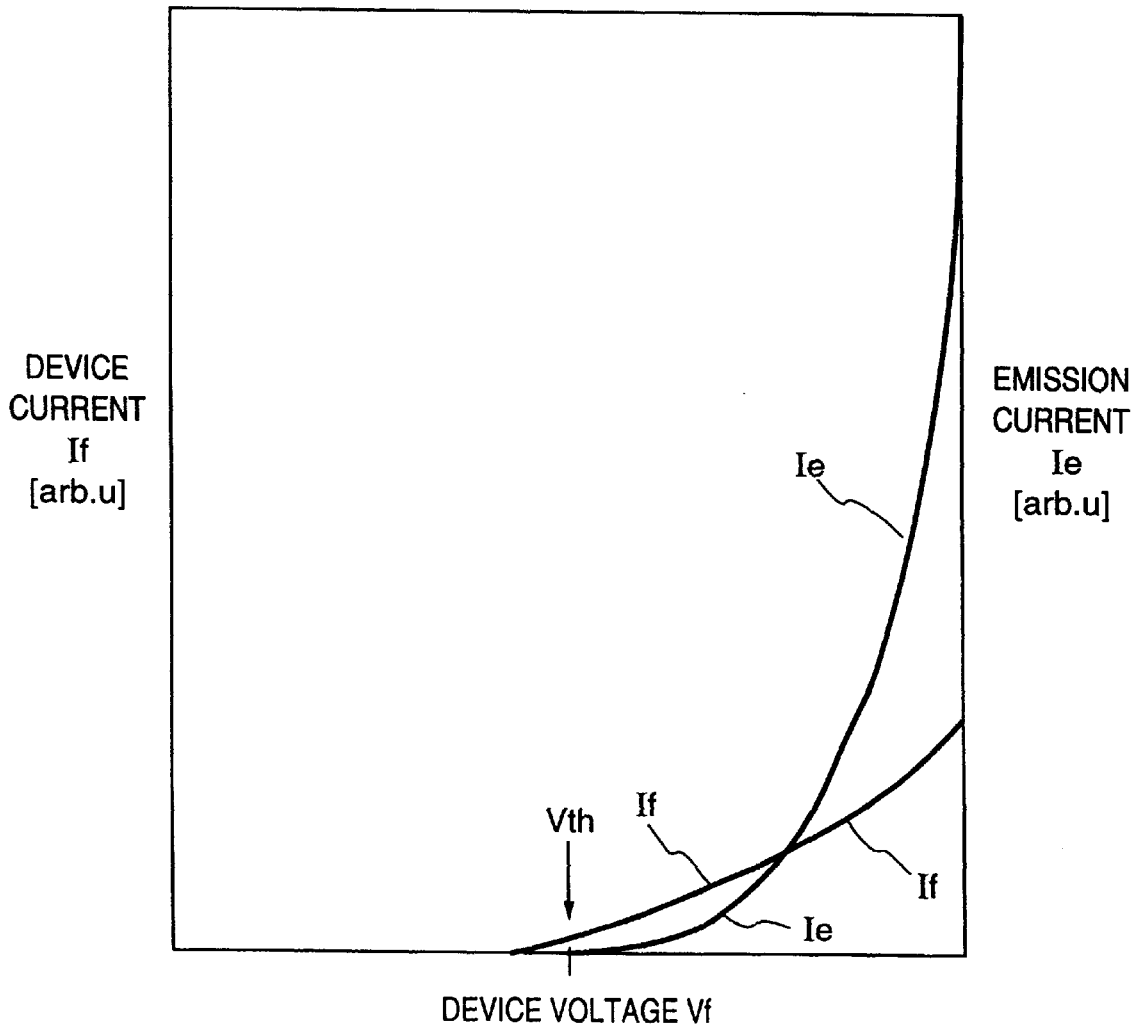
FIG. 10 is a graph showing the Vf-Ie characteristic of the surface-conduction type electron-emitting device.

FIG. 10 shows typical examples of the (emission current Ie) to (device voltage Vf) characteristic and the (device current If) to (device voltage Vf) characteristic of the surface-conduction type electron-emitting device used in the display apparatus. Note that compared with the device current If, the emission current Ie is very small, and hence it is difficult to illustrate the emission current Ie by the same measure as that for the device current If. In addition, these characteristics are changed by changing the design parameters such as the size and shape of the device. For these reasons, the two curves in FIG. 10 are respectively plotted in arbitrary units.

Regarding the emission current Ie, the device used in the display apparatus of this embodiment has the following three characteristics:

First, when a given voltage (referred to as a threshold voltage Vth) or more is applied to the device, the emission current Ie drastically increases. However, with a voltage lower than the threshold voltage Vth, almost no emission current Ie is detected. That is, regarding the emission current Ie, the device has a nonlinear characteristic based on the clear threshold voltage Vth.

Second, the emission current Ie changes depending on the voltage Vf applied to the device. Accordingly, the magnitude of the emission current Ie can be controlled by changing the voltage Vf.

Third, the emission current Ie is output quickly in response to application of the device voltage Vf to the device. Accordingly, the electrical charge amount of electrons to be emitted from the device can be controlled by changing the period of application of the device voltage Vf.

The surface-conduction type electron-emitting device with the above three characteristics is preferably applied to the display apparatus. For example, in a display apparatus having a large number of devices arranged in correspondence with the pixels of the display screen, if the first characteristic is utilized, a display operation can be performed by sequentially scanning the display screen. This means that a voltage equal to or higher than the threshold voltage Vth is appropriately applied to a driven device, while a voltage lower than the threshold voltage Vth is applied to a non-selected device. In this manner, sequentially changing the driven devices enables display by sequential scanning of the display screen.

Furthermore, emission brightness can be controlled by utilizing the second or third characteristic. Gradation display can therefore be realized.

The structure of a multi-electron beam source having the above surface-conduction type electron-emitting devices wired in a simple matrix will be described next by referring to FIG. 1 again. As described above, surface-conduction type electron-emitting devices identical to those in FIG. 1 are arranged on a substrate 59. These devices are connected to row and column wiring layers 55 and 54 to be wired in a simple matrix. An insulating layer (not shown) is formed between the electrodes at each intersection between the row and column wiring layers to electrically insulate the wiring layers from each other. A plurality of surface-conduction type electron-emitting devices 51 can be manufactured while the above forming process and activation process are performed for this multi-electron beam source.

In the first embodiment, since signal of each color is allocated to a predetermined column wiring layer, signals of different colors allocated to column wiring layers need not be switched at 1H scanning intervals. R, G, B, and R signals are allocated to column wiring layers i, j, k, and l in FIG. 1 regardless of the rows to be scanned. For this reason, a simple driving circuit can be used. In addition, in this embodiment, the devices may be replaced with lateral FE type electron-emitting devices.

(Second Embodiment)

Figure 11A:
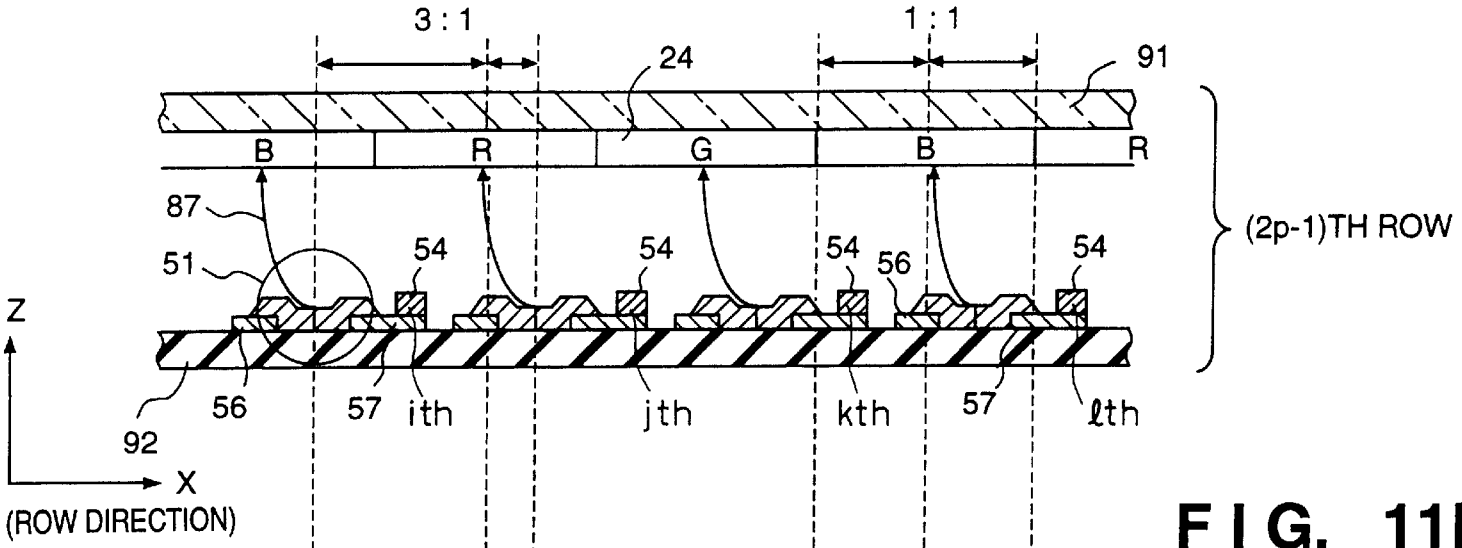
FIGS. 11A and 11B are sectional views showing the electron orbits of electrons emitted from a multi-electron beam source in the second embodiment of the present invention.
Figure 11B:
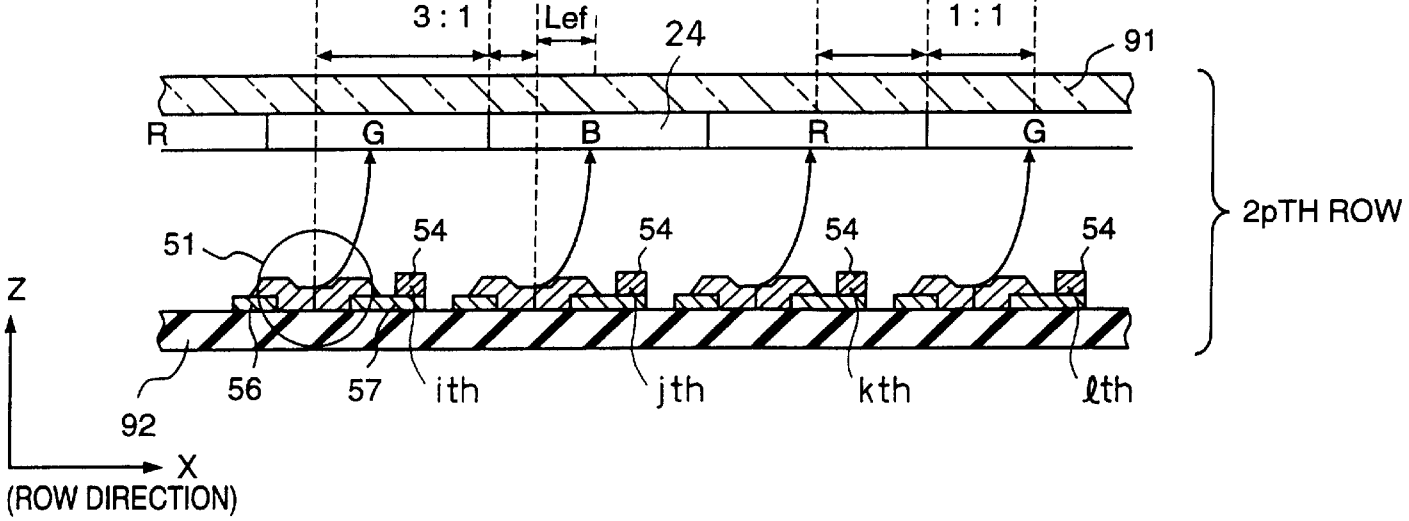

In the second embodiment, a voltage Vf lower than that in the first embodiment is used to shorten the distances electrons propagate (Lef), but signals of different colors to be allocated to column wiring layers are switched at 1H intervals. FIGS. 11A and 11B are sectional views showing the positions of a multi-electron beam source and phosphors in a delta arrangement according to this embodiment. FIG. 11A is a sectional view taken along the (2p−1)th row of the multi-electron beam source. FIG. 11B is a sectional view taken along the 2pth row of the multi-electron beam source. When the (2p−1)th row is scanned, devices 51 connected to column wiring layers i, j, k, and l emit electrons to the left to cause the corresponding B, R, G, and B phosphors to emit light. At this time, B, R, G, and B color signals flow in the column wiring layers i, j, k, and l. When the 2pth row is scanned, the devices 51 connected to the column wiring layers i, j, k, and l emit electrons to the right to cause the G, B, R, and G phosphors to emit light. At this time, G, B, R, and G color signals flow in the column wiring layers i, j, k, and l.

A driving circuit in this embodiment causes the signal processing unit 1 in FIG. 3 described in the first embodiment to switch signals of different colors at 1H scanning intervals. Except for this operation, the driving operation is performed in the same form as that in the first embodiment. In the second embodiment, since the distances electrons propagate are short, the reliability associated with the positions electrons reach is high.

(Third Embodiment)

A method of performing a display operation by interlaced scanning of an NTSC signal will be described next as the third embodiment of the present invention. Note that the third embodiment can also be realized by the circuit in FIG. 3, similar to the first embodiment. However, the switching period of the switch 8 and the switch 10 in FIG. 3 is not a one-horizontal scanning (1H) interval but is a one-field interval. In addition, the scanning circuit 7 must select alternate scanning lines to perform interlaced scanning. In addition, this embodiment uses a multi-electron beam source identical to that in the first embodiment, and wiring is performed in the same manner as in FIG. 1.

Figure 12:
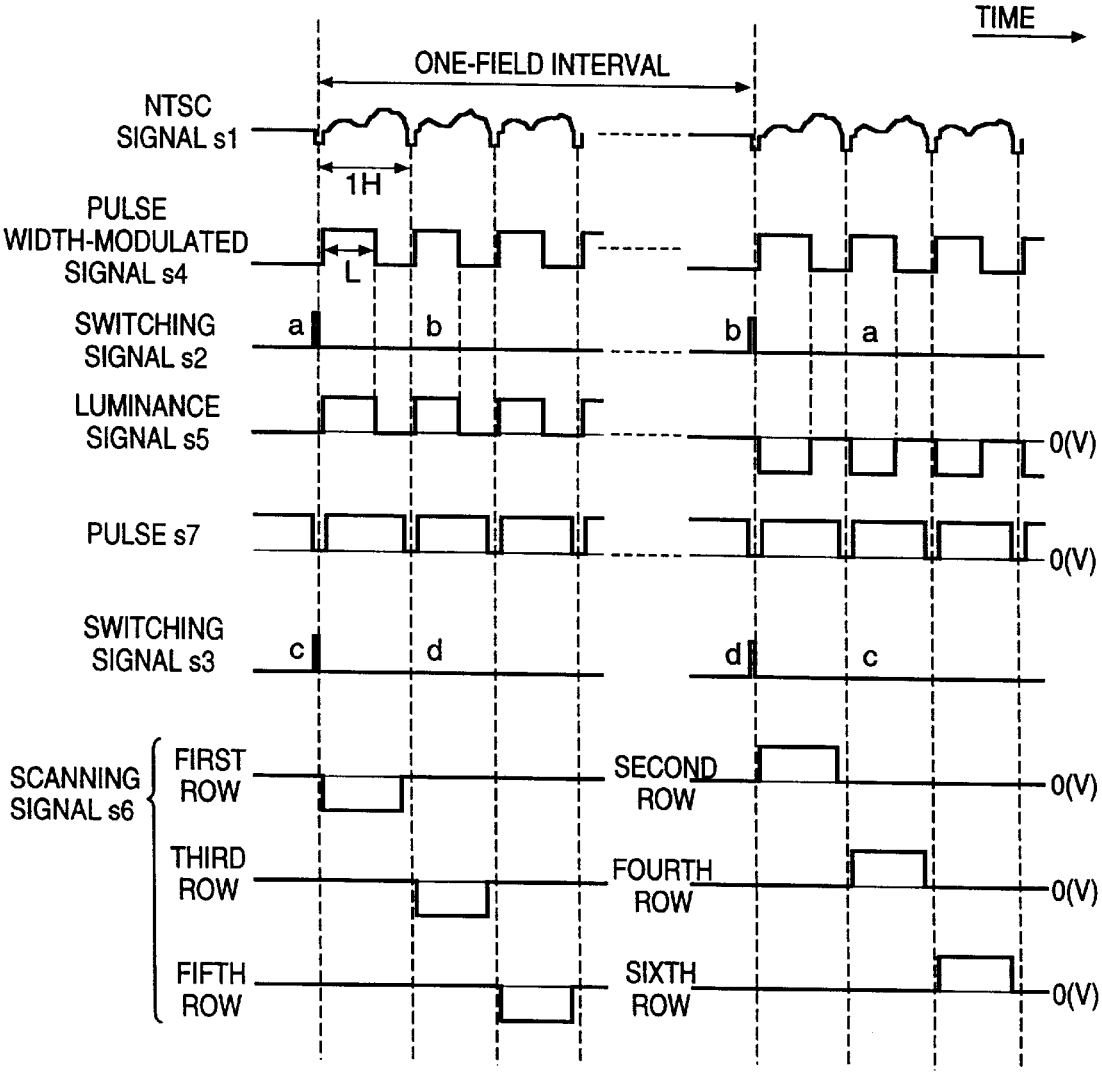
FIG. 12 is a timing chart in the third and fourth embodiments of the present invention.

The operation of this embodiment will be described next with reference to the timing chart of FIG. 12. Note that the same reference numerals denote the same parts as in FIG. 3. An NTSC signal s1 is subjected to signal processing in a pulse width modulation circuit 25 to become a pulse width-modulated signal s4. The pulse width-modulated signal s4 represents a signal flowing in a given column signal line. A switching signal s2 is generated at one-field intervals to switch connection of the switch 10. Portions a and b of the signal s2 in FIG. 12 represent terminals to which the switch 10 is to be connected. When the switch 10 is connected to a terminal a, a luminance signal s5 has a negative polarity. When the switch 10 is connected to a terminal b, the luminance signal s5 has a positive polarity. FIG. 12 shows this state of the luminance signal s5. Each thin solid line in FIG. 12 represents the ground potential (=0 V). The pulse width of the luminance signal s5 is equal to a width L of the pulse width modulation signal s4.

A pulse signal s7 is generated at 1H intervals. In this embodiment, the pulse signal s7 has the positive polarity. A signal s3 for switching the switch 8 is generated at one-field intervals. With this operation, the switch 8 is switched to be connected to a terminal c and a terminal d at one-field intervals. With this operation, the polarity of a scanning signal s6 is inverted for each field, as shown in FIG. 12. In this embodiment, since interlaced scanning is performed, odd rows, e.g., the first row, the third row, and the fifth row, are displayed in an odd field, and even fields, e.g., the second row, the fourth row, and sixth row, are displayed in an even field. In this case as well, the luminance signal s5 and the scanning signal s6 must always have opposite polarities.

In this embodiment, since the polarities of signals are inverted at long intervals, i.e., one-field intervals, the operation load on the driving circuit is small. In the third embodiment as well, the devices can be replaced with lateral FE type electron-emitting devices.

(Fourth Embodiment)

In the fourth embodiment, similar to the second embodiment, the distances electrons propagate are shortened, and a display operation is performed by interlaced scanning. The positions of a multi-electron beam source and phosphors in a delta arrangement are the same as those in FIG. 11 described in the second embodiment. In this embodiment, a driving circuit causes the signal processing unit 1 described in the first embodiment to switch signals of different colors at one-field intervals, and switches 4 and 5 are used to invert a luminance signal s5 and a scanning signal s6 at one-field intervals. In the fourth embodiment, since the distances electrons propagate are short, the reliability associated with the positions electrons reach is high. In addition, since luminance signals of different colors and the polarities of the luminance signals themselves which are to be output to column wiring layers are switched in long interval, i.e., one-field interval, the operation load on the driving circuit is small.

(Fifth Embodiment)

Figure 13A:
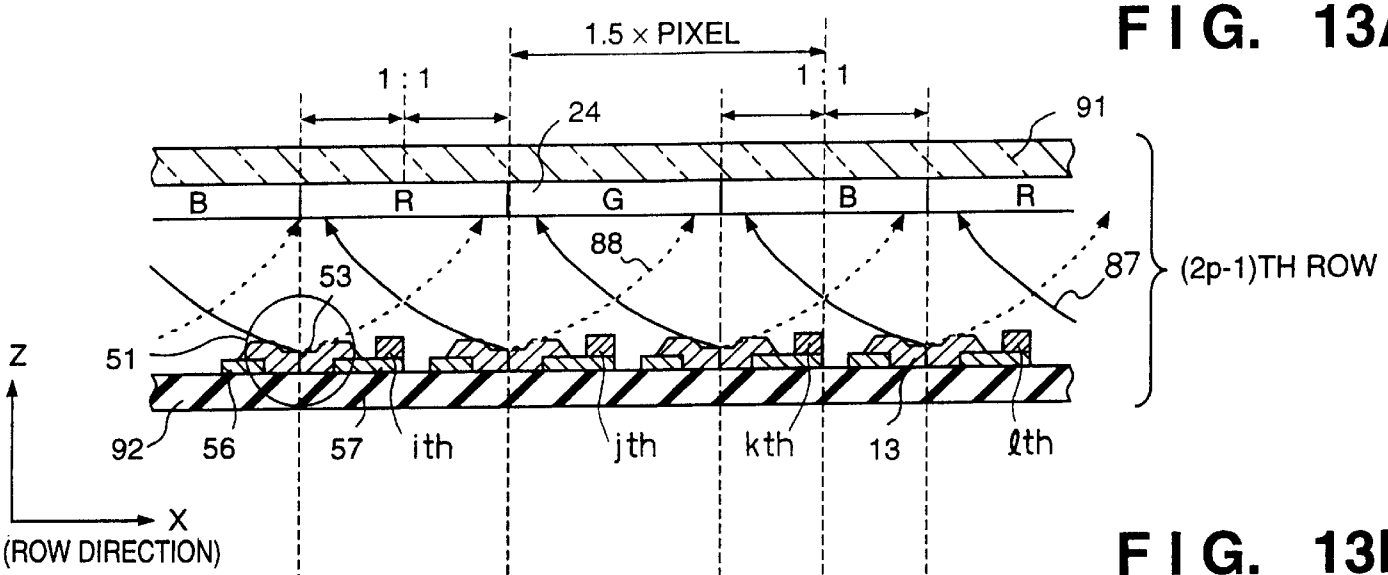
FIGS. 13A and 13B are sectional views showing the electron orbits of electrons emitted from a multi-electron beam source in the fifth embodiment of the present invention.
Figure 13B:
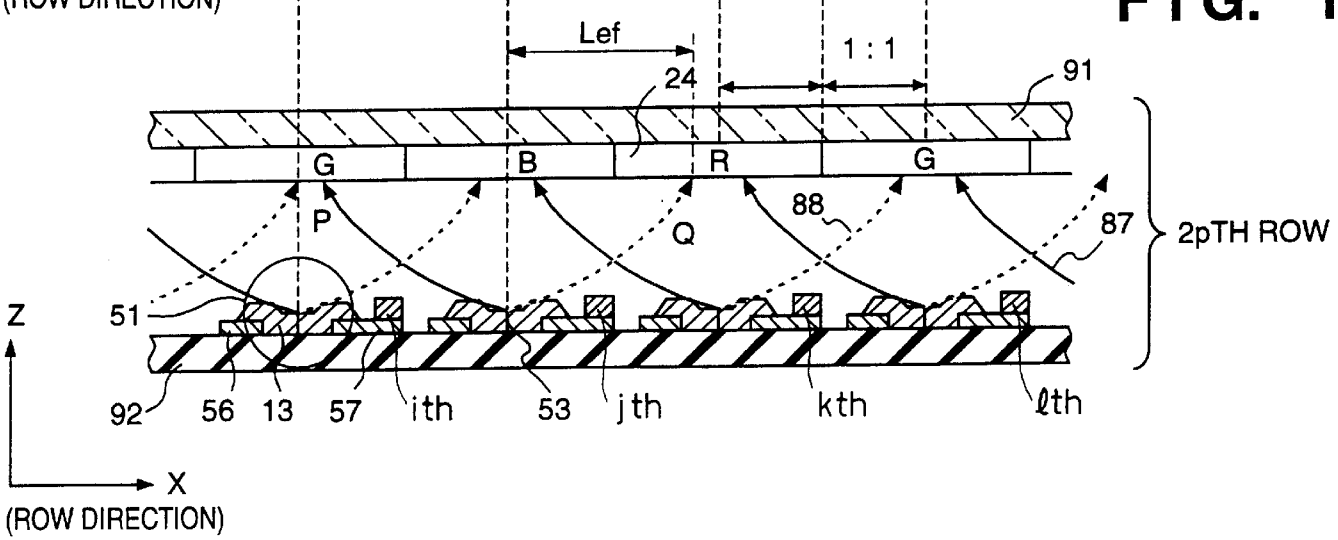

In the fifth embodiment, a display operation is performed such that duration of driving one row is divided into halves and the polarity of a device voltage is inverted at 0.5H intervals in each IH intervals. FIGS. 13A and 13B are sectional views showing how electrons from the electron-emitting devices on the (2p−1)th and 2pth rows in this embodiment propagate. Each solid line with an arrow represents an electron orbit 87 in the first half of 1H; and each dotted line with an arrow, an electron orbit 88 in the second half of 1H. R, G, and B phosphors 24 are arranged such that pixels of the same color are shifted by 1.5 pixels in the horizontal direction. The center of each phosphor on the (2p−1)th row is located above the position where the distance between adjacent electron-emitting portions 53 is divided at 1:1. The center of each phosphor on the 2pth row is located above the electron-emitting portion 53. Although not shown, the devices on the remaining rows are arranged in the same manner as those on the (2p−1)th and 2pth rows.

Figure 14:
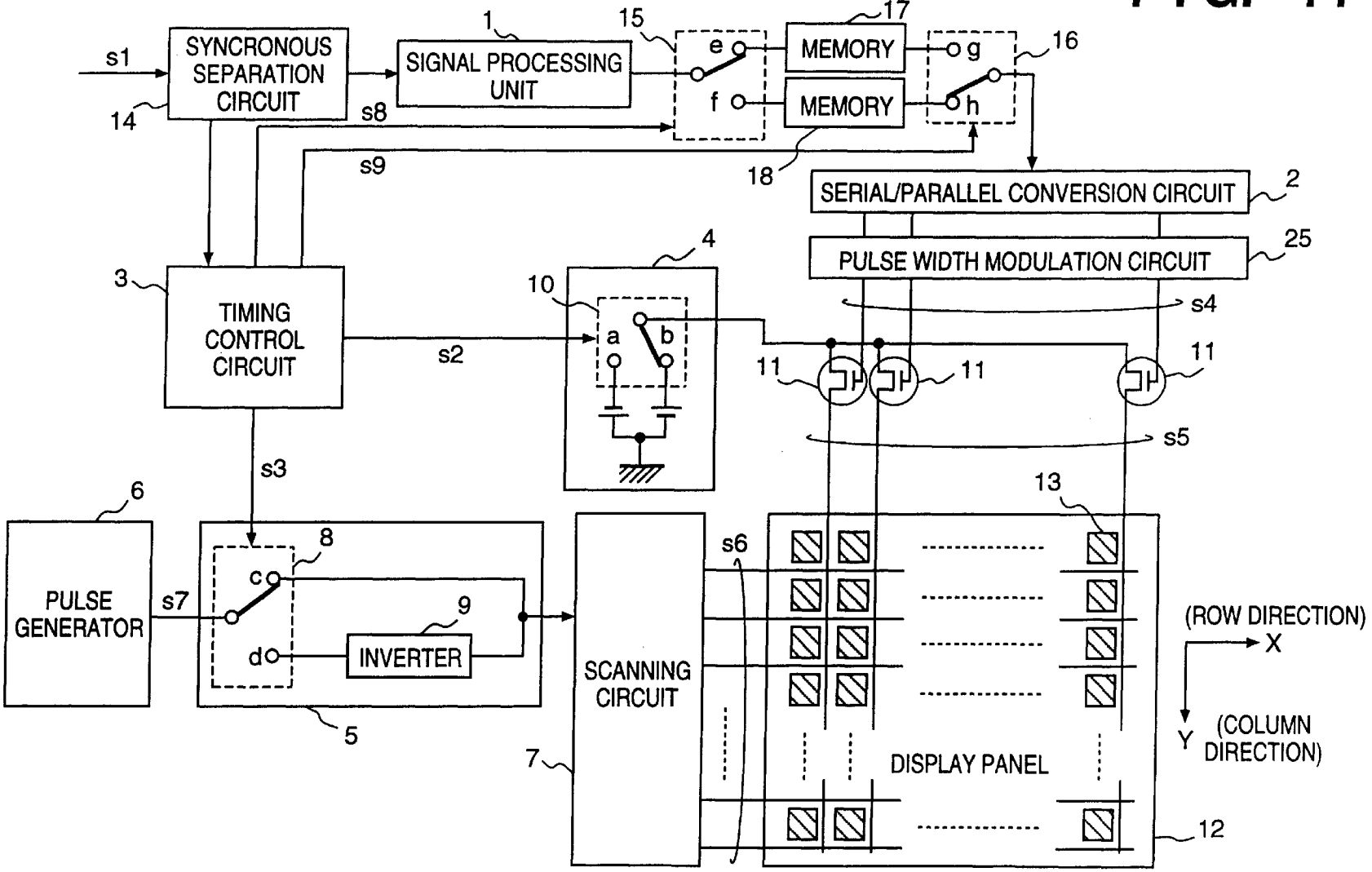
FIG. 14 is a block diagram showing a driving circuit in the fifth embodiment.

FIG. 14 is a block diagram showing a driving circuit for a display panel 12. This embodiment includes switches 15 and 16 and memories 17 and 18 in addition to the arrangement in FIG. 3 described in the first embodiment. The switch 15 switches connection to terminal e or f at 1H intervals to write a one-row luminance signal in the memories 17 or 18. In this case, odd-row data is written in the memory 17, and even-row data is written in the memory 18. In a 1 H interval during which a signal processing unit 1 outputs odd-row luminance signals, the switch 15 is connected to the terminal e to write the odd-row luminance signals in the memory 17. In a 1 H interval during which the signal processing unit 1 outputs even-row luminance signals, the switch 15 is connected to the terminal f to write the even-row luminance signals in the memory 18. In a 1 H interval during which the signal processing unit 1 outputs even-row luminance signals, the switch 16 is connected to a terminal g to output an odd-row luminance signal twice. The first output operation is performed in the first half of the 1 H interval during which the signal processing unit 1 outputs the even-row luminance signals. The second output operation is performed in the second half of the 1 H interval. Subsequently, a pulse width-modulated luminance signal is supplied to a column wiring layer 54 by the same operation as in the first embodiment. Note that the second luminance signal supplied to the column wiring layer 54 is offset from the first luminance signal to the right by one bit with respect to the column wiring layer 54. With this operation, the odd-row devices emit electrons to the left in the first half of a 1 H interval during which the signal processing unit 1 outputs even-row luminance signals, and the same devices emit electrons to the right in the second half of the 1 H interval.

Similarly, in a 1 H interval during which the signal processing unit 1 outputs odd-row luminance signals, the switch 16 is connected to a terminal h to output a even-row luminance signal twice from the memory 18. Note that the second luminance signal supplied to the column wiring layer 54 is offset from the first luminance signal to the right by two bits with respect to the column wiring layer 54. In order to offset these luminance signals, the read out address of the memories 17 and 18 are changed appropriately.

Similar to the first embodiment, a switching circuit 4 is a circuit for inverting the polarity of a luminance signal s5. A switch 10 receives a switching signal s2 from a timing control circuit 3 to switch connection of the switch 10 between terminals a and b in accordance with the switching signal s2. When the switch 10 is connected to the terminal a, the negative luminance signal s5 is sent to a display panel 12. On the contrary, when the switch 10 is connected to the terminal b, the positive luminance signal s5 is output. The positive and negative polarities are switched at ½ horizontal scanning (0.5 H) intervals.

A switching circuit 5 is a circuit for inverting the polarity of a scanning signal s6 input to the display panel 12. First of all, a pulse generator 6 generates a pulse signal s7 with the same polarity (e.g., the positive polarity) at 0.5 H intervals. A switch 8 is switched by a switching signal s3 from the timing control circuit 3 at 0.5 H intervals. That is, when the switch 8 is connected to a terminal c, a pulse signal s7 passes through the switching circuit 5 without any change and input to the scanning circuit 7. On the contrary, when the switch 8 is connected to a terminal d, the polarity of the pulse signal s7 is inverted (to the negative polarity) by an inverter 9, and the inverted signal is sent to the scanning circuit 7. The pulse having passed through the switching circuit 5 is inverted at 0.5 H intervals. The scanning circuit 7 switches rows to be selected at 1 H intervals, and outputs the scanning signal s6 to the display panel 12. The signal whose polarity is inverted at 0.5 H intervals is sent to each selected scanning line of the display panel 12 through the scanning circuit 7. Therefore, one line of the display panel 12 is scanned/driven with one-row data itself in the first 0.5 H interval, and is scanned/driven with the shifted one-row video data in the second 0.5 H interval. In this manner, scanning is performed twice in the first and second 0.5 H intervals. The polarity of the voltage applied to the electron-emitting portion 53 is inverted in the two scanning operations.

Figure 15:
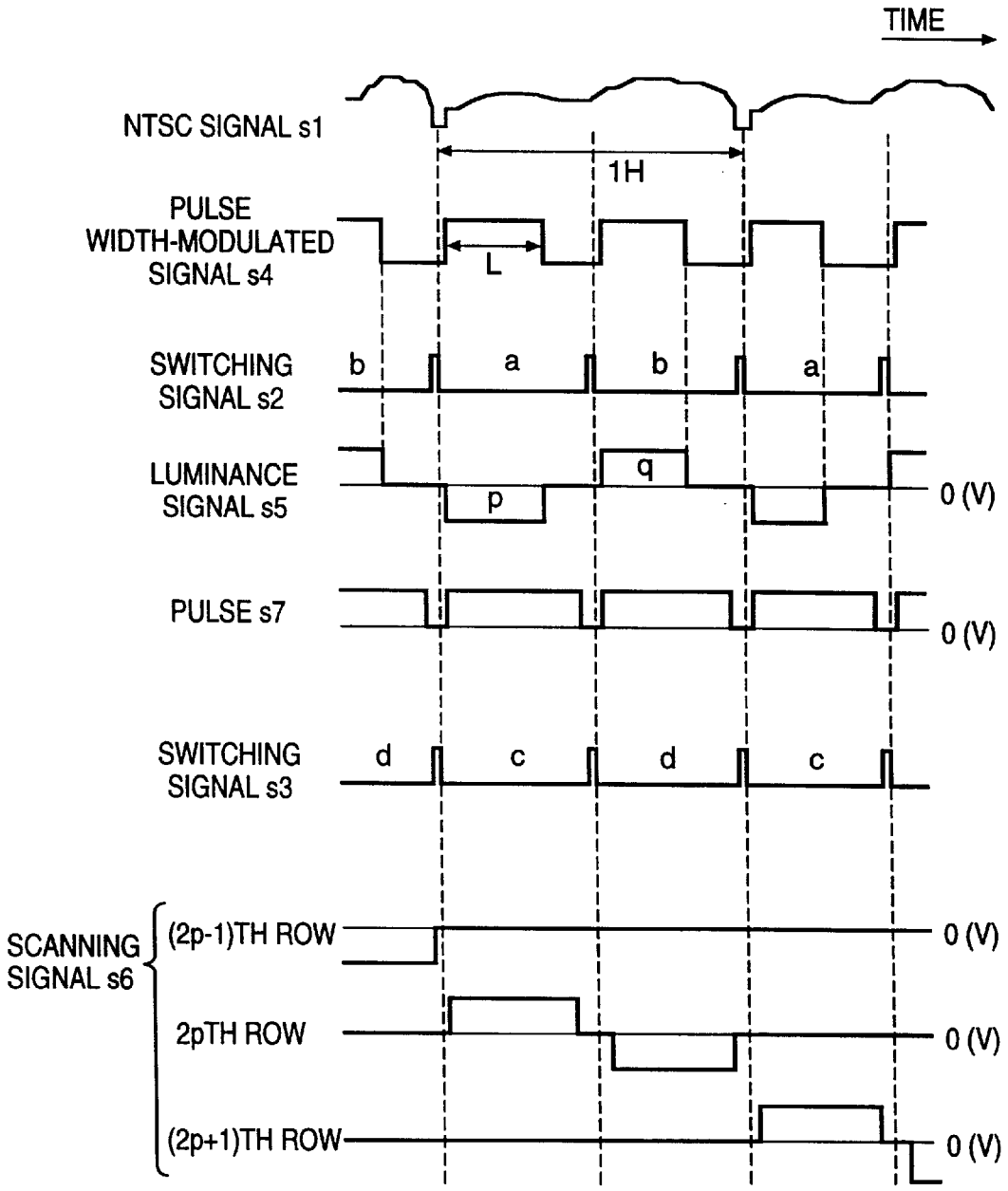
FIG. 15 is a timing chart in the fifth embodiment.

The operation of this embodiment will be described next with reference to the timing chart of FIG. 15. The same reference numerals in FIG. 15 denote the same parts as in FIG. 14. The video signal of the NTSC signal s1 is subjected to signal processing in the signal processing unit 1 and the modulation circuit 2 to become the pulse width-modulated signal s4. The pulse width-modulated signal s4 represents a signal flowing in a given column signal line. The switching signal s2 for switching the switching circuit 4 is generated at 0.5 H intervals. The switch 10 is switched by this switching signal s2. Portions a and b of the switching signal s2 in FIG. 15 represent the connection states of the switch 10 with respect to the terminals. More specifically, when the switch 10 is connected to the terminal a, the luminance signal s5 has the negative polarity. When the switch 10 is connected to the terminal b, the luminance signal s5 has the positive polarity. FIG. 15 shows this state of the luminance signal s5. Note that each thin solid line indicating the luminance signal s5 represents the ground potential (=0 V). The pulse width of the luminance signal s5 is equal to a width L of the pulse width modulation signal s4.

The pulse signal s7 is generated by the pulse generator 6 at 0.5 H intervals, as described above. In this embodiment, the pulse signal s7 has the positive polarity. The signal s3 for switching the switch 8 is also generated by the timing control circuit 3 at 0.5 H intervals. With this signal, the switch 8 is switched and connected to the terminal c or d at 0.5 H intervals. Portions c and d of the signal s3 in FIG. 15 represent the connection states of the switch 8 with respect to the terminals c and d. With this signal, the polarity of the scanning signal s6 is inverted at 0.5 H intervals, as shown in FIG. 15. In this case, the luminance signal s5 and the scanning signal s6 must always have opposite polarities. With this operation, portions p and q of the luminance signal s5 in FIG. 15 make electron orbits drawn as solid line P and dot line Q (FIG. 13B), respectively.

In this manner, the voltage polarities of electrodes 56 and 57 for each electron-emitting portion 53 are inverted in continuous 0.5 H intervals to irradiate phosphors 24 arranged in a delta arrangement.

Sixth Embodiment

Figure 16A:
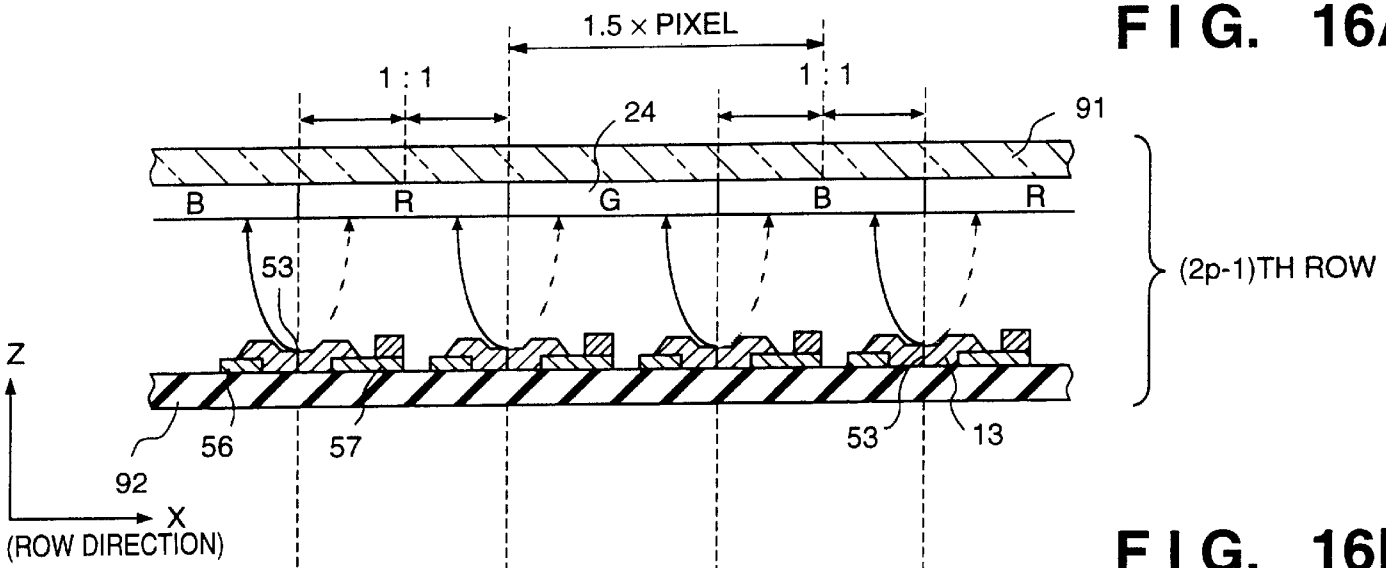
FIG. 16A and 16B are sectional views showing the electron orbits of electrons emitted from a multi-electron beam source in the sixth embodiment of the present invention.
Figure 16B:
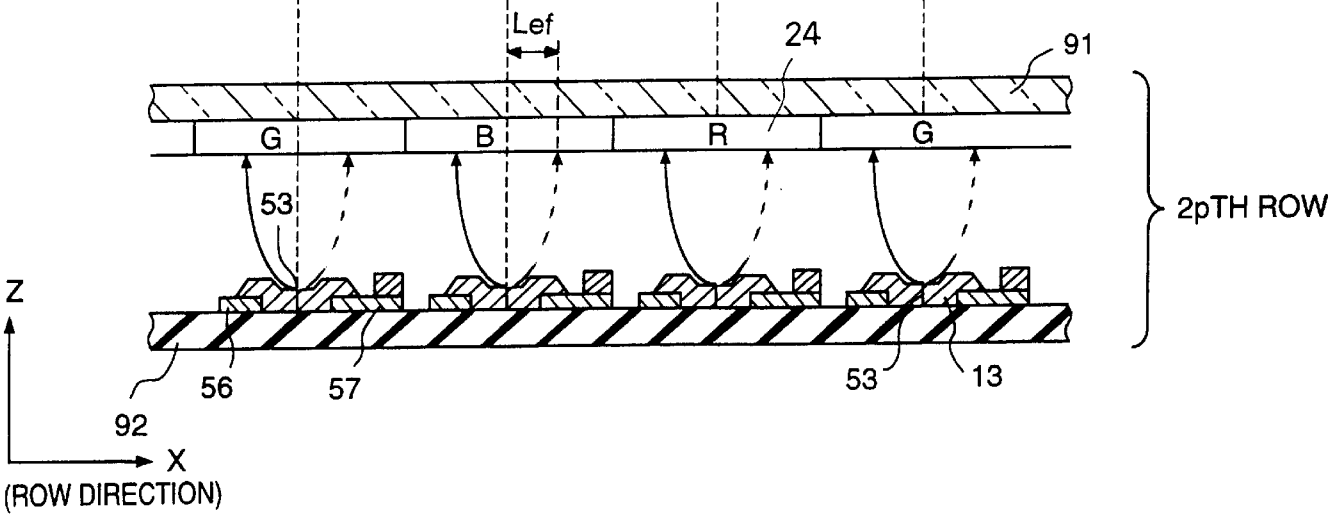

In the sixth embodiment, the same operation as that in the fifth embodiment is performed. However, since a voltage Vf is lower than that in the fifth embodiment, each electron orbit is shorter than that in the fifth embodiment. FIGS. 16A and 16B are sectional views of a display panel, showing electron orbits in the sixth embodiment. As shown in FIGS. 16A and 16B, by changing the length of each electron orbit, a combination of an electron-emitting portion 53 and phosphors 24 may have an arrangement different from that in FIGS. 13A and 13B. The length Lef of each electron orbit can be changed by changing the values of Va and Vf in equation (1) described above. Similar to the arrangement in FIGS. 13A and 13B, in the arrangement in FIGS. 16A and 16B, phosphors are arranged in a delta arrangement, and the center of each phosphor film 24 is located at almost the middle point between adjacent electron-emitting portions. In the arrangement in FIGS. 16A and 16B, the Lef of each electron orbit is smaller than that in the arrangement shown in FIGS. 13A and 13B. For this reason, the phosphor driven by a given electron-emitting device on the $(2p-1)$th row in the first 0.5 H interval is shifted from the phosphor driven by the same electron-emitting device in the second 0.5 H interval to the right by one phosphor. On the $2pth$ row, the same phosphor is driven. Therefore, in reading data from a memory 17, similar to the case shown in FIGS. 13A and 13B, one-row data is read out without any change in the first 0.5 H interval, and one-row data shifted to the right by one bit is read out in the second 0.5 H interval. In reading out data from a memory 18, identical row data are read out in the first and second 0.5 H intervals.

In the fifth and sixth embodiments, bit shifting of one-row data in the first and second 0.5 H intervals of a 1 H interval is performed by using the memories 17 and 18. However, the present invention is not limited to this. For example, this operation may be performed by a S/P conversion circuit 2. In this case, however, the S/P conversion circuit 2 needs to use some means or receive some signals from a timing control circuit 3 to check whether a selected display line is an odd or even row, and a display interval is the first or second 0.5 H interval.

As is apparent from FIGS. 13A and 13B showing the fifth embodiment and FIGS. 16A and 16B showing the sixth embodiment, since pixels are displayed while the landing positions of electrons on even phosphors of the same colors are changed, a plurality of bright spots can be formed on one phosphor in a 1 H interval. Therefore, each phosphor can be displayed in halves.

Seventh Embodiment

Figure 17A:
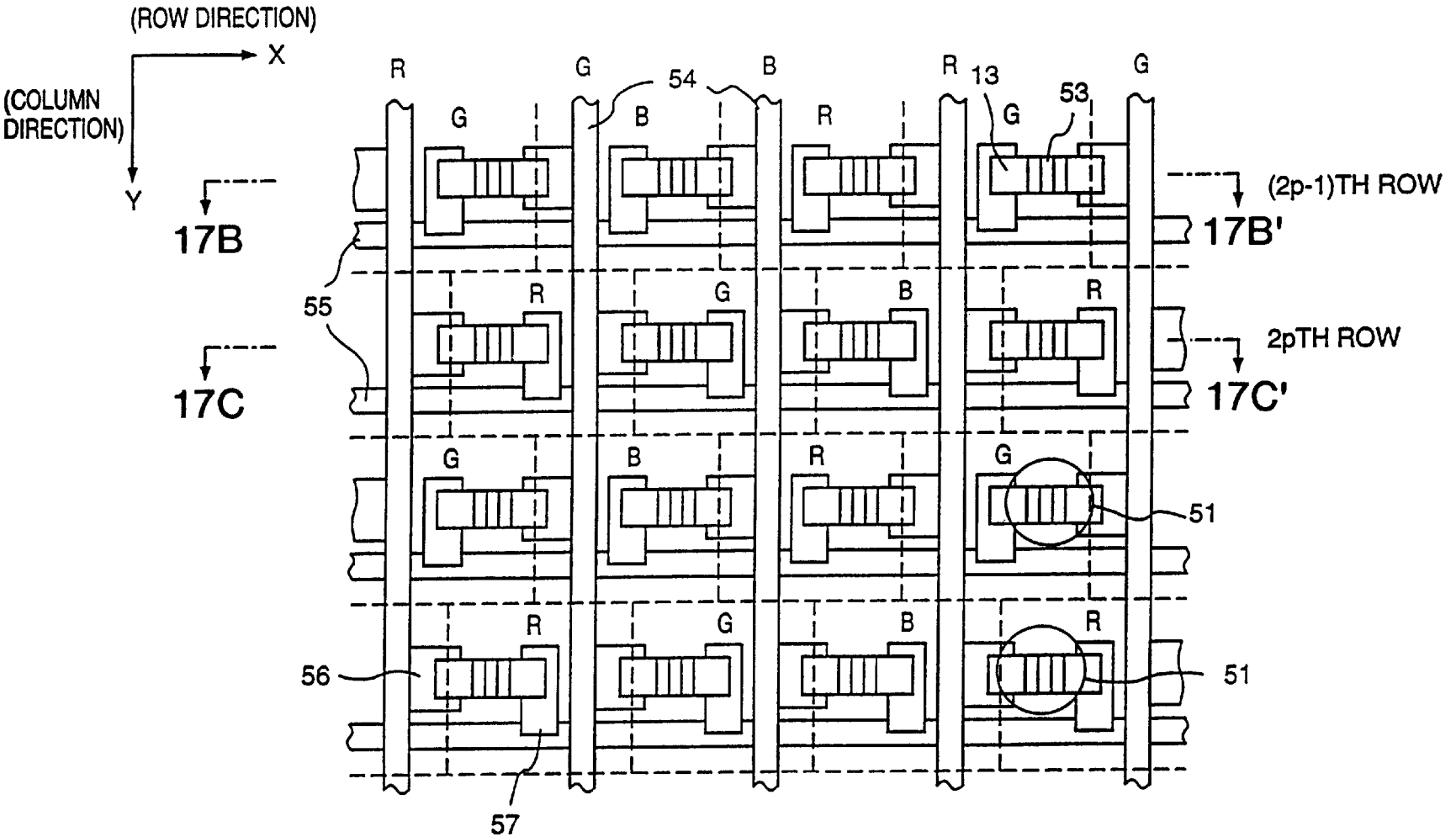
FIG. 17A is a plan view showing a multi-electron beam source in the seventh embodiment of the present invention.
Figure 17B:
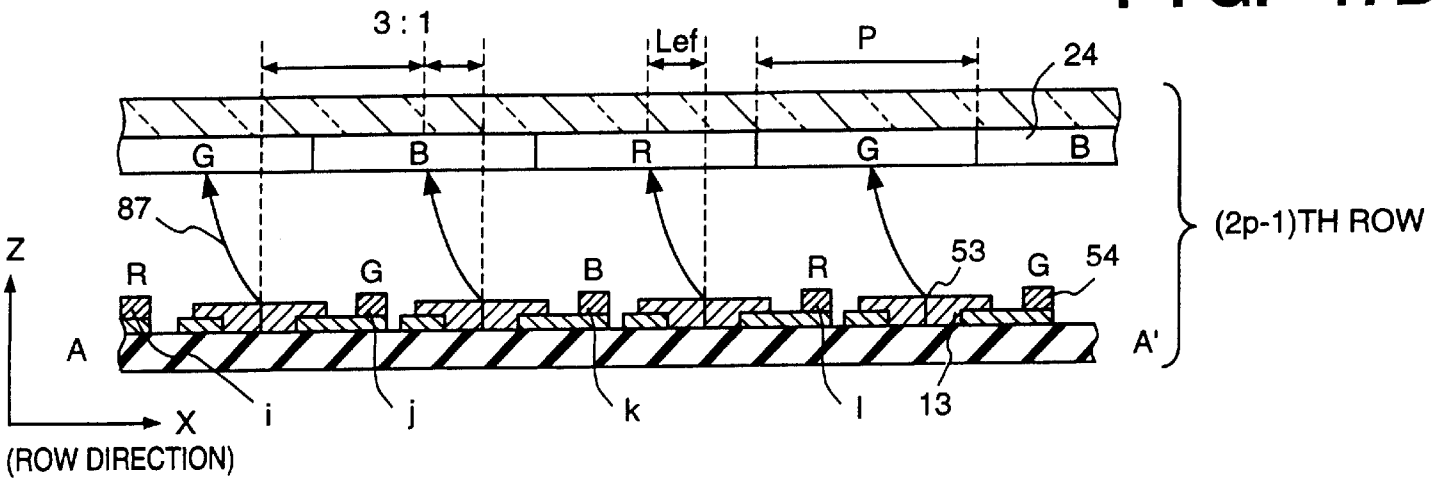
FIGS. 17B and 17C are sectional views showing the electron orbits of electrons emitted from the source.
Figure 17C:
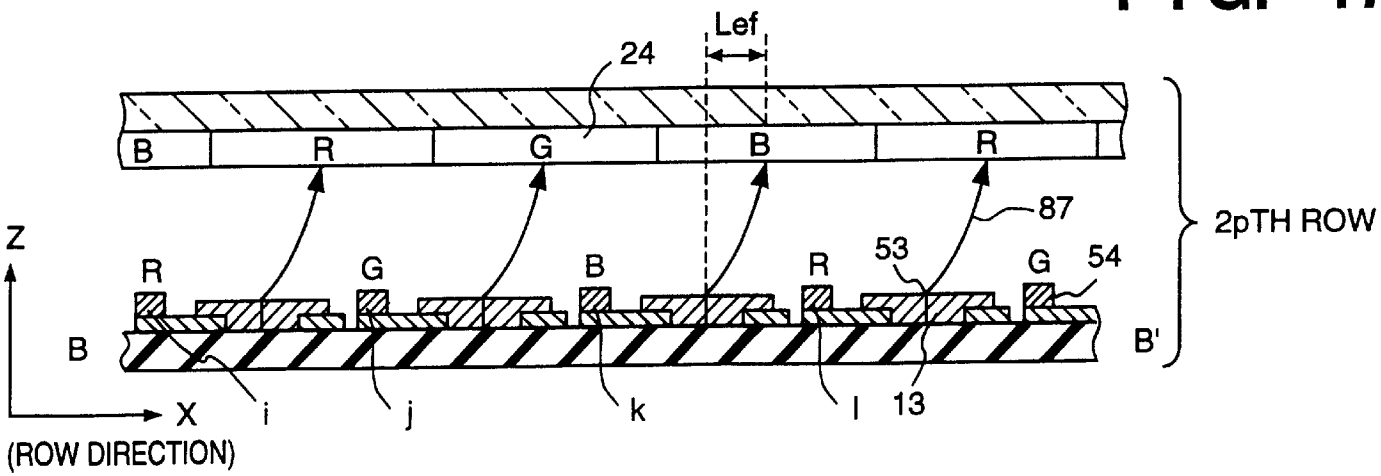

In the seventh embodiment, the surface-conduction type electron-emitting devices on the odd rows and the surface-conduction type electron-emitting devices on the even rows are connected to the same column wiring layers in opposite directions. By applying luminance signals having the same polarity to all the column wiring layers, electrons are emitted in opposite sides. FIGS. 17A, 17B, and 17C are a plan view and a sectional view, respectively, showing a multi-electron beam source of the seventh embodiment. FIG. 17B is a sectional view taken along the $(2p-1)$th row as an odd row in FIG. 17A, i.e., a line 17B—17B'. FIG. 17C is a sectional view taken along the $2pth$ row as an even row in FIG. 17A, i.e., a line 17C—17C'. The same reference numerals in FIGS. 17A to 17C denote the same parts as described above. In this embodiment, as shown in FIGS. 17A to 17C, the devices on the $(2p-1)$th row are connected to the left sides of the column wiring layers 54, and the devices on the $2pth$ row are connected to the right sides of the column wiring layers 54. As shown in FIGS. 17A to 17C, signals of predetermined colors are always supplied to the column wiring layers 54. The devices on the $(2p-1)$th row emit electrons to the left, and the devices on the $2pth$ row emit electrons to the right. The phosphors in a delta arrangement can therefore be excited to emit light by driving them appropriately according to equation (1). The central portion of each phosphor film 24 in this embodiment is located at the position where the distance between adjacent electron-emitting portions 53 is divided at 3:1, as in the first embodiment.

Figure 18:
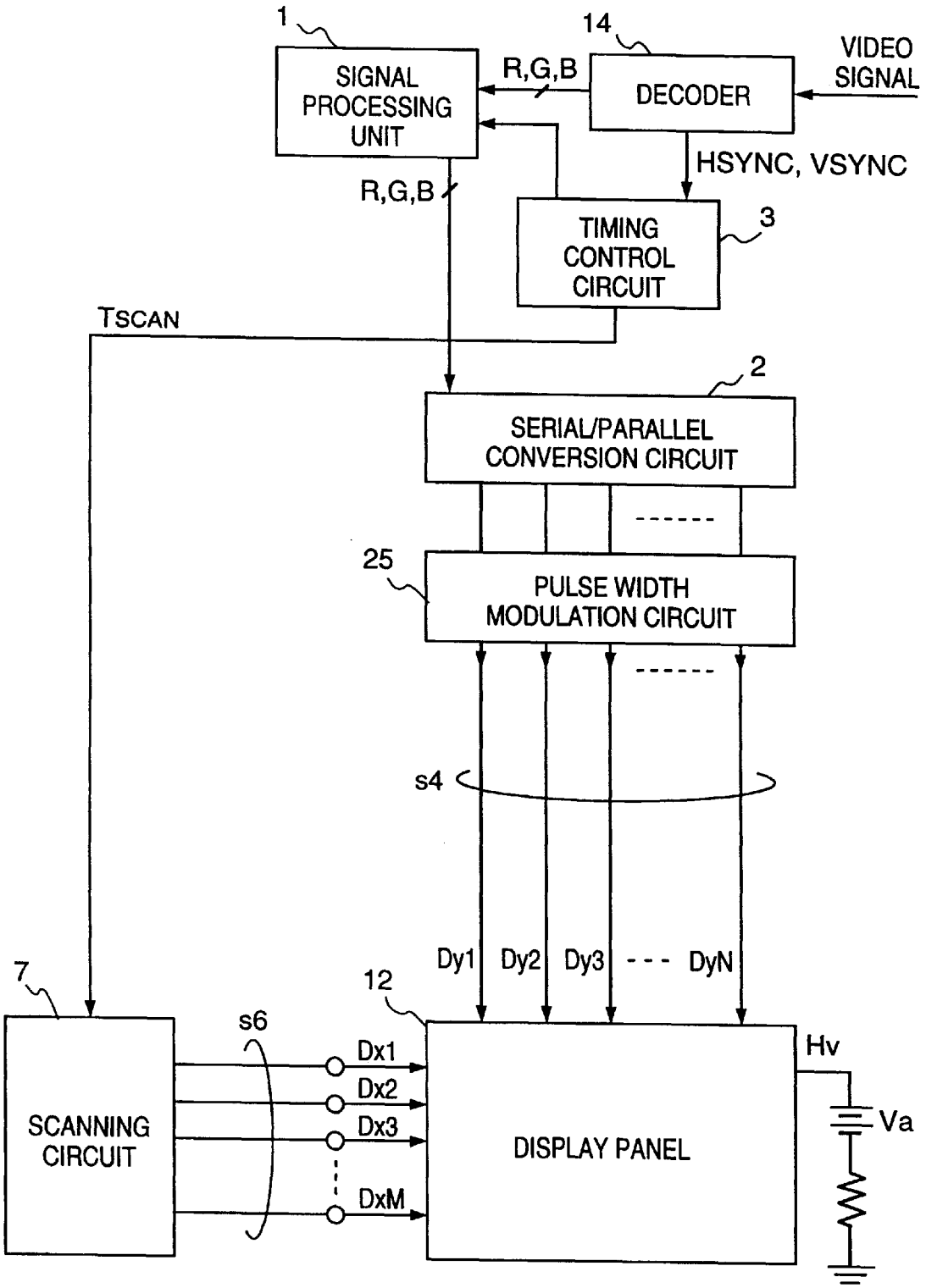
FIG. 18 is a block diagram showing a driving circuit in the seventh embodiment.
Figure 19:
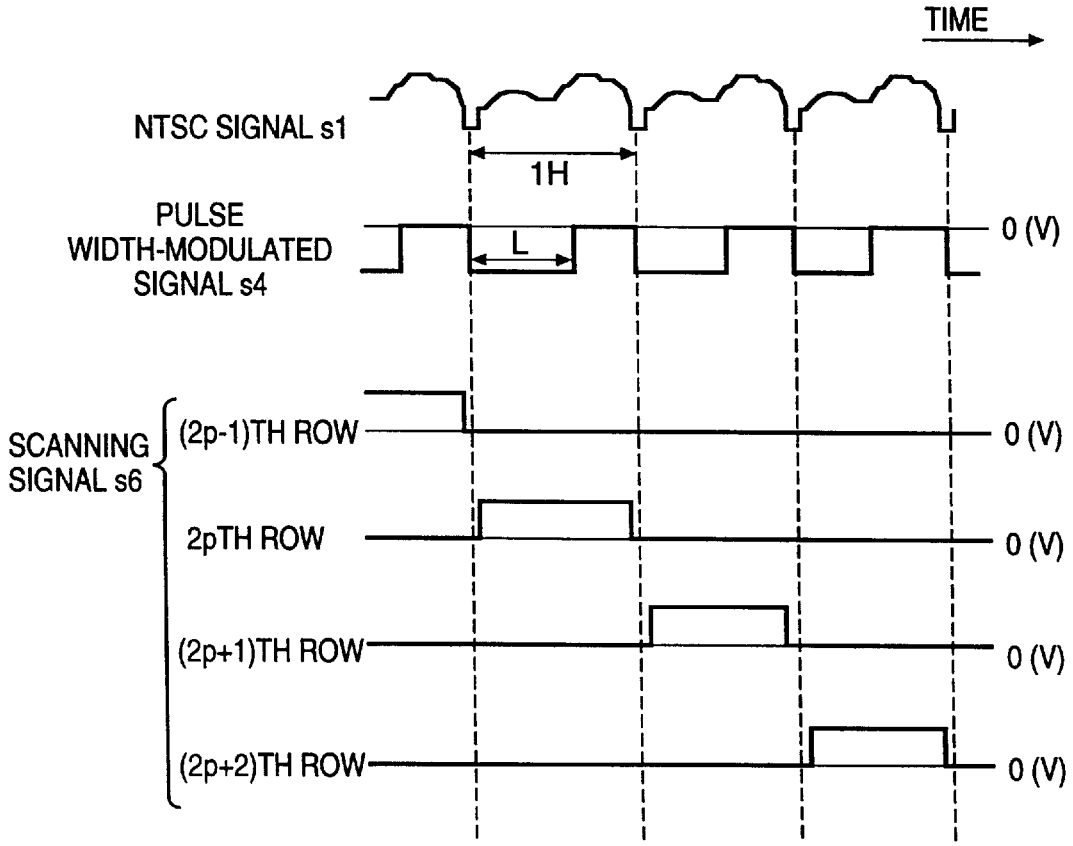
FIG. 19 is a timing chart in the seventh embodiment.

FIG. 18 is a block diagram showing a driving circuit in this embodiment. This driving circuit does not include the switching circuits 4 and 5, the switches 8 and 10, the inverter 9, and the MOS-FET 11 of the driving circuit in the first embodiment described with reference to FIG. 3. The driving circuit directly outputs a luminance signal s4 output from a pulse width modulation circuit 25 to a display panel 12. Except for this operation, the driving circuit operates in the same manner as in the first embodiment. In this embodiment, therefore, neither inverting operation nor color switching operation is performed. FIG. 19 is a timing chart showing pulses used in the embodiment. The luminance signal s4 as a pulse width-modulated signal always has the negative polarity. A scanning signal s6 always has the positive polarity. In the embodiment, since neither signal inverting operation nor color switching operation is performed, the driving circuit can be simplified.

Eighth Embodiment

Figure 20A:
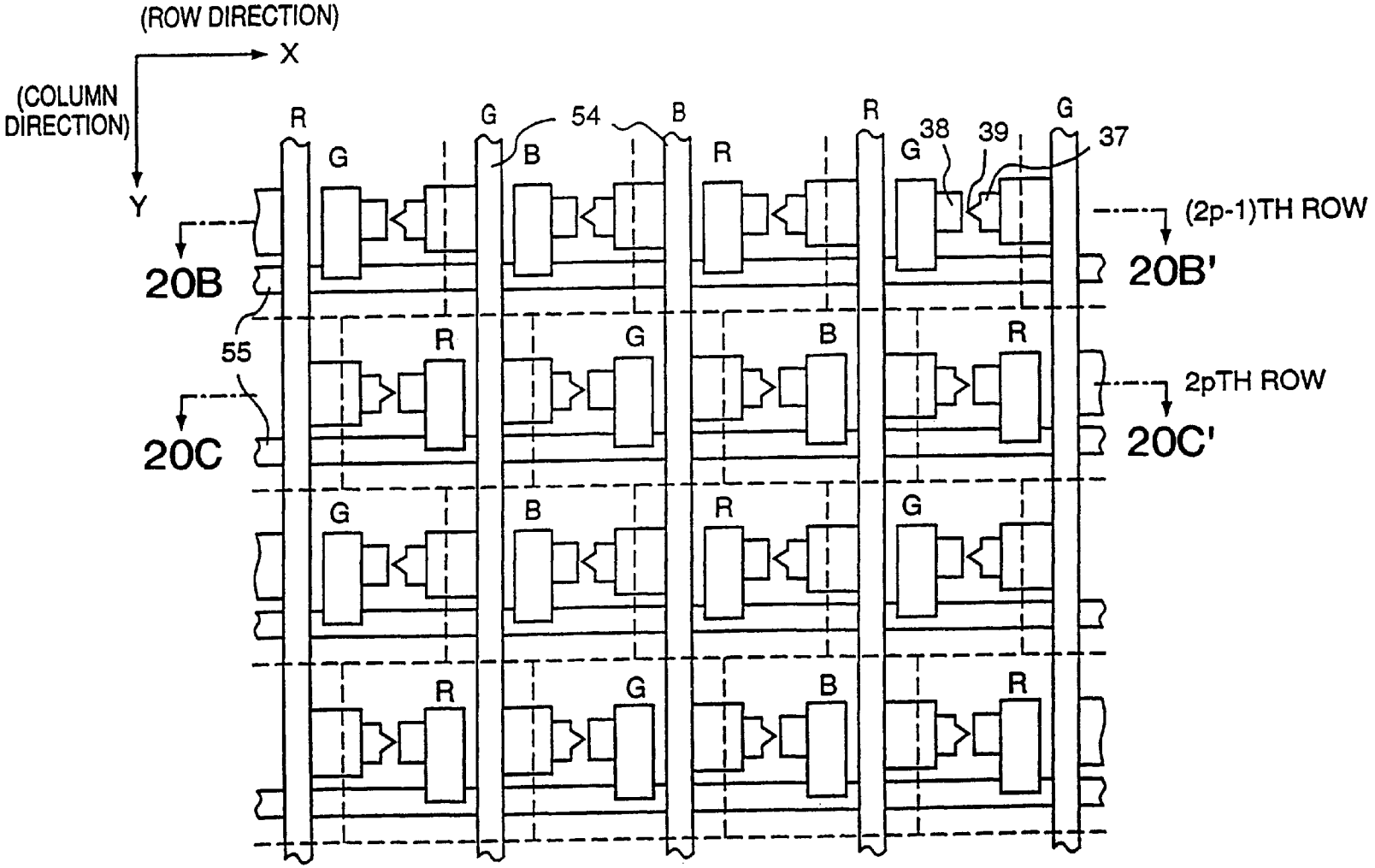
FIG. 20A is a plan view showing a multi-electron beam source in the eighth embodiment.
Figure 20B:
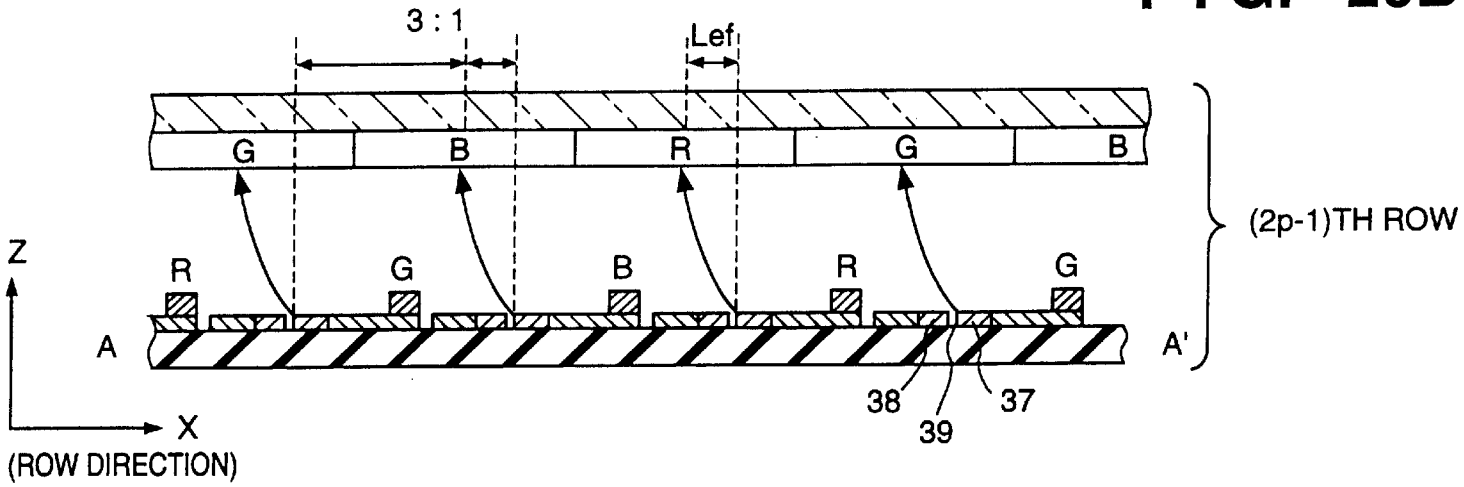
FIGS. 20B and 20C are sectional views showing the electron orbits of electrons emitted from the source.
Figure 20C:
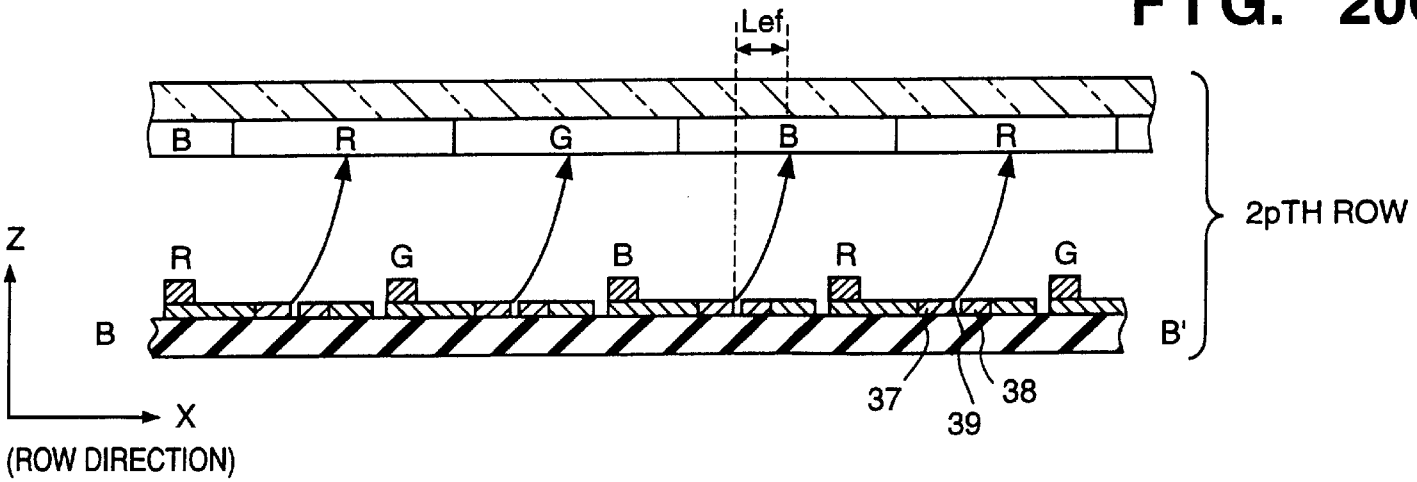

In the eighth embodiment, the surface-conduction type electron-emitting devices of the seventh embodiment are replaced with lateral field emission type electron-emitting devices (to be referred to as lateral FE type electron-emitting devices hereinafter). FIGS. 20A, 20B, and 20C are a plan view and sectional views, respectively, showing a multi-electron beam source of this embodiment. FIG. 20B is a sectional view taken along a line 20B—20B' in FIG. 20A as an odd row, i.e., the (2*p*−1)th row. FIG. 20C is a sectional view taken along a line 20C—20C' in FIG. 20A as an even row, i.e., the 2*pth* row. Referring to FIGS. 20A to 20C, reference numeral 37 denotes a negative electrode of the lateral FE type electron-emitting device; 38, a positive electrode; and 39, an electron-emitting portion. The remaining reference numerals are the same as those described above. In this embodiment as well, the devices on the (2*p*−1)th row emit electrons to the left, and the devices on the 2*pth* row emit electrons to the right.

Figure 21A:
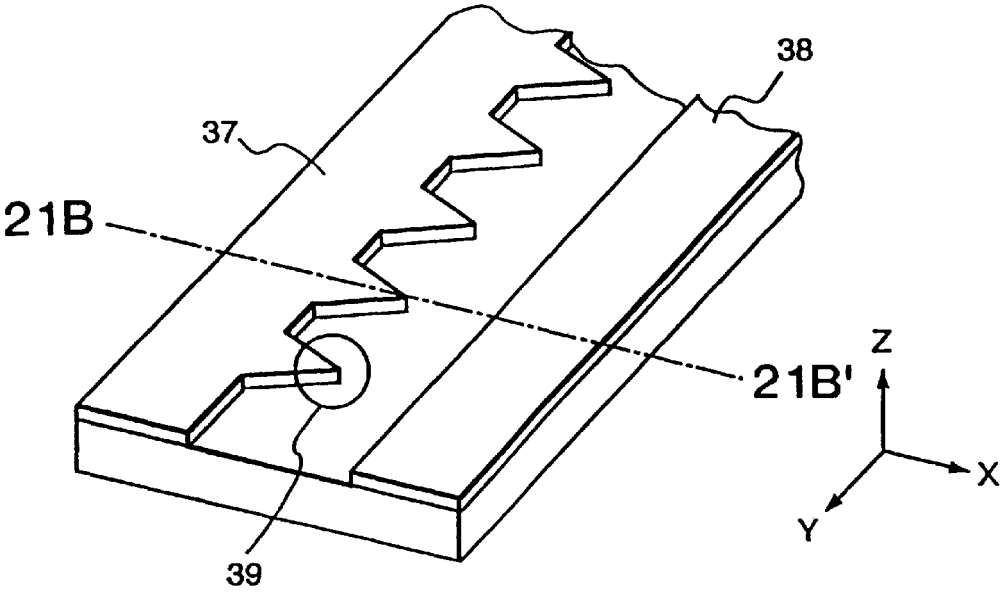
FIG. 21A is a perspective view showing a lateral field emission type electron-emitting device.
Figure 21B:
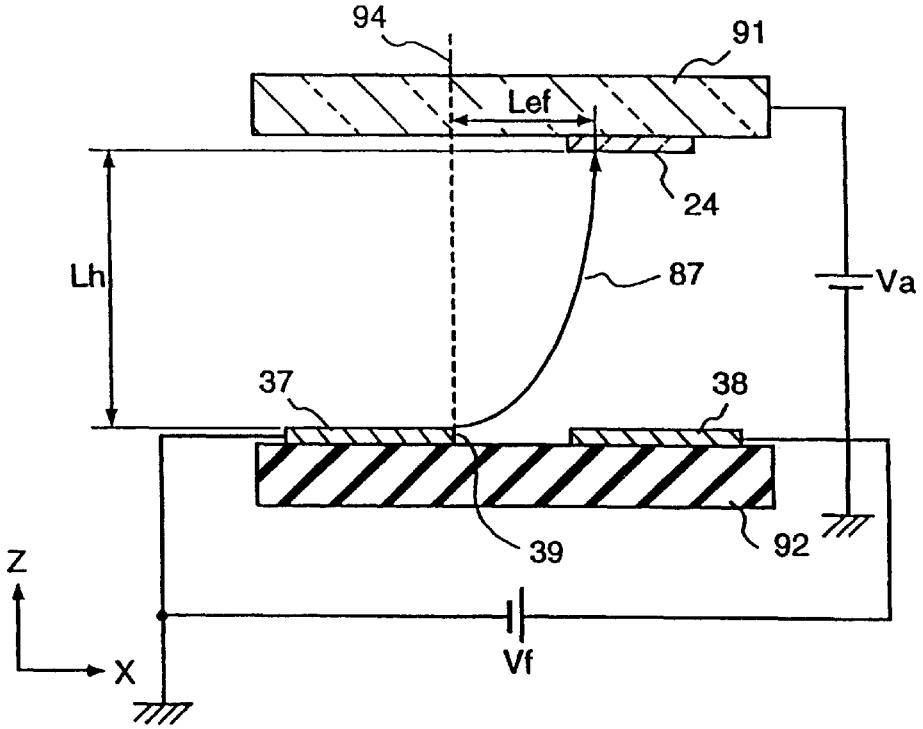
FIG. 21B is a sectional view showing an electron orbit.

FIG. 21A is a perspective view of the lateral FE type electron-emitting device. FIG. 21B is a sectional view taken along a line 21B—21B' in FIG. 21A. The same reference numerals in FIGS. 21A and 21B denote the same parts as described above. When a device voltage Vf is applied between the negative electrode 37 and the positive electrode 38, the electron-emitting portion 39 emits electrons. At this time, in the lateral FE type electron-emitting device as well, a distance Lef between a plane 94 and the landing position of each electron is given as follows, similar to equation (1), from an anode voltage Va applied between a faceplate 91 and the electron-emitting portion 39, and a distance Lh between the electron-emitting portion 39 and a phosphor film 24:

$$Lef = 2 \times K \times Lh \times \sqrt{\frac{Vf}{Va}}$$

On the basis of this equation, the voltages Vf and Va for a driving operation are determined to irradiate the delta arranged phosphor. A driving circuit and its timing chart are the same as those in the seventh embodiment.

Ninth Embodiment

Figure 22A:
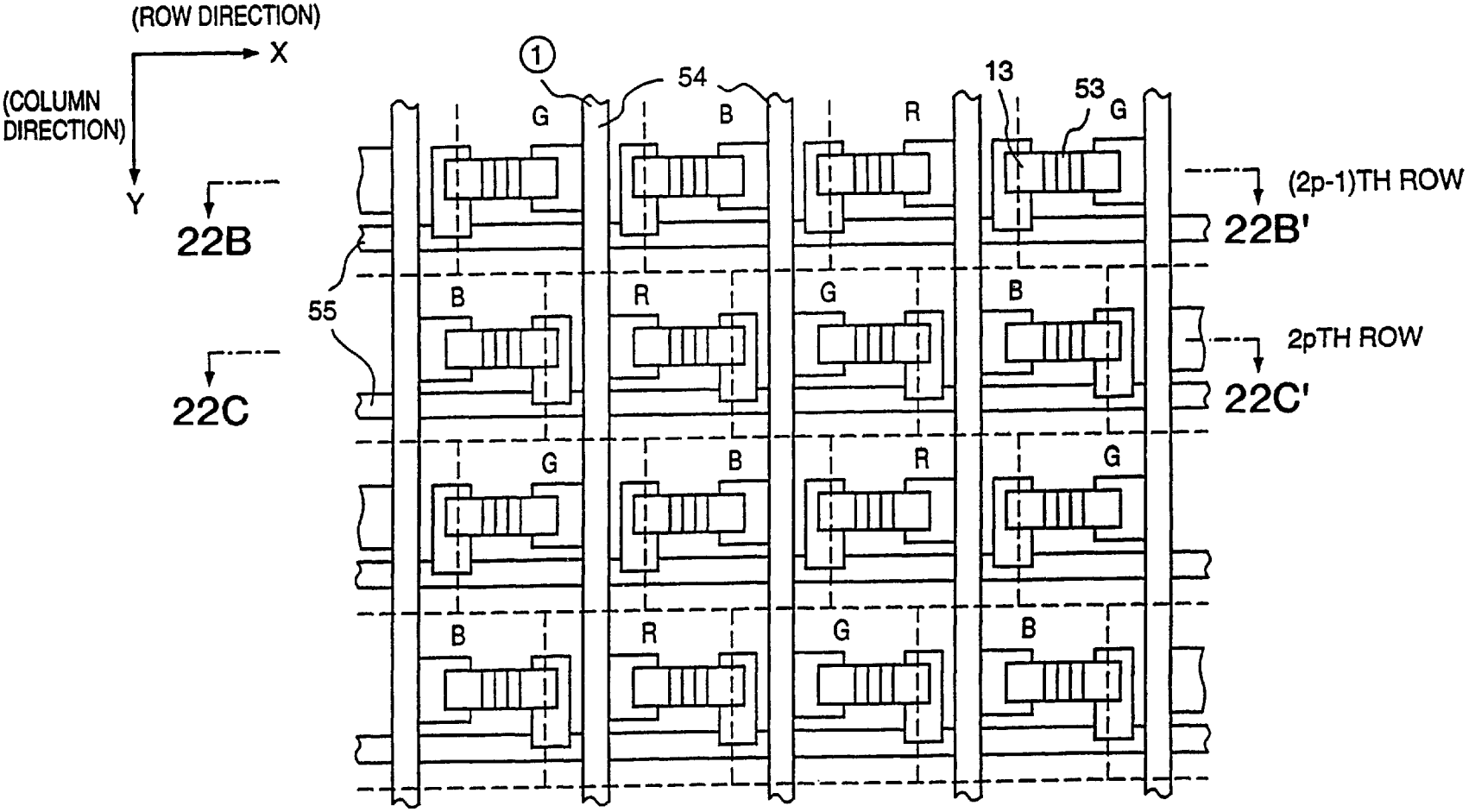
FIG. 22A is a plan view showing a multi-electron beam source in the ninth embodiment of the present invention.
Figure 22B:
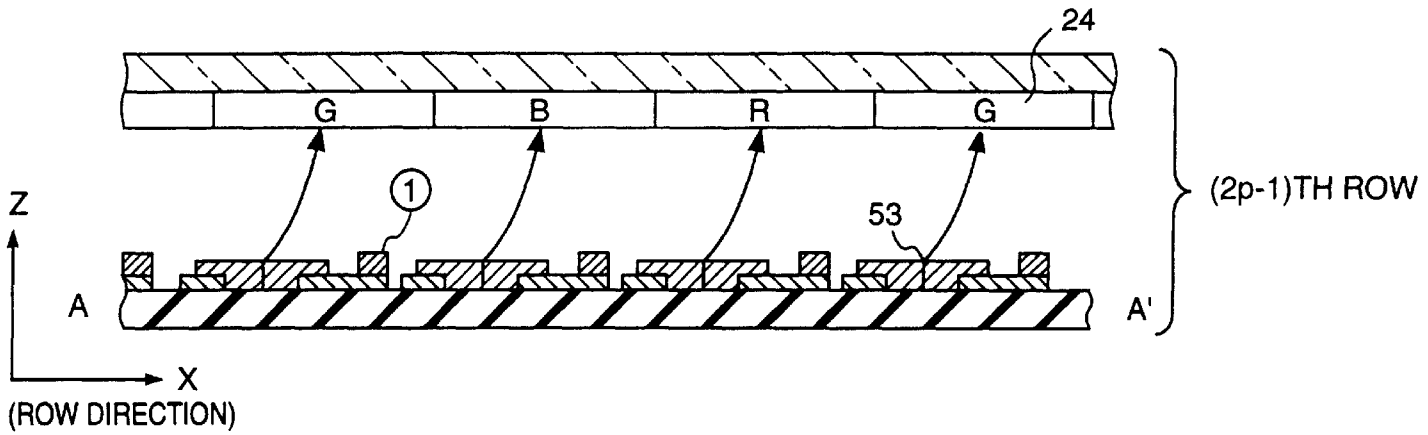
FIGS. 22B and 22C are sectional views showing the electron orbits of electrons emitted from the source.
Figure 22C:
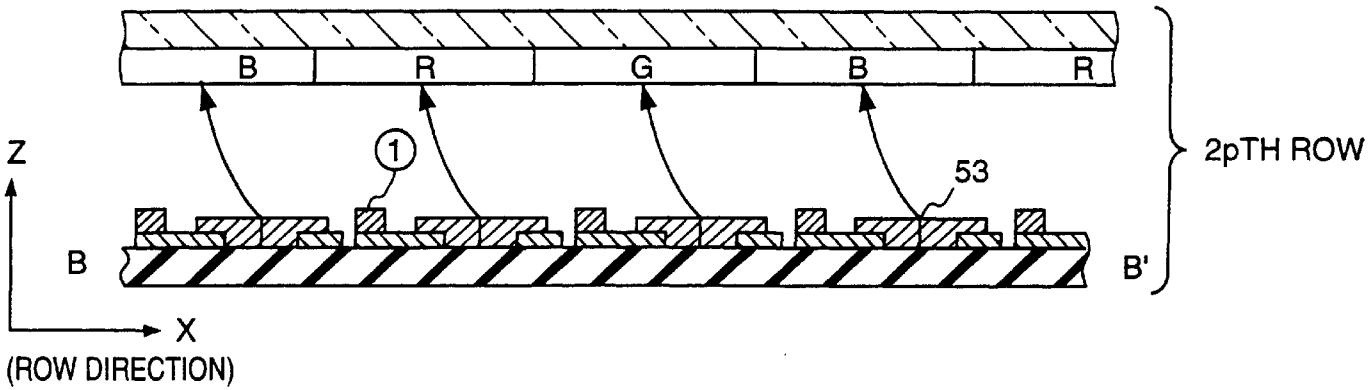

In the ninth embodiment, similar to the seventh embodiment, the surface-conduction type electron-emitting devices on the odd rows and the surface-conduction type electron-emitting devices on the even rows are connected to the same column wiring layers in opposite sides, and voltages having the same polarity are applied to the column wiring layers to emit electrons in opposite directions. In this case, each device emits electrons in a direction to approach the column wiring layer to which the device is connected. FIG. 22A is a plan view of a multi-electron beam source of the ninth embodiment. FIG. 22B is a sectional view taken along a line 22B—22B' in FIG. 22A. FIG. 22C is a sectional view taken along a line 22C—22C' in FIG. 22A. The same reference numerals in FIGS. 22A to 22C denote the same parts as described above. In this embodiment, as shown in FIGS. 22A to 22C, the devices on the (2*p*−1)th row are connected to the left sides of column wiring layers 54, and the devices on the 2*pth* row are connected to the right sides of the column wiring layers 54. Unlike in the seventh embodiment, in this embodiment, signals of different colors are switched and supplied to the column wiring layer 54 depending on whether an odd or even row is to be scanned.

Figure 23:
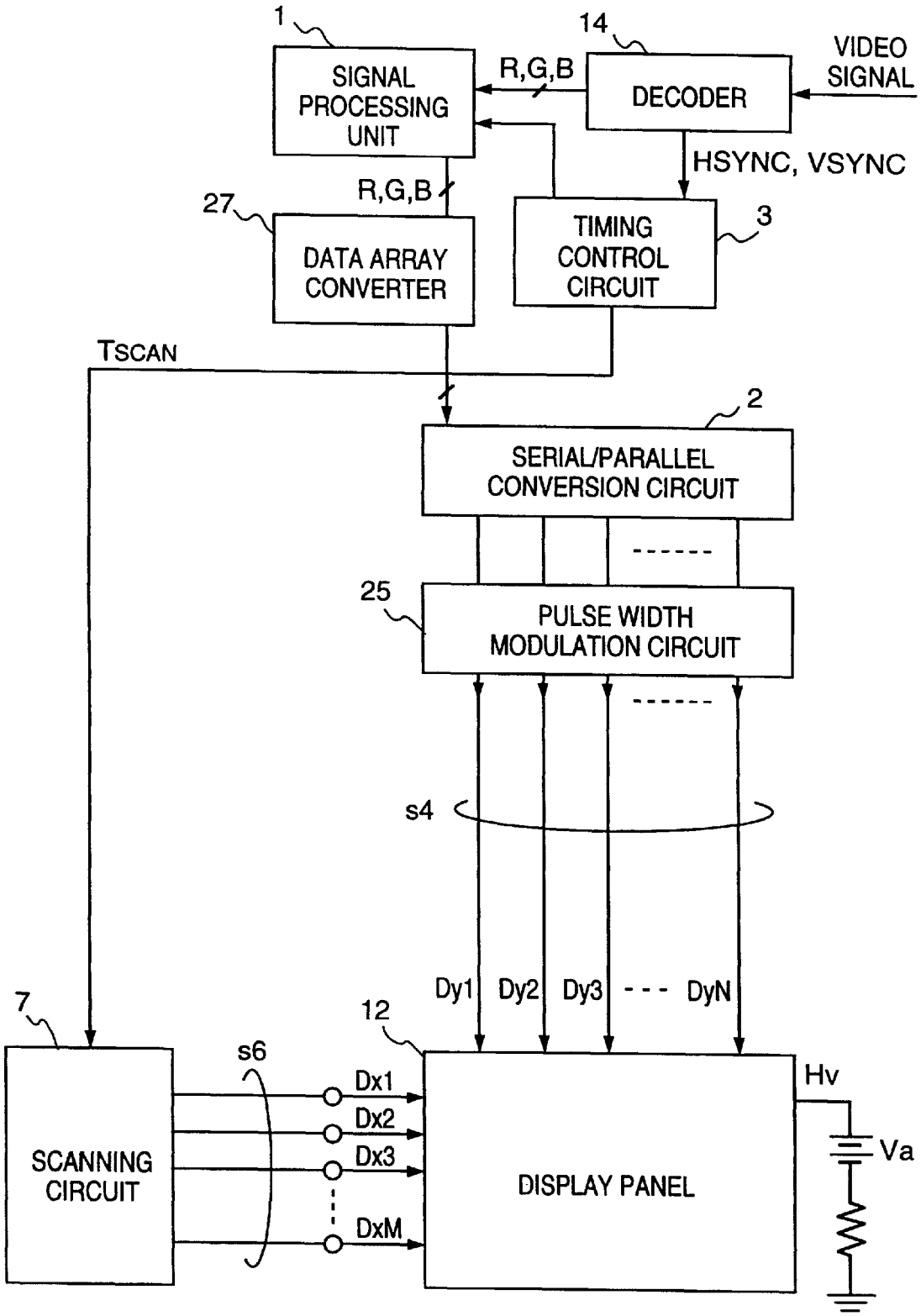
FIG. 23 is a block diagram showing a driving circuit in the ninth embodiment.
Figure 24:
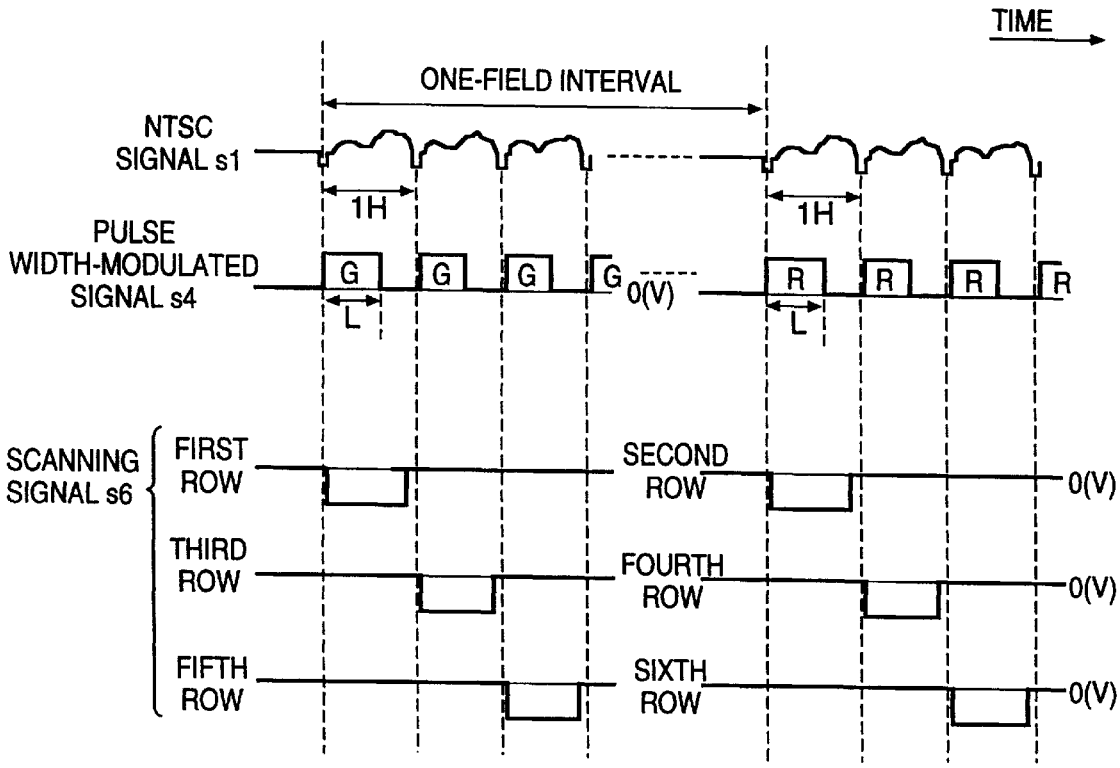
FIG. 24 is a timing chart in the ninth embodiment.

FIG. 23 is a block diagram showing a driving circuit in this embodiment. Referring to FIG. 23, reference numeral 27 denotes a data array converter for shifting luminance signals output from a signal processing unit 1 at 1 H intervals in a non-interlaced scanning operation, and at one-field intervals in an interlaced scanning operation. Except for this operation, the driving circuit operates in the same manner as in the seventh embodiment. FIG. 24 is a timing chart showing an operation associated with a column wiring layer ① in FIGS. 22A–22C, in particular, when interlaced scanning is performed in this embodiment. In the first one-field interval, a green (G) signal is assigned to the column wiring layer ①. In the second one-field interval, a red (R) signal is assigned to the column wiring layer ①.

Tenth Embodiment

Figure 25A:
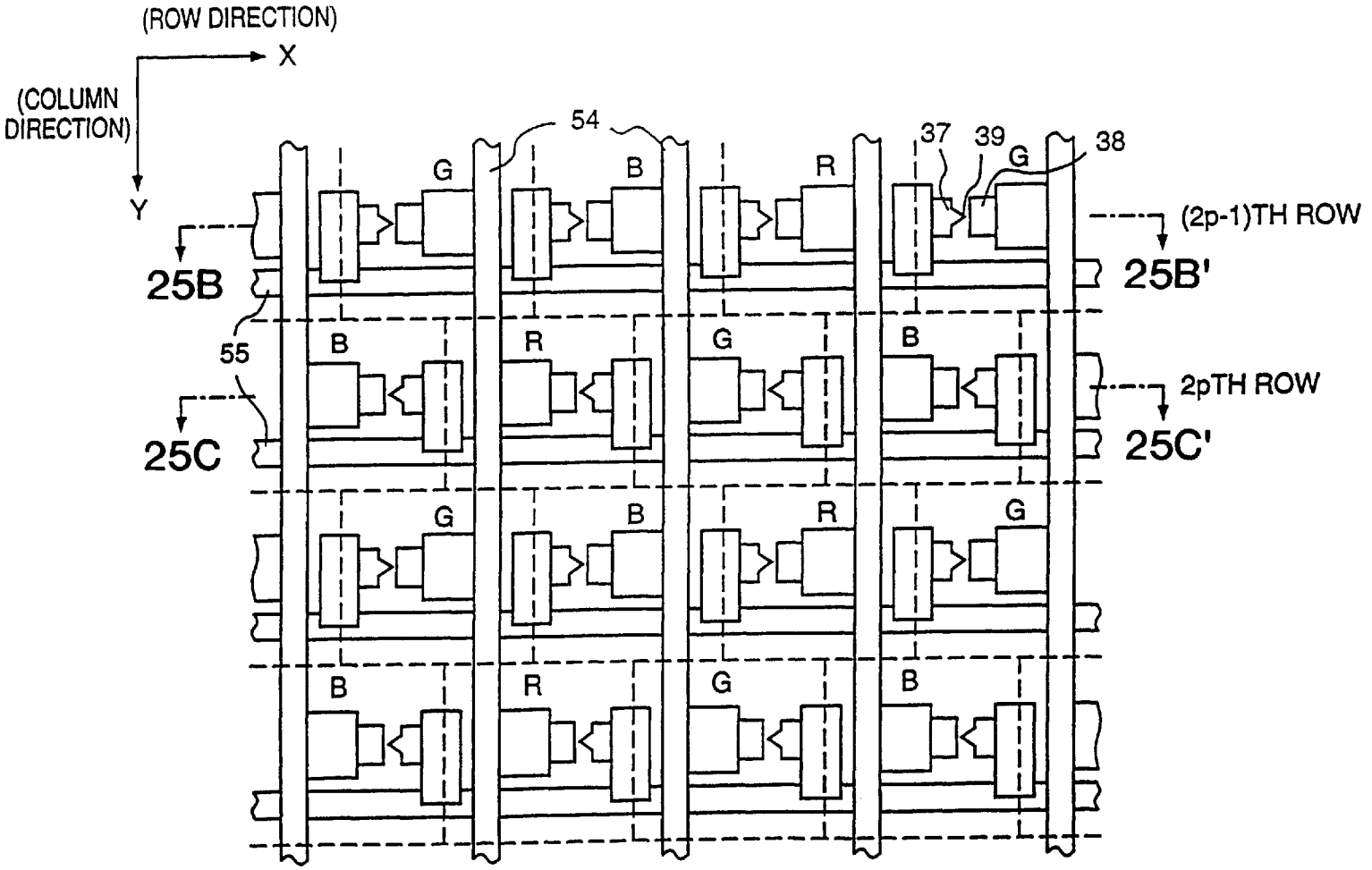
FIG. 25A is a plan view showing a multi-electron beam source in the 10th embodiment of the present invention.
Figure 25B:
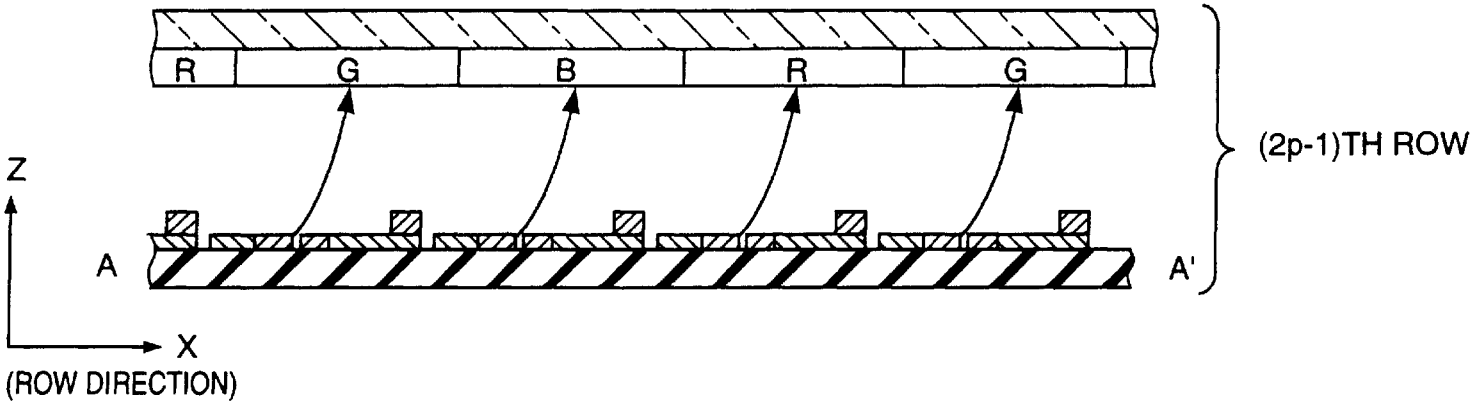
FIGS. 25B and 25C are sectional views showing the electron orbits of electrons emitted from the source.
Figure 25C:
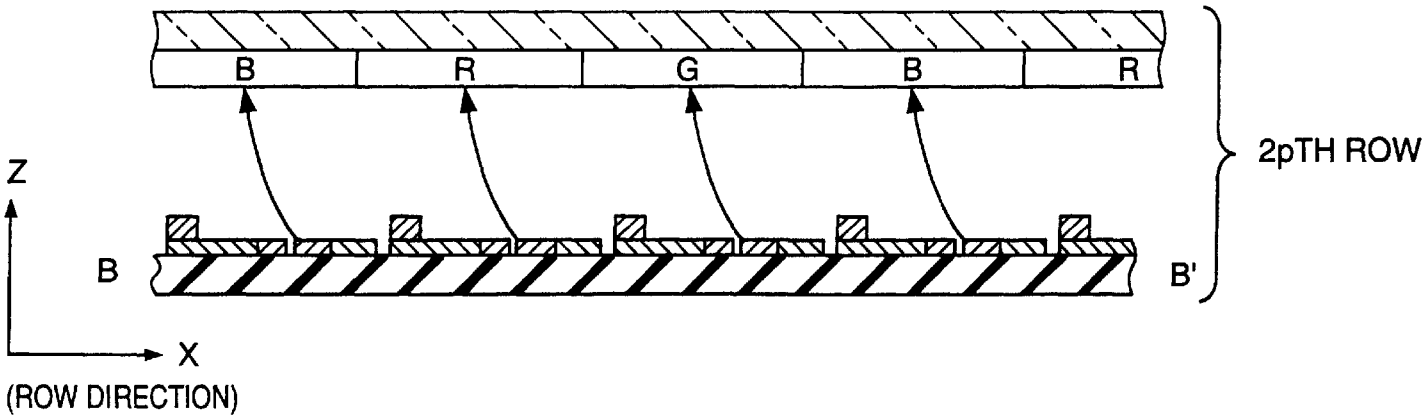

In the 10th embodiment, the surface-conduction type electron-emitting devices in the ninth embodiment are replaced with lateral FE type electron-emitting devices. FIG. 25A is a plan view showing a multi-electron beam source of this embodiment. FIG. 25B is a sectional view taken along a line 25B—25B' in FIG. 25A. FIG. 25B is a sectional view taken along a line 25C—25C' in FIG. 25A. The same reference numerals in FIGS. 25A to 25C denote the same parts as described above. The devices in this embodiment emit electrons in directions opposite to the directions in which the devices in FIGS. 20A to 20C emit electrons. A driving circuit and its timing chart are the same as those in the ninth embodiment.

Eleventh Embodiment

Figure 26A:
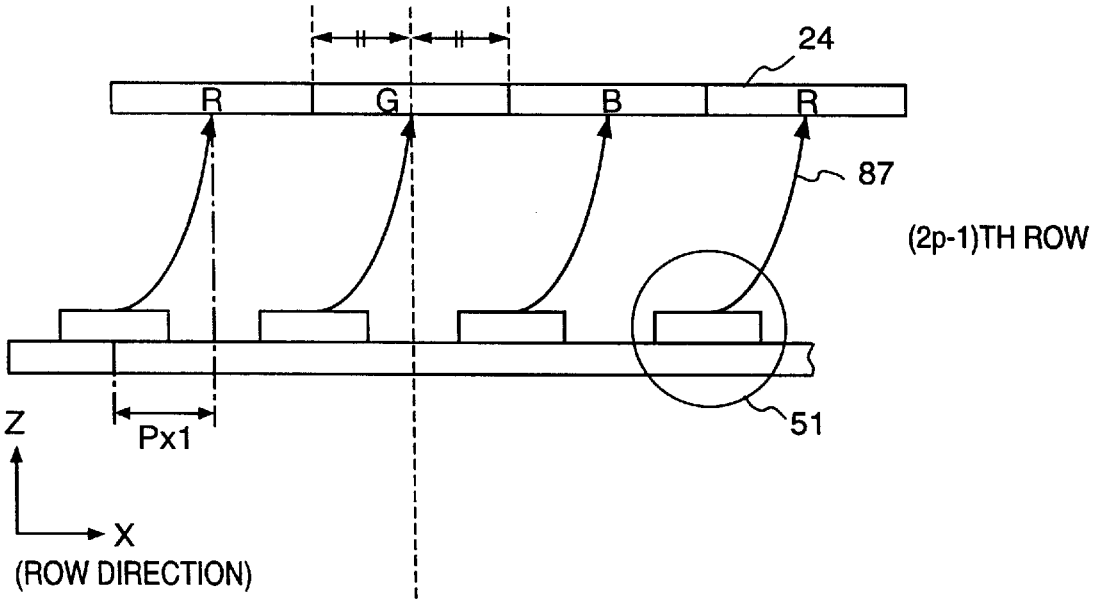
FIGS. 26A and 26B are sectional views showing the electron orbits of electrons emitted from a multi-electron beam source in the 11th embodiment of the present invention.
Figure 26B:
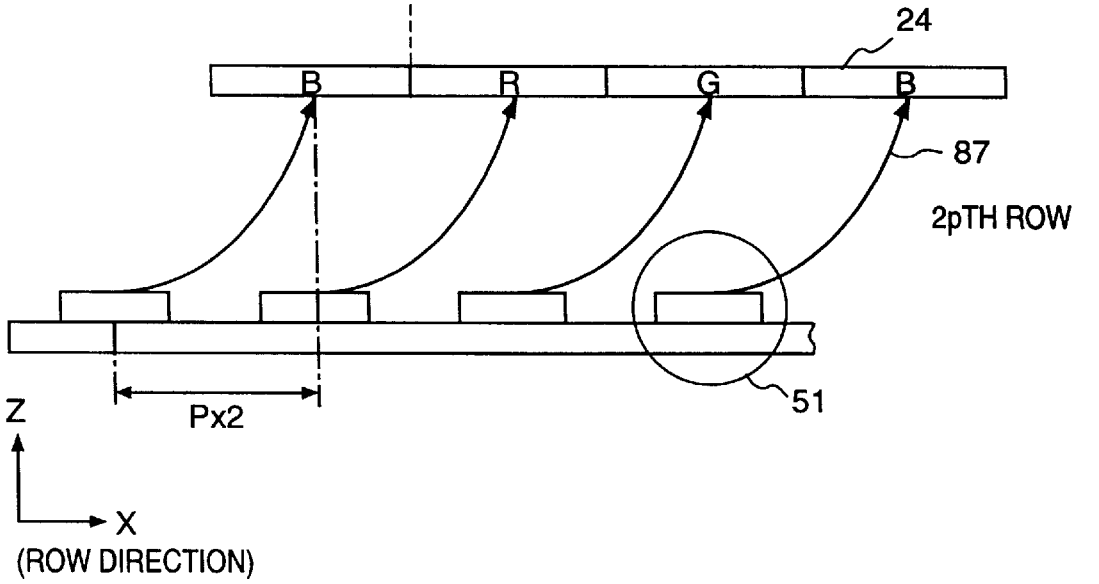

In the 11th embodiment, the surface-conduction type electron-emitting devices on the odd and even rows emit electrons in the same direction, and a device voltage Vf is changed to change the distance Lef on the odd and even rows. FIGS. 26A and 26B explain the positions where electrons emitted from the devices on the (2*p*−1)th and 2*pth* rows reach. Each of FIGS. 26A and 26B is a sectional view of the display panel in FIG. 5, taken along a plane perpendicular to the y-axis. Reference symbols Px1 and Px2 respectively denote the distances between a position on which electrons from the devices on the (2*p*−1)th and 2*pth* rows reach and the central axes of the corresponding phosphors. By setting the device voltage Vf for each device on the 2*pth* row to be higher than that for each device on the (2*p*−1)th row, the distance Px2 can be made larger than the distance Px1. These distances Px1 and Px2 are calculated according to equation (1) described in the first embodiment.

Figure 27:
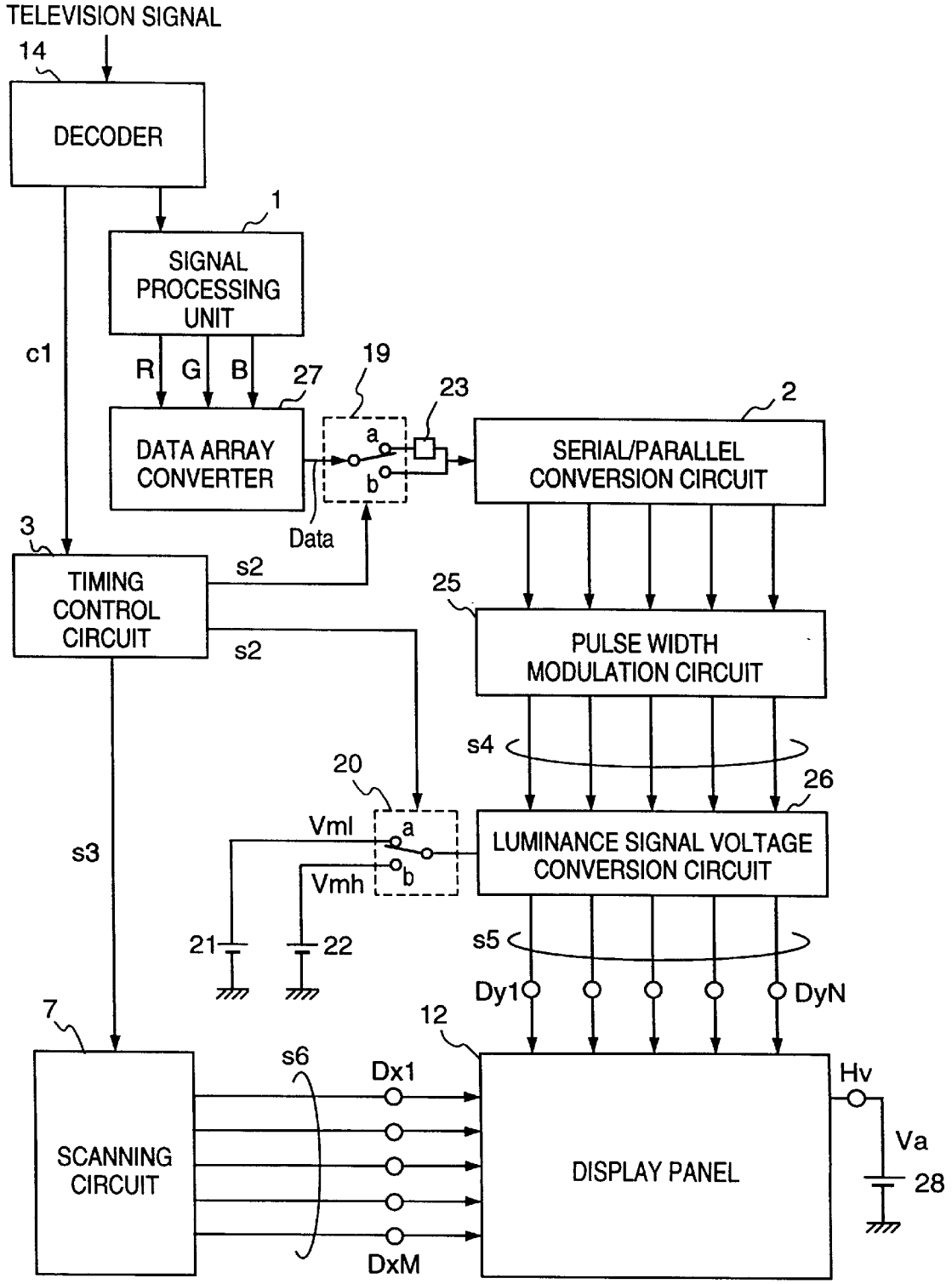
FIG. 27 is a block diagram showing a driving circuit in the 11th embodiment.
Figure 28:
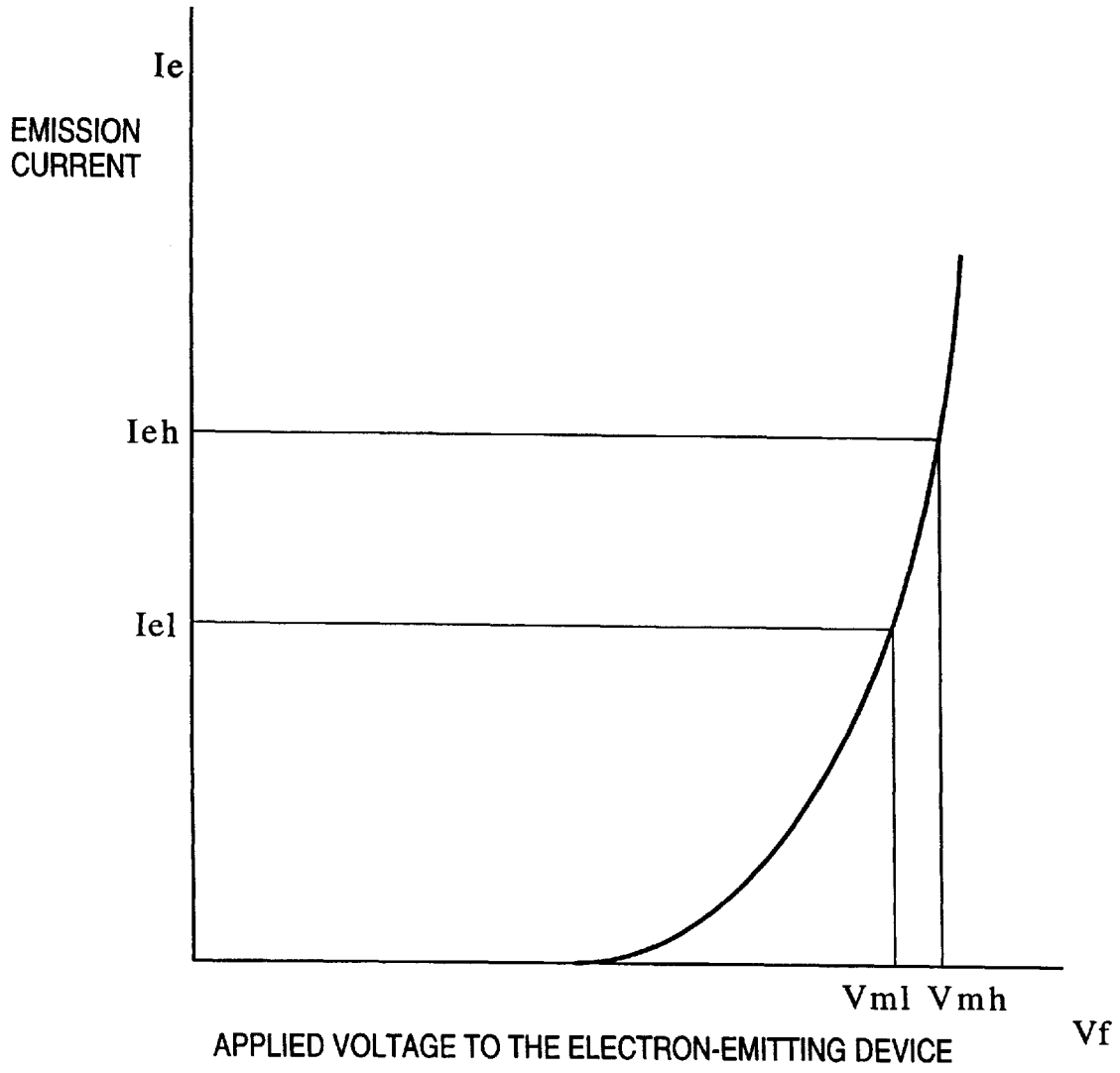
FIG. 28 is a graph showing the correlation between a device voltage Vf applied to a surface-conduction emission type electron-emitting device and an emission current Ie.

FIG. 27 is a block diagram showing a driving circuit for the display panel. This driving circuit includes a luminance signal voltage conversion circuit 26 for changing the device voltage Vf at 1 H intervals, voltage sources 21 and 22, switches 19 and 20, a multiplier 23, and a data array converter 27, in addition to the arrangement of the driving circuit in FIG. 3 described in the first embodiment. In this embodiment, since an inverting/scanning operation is not performed, a scanning circuit 7 does not invert and output a scanning signal at 1 H intervals as in the first embodiment, but outputs a scanning signal having a predetermined magnitude. The luminance signal voltage conversion circuit 26 converts a pulse width-modulated signal s4 output from a pulse width modulation circuit 25 into a luminance signal s5 with a voltage Vm1 of the voltage source 21 to scan an odd row, and with a voltage Vmh of the voltage source 22 to scan an even row, and output the luminance signal s5 to the display panel. At this time, the switch 20 is used. The multiplier 23 is a circuit for correcting a difference in luminance of a phosphor which is caused by the voltage Vm1 of the luminance signal s5 for scanning an odd row and the voltage Vmh of the luminance signal s5 for scanning an even row. This correction circuit is used because an emission current Ieh obtained upon application of a device voltage Vmh differs from an emission current Ie1 obtained upon application of a device voltage Vm1. FIG. 28 is a graph showing the device characteristics. The abscissa represents the device voltage Vf; and the ordinate, the emission current. If no correction is performed, the brightness of a phosphor irradiated with electrons from a device scanned with the device voltage Vmh is Ieh/Ie1 times that of a phosphor irradiated with electrons from a device scanned with the device voltage Vm1. For this reason, the multiplier 23 multiplies data of odd rows to be output to an S/P conversion circuit 2 by Ieh/Ie1, thereby eliminating the difference in luminance between odd and even rows.

Figure 29:
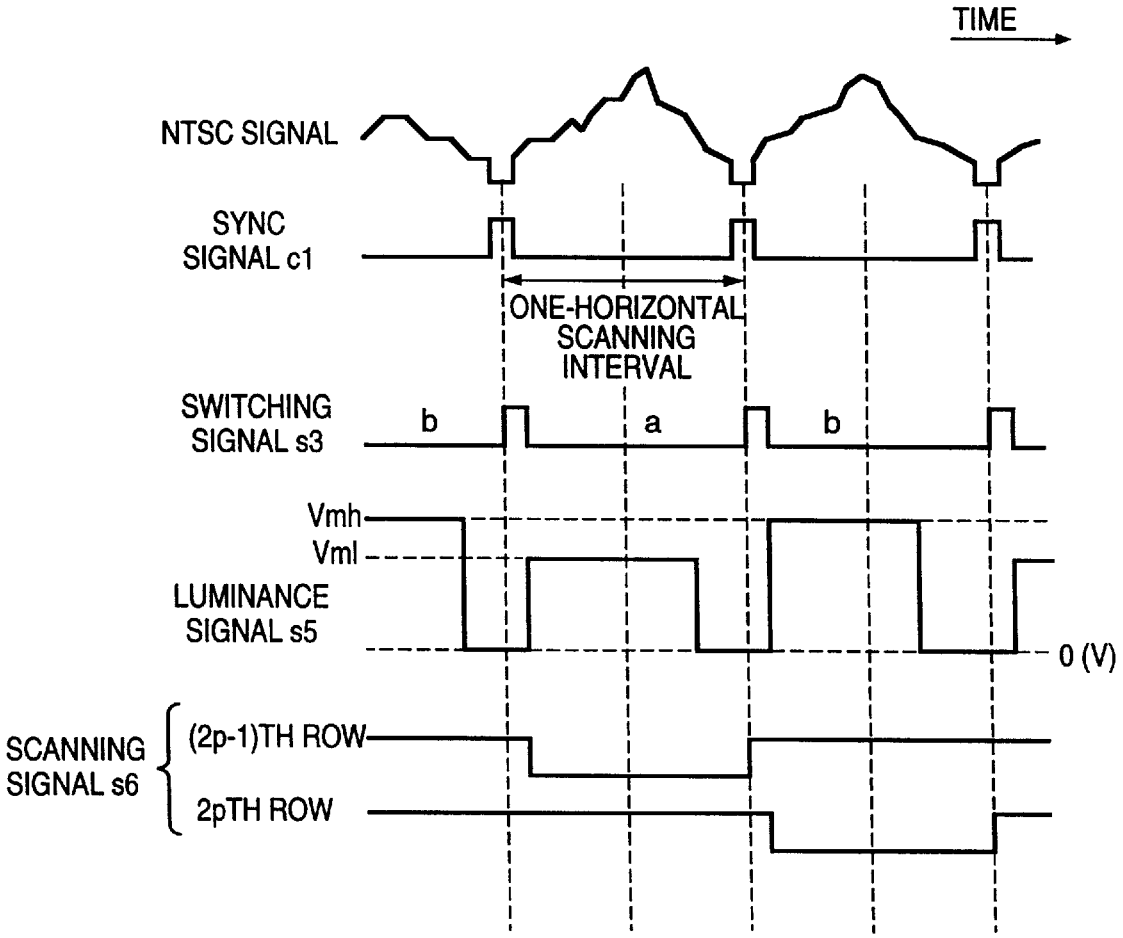
FIG. 29 is a timing chart in the 11th embodiment.

FIG. 29 is a timing chart of this embodiment, showing a pulse for a given column wiring layer. As shown in FIG. 29, in scanning the (2*p*−1)th and 2*pth* rows, the voltages of the luminance signals s5 are changed to "Vnh" and "Vm1" in FIG. 29. A display apparatus having a delta arrangement can be realized by changing the voltages of pulse with modulation signals to be output to the devices on adjacent rows in this manner.

Twelfth Embodiment

Figure 30:
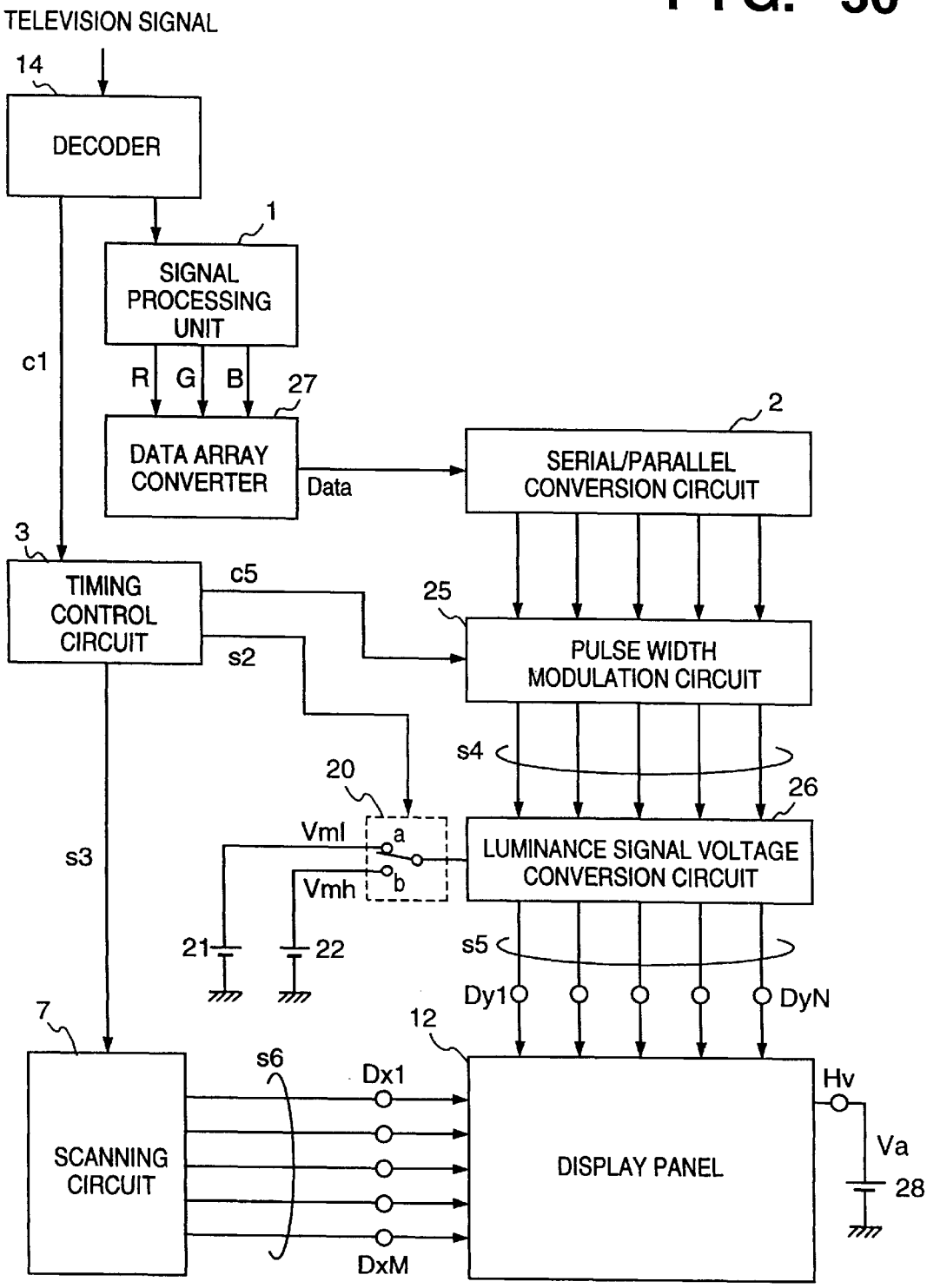
FIG. 30 is a block diagram showing a driving circuit in the 12th embodiment of the present invention.

The 12th embodiment is the same as the 11th embodiment except for the manner of correcting a brightness difference. FIG. 30 is a block diagram showing a driving circuit for the 12th embodiment. Although this embodiment does not include the switch 19 and the multiplier 23 in FIG. 27 described in the 11th embodiment, a timing control circuit 3 outputs a signal c5 to a pulse width modulation circuit 25. In this embodiment as well, a switch 20 is switched at 1 H intervals to form bright spots on a delta arranged phosphor. Similar to the above embodiment, since a voltage applied to each device is changed, brightness correction is required. In this embodiment, however, this correction is performed in the pulse width modulation circuit 25.

Figure 31A:
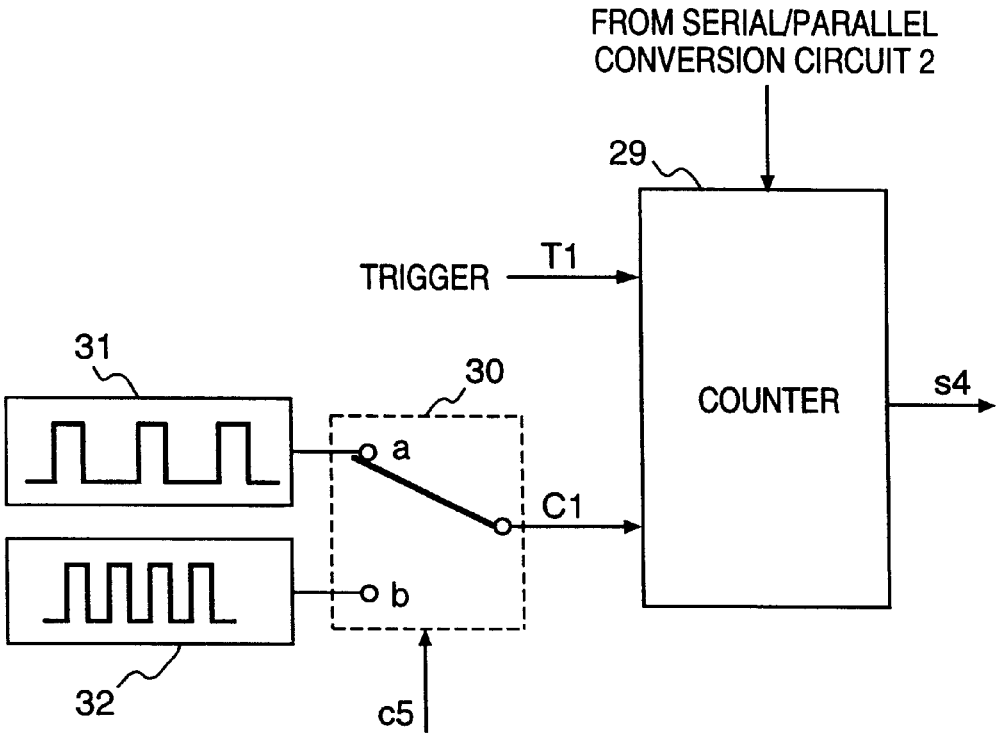
FIGS. 31A and 31B are a block diagram and a timing chart showing the internal arrangement of a pulse width modulation circuit in the 12th embodiment.
Figure 31B:
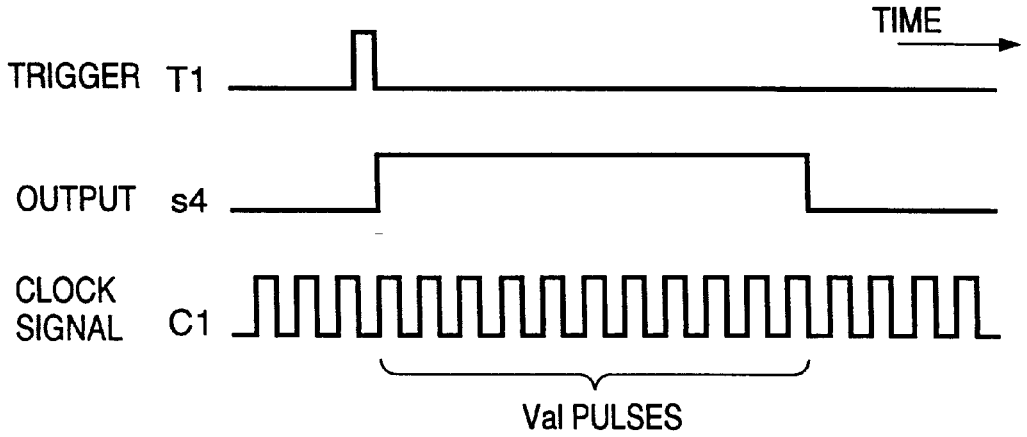

The mechanism of the pulse width modulation circuit 25 will be described with reference to FIGS. 31A and 31B to explain the operation of this embodiment. FIG. 31A shows a portion of the pulse width modulation circuit 25 which outputs a pulse width-modulated signal to the jth column wiring layer. Data Va1 parallel-converted by a serial/parallel conversion circuit 2 is set in a counter 29. When a trigger T1 is input to the counter 29, an output from the counter 29 is set at high level. Clock pulses C1 are input to the counter 29. When the number of the clock pulses C1 input to the counter 29 becomes equal to the set value Va1 after the trigger T1 is input, the output s4 is set at low level. FIG. 31B is a timing chart in this case. In this manner, a pulse having a width proportional to the input value (Va1) is generated. In this case, when the frequency of the clock pulses C1 supplied to the counter 29 is changed, the pulse width of the output s4 from the counter 29 can be changed even if the same value is set therein. More specifically, as the frequency of the clock pulse C1 is increased, the width of the pulse width of output s4 is decreased, and vice versa. That is, the frequency of the clock pulse C1 is inversely proportional to the pulse width of the output s4.

When the switch 30 is connected to a terminal a, the frequency (31) of the clock pulse C1 is set to be Ie1/Ieh times higher than that (32) set when the switch 30 is connected to a terminal b. For this reason, the pulse width of the output s4 becomes Ieh/Ie1 times higher than that when the switch 30 is connected to the terminal b. This operation can eliminate the difference between the brightness obtained when a pulse width-modulated luminance signal s5 has a voltage Vm1 and the brightness obtained when the signal s5 has a voltage Vmh. In this embodiment, the switch 30 switches outputs of two clock pulse generators 31 and 32 at 1 H intervals in accordance with the signal c5 from the timing control circuit 2, thereby realizing the above operation. A display apparatus having a delta arrangement can be realized by changing voltages for driving devices at 1 H intervals.

Thirteenth Embodiment

Figure 32:
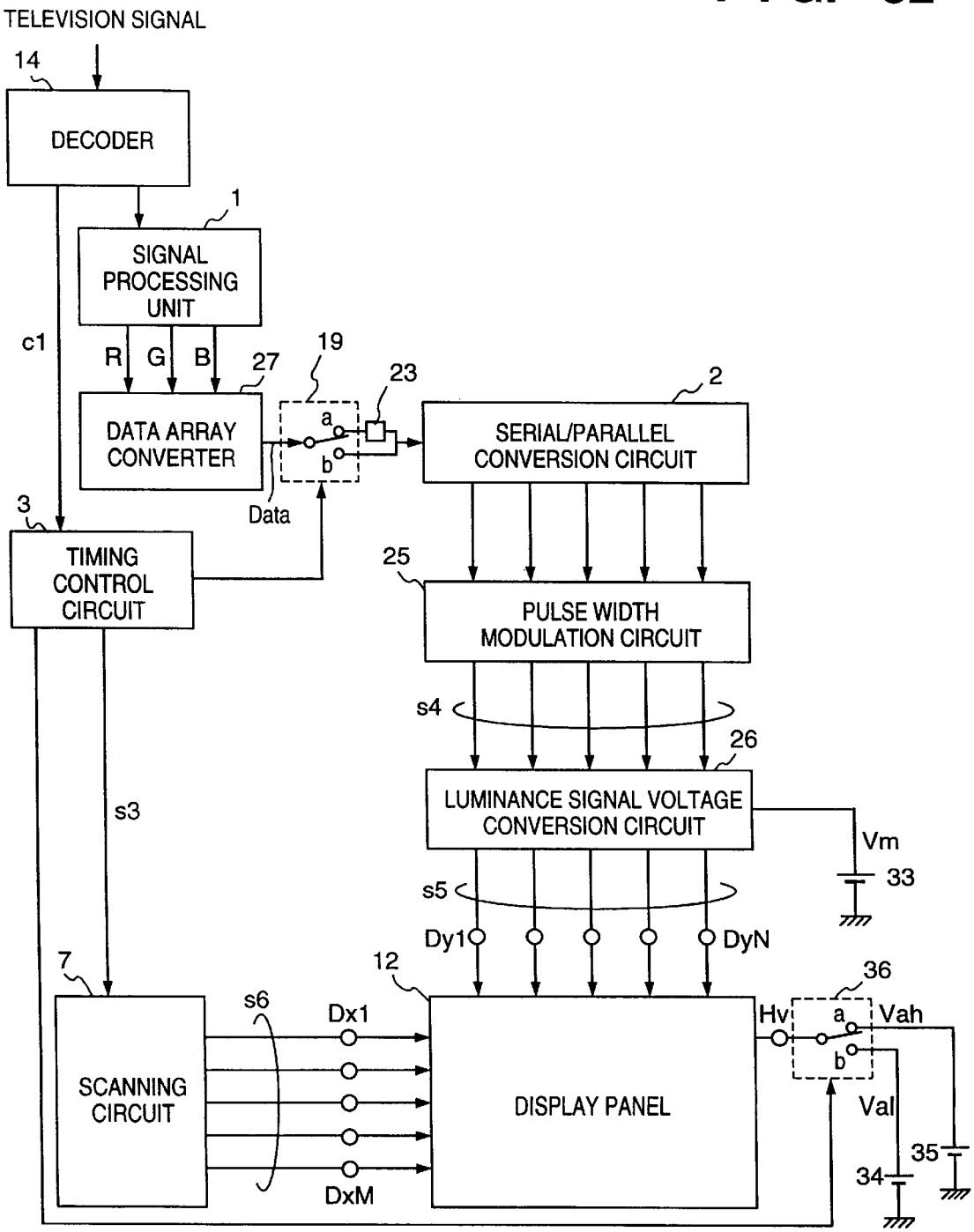
FIG. 32 is a block diagram showing a driving circuit in the 13th embodiment of the present invention.
Figure 33:
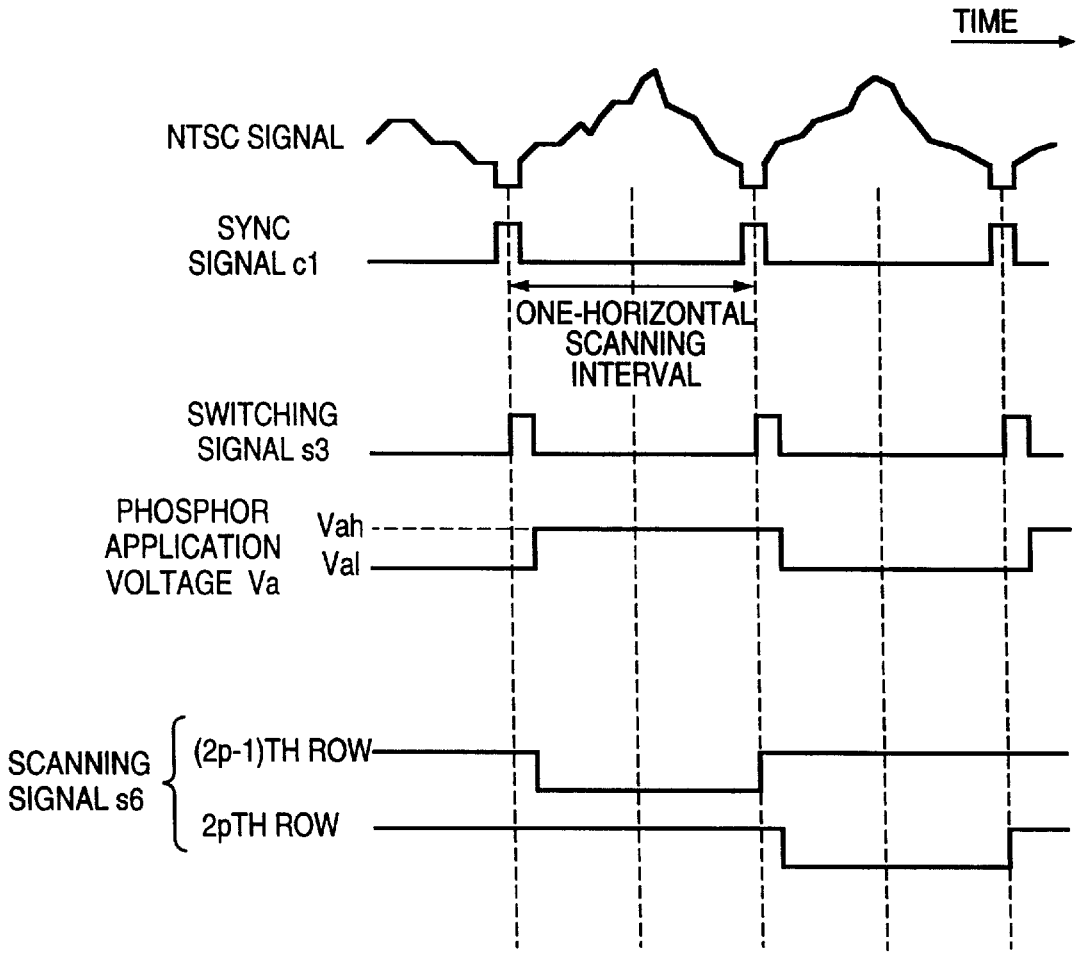
FIG. 33 is a timing chart in the 13th embodiment.

In the 13th embodiment, similar to the 11th embodiment, electrons are emitted from the devices on adjacent rows in the same direction. However, the positions where electrons from the devices on the odd and even rows reach are shifted from each other by changing an anode voltage Va. Electrons emitted from the devices on the odd and even rows are shifted from each other in the same manner as in the case shown in FIGS. 26A and 26B. FIG. 32 is a block diagram showing a driving circuit according to this embodiment. Referring to FIG. 32, the circuit includes a switch 36 for changing the anode voltage Va between voltages Vah and Va1, a voltage source 34 for the voltage Va1, and a voltage source 35 for the voltage Vah. The remaining parts are the same as those in FIG. 27 described in the 11th embodiment. Upon reception of an output from a timing control circuit 3, the switch 36 switches the anode voltage between the voltages Vah and Va1 depending on whether an odd or even row is scanned. A multiplier 23 is a circuit for correcting the difference between the brightness of a phosphor which is obtained when the anode voltage is the voltage Va1 and the brightness of the phosphor which is obtained when the anode voltage is the voltage Vah. Let B1 be the brightness of a phosphor when the anode voltage is the voltage Va1, and B2 be the brightness of the phosphor irradiated by the same pulse width when the anode voltage is the voltage Vah. In scanning a row while using the anode voltage Vah, the multiplier 23 multiplies the voltage of a luminance signal to be output to an S/P conversion circuit 2 by B1/Bh. FIG. 33 is a timing chart associated with a given column wiring layer in this embodiment. As shown in FIG. 33, a phosphor application voltage Va is changed depending on whether the (2*p*−1)th row or 2*pth* row is scanned.

Fourteenth Embodiment

Figure 34:
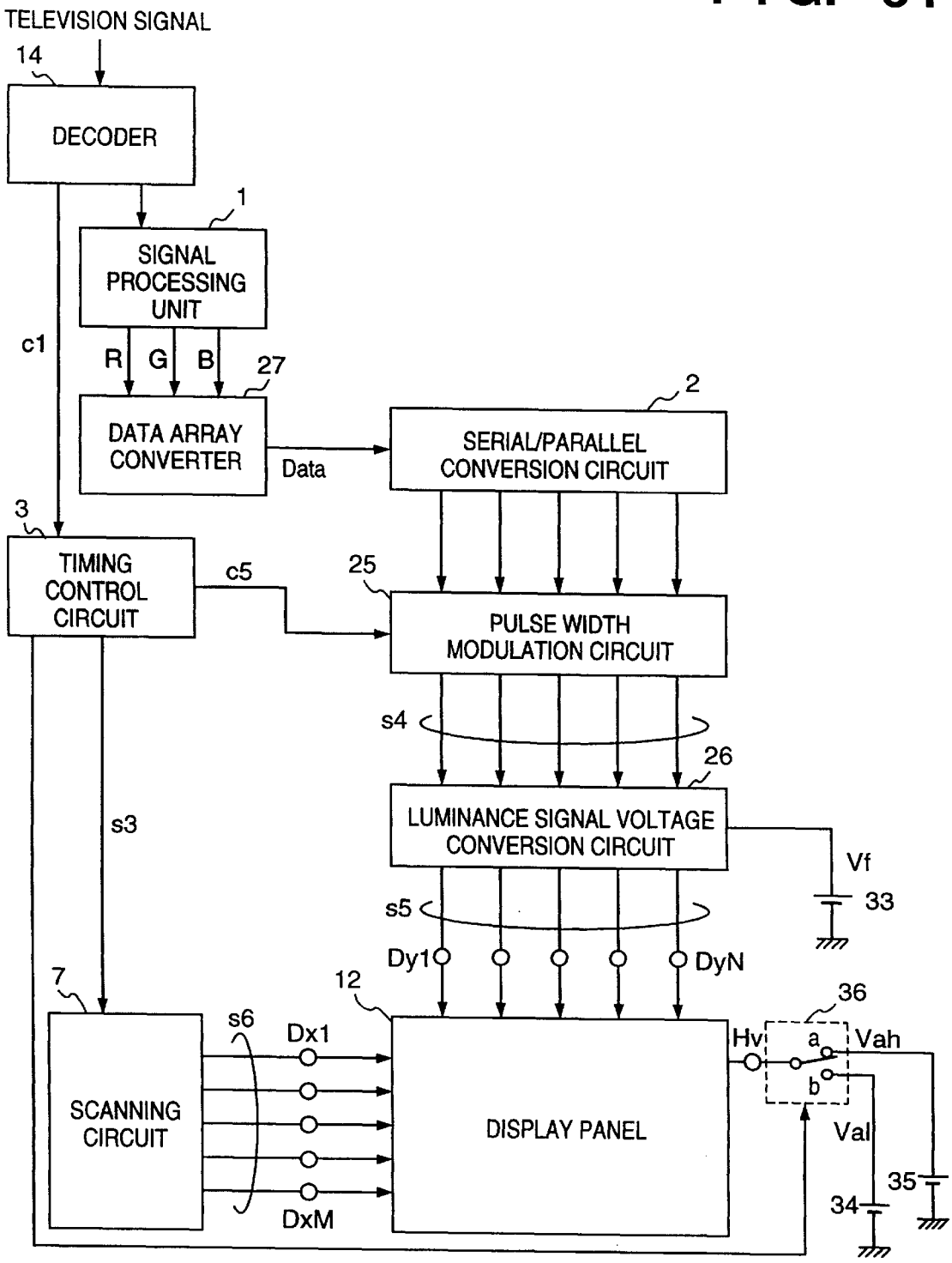
FIG. 34 is a block diagram showing a driving circuit in the 14th embodiment of the present invention.

The 14th embodiment is the same as the 13th embodiment except for the manner of correcting brightness differences. FIG. 34 is a block diagram showing a driving circuit in the 14th embodiment. This embodiment does not include the switch 19 and the multiplier 23 in FIG. 32 described in the 13th embodiment. However, a timing control circuit 3 outputs a signal c5 to a pulse width modulation circuit 25. In the embodiment, similar to the 13th embodiment, a phosphor has a brightness B1 when the anode voltage is a voltage Va1, and a luminance B2 when the anode voltage is a voltage Vah. A timing control circuit 3 outputs the signal c5 to the pulse width modulation circuit 25 to correct the pulse width B1/Bh by changing the frequency of the clock pulse C1 in the pulse width modulation circuit 25 according to the same correction method as that in the 12th embodiment when a row is to be scanned by applying the anode voltage Vah.

Fifteenth Embodiment

Figure 35A:
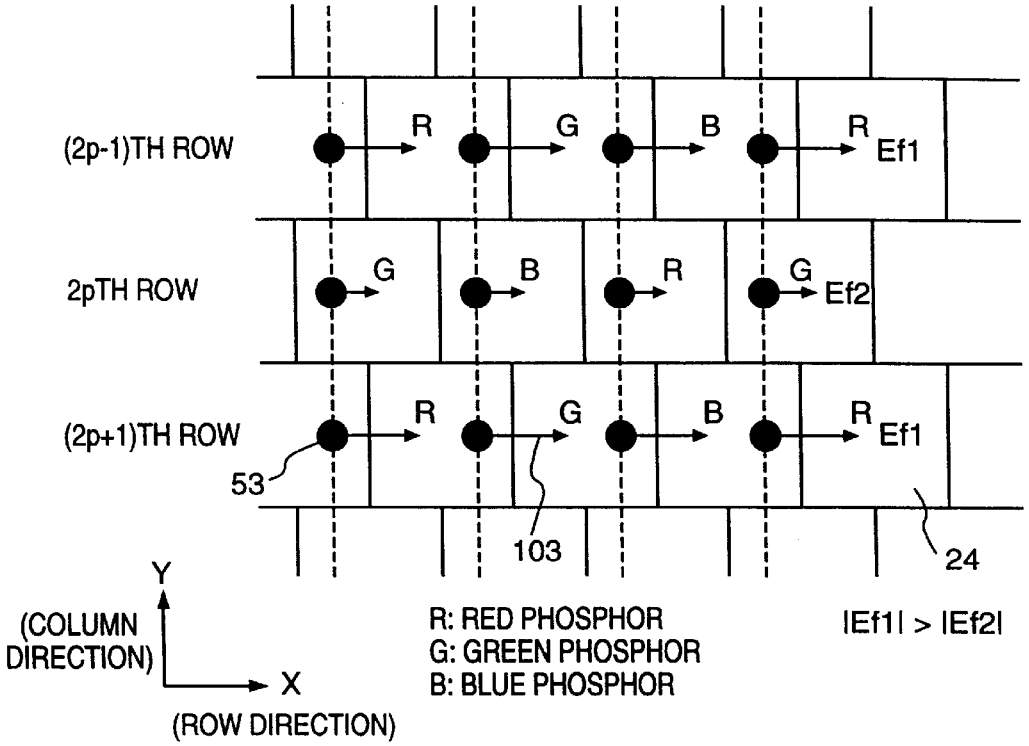
FIGS. 35A and 35B are plan views respectively showing phosphors and a multi-electron beam source in the 15th embodiment of the present invention.
Figure 35B:
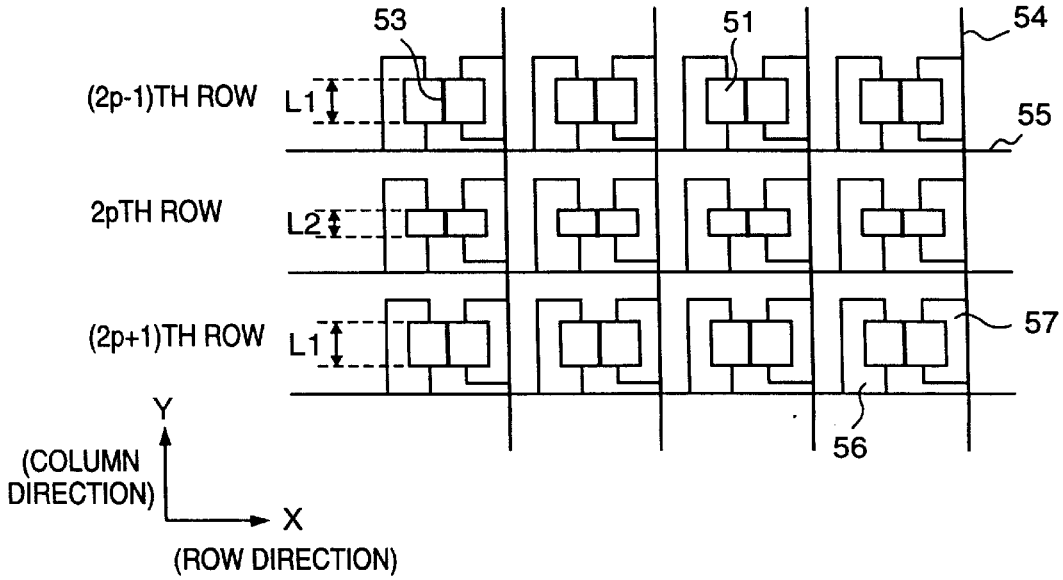
Figure 36A:
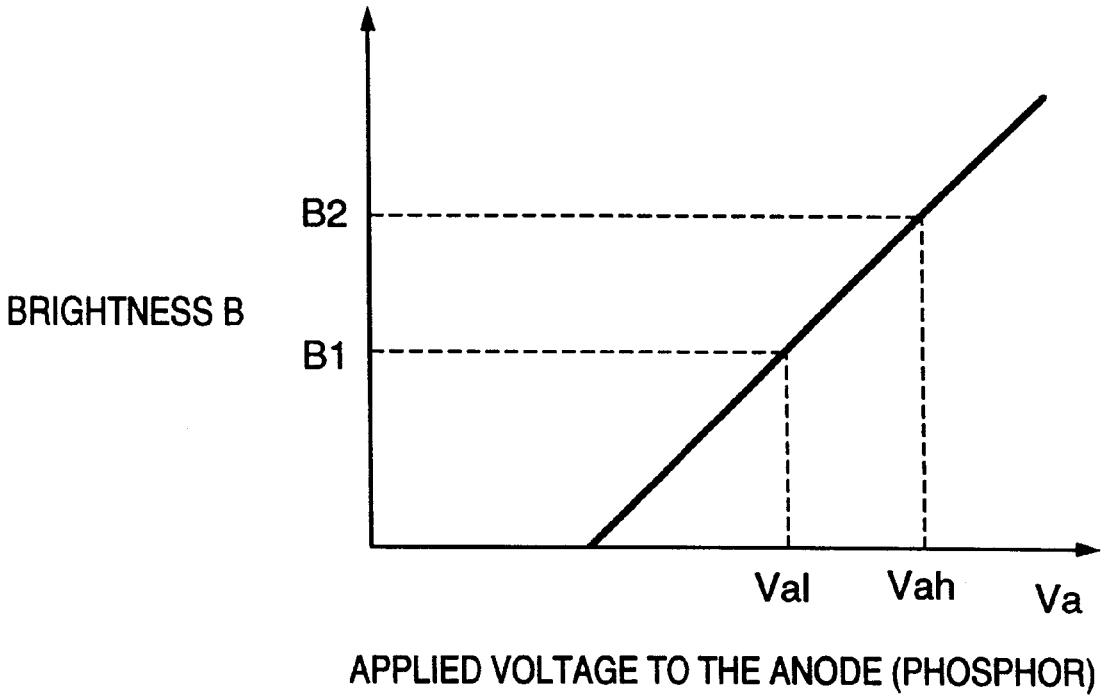
FIG. 36A is a graph showing the correlation between an anode voltage Va applied to an anode (phosphor) and a brightness B.
Figure 36B:
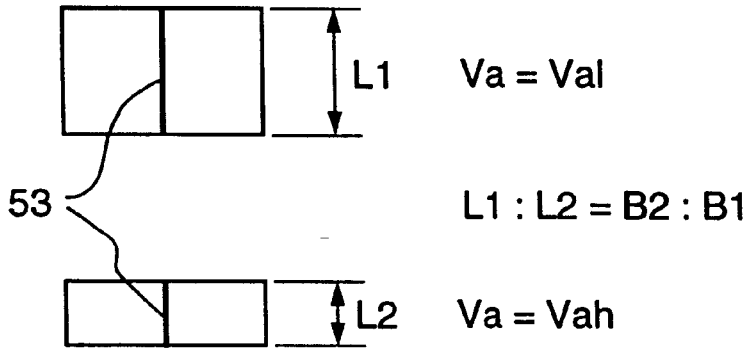
FIG. 36B is a plan view showing electron-emitting devices.

In the 15th embodiment, similar to the 13th embodiment, electrons are emitted from the devices on adjacent rows in the same direction, and the positions where electrons emitted from the devices on odd and even rows reach are shifted from each other by changing an anode voltage Va. The difference between the amounts of electrons emitted from devices on odd and even rows is adjusted by making the devices have different electron-emitting characteristics. FIG. 35A is a plan view showing the arrangement of phosphors. FIG. 35B is a plan view of a multi-electron beam source formed below the phosphors. Referring to FIG. 35A, each dot represents an electron-emitting portion of a surface-conduction type electron-emitting device below a phosphor. The devices on the (2*p*−1)th and (2*p*+1)th rows are caused to emit electrons to the right so as to propagate long distances, whereas the devices on the 2*pth* row are caused to emit electrons to the right so as to propagate short distances. A delta arrangement of phosphors 24 is realized while electron-emitting portions 53 are kept in a regular arrangement. In this case, the differences between the amounts of electrons emitted from the devices on the (2*p*−1)th, (2*p*+1)th, and 2*pth* rows must be corrected as in the 13th embodiment. FIG. 35B shows electron emission amount correction performed for each device. More specifically, since an anode voltage Va applied to each device on the 2*pth* row is higher than that applied to each of the devices on the (2*p*−1)th and (2*p*+1)th rows, the device on the 2*pth* row has a small electron-emitting portion. FIG. 36A is a graph showing the relationship between the anode voltage Va and a brightness B. FIG. 36B is a plan view showing devices to explain the desired lengths of the electron-emitting portions 53. Let Va1 be the anode voltage set when an odd row is to be scanned, and Vah be the anode voltage set when an even row is to be scanned. In this case, brightnesses B1 and B2 are obtained by the voltages Va1 and Vah, respectively, if a device voltage Vf and the driving pulse width remains the same. For this reason, the electron-emitting portion 53 of a device to which only the anode voltage Va1 is applied is made longer than that of a device to which the anode voltage Vah is applied, as shown in FIG. 36B. If the lengths of the respective electron-emitting portions 53 are represented by L1 and L2, L1:L2=B2:B1 is appropriate.

Figure 37:
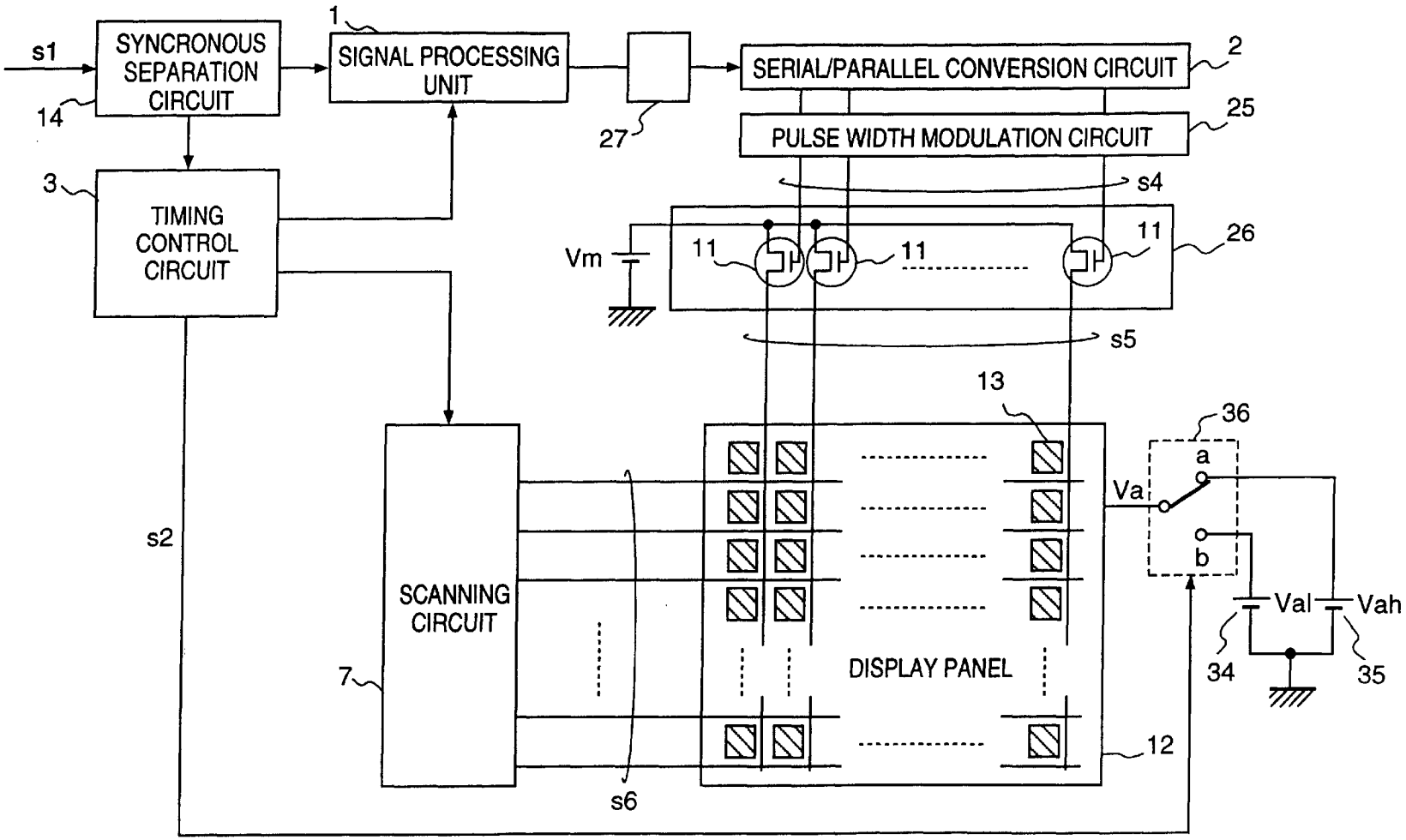
FIG. 37 is a block diagram showing a driving circuit in the 15th embodiment.
Figure 38:
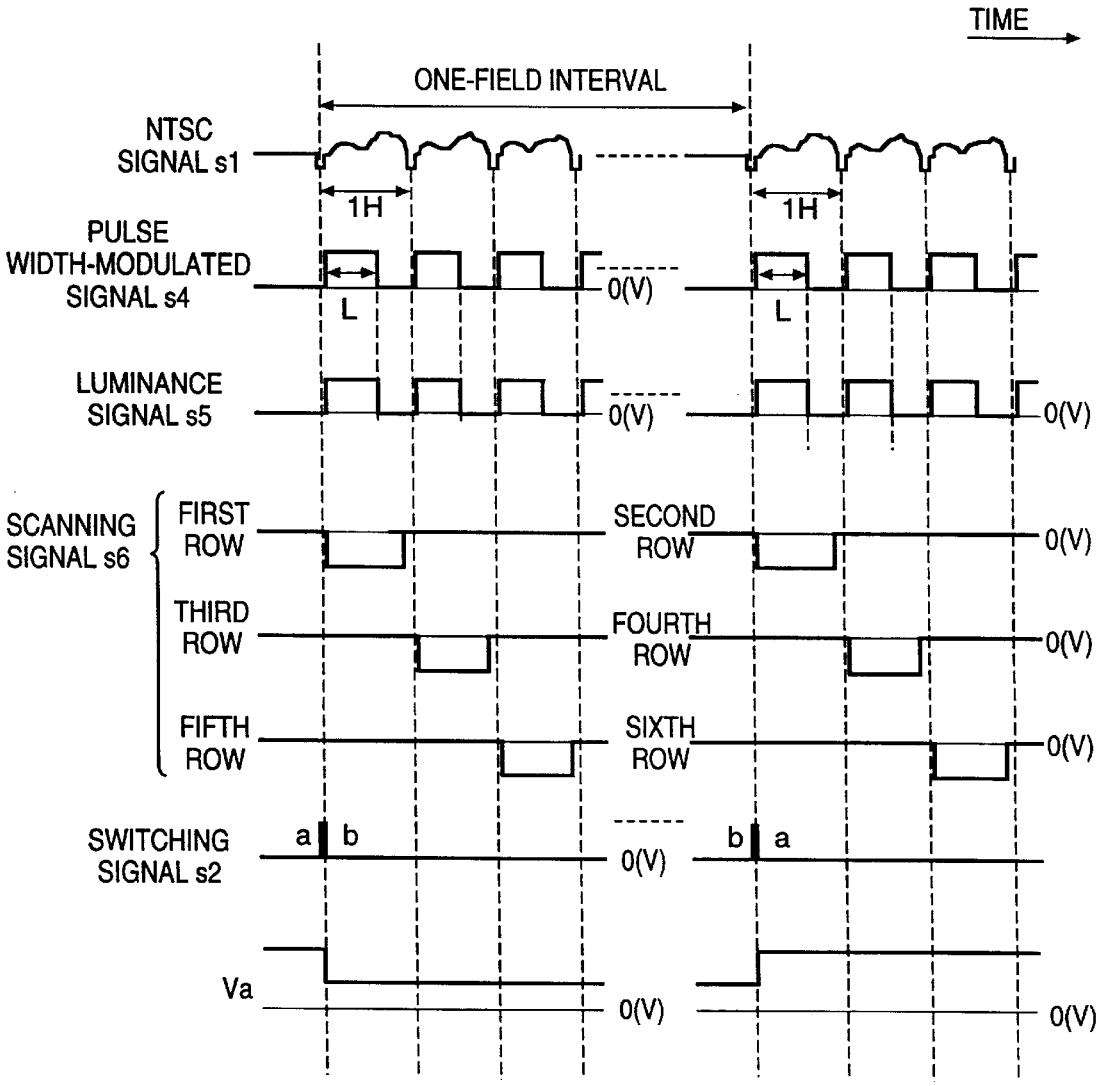
FIG. 38 is a timing chart in the 15th embodiment.

FIG. 37 is a block diagram showing a driving circuit in this embodiment. This circuit is the same as that shown in FIG. 32 described in the 13th embodiment except that the switch 19 and the multiplier 23 are omitted. In the embodiment, since each of the devices on the odd rows has an electron-emitting characteristic different from that of each of the devices on the even rows, the driving circuit need not perform any special correction processing. A timing chart indicating a non-interlaced scanning operation in the embodiment is the same as that of FIG. 33 described in the 13th embodiment, and hence a description thereof will be omitted. FIG. 38 is a timing chart indicating an interlaced scanning operation in the embodiment. In this case, a pulse s2 for switching a switch 36 is output at one-field intervals. As a result, the anode voltage Va is switched at one-field intervals.

Sixteenth Embodiment

Figure 39A:
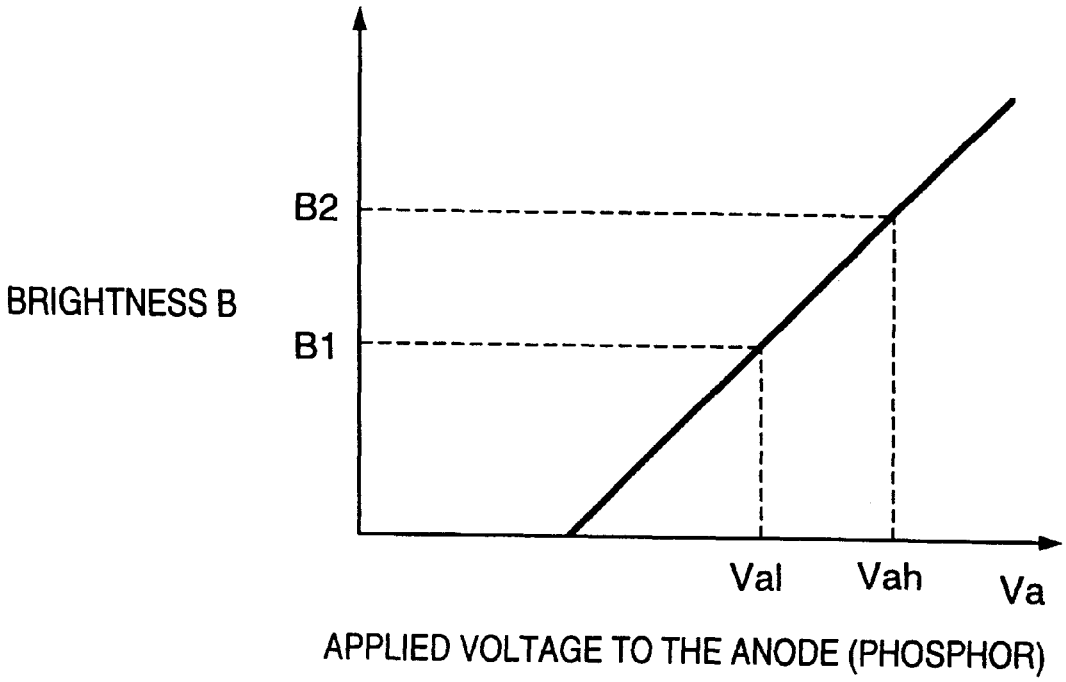
FIG. 39A is a graph showing the correlation between an anode voltage Va applied to a phosphor and a brightness B.
Figure 39B:
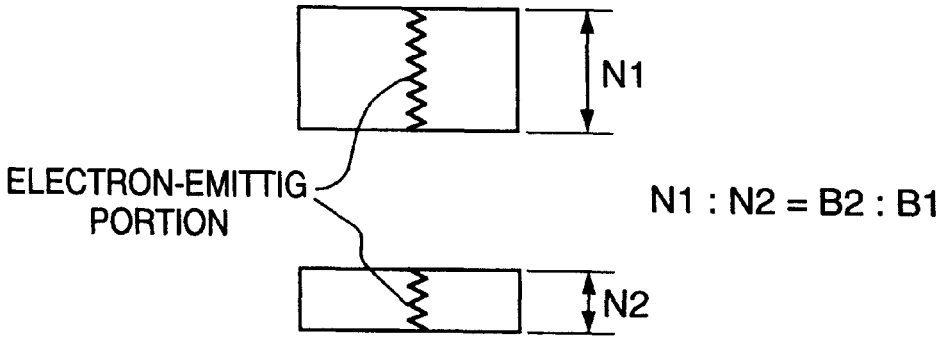
FIG. 39B is a plan view showing electron-emitting devices.

In the 16th embodiment, the surface-conduction type electron-emitting devices in the 15th embodiment are replaced with lateral FE type electron-emitting devices. FIG. 39A is a graph showing the correlation between an anode voltage Va and a brightness B. FIG. 39B is a plan view showing electron-emitting portions. Let Va1 be the anode voltage set when an odd row is to be scanned, and Vah be the anode voltage set when an even row is to be scanned. In this case, brightnesses B1 and B2 are obtained by the voltages Va1 and Vah, respectively, if a device voltage Vf and the driving pulse width remains the same. For this reason, the electron-emitting portion 53 of a device to which only the anode voltage Va1 is applied is made longer than that of a device to which the anode voltage Vah is applied, thereby increasing the number of electron-emitting portions. If the lengths of the respective electron-emitting portions are represented by N1 and N2, N1:N2=B2:B1 is appropriate. A driving circuit and a timing chart used in this embodiment are the same as those in FIGS. 37 and 38 which are used in the 15th embodiment.

Seventeenth Embodiment

Figure 40A:
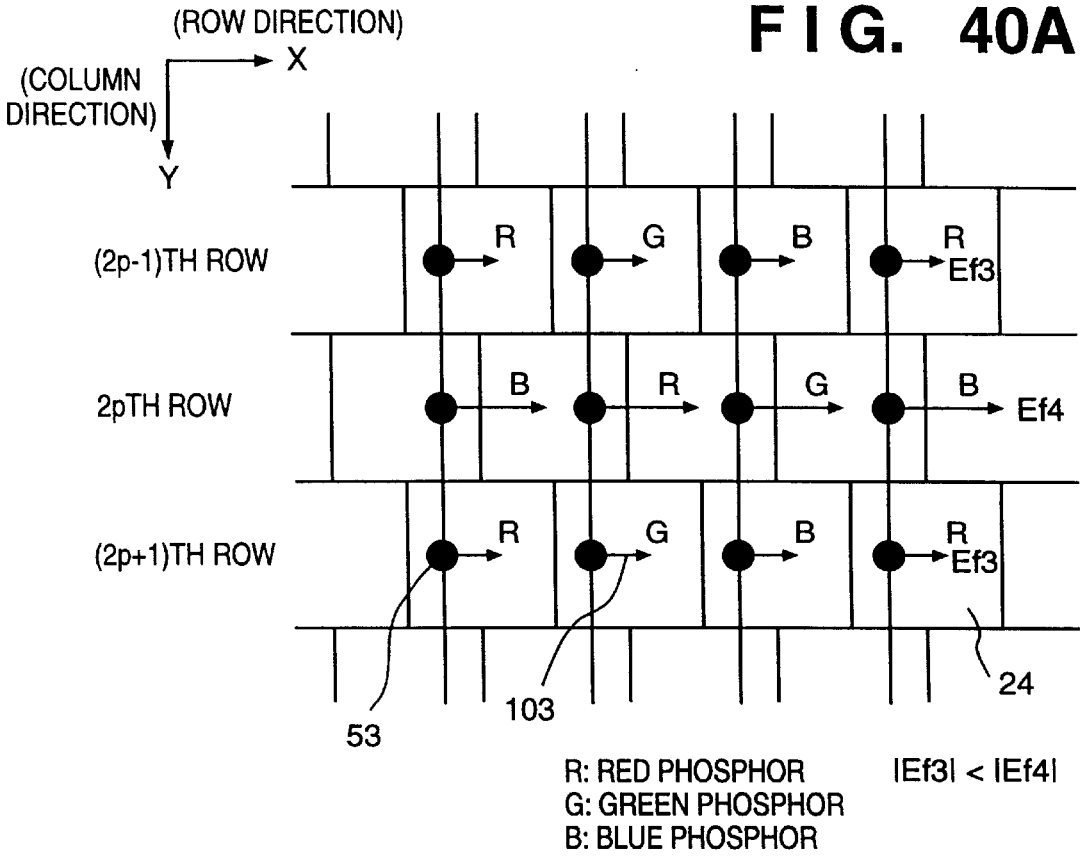
FIGS. 40A and 40B are plan views respectively showing phosphors and a multi-electron beam source in the 17th embodiment of the present invention.
Figure 40B:
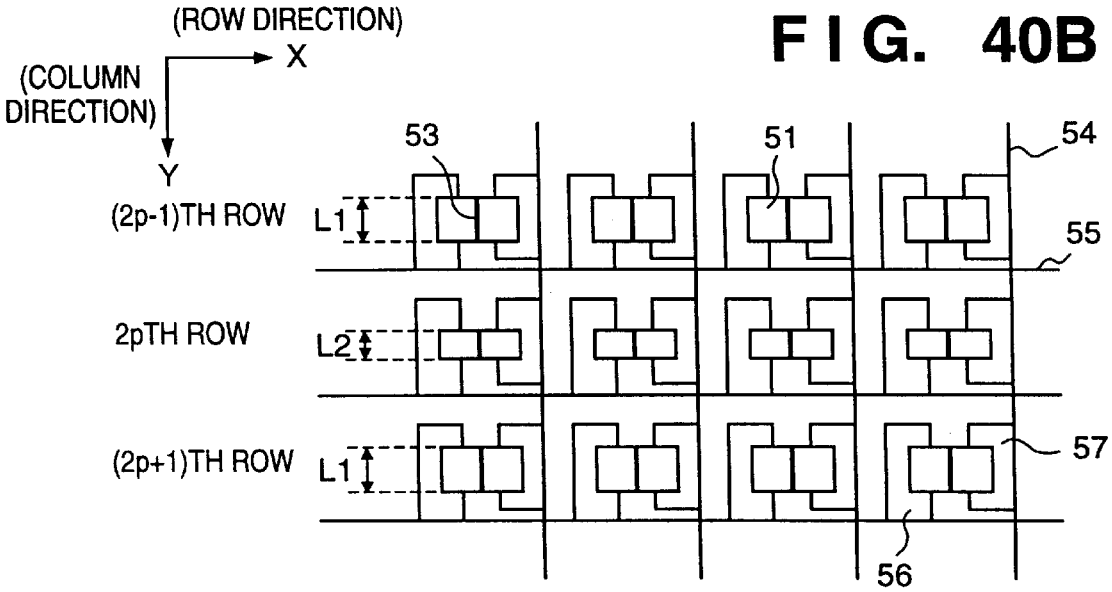

In the 17th embodiment, the voltage of a luminance signal as a pulse width modulation signal to be output to a column wiring layer is changed, together with the voltage of a scanning signal to be output to a row wiring layer, depending on whether the devices on an odd or even row are to be scanned, thereby changing a voltage Vf applied to each device. As electron-emitting devices, surface-conduction type electron-emitting devices are used. FIG. 40A is a plan view showing the arrangement of phosphors in this embodiment. FIG. 40B is a plan view showing a multi-electron beam source formed below the phosphors. Referring to FIG. 40A, each dot represents the electron-emitting portion of a surface-conduction type electron-emitting device below a phosphor. The devices on the (2*p*−1)th and (2*p*+1)th rows are caused to emit electrons to the right so as to propagate short distances, whereas the devices on the 2*pth* row are caused to emit electrons to the right so as to propagate long distances. A delta arrangement of phosphors 24 is realized while electron-emitting portions 53 are kept in a regular arrangement. In this case, the differences between the amounts of electrons emitted from the devices on the (2*p*−1)th, (2*p*+1)th, and 2*pth* rows must be corrected as in the 15th embodiment. FIG. 40B shows electron emission amount correction performed for each device. More specifically, since a device voltage Vf applied to each device on the 2*pth* row is higher than that applied to each of the devices on the (2*p*−1)th and (2*p*+1)th rows, the device on the 2*pth* row has a small electron-emitting portion. A graph showing the relationship between the device voltage Vf and an electron emission amount Ie is the same as that in the 11th embodiment. Let Vf1 be the device voltage set when an odd row is to be scanned, and Vfh be the device voltage set when an even row is to be scanned. In this case, emission currents Ie1 and Ieh are obtained by the device voltages Vf1 and Vfh, respectively, if an anode voltage Va remains the same. For this reason, the electron-emitting portion 53 of a device to which the device voltage Vfh is applied is made shorter than that of a device to which only the device voltage Vf1 is applied. If the lengths of the electron-emitting portions 53 on odd and even rows are respectively represented by L1 and L2, L1:L2=Ieh:Ie1 is appropriate.

Figure 41:
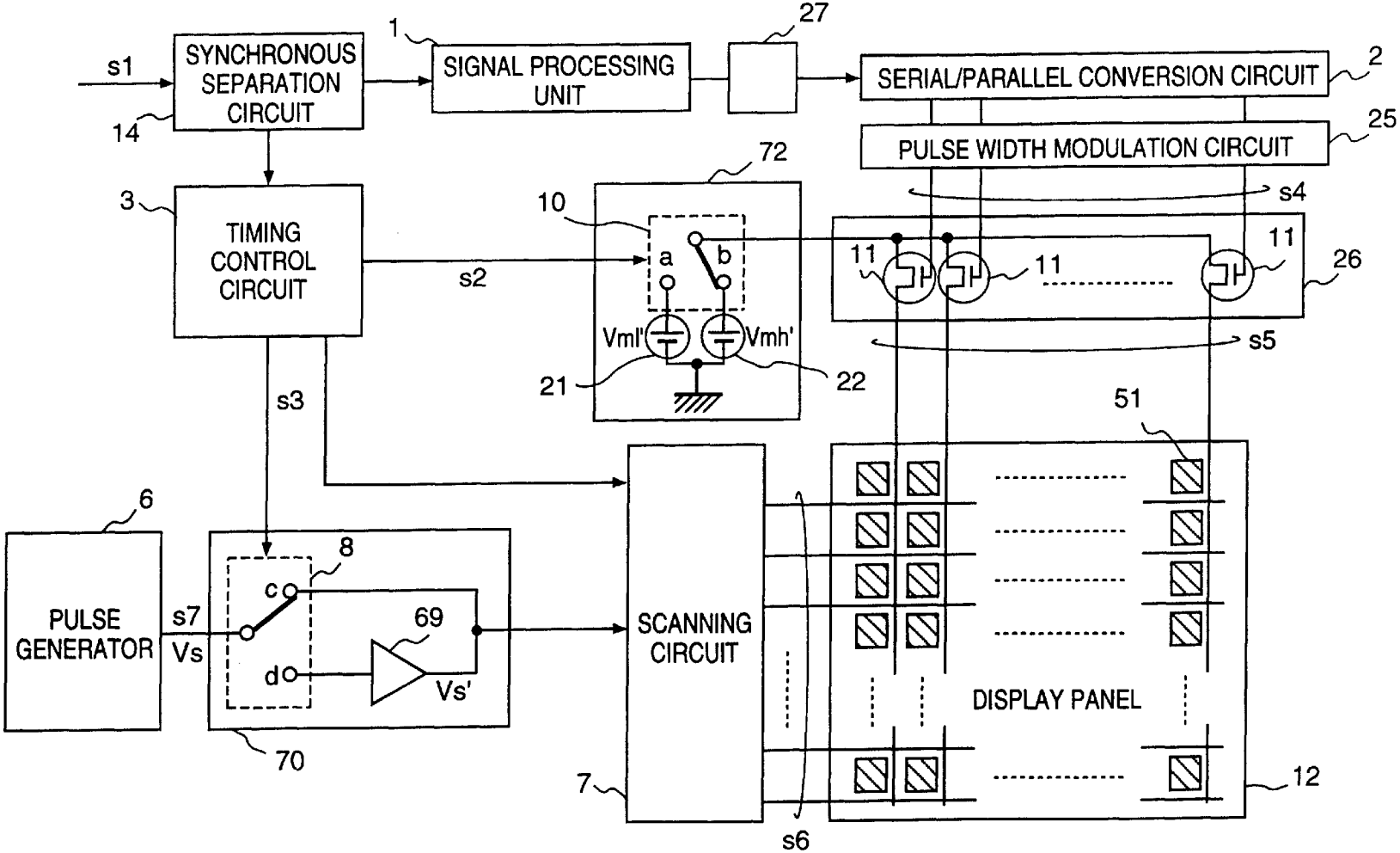
FIG. 41 is a block diagram showing a driving circuit in the 17th embodiment.

FIG. 41 is a block diagram showing a driving circuit in this embodiment. The driving circuit in this embodiment is different from that shown in FIG. 27 described in the 11th embodiment in that the switch 19 and the multiplier 23 are omitted, a pulse generator 6 and a switching circuit 70 are added, and voltage sources 21 and 22 respectively have voltage values Vm1' and Vmh'. Except for this arrangement, the driving circuit performs the driving operation as that in the 11th embodiment. The pulse generator 6 outputs a pulse having a voltage Vs at 1 H intervals. The switching circuit 70 includes a switch 8 and an amplifier 69. The switching circuit 70 switches and outputs, at 1 H or one-field intervals, each pulse output from the pulse generator 6 at 1 H intervals so as to let it pass through or amplify it to a voltage Vs'.

Figure 42:
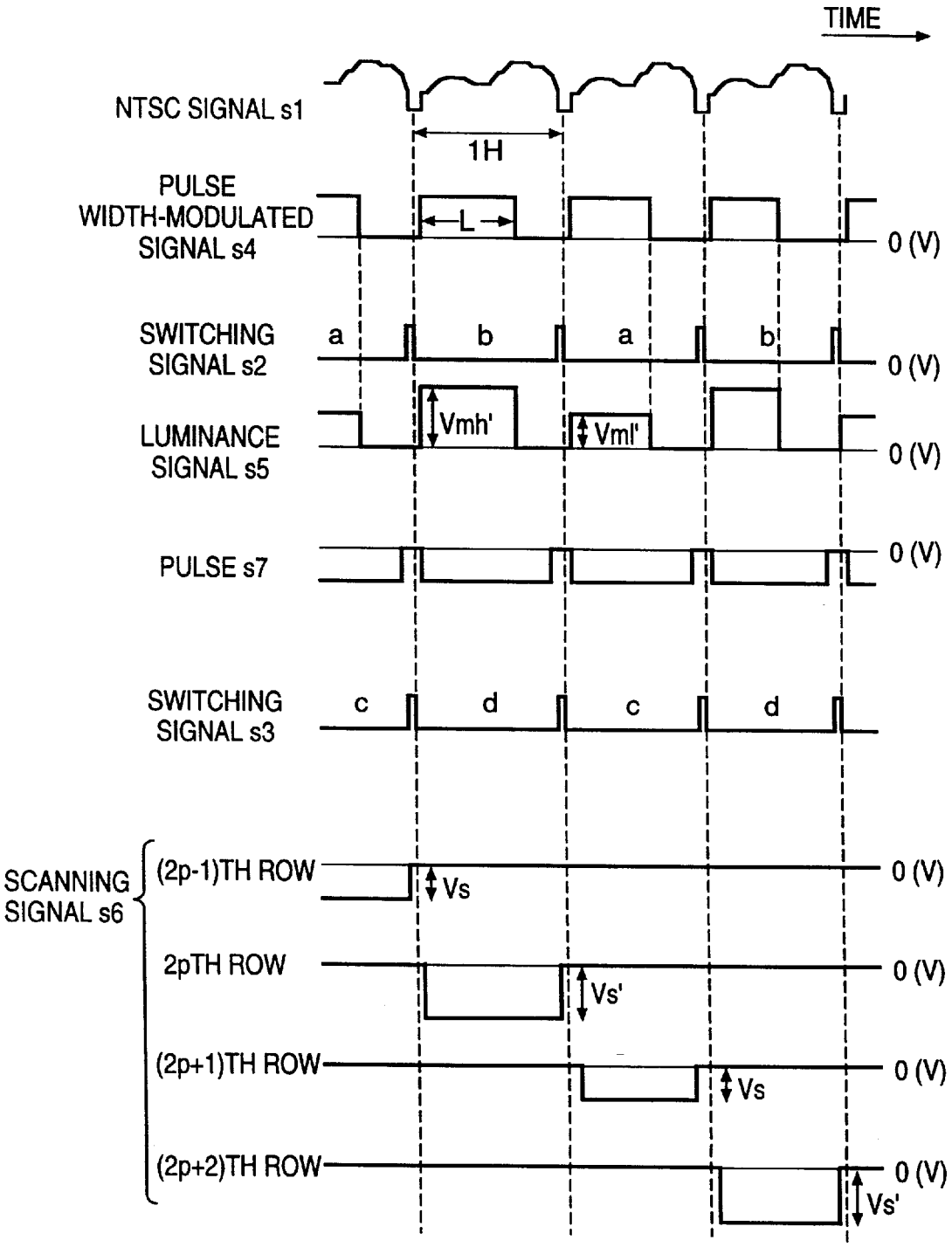
FIG. 42 is a timing chart in the 17th embodiment.
Figure 43:
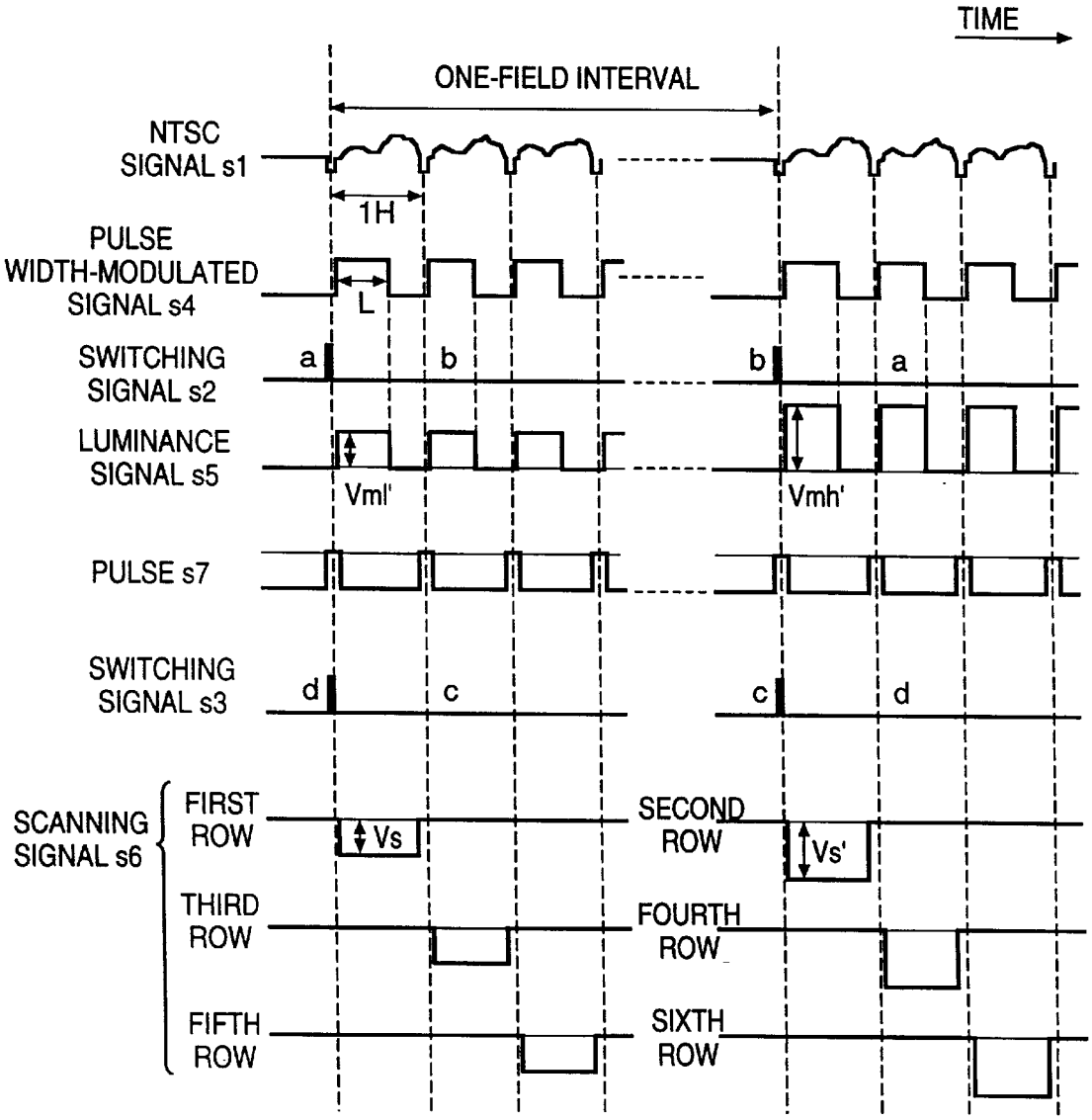
FIG. 43 is a timing chart in the 17th embodiment.

FIG. 42 is a timing chart showing a non-interlaced scanning operation for a given column wiring layer. As shown in FIG. 42, when the (2*p*−1)th and (2*p*+1)th rows are to be scanned, a luminance signal s5 representing a brightness with a pulse width has a voltage Vf1', and a scanning signal s6 has a voltage Vs. In this case, a device voltage Vf of each device which is scanned is given by (Vm1'+Vs) without taking the wiring resistances of column and row wiring layers 54 and 55 into account. When the devices on the 2*pth* and (2*p*+2)th rows are to be scanned, the luminance signal s5 has the voltage Vmh', and the scanning signal s6 has the voltage Vs'. In this case, the device voltage Vf of each device which is scanned is given by (Vmh'+Vs'). For this reason, the length of each electron-emitting portion 53 must be determined upon consideration of switching of the device voltages Vf between (Vm1'+Vs) and (Vmh'+Vs') on the basis of the If-Ie characteristics of each surface-conduction type electron-emitting device in FIG. 28. FIG. 43 is a timing chart showing an interlaced scanning operation for a given column wiring layer in this embodiment. In this case, pulses appear in a signal s2 for switching a switch 10 and a signal s3 for switching a switch 8 at one-field intervals.

Eighteenth Embodiment

Figure 44A:
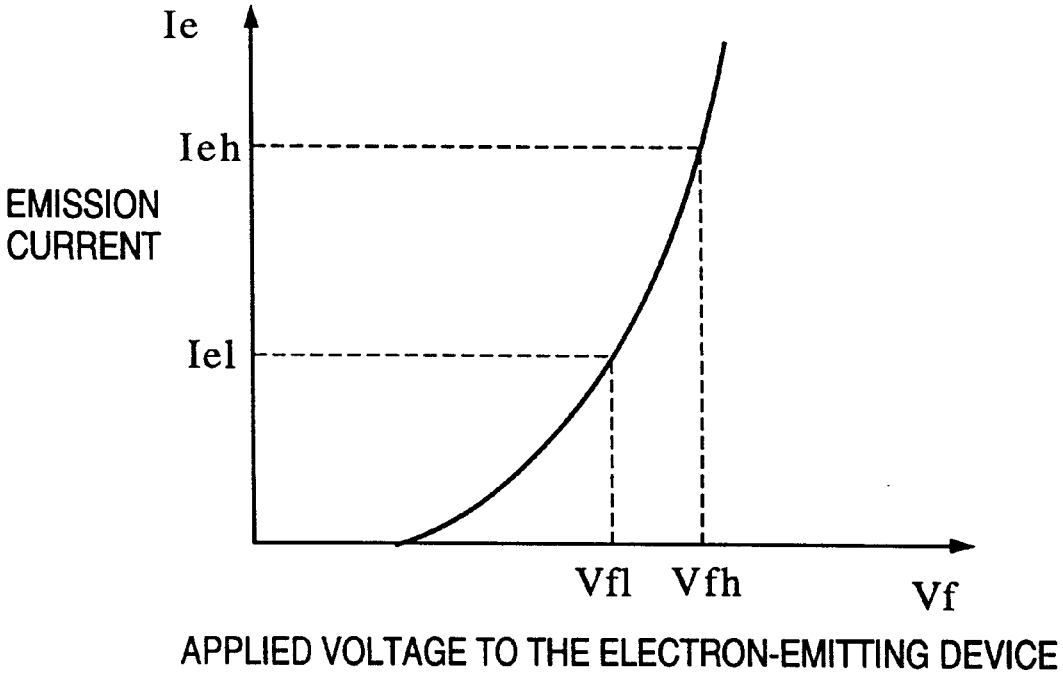
FIG. 44A is a graph showing the correlation between a device voltage Vf applied to a lateral field emission type electron-emitting device and the emission current in the 18th embodiment.
Figure 44B:
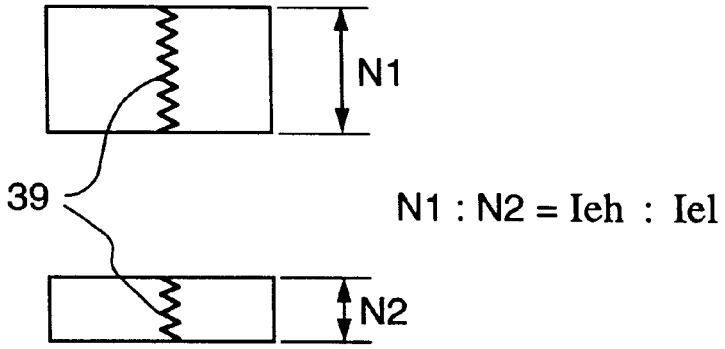
FIG. 44B is a plan view showing electron-emitting devices.

In the 18th embodiment, the surface-conduction type electron-emitting devices in the 17th embodiment are replaced with lateral FE type electron-emitting devices. FIG. 44A is a graph showing the correlation between a device voltage Vf and the emission current Ie. FIG. 44B is a plan view showing electron-emitting portions. In this embodiment, similar to the 17th embodiment, since the device voltage Vf is changed depending on a row to be scanned, the voltage of a luminance signal supplied to a column wiring layer and the voltage of a scanning signal supplied to a row wiring layer are changed. For this reason, the number of emission points of a electron-emitting portion 39 of a device to which the high device voltage Vf is applied must be decreased. If, therefore, the number of emission points per unit length remains the same, the length of the electron-emitting portion 39 must be changed. If the device voltages Vf applied to the upper and lower devices in FIG. 44B are respectively represented by Vf1 and Vfh, N1:N2=Ieh:Ie1 must be satisfied. The lengths of the adjacent row of electron-emitting portions 39 are respectively set to N1 and N2 on the basis of this calculation. A driving circuit and a timing chart are the same as those in FIGS. 41 to 43 described in the 17th embodiment.

Nineteenth Embodiment

In the 19th embodiment, similar to the 17th embodiment, different device voltages Vf are applied to adjacent row of surface-conduction emission type electron-emitting devices to change the positions where emitted electrons reach. To set the different voltages Vf, a scanning signal is only changed depending on a row to be scanned. In addition, correction is performed by using the memory function of each surface-conduction type electron-emitting device.

Prior to a detailed description of the operation of this embodiment, the memory function will be described with reference to 45A to 46B. The present inventors drove a surface-conduction type electron-emitting device having undergone forming process and activation process in an atmosphere where the partial pressure of an organic gas is reduced, and measured its electrical characteristics.

Figure 45A:
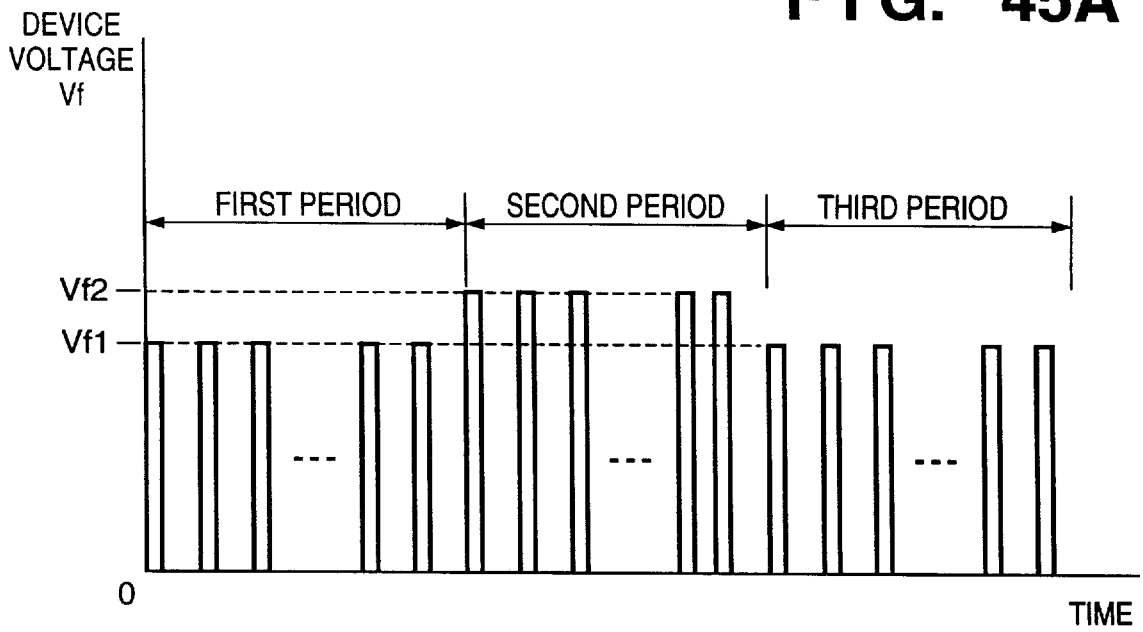
FIGS. 45A and 45B are graphs for explaining the memory function of each surface-conduction type electron-emitting device.
Figure 45B:
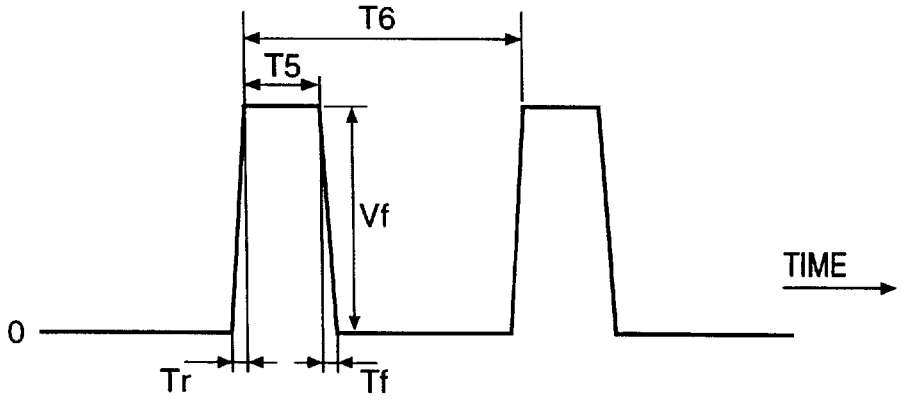

FIGS. 45A and 45B are graphs showing the voltage waveforms of device signal applied to each surface-conduction type electron-emitting devices. The abscissa represents the time axis; and the ordinate, the voltage (to be referred to as a device voltage Vf hereinafter) applied to the surface-conduction type electron-emitting device. As shown in FIG. 45A, consecutive rectangular voltage pulses are used as a driving signal, and the application period of the voltage pulses are divided into three periods, namely first to third periods. In each period, 100 pulses having the same width and height are applied. FIG. 45B is an enlarged view of the waveform of such a pulse voltage. Measurement conditions are: pulse width T5=66.8 [μs] and pulse period T6=16.7 [ms] in each period. These conditions are determined with reference to the standard driving conditions set when a surface-conduction type electron-emitting device is applied to a general TV receiver. However, the memory function can be measured under other conditions. Note that measurement was performed while the impedance of a wiring path from a driving signal source to each surface-conduction type electron-emitting device was sufficiently reduced such that both a rise time Tr and a fall time Tf of a voltage pulse effectively applied to the surface-conduction type electron-emitting device became equal to or lower than 100 [ns].

The device voltage Vf is Vf=Vf1 in the first and third periods, and is Vf=Vf2 in the second period. Both the voltages Vf1 and Vf2 are set to be higher than the electron emission threshold voltage of each surface-conduction type electron-emitting device and to satisfy Vf1<Vf2. Since the electron emission threshold voltage varies depending on the shape and material of a surface-conduction type electron-emitting device, these voltages are appropriately set in accordance with a surface-conduction type electron-emitting device to be measured. With regard to an atmosphere around the surface-conduction type electron-emitting device in a measurement operation, the total pressure is $1\times10^{-6}$ Torr, and the partial pressure of an organic gas is $1\times10^{-9}$ Torr.

Figure 46A:
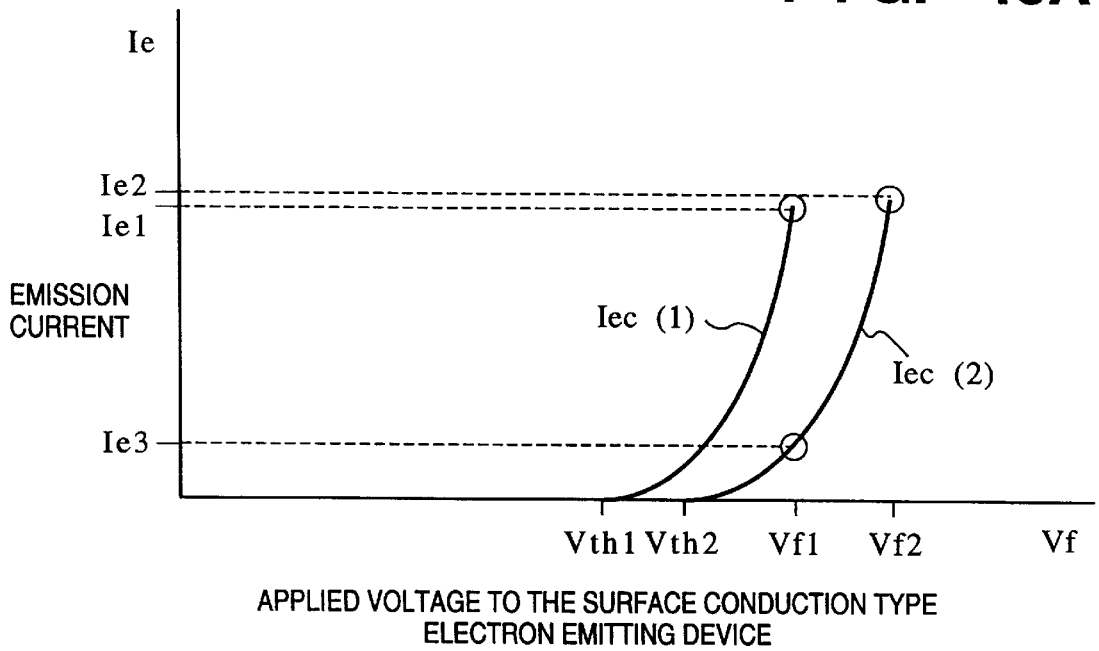
FIGS. 46A and 46B are graphs for explaining the memory function of each surface-conduction type electron-emitting device.
Figure 46B:
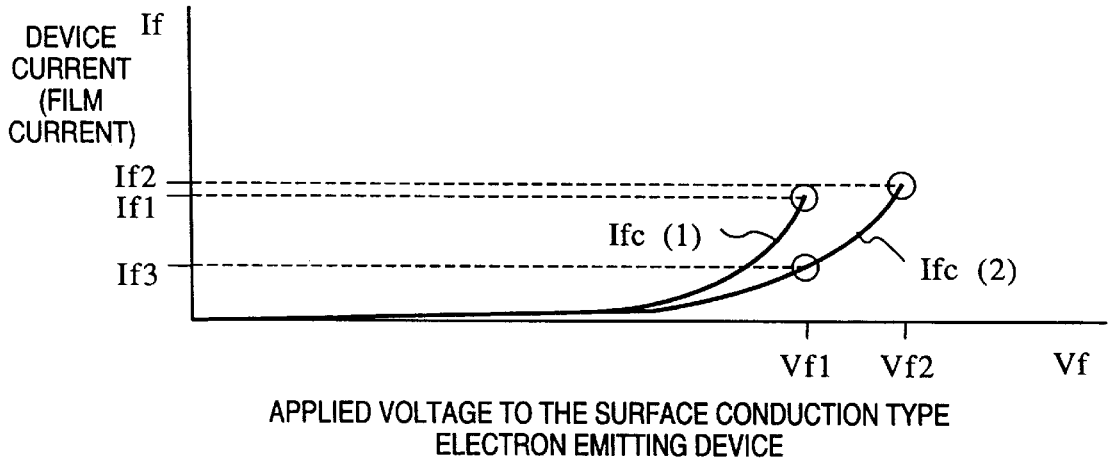

FIGS. 46A and 46B are graphs showing the electrical characteristics of the surface-conduction type electron-emitting device upon application of the device voltage Vf shown in FIGS. 45A and 45B. Referring to FIG. 46A, the abscissa represents the device voltage Vf; and the ordinate, the measurement value a current Ie emitted from the surface-conduction type electron-emitting device. Referring to FIG. 45B, the abscissa represents the device voltage Vf; and the ordinate, a current (to be referred to as a device current If hereinafter) flowing in the surface-conduction type electron-emitting device.

The (device voltage Vf)-to-(emission current Ie) characteristic shown in FIG. 46A will be described first. In the first period in FIG. 45A, the surface-conduction type electron-emitting device outputs an emission current according to a characteristic curve Iec(1) in response to a driving pulse. In the rise time Tr of a driving pulse, when the applied voltage Vf exceeds Vth1, the emission current abruptly increases according to the characteristic curve Iec(1). In the period of Vf=Vf1, i.e., an interval T5, the emission current Ie is kept at Ie1. In the fall time Tf of the driving pulse, the emission current Ie abruptly decreases according to the characteristic curve Iec(1).

In the second period, when application of a pulse given by Vf=Vf2 is started, the characteristic curve Iec(1) changes to a characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf2, i.e., the interval T5, the emission current Ie is kept at Ie2. In the fall time Tf of the driving pulse, the emission current Ie abruptly decreases according to the characteristic curve Iec(2).

In the third period, although the pulse given by Vf=Vf1 is applied again, the emission current changes according to the characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf1, i.e., the interval T5, the emission current Ie is kept at Ie3. In the fall time Tf of the driving pulse, the emission current Ie abruptly decreases according to the characteristic curve Iec(2).

As described above, in the third period, since the characteristic curve Iec(2) in the second period is stored, even if the same device voltage is applied, the emission current Ie becomes smaller than that in the first period.

With regard to the (device voltage Vf)-to-(device current If) characteristic as well, as shown in FIG. 46B, the device operates according to a characteristic curve Ifc(1) in the first period. In the second period, however, the device operates according to a characteristic curve Ifc(2). In the third period, the device operates according to the characteristic curve Ifc(2) stored in the second period.

For the sake of descriptive convenience, only the three periods, i.e., the first to third periods, are set. As is apparent, however, the above phenomenon is not limited to this condition. In applying a pulse voltage to a surface-conduction type electron-emitting device having a memory function, when a pulse having a voltage higher than that of a previously applied pulse is applied, a characteristic shifts, and the resultant characteristic is stored. Subsequently, the characteristic is kept stored unless a pulse having a higher voltage is applied. Such a memory function has not been observed in other electron-emitting devices including FE type electron-emitting devices. This function is therefore unique to a surface-conduction type electron-emitting device. With this memory function, different electron emission characteristics are stored in the electron-emitting devices on odd and even rows after the maximum voltage Vf1 is applied to each device on an odd row of the display panel 12, and the maximum voltage Vf2 (Vf1<Vf2) is applied to each device on an even row.

Figure 47:
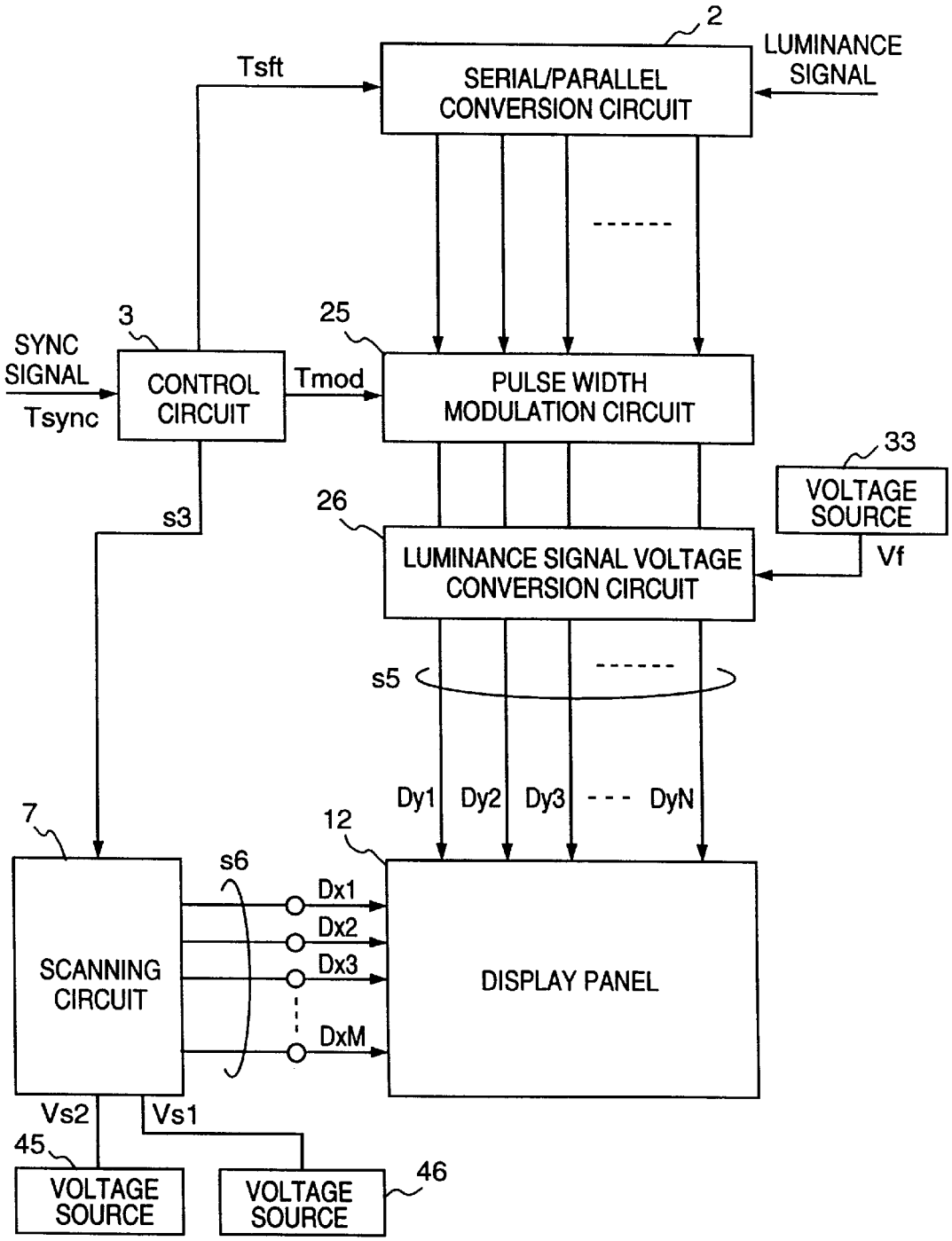
FIG. 47 is a block diagram showing a driving circuit in the 19th embodiment of the present invention.
Figure 48:
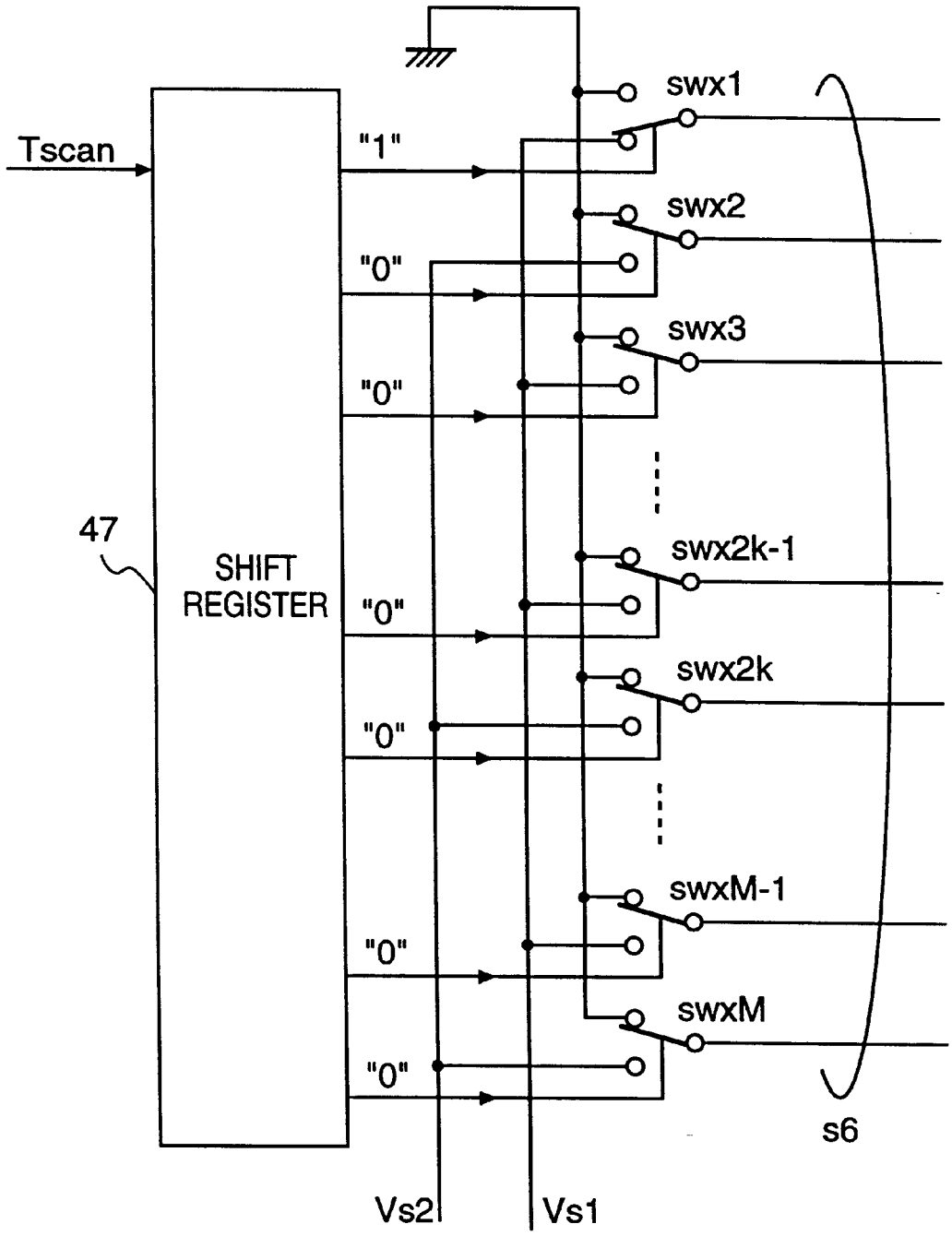
FIG. 48 is a circuit diagram showing the internal arrangement of a scanning circuit in the 19th embodiment.

FIG. 47 is a block diagram showing a driving circuit in the 19th embodiment. This circuit is almost the same as that shown in FIG. 41 described in the 17th embodiment except that the pulse generator 6 and the switching circuits 70 and 72 in FIG. 41 are omitted, and a pulse generator 6 and the internal structures of a luminance signal voltage conversion circuit 26 are different from those in the 17th embodiment. FIG. 48 is a block diagram showing the arrangement of a scanning circuit 7 in this embodiment. The scanning circuit 7 includes a shift register 47 and M switching elements swx1 to swxM corresponding to M column row wiring layers of the display panel 12. Each switching element selects one of output voltages from DC voltage sources 45 and 46 and 0 V (ground level), and outputs it to a corresponding one of the terminals $D_{x1}$ to $D_{xM}$ of the display panel 12. The output voltages from these DC voltage sources 45 and 46 correspond to the electron emission characteristics stored in each device on an odd row and each device on an even row, respectively, and are set such that the voltage Vs1 is applied to each device on the odd row; and the voltage Vs2 (|Vs1|<|Vs2|), to each device on the even row (FIG. 47 shows a case wherein the value M is an even number). Each switching element is switched to the ground side or the output voltage side in accordance with an output from the shift register 47. In the case shown in FIG. 48, only the signal corresponding to the switch swx1 is "1", but all the remaining output signals are "0".

The shift register 47 sequentially shifts 1-bit data "1" in response to a timing signal Tscan (s3) from a control circuit 3 to output signals for sequentially switching the switching elements swx1 to swxM. More specifically, as shown in FIG. 48, when the data corresponding to the first line of the display panel 12 is "1", only the output of the switch swx1 is connected to a supply voltage Vs1, but all the remaining switches are connected to the ground side. When the data "1" is shifted in response to the signal Tscan (s3), and only the second row is selected, only the output of the switch swx2 is connected to a supply voltage Vs2 side, but the all the remaining switches are connected to the ground side. Subsequently, switch elements are sequentially selected throughout the rows to perform a display operation. Note that these switching element can be easily realized by, e.g., FETs.

Note that the above DC voltages Vs1 and Vs2 are respectively output from the DC voltage sources 45 and 46. In this embodiment, these voltages are set to Vs1=−(Vth1−1) [V], and Vs2=−(Vth2−1) [V] so as to be equal to or lower than the electron emission threshold voltage based on the characteristics of the surface-conduction type electron-emitting device shown in FIGS. 46A and 46B.

The control circuit 3 controls the overall operation of this image display apparatus, and serves to match the operations of the respective components with each other to perform a proper display operation on the basis of an external digital video signal and a sync signal Tsync. The control circuit 3 outputs various control signals such as signals Tscan (s3), Tsft, Tmod, and Tmry to the respective components on the basis of the sync signal Tsync. As is known well, this sync signal Tsync includes a vertical sync signal and a horizontal sync signal. In this case, for the sake of descriptive convenience, the sync signal is written as "Tsync" in FIG. 47.

Figure 49:
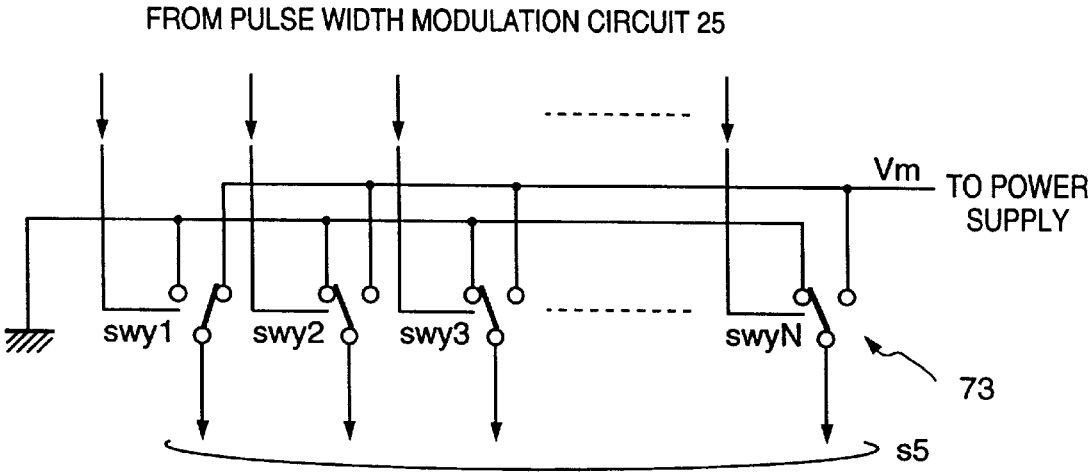
FIG. 49 is a circuit diagram showing the internal arrangement of a video data voltage conversion circuit in the 19th embodiment.

FIG. 49 shows the internal structure of the luminance signal voltage conversion circuit 26. Output signals from a pulse width modulation circuit 25 control the ON times of the respective switches of a switch element group 73. A voltage Vm from a voltage source 33 is supplied to one terminal of each of the switches of the switch element group 73, and the other terminal is grounded. When a given switch is turned on, the corresponding voltage Vm from the voltage source 33 is supplied. As switches swy1 to swyN, bipolar transistors, FETs, or the like are used.

Figure 50:
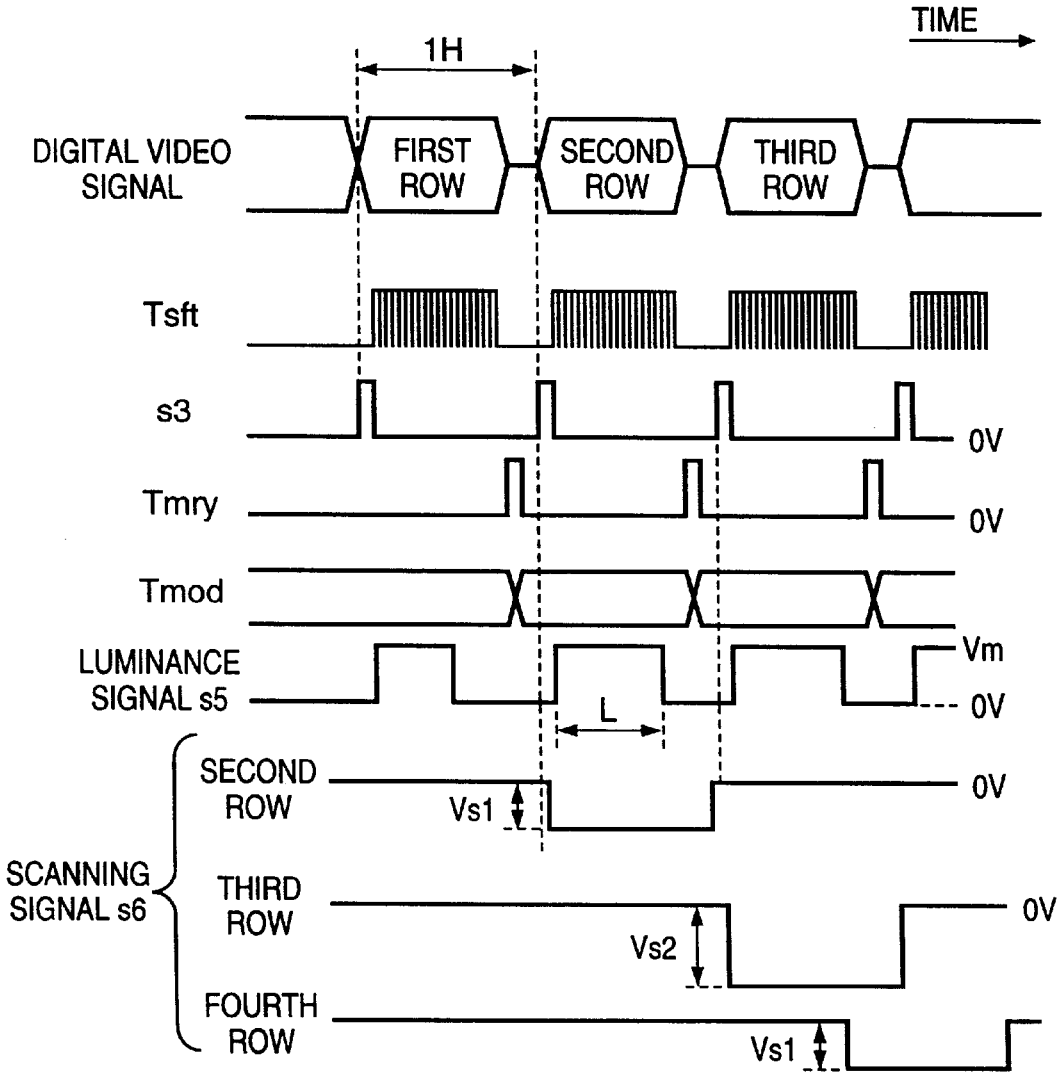
FIG. 50 is a timing chart in the 19th embodiment.

FIG. 50 is a timing chart associated with the ith column wiring layer, in particular, in this embodiment. This timing chart is similar to that of FIG. 42 described in the 17th embodiment except that the voltage of the luminance signal S5 is not switched. More specifically, the scanning circuit 7 switches its device voltages depending on whether an odd or even row is to be scanned. In this embodiment, when an odd row is to be scanned, the output voltage Vs1 from the voltage source 46 is selected, whereas when an even row is to be scanned, the output voltage Vs2 from the voltage source 45 is selected. FIG. 50 shows a scanning operation up to the third row. As is apparent, however, such a scanning operation is repeated up to the Mth row.

Twentieth Embodiment

Figure 51:
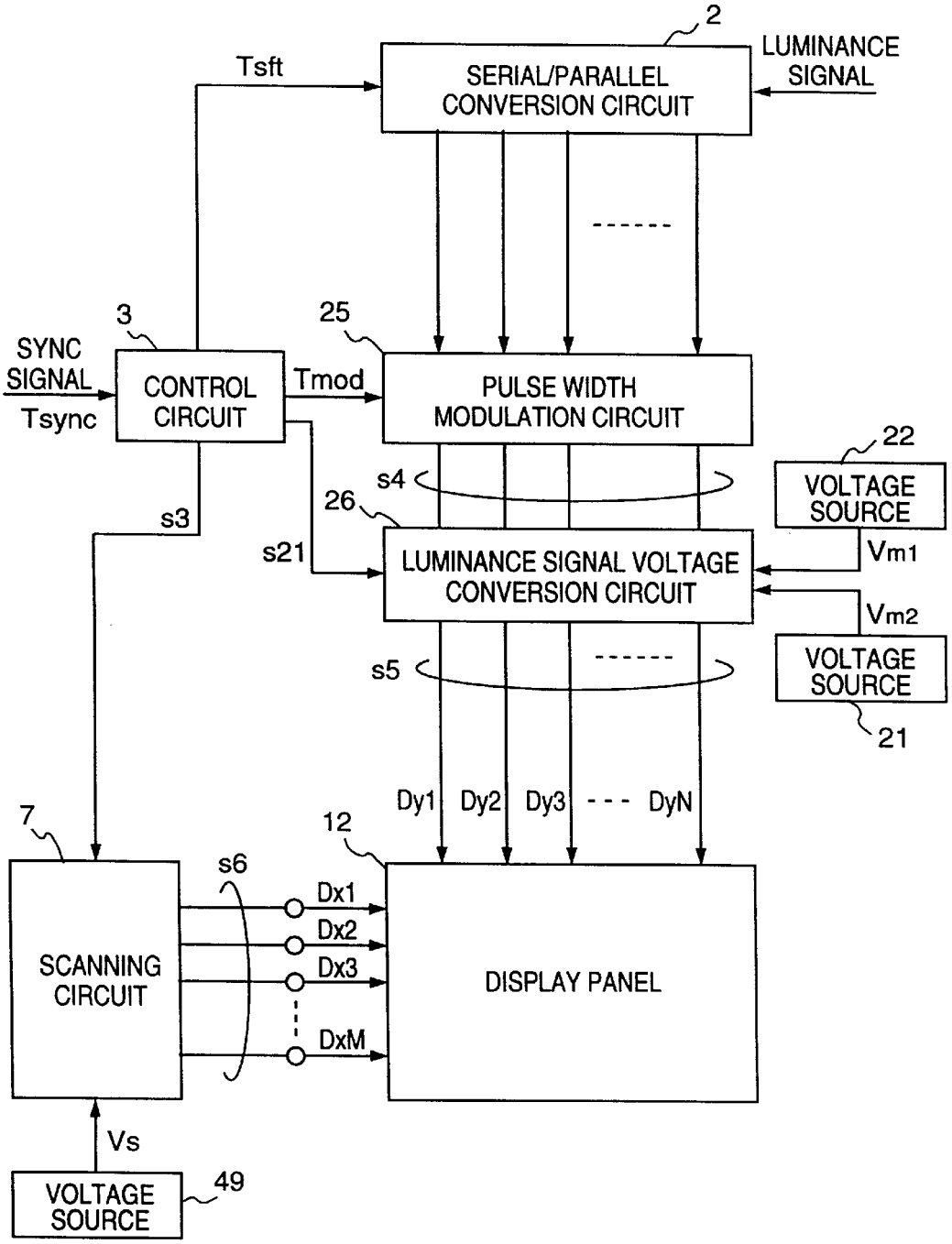
FIG. 51 is a block diagram showing a driving circuit in the 20th embodiment of the present invention.
Figure 52:
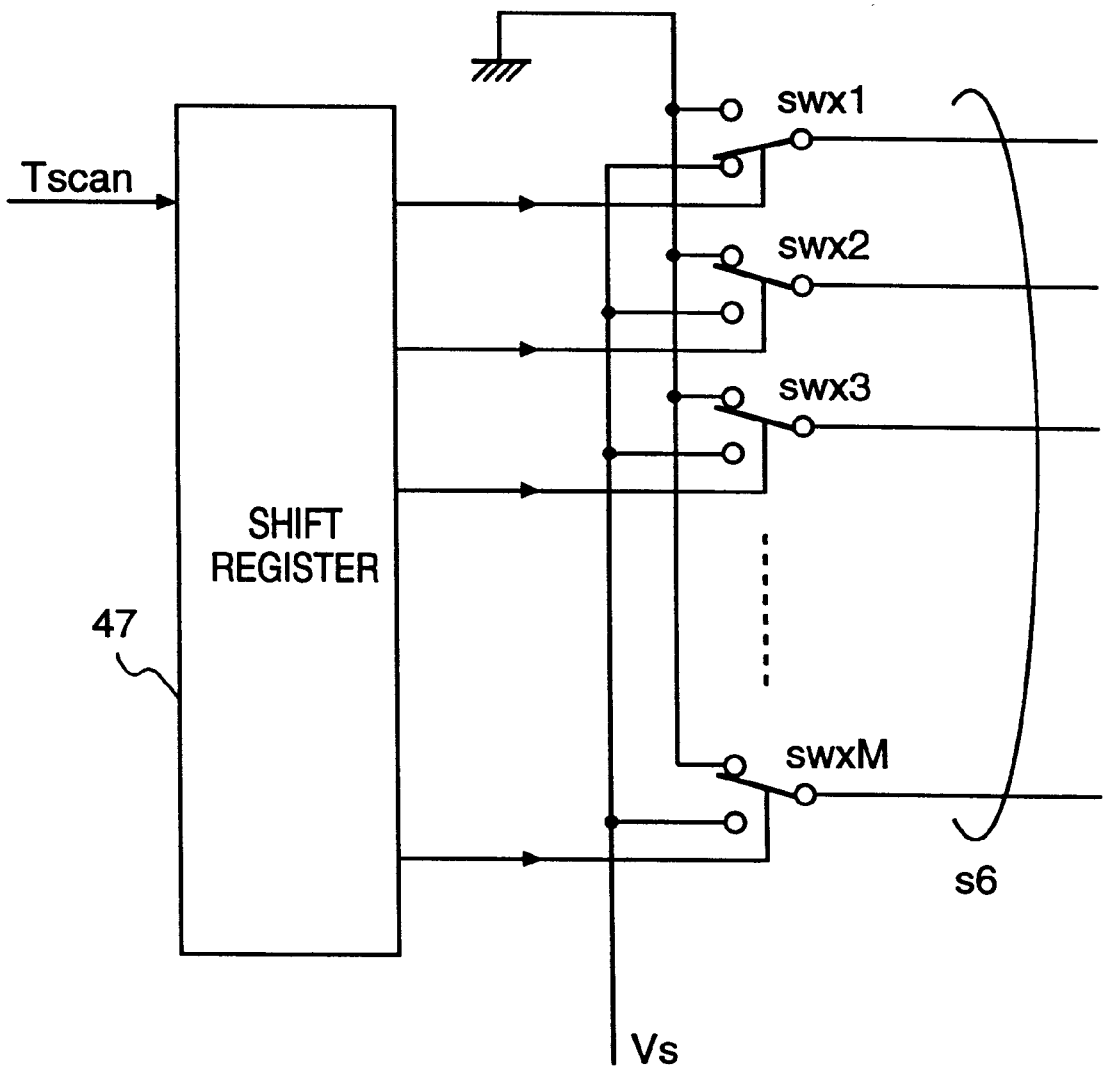
FIG. 52 is a circuit diagram showing the internal arrangement of a scanning circuit in the 20th embodiment.

The 20th embodiment is the same as the 19th embodiment except that a voltage to be output to each column wiring layer is changed instead of changing a voltage depending on a row to be scanned. FIG. 51 is a block diagram showing a driving circuit in this embodiment. The same reference numerals in FIG. 51 denote the same parts as in FIG. 47, and a description thereof will be omitted. The arrangement of a scanning circuit 7 will be described with reference to FIG. 52. The scanning circuit 7 is basically constituted by a shift register 47 and switching elements swx1 to swxM constituted by EFTs or the like, similar to the scanning circuit 7 in FIG. 48. The basic arrangement and operation of this circuit are the same as those of the scanning circuit 7 in FIG. 48 except that only an output voltage Vs from a voltage source 49 is used as a scanning voltage. Note that this voltage Vs is set to Vs=−(Vth1−1) [V] in FIG. 45A.

Figure 53:
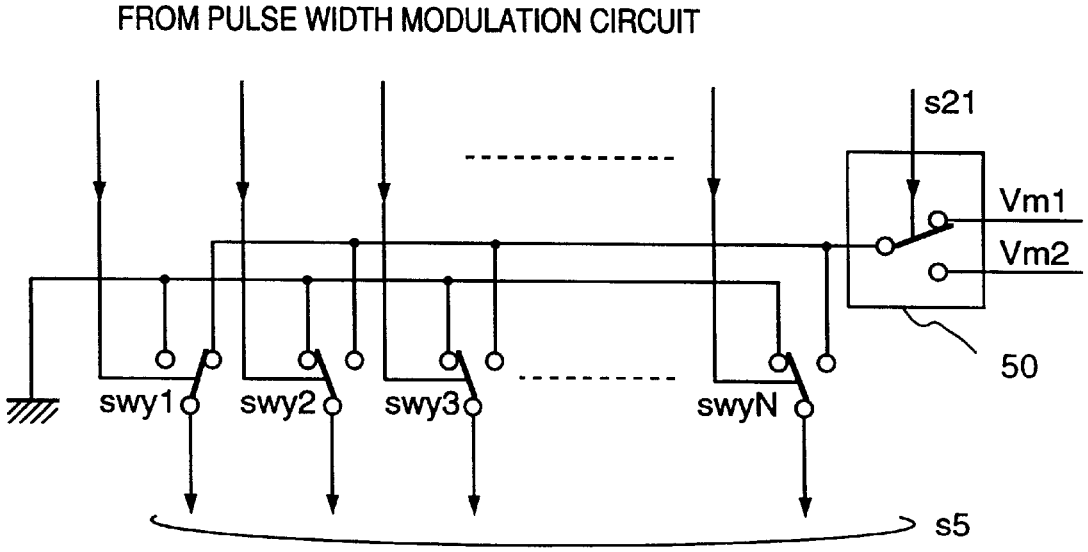
FIG. 53 is a circuit diagram showing the internal arrangement of a video data voltage conversion circuit in the 20th embodiment.

FIG. 53 is a block diagram showing the arrangement of a luminance signal voltage conversion circuit 26 in this embodiment.

The luminance signal voltage conversion circuit 26 is basically constituted by a switch element group (swy1 to swyN) for switching output voltages. The basic operation of this switch element group is the same as that in the 19th embodiment except that a voltage value Vm corresponding to an output voltage to a display panel 12 is switched by a control circuit 3 in accordance with a row scanned by the scanning circuit 7. More specifically, when an odd row of the display panel 12 is to be displayed/driven, a switch 50 is switched in response to a signal s21 output from the control circuit 3 so as to apply a voltage Vm1 from a voltage source 22 to the switch element group. When an even row is to be displayed/driven, the switch 50 is switched to the other side in response to a signal s21 so as to apply a voltage Vm2 from a voltage source 21 to the switch element group. In this case, the voltage value Vm1 is set to Vm1=Vf1−Vth1 [V] on the basis of the values shown in FIG. 46A, and the voltage value Vm2 is set to Vm2=Vf2−Vth1 [V].

Figure 54:
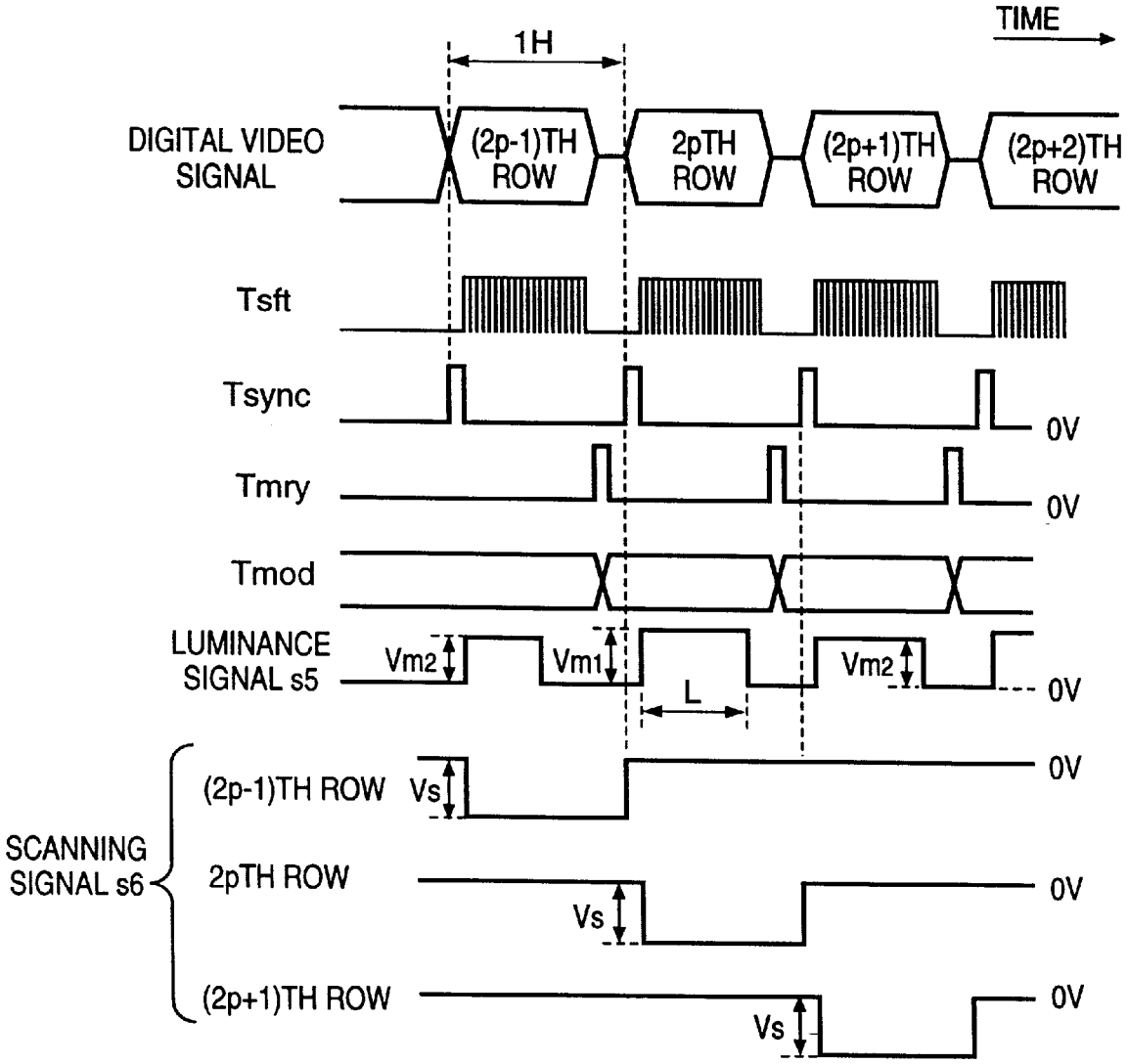
FIG. 54 is a timing chart in the 20th embodiment.

FIG. 54 is a timing chart for a given column wiring layer in this embodiment. As is apparent from FIG. 54, the voltage value of a pulse-width-modulated luminance signal s5 (a pulse width modulation signal for the ith row) is switched depending on whether an odd or even row is to be scanned. A signal s6 for a scanning line is always output with a constant voltage value Vs.

In addition, as another form of using the above memory function of each surface-conduction type electron-emitting device, like the 13th and 16th embodiments, the electron irradiation position can be changed in units of rows by changing the voltage Va while keeping the device application voltage Vf constant throughout all rows. In this case, in order to prevent a change in brightness with a change in Va, the characteristics of the devices on an even row (odd row) are changed to satisfy $$Ie1 \times Va1 = Ie2 \times Va2$$

where Va1 is the voltage Va for the (2*n*+1)th (odd) row, Va2 is the voltage Va for the 2*nth* (even) row, Ie1 is the emission current obtained when the odd row is driven with the voltage Vf under the condition of Va=Va', and Ie2 is the emission current obtained when the even row is driven with the voltage Vf under the condition of Va=Va'.

Twenty-first Embodiment

Figure 55:
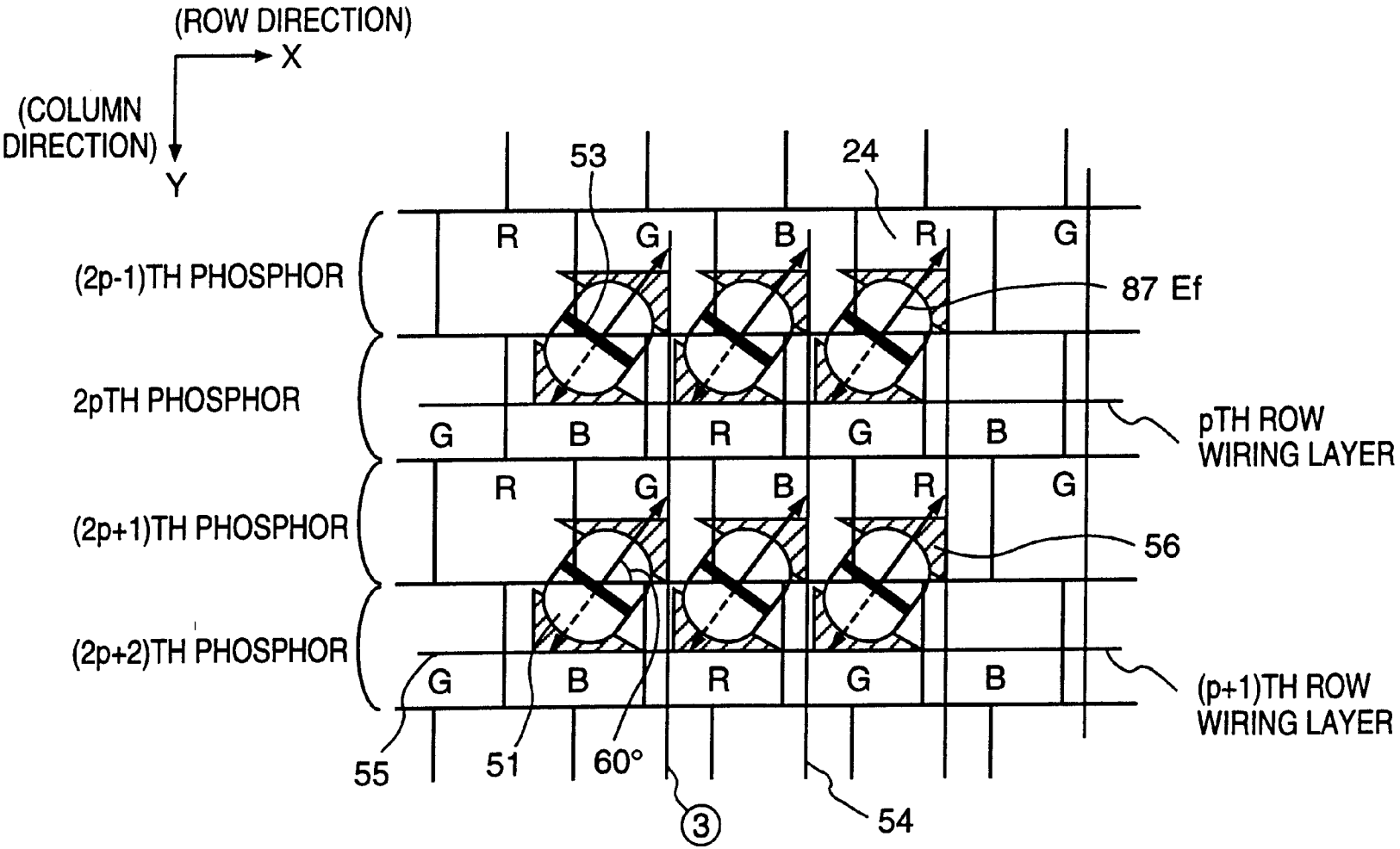
FIG. 55 is a plan view showing the positions of phosphor and a multi-electron beam source in the 21st embodiment of the present invention.

In the 21st embodiment, surface-conduction type electron-emitting devices are used as electron-emitting devices, and all the devices are caused to emit electrons obliquely to the row direction, thereby irradiating a delta arrangement phosphor. In this embodiment, the electron-emitting portions of all the devices are set obliquely at the same angle to the row direction. In the embodiment, the devices on one row irradiate electrons onto the phosphors on two rows sequentially. For this purpose, the polarity of a device voltage Vf applied to the same device is inverted depending on whether phosphor of an odd or phosphor of even row is to be irradiated. FIG. 55 is a plan view showing the positions of phosphors and a multi-electron beam source in the embodiment. The same reference numerals in FIG. 55 denote the same parts as described above. As shown in FIG. 55, electron-emitting portions 53 of all devices 51 as surface-conduction type electron-emitting devices are set obliquely at the same angle with respect to the row wiring layers. For this reason, the angles defined by the direction of electric fields applied to all the devices 51 and row wiring layers 55 are the same (60° in this case). A line having as the start point the center of the electron-emitting portion 53 of the device 51 and perpendicular to a plane of the multi-electron beam source crosses the middle point of a straight line connecting the centers of phosphors 24 on adjacent rows at a right angle.

Consequently, the angle defined by the direction of an electric field applied to the device 51 and the row wiring layer 55 is equal to the angle defined by a line connecting the centers of the phosphors 24 on adjacent rows and the row wiring layer 55. In addition, the electron emitting devices 51 connected to the pth row wiring layer cause the phosphors 24 on the two rows, i.e., the (2*p*−1)th and 2*pth* rows, to emit light, whereas the electron-emitting devices 51 connected to the (p+1)th row wiring layer cause the phosphors 24 on the two rows, i.e., the (2*p*+1)th and (2*p*+2)th rows, to emit light. With this operation, the devices 51 emit electrons in the consecutive 1 H intervals. In the first 1 H interval, the devices 51 emit electrons to the upper right (solid lines 87). In the second 1 H interval, the devices 51 emit electrons to the lower left (dotted lines).

Figure 56:
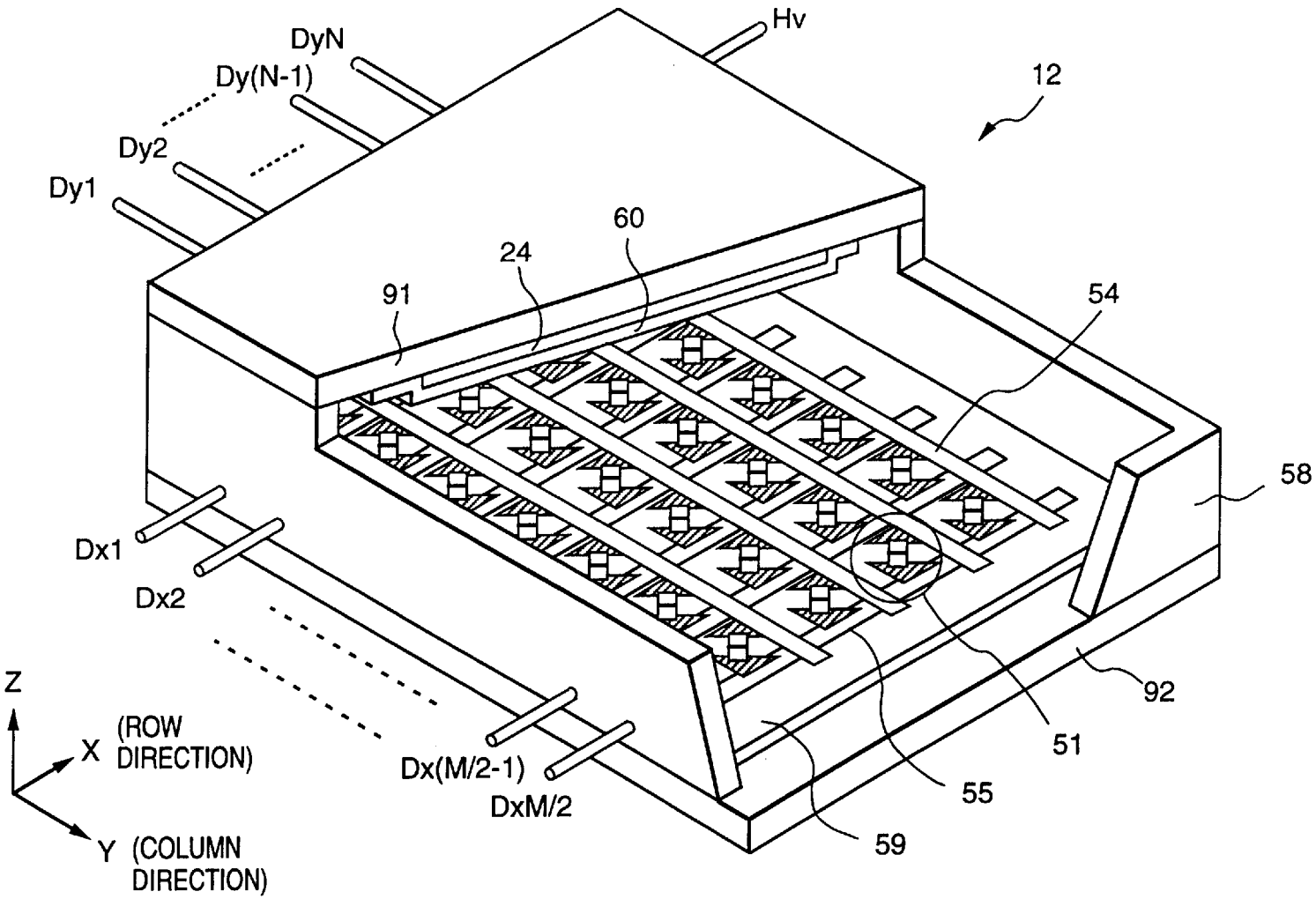
FIG. 56 is a perspective view showing a display panel in the 21st embodiment.
Figure 57:
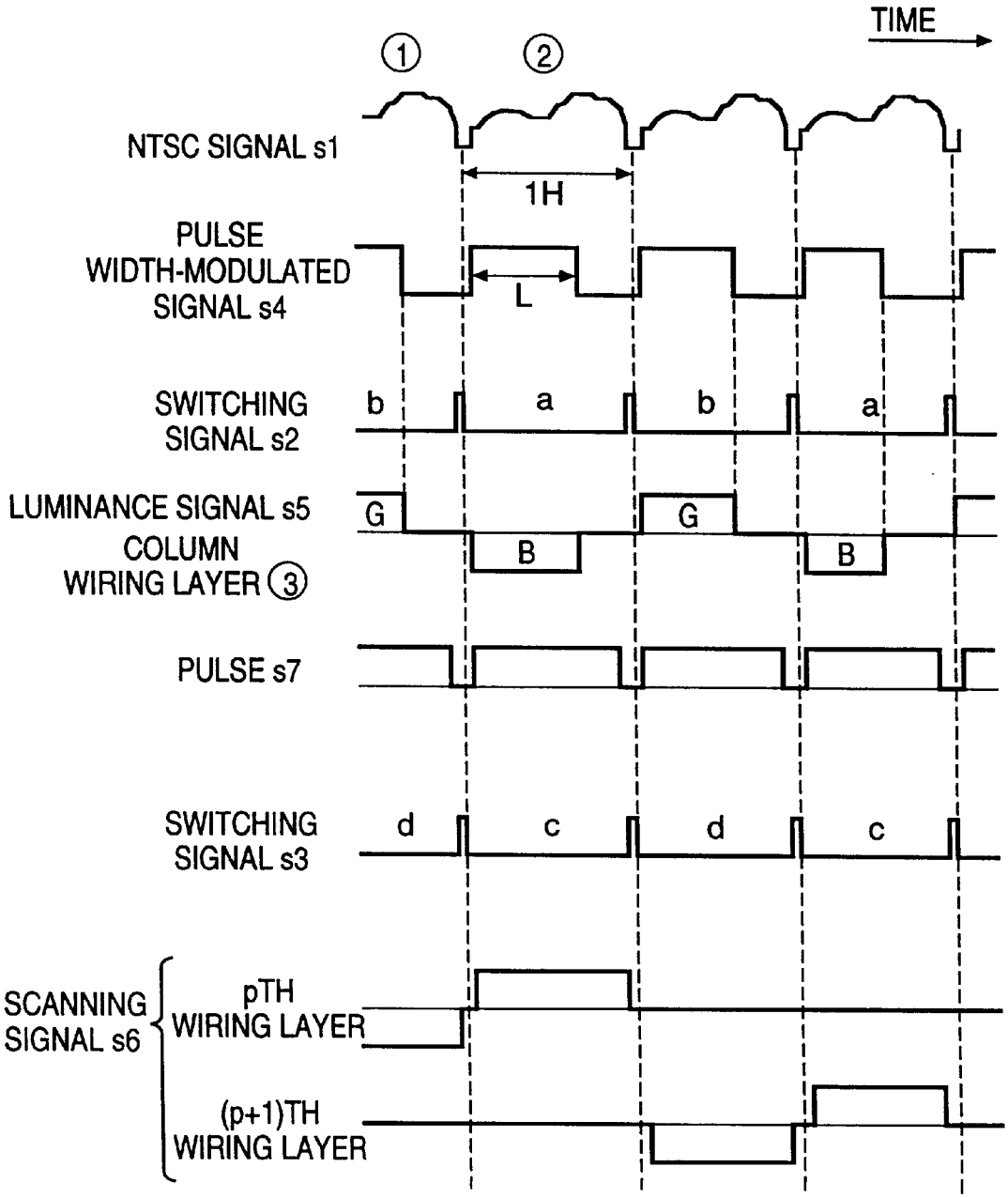
FIG. 57 is a timing chart in the 21st embodiment.

FIG. 56 is a perspective view of a display panel in this embodiment. The structure of a display panel 12 of this embodiment and its manufacturing method are the same as those in the first embodiment described with reference to FIG. 5 except that the devices 51 are obliquely formed to column wiring layers 54 and the row wiring layers 55, and the number of row wiring layers 55 is ½ that in the first embodiment. A driving circuit in this embodiment is almost the same as that in FIG. 3 described in the first embodiment except that a scanning circuit 7 outputs a pulse for selecting one row twice to each row wiring layer 55, and a signal processing unit 1 switches luminance signals of difference colors to be output to each column wiring layer. FIG. 57 is a timing chart for a column wiring layer ③ in this embodiment. In the embodiment, a non-interlaced scanning operation is performed. This operation is almost the same as that shown in FIG. 4 described in the first embodiment. However, in the first 1 H interval, a negative scanning signal s6 is supplied to a column wiring layer. In the second 1 H interval, the positive signal s6 is supplied to the same column wiring layer. As a result, in the first 1 H interval indicated by "①" in FIG. 57, a positive G luminance signal s5 for the green phosphor is supplied to the column wiring layer ③ in FIG. 55, and the negative scanning signal s6 is supplied to the pth row wiring layer. In this case, as shown in FIG. 55, the electron-emitting device 51 connected to the column wiring layer ③ and the pth row wiring layer emits electrons from the electron-emitting portion 53 to the upper right direction, thereby irradiating the phosphor on the odd ((2*p*−1)th) row. In the second 1 H interval, as shown in FIG. 57, a negative B luminance signal s5 for the blue phosphor is supplied to the column wiring layer ③, and the positive scanning signal s6 is supplied to the pth row wiring layer. In this case, as shown in FIG. 55, the device 51 connected to the column wiring layer ③ and the pth row wiring layer emits electrons from the electron-emitting portion 53 to the lower left direction, thereby irradiating the phosphor on the even (2*pth* ) row. The (p+1)th row wiring layer and the subsequent row wiring layers are scanned in the same manner as described above.

In this embodiment, since the devices on one row cause the phosphors on two rows in a delta arrangement to emit light, even if the resolution of the multi-electron beam source is not very high, the resolution of the display panel obtained by integrating phosphors can be increased.

Twenty-second Embodiment

Figure 58:
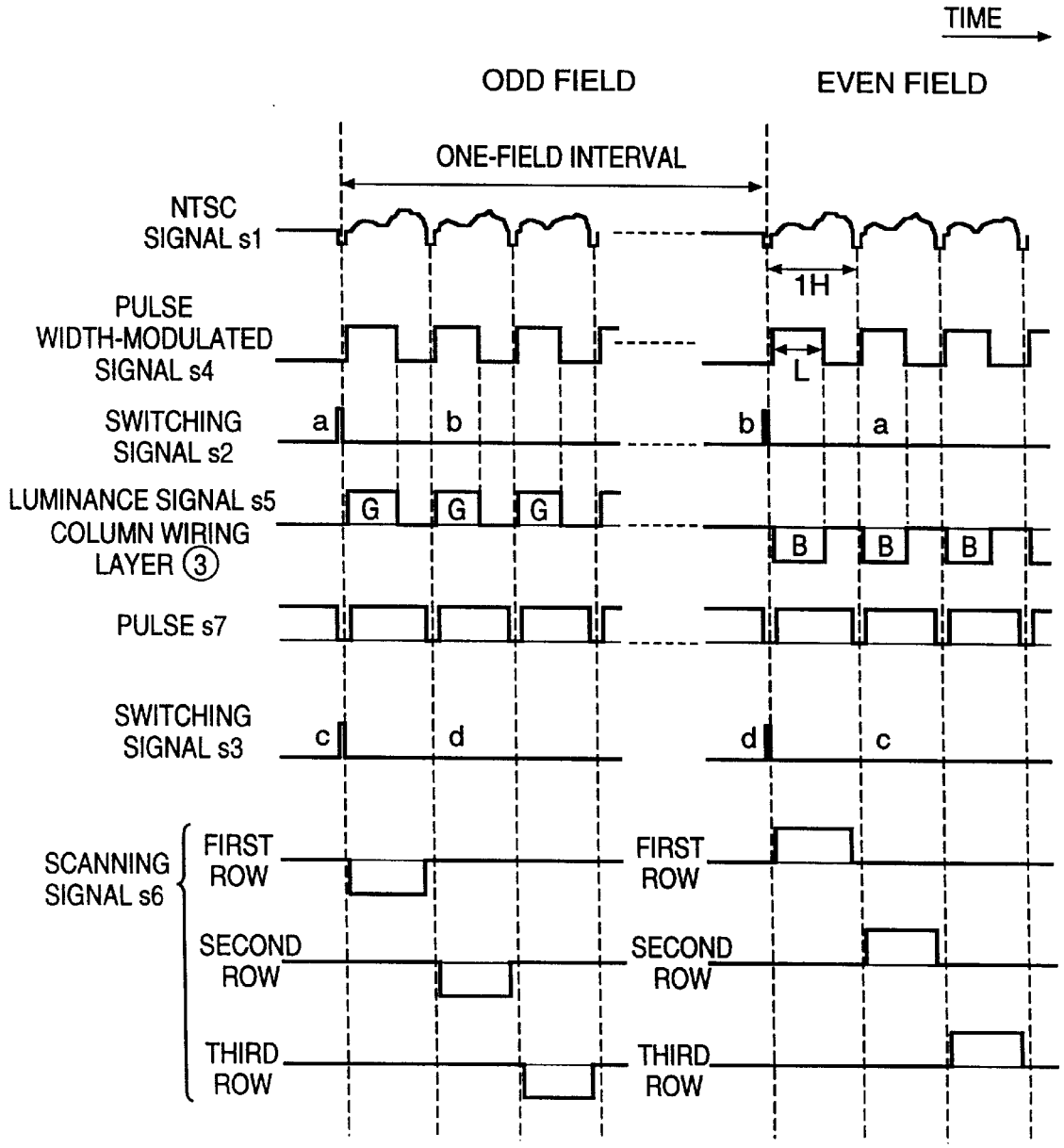
FIG. 58 is a timing chart in the 22nd embodiment of the present invention.

In the 22nd embodiment, the apparatus of the 21st embodiment is operated in the interlaced scanning mode. The structures of a display panel and a driving circuit are the same as those in the 21st embodiment. FIG. 58 is a timing chart in this embodiment. This timing chart is almost the same as that of FIG. 12 described in the second embodiment except that a scanning signal s6 is supplied to the same row wiring layer in both odd and even fields.

Twenty-third Embodiment

Figure 59:
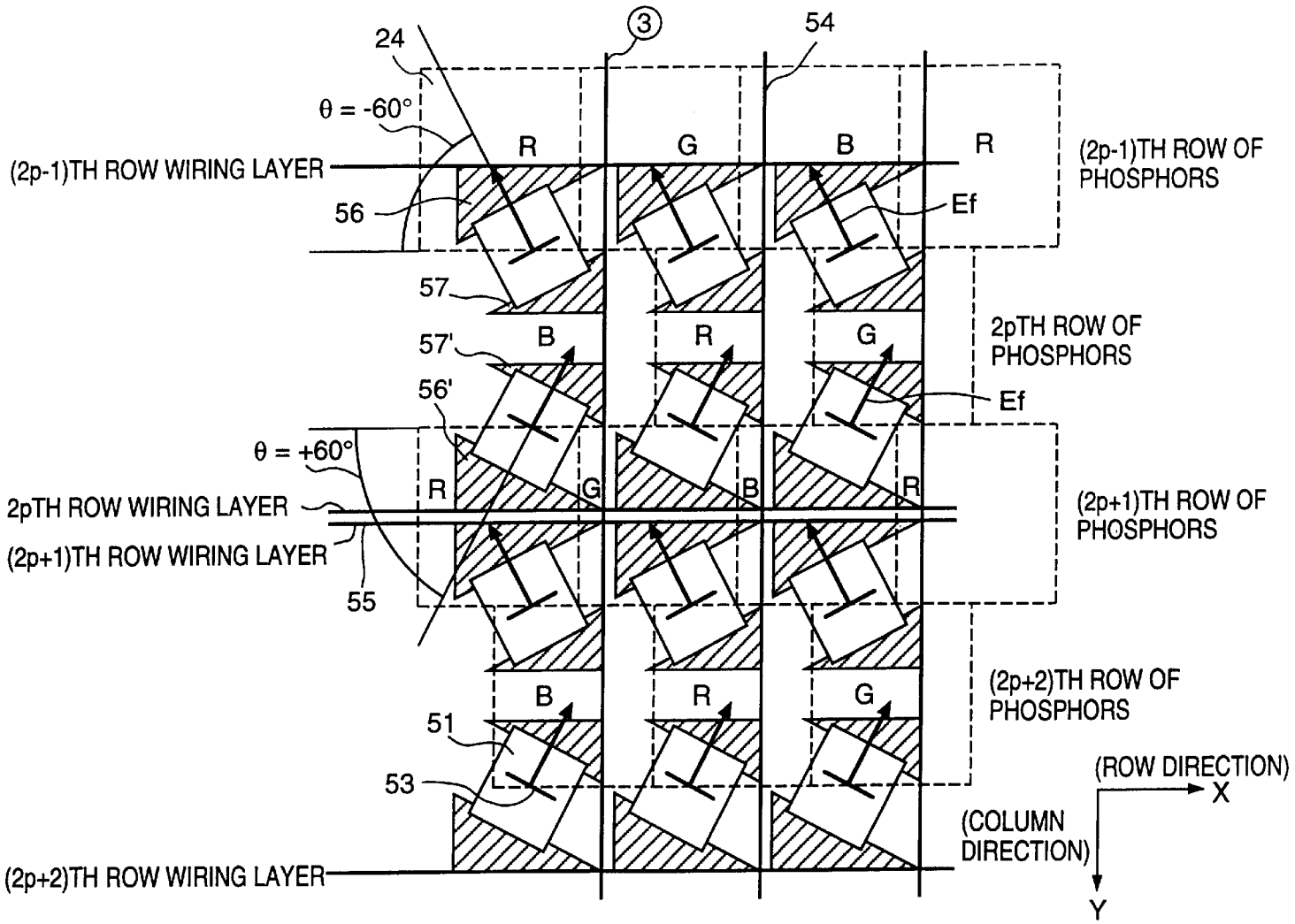
FIG. 59 is a plan view showing the positions of phosphors and a multi-electron beam source in the 23rd of the present invention.

In the 23rd embodiment, surface-conduction type electron-emitting devices are used as electron-emitting devices, and all the devices are caused to emit electrons obliquely to the row direction, thereby realizing a delta arrangement display device. In this embodiment, the electron-emitting portions of the devices on the odd and even rows are set obliquely such that the angles of the electron-emitting portions are symmetrical about a plane parallel to the longitudinal axis of each row wiring layer and perpendicular to a plane of the multi-electron beam source. In the embodiment, the devices on one row irradiate phosphors on one row. FIG. 59 is a plan view showing the positions of phosphors and the multi-electron beam source in the embodiment. The same reference numerals in FIG. 59 denote the same parts as described above. As shown in FIG. 59, electron-emitting portions 53 of surface-conduction type electron-emitting devices 51 are set obliquely at the certain angle with respect to the row direction. The devices 51 on an odd row are connected to the lower side of the row wiring layer 55 at an angle of −60°, whereas the devices on an even row are connected to the upper side of the row wiring layer 55 at an angle of +60°. That is, electric fields applied to the devices 51 on the even (2*pth* ) row and the odd ((2*p*+1)th) row become symmetrical about the 2*pth* or (2*p*+1)th row wiring layer. For this reason, the devices 51 on the odd row emit electrons to the upper left direction, and the devices 51 on the even row emit electrons to the upper right direction.

Figure 60:
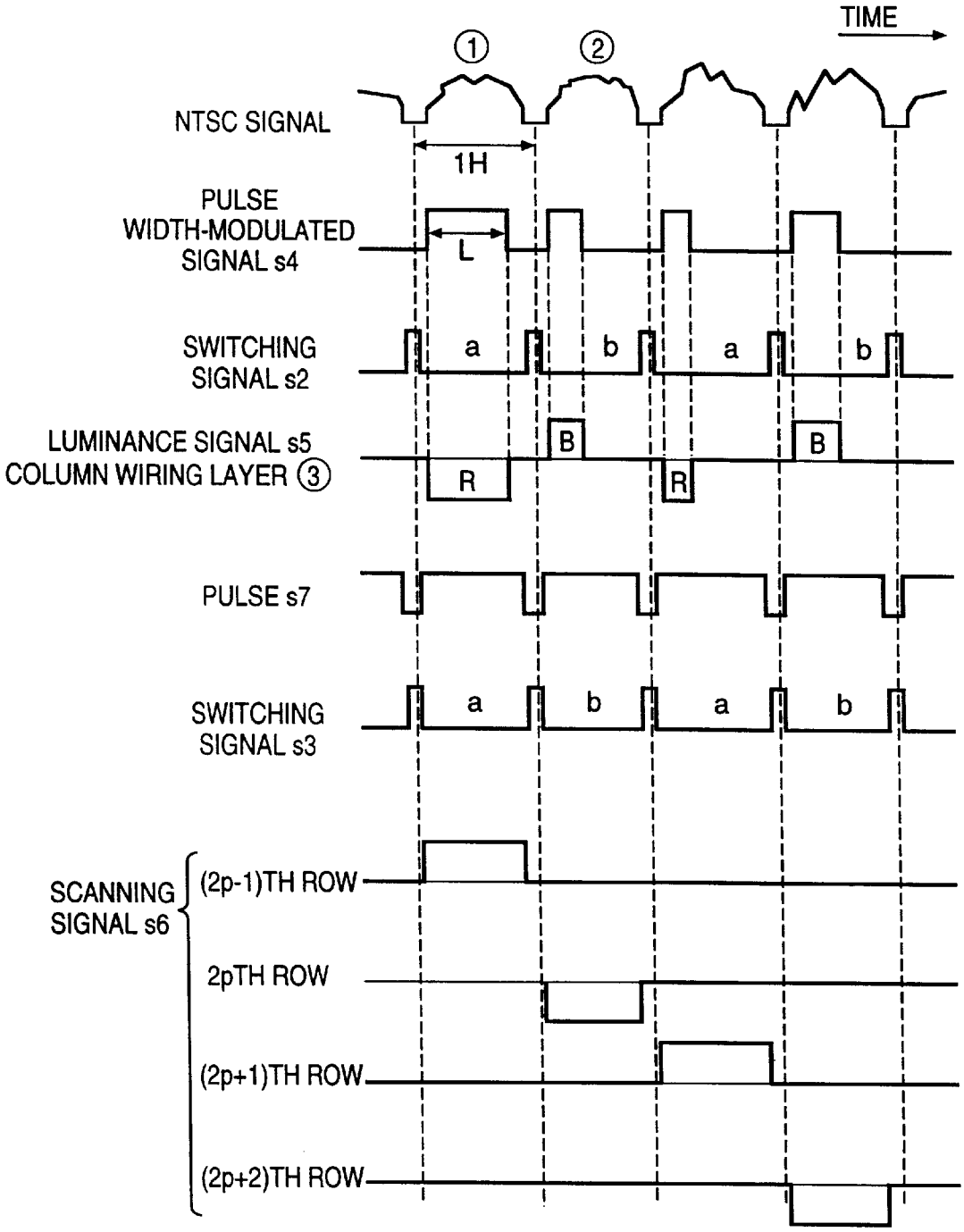
FIG. 60 is a timing chart in the 23rd embodiment of the present invention.

A driving circuit in this embodiment is almost the same as that in FIG. 3 described in the first embodiment except that a signal processing unit 1 switches luminance signals of different colors to be output to each column wiring layer. FIG. 60 is a timing chart for a column wiring layer 54 indicated by "③" in FIG. 59, in particular, in the embodiment. This timing chart is almost the same as that of FIG. 4 described in the first embodiment except that colors assigned to a luminance signal s5 are switched at 1 H intervals. Consequently, in the first 1 H interval indicated by "①" in FIG. 60, a negative R luminance signal s5 for red is supplied to the column wiring layer ③ in FIG. 59, and a positive scanning signal s6 is supplied to the (2*p*−1)th row wiring layer. In this case, the device 51 connected to the column wiring layer ③ and the (2*p*−1)th row wiring layer emits electrons from the electron-emitting portion 53 to the upper left so as to irradiate the R phosphor on the odd ((2*p*−1)th) row. In the second 1 H interval indicated by "②" in FIG. 60, a positive B luminance signal s5 for blue is supplied to the column wiring layer ③, and a negative scanning signal s6 is supplied to the 2*pth* row wiring layer. In this case, the device 51 connected to the column wiring layer ③ and the pth row wiring layer emits electrons from the electron-emitting portion 53 to the upper right direction to irradiate the B phosphor on the even (2*pth* ) row. The (p+2)th row wiring layer and the subsequent row wiring layers are scanned in the same manner as described above. Note that this timing chart indicates a non-interlaced scanning operation. The devices can be replaced with lateral FE type electron-emitting devices.

Twenty-fourth Embodiment

Figure 61:
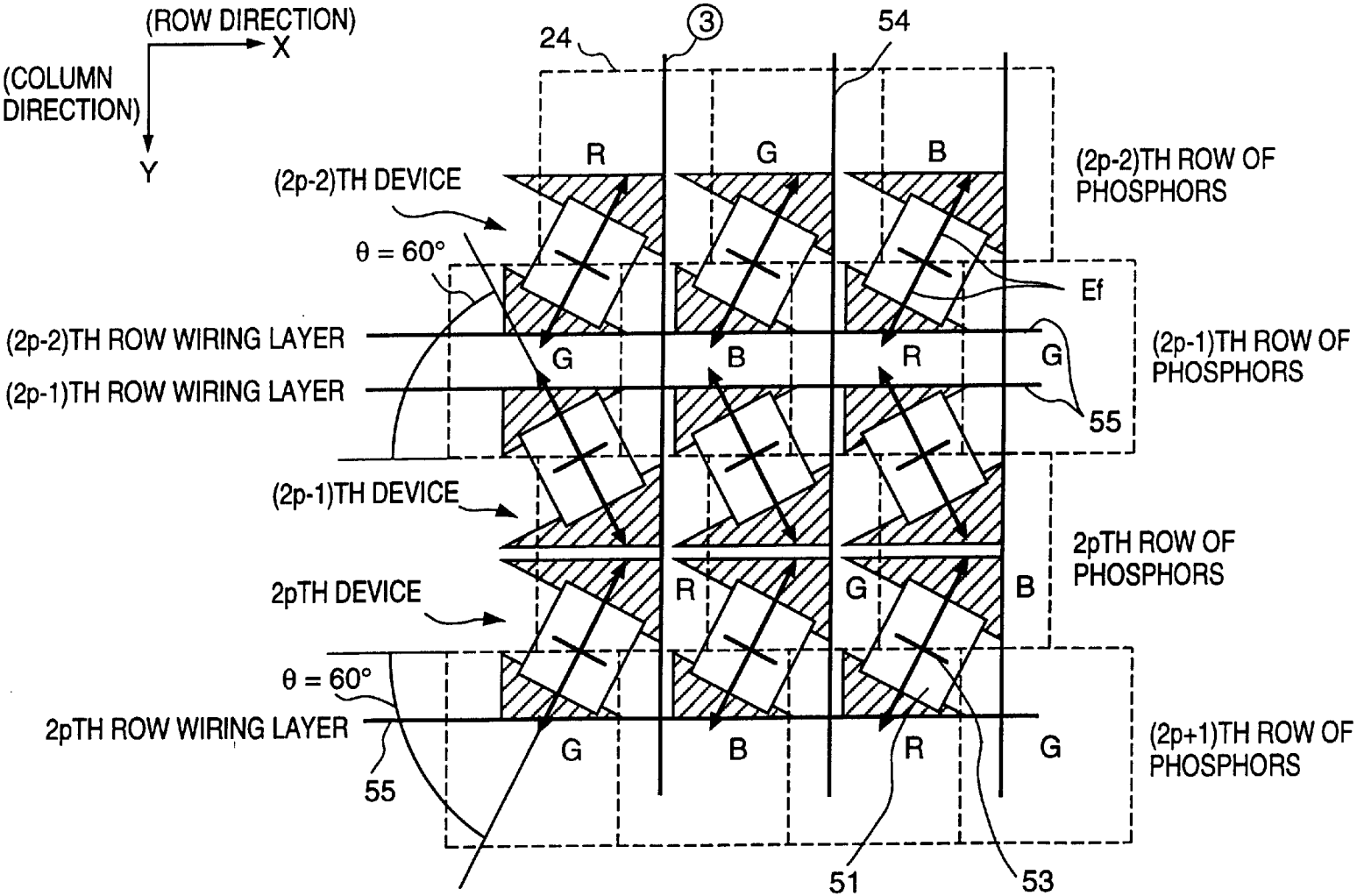
FIG. 61 is a plan view showing the positions of phosphors and a multi-electron beam source in the 24th embodiment of the present invention.
Figure 62:
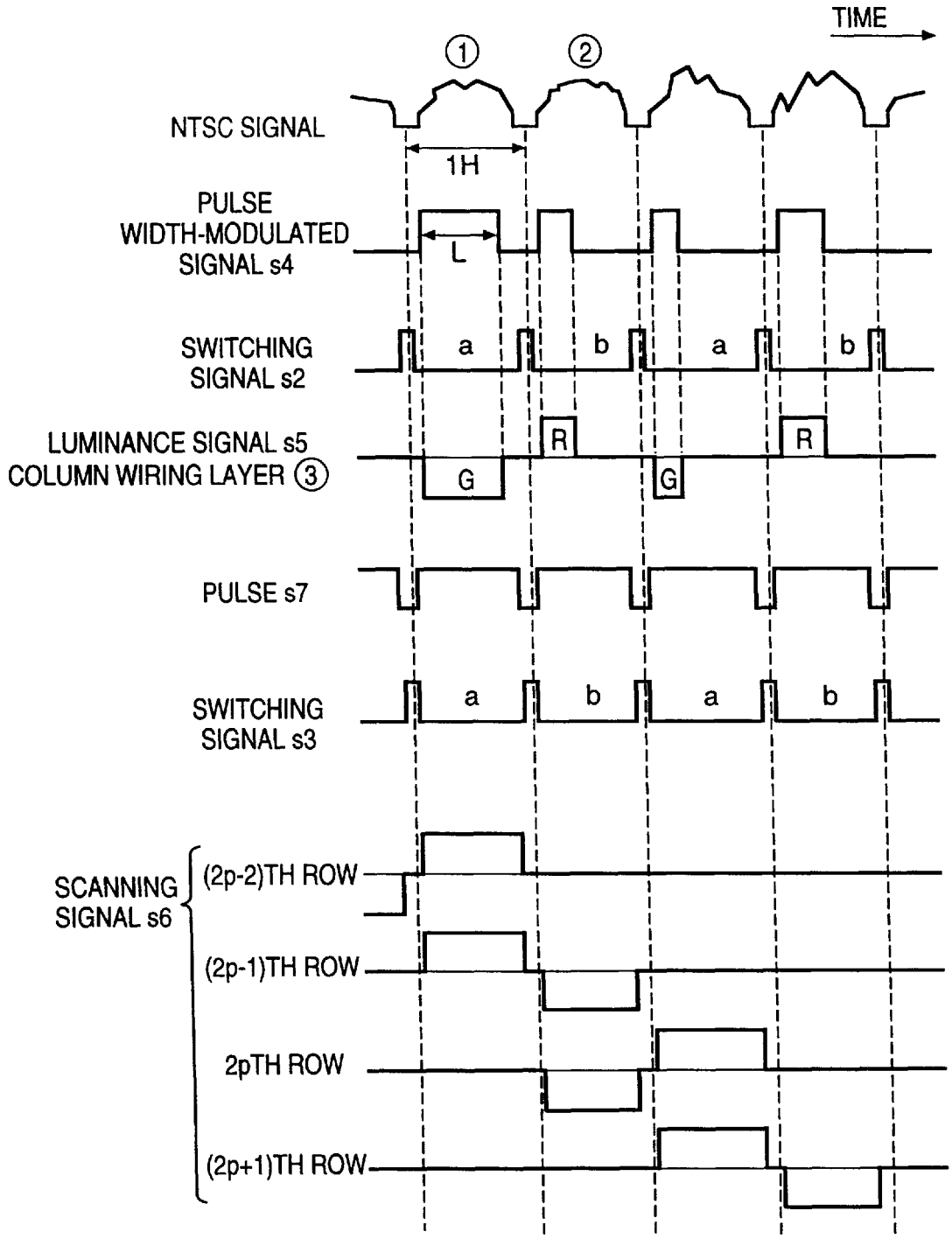
FIG. 62 is a timing chart in the 24th embodiment.

In the 24th embodiment, the same display panel as that in the 23rd embodiment is used, and the devices on two rows are used simultaneously to irradiate electrons on the phosphors on one row. FIG. 61 is a plan view showing the positions of phosphors and a multi-electron beam source in this embodiment. The same reference numerals in FIG. 61 denote the same parts as described above. In this embodiment, when phosphors 24 on ((2*p*−1)th) row are to be caused to emit light, electrons from devices 51 on an even ((2*p*−2)th) row and an odd ((2*p*−1)th) row are irradiated on the phosphors 24. The phosphors 24 on the other row are caused to emit light in the same manner as described above. FIG. 62 is a timing chart for a column wiring layer 54 indicated by "③" in FIG. 61 in the embodiment. This timing chart is almost the same as that of FIG. 60 described in the 23rd embodiment except that different colors are assigned to a luminance signal s5, and scanning signals s6 are used as pulses for simultaneously scanning two adjacent rows. More specifically, in the first 1 H interval indicated by "①" in FIG. 62, a negative G luminance signal s5 is supplied to the column wiring layer ③ in FIG. 61, and positive scanning signals s6 are supplied to the (2*p*−2)th and (2*p*−1)th row wiring layers. In this case, as shown in FIG. 61, the device 51 connected to the column wiring layer ③ and the (2*p*−2)th row wiring layer emits electrons from an electron-emitting portion 53 to the lower left direction, and the device 51 connected to the column wiring layer ③ and the (2*p*−1)th row wiring layer emits electrons from the electron-emitting portion 53 to the upper left direction. In this manner, both the devices irradiate the G phosphor on the odd ((2*p*−1)th) row with the electrons simultaneously.

In the second 1 H interval indicated by "②" in FIG. 62, as shown in FIG. 61, a positive R luminance signal s5 is supplied to the column wiring layer ③, and negative scanning signals s6 are supplied to the (2*p*−1)th and 2*pth* row wiring layers. In this case, as shown in FIG. 61, the device 51 connected to the column wiring layer ③ and the (2*p*−1)th row wiring layer emits electrons from the electron-emitting portion 53 to the lower right direction, and the device 51 connected to the column wiring layer ③ and the 2*pth* row wiring layer emits electrons from the electron-emitting portion 53 to the upper right direction. In this manner, both the devices irradiate the R phosphor on the even (2*pth* ) row with the electrons simultaneously. The (2*p*+1)th row wiring layer and the subsequent row wiring layers are scanned in the same manner as described above. In this embodiment, since the electron-emitting devices on two rows are used to irradiate electrons onto the phosphors on one row, a bright display operation can be performed.

Twenty-fifth Embodiment

Figure 63:
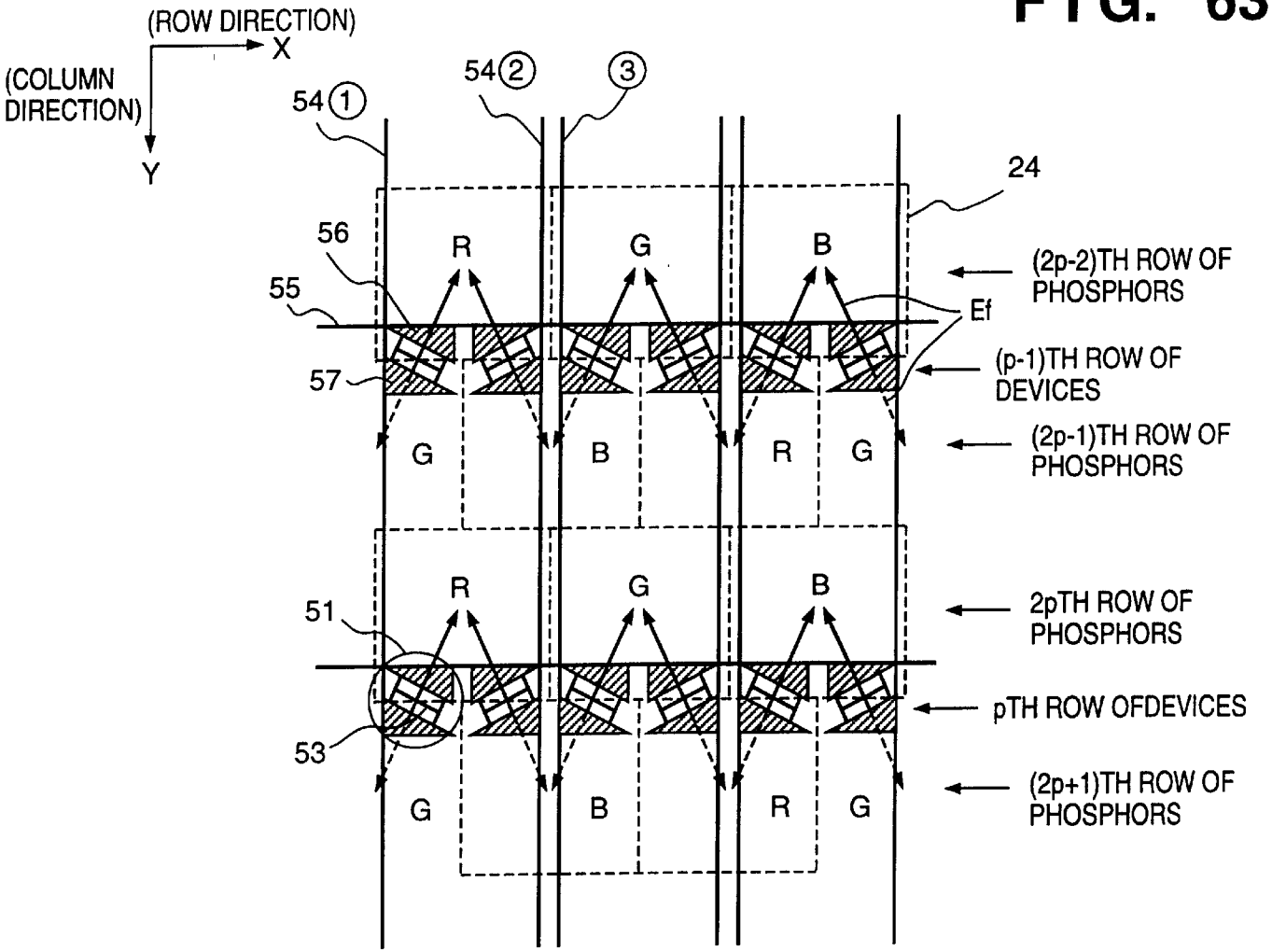
FIG. 63 is a plan view showing the positions of phosphors and a multi-electron beam source in the 25th embodiment of the present invention.

In the 25th embodiment, surface-conduction type electron-emitting devices are used as electron-emitting devices, and the devices are caused to emit electrons obliquely to the row direction, thereby realizing a delta arrangement display device. FIG. 63 is a plan view showing phosphors and a multi-electron beam source in this embodiment. As shown in FIG. 63, in this embodiment, the devices on odd and even columns are symmetrical about a plane parallel to the longitudinal axis of each column wiring layer and perpendicular to a plane of the multi-electron beam source. In addition, the electron-emitting portions of the devices are set obliquely. In the embodiment, the devices on two columns are used to irradiate electrons onto the phosphors on one column, and the ratio of the number of devices to that of phosphors is almost 1:1. This ratio is set to be almost 1:1 because phosphors larger in number than devices are required at the end portions of the display panel 12. For this reason, the number of column wiring layers 54 of the multi-electron beam source is almost twice that of phosphors in the horizontal direction, and the number of row wiring layers 55 is almost half that of phosphors in the vertical direction. In the embodiment, as shown in FIG. 63, phosphors 24 on an even (2*pth* ) row are irradiated with electrons emitted from the devices on the pth row along the electron orbits Ef indicated by the solid lines. The phosphors on an odd ((2*p*+1)th) row are irradiated with electrons emitted from the devices on the pth row along the electron obits Ef indicated by the dotted lines. A line having as the start point the center of the electron-emitting portion 53 of the device 51 and perpendicular to a plane of the multi-electron beam source crosses the middle point of a straight line connecting the centers of the adjacent rows of phosphors 24 at a right angle. In the embodiment as well, the angles defined by the directions of electric fields applied to the devices 51 and the row wiring layers 55 are not zero (±60° in this case).

Figure 64:
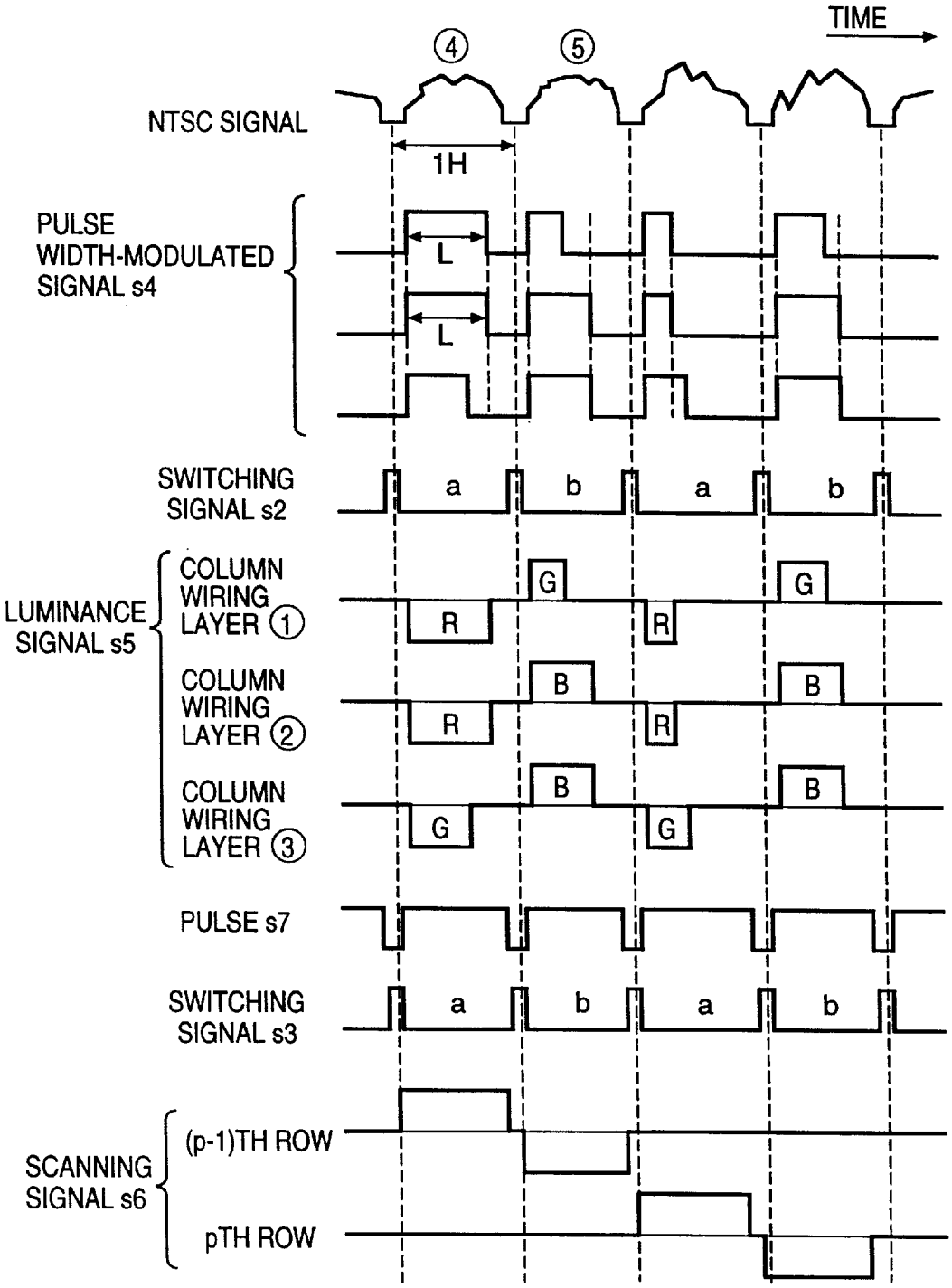
FIG. 64 is a timing chart in the 25th embodiment.

A driving circuit in this embodiment is almost the same as that shown in FIG. 3 described in the first embodiment except that a signal processing unit 1 switches brightness colors of different colors to be supplied to the column wiring layers 54, and luminance signals of the same color are supplied to the adjacent column wiring layers 54. FIG. 64 is a timing chart for column wiring layers ①, ②, and ③ in FIG. 63 in this embodiment. In a 1 H interval indicated by "④" in FIG. 64, when a positive scanning signal s6 is supplied to the (p−1)th row wiring layer, negative luminance signals s5 of the same color (R) are output to the column wiring layers ① and ②, and a negative luminance signal s5 of a difference color (G) is supplied to the column wiring layer ③. In this case, as shown in FIG. 63, devices 51 connected to the column wiring layers ① and ② and the (p−1)th row wiring layer emit electrons to the upper right and the upper left directions, respectively, to irradiate the electrons onto the same phosphor (R) on the (2*p*−2)th row. At the same time, the device 51 connected to the column wiring layer ③ and the (p−1)th row wiring layer emits electrons to the upper right to irradiate the electrons onto the phosphor (G) on the (2*p*−2)th row. In a 1 H interval indicated by "⑤" in FIG. 64, when a negative scanning signal s6 is supplied to the pth row wiring layer, a positive G luminance signal S5 is supplied to the column wiring layer ①, and positive luminance signals s5 of the same color (B) are supplied to the column wiring layers ② and ③. In this case, the device 51 connected to the column wiring layer ① and the pth row wiring layer emits electrons to the lower left as indicated by the dotted line (FIG. 63) to irradiate the electrons onto the phosphor (G) on the (2*p*−1)th row.

At the same time, the devices 51 connected to the column wiring layers ② and ③ and the pth row wiring layer emit electrons to the lower right and the lower left direction, respectively, as indicated by the dotted lines in FIG. 63, to irradiate the electrons to the same phosphor (B) on the (2*p*−1)th row. The (p+1)th row wiring layer and the subsequent row wiring layers are scanned in the same manner. In the embodiment, since the devices on two rows are used to irradiate electrons onto the phosphors on one row, a bright display operation can be performed.

Twenty-sixth Embodiment

Figure 65:
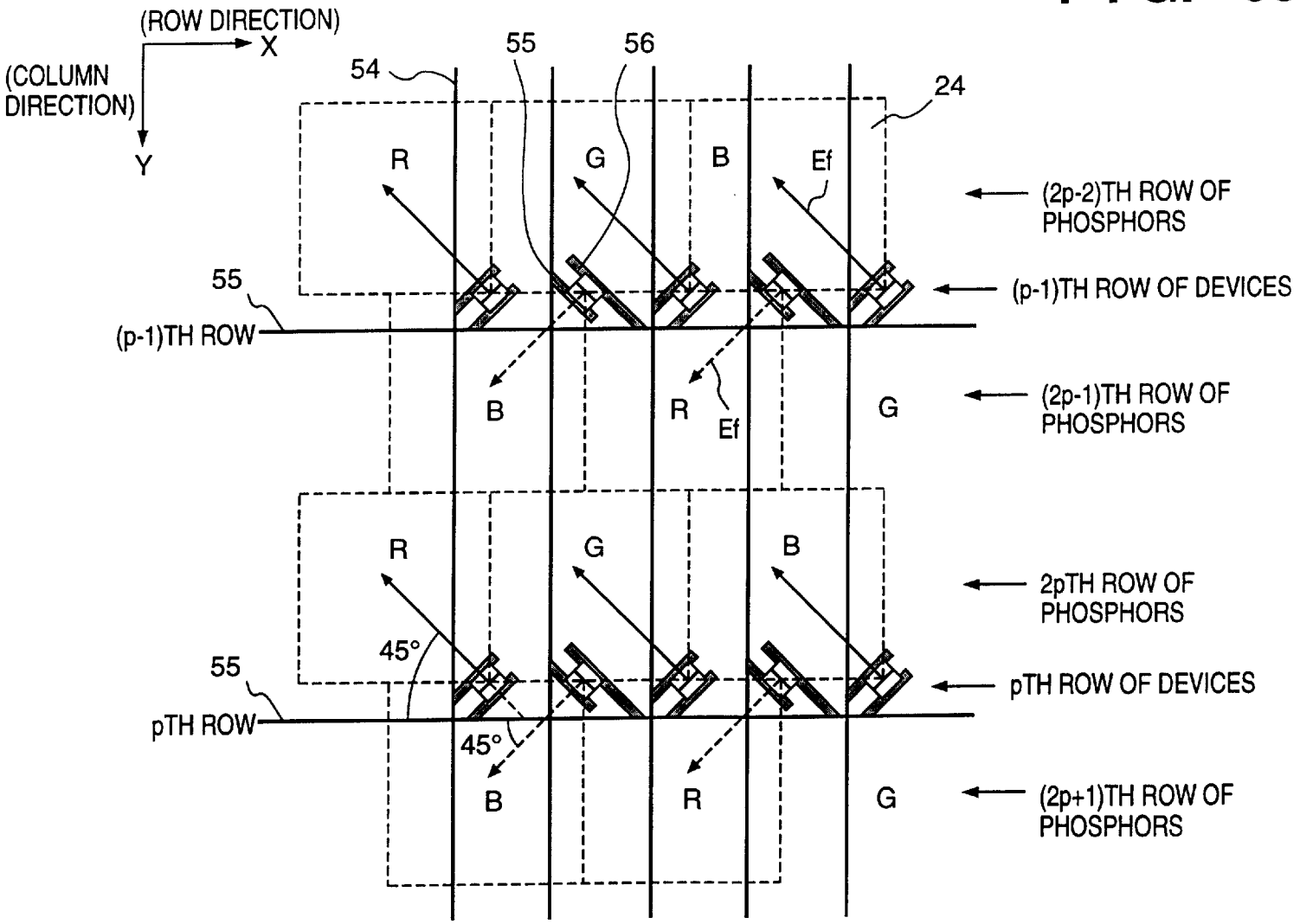
FIG. 65 is a plan view showing the positions of phosphors and a multi-electron beam source in the 26th embodiment of the present invention.

In the 26th embodiment, surface-conduction type electron-emitting devices are used as electron-emitting devices, and all the devices are caused to emit electrons obliquely to the row direction, thereby realizing a delta arrangement display apparatus. FIG. 65 is a plan view showing phosphors and a multi-electron beam source in this embodiment. Similar to the 25th embodiment, the number of phosphors in the vertical direction is almost twice that of row wiring layers, and the number of phosphors in the horizontal direction is almost ½ that of column wiring layers 54 of the multi-electron beam source. Phosphors 24 on an even (2*pth* ) row are irradiated with electrons emitted from devices on the pth row along the electron orbits Ef indicated by the solid lines, and the phosphors on an odd ((2*p*+1)th) row are irradiated with electrons emitted from devices on the pth row along the electron orbits Ef indicated by the dotted lines. As shown in FIG. 65, each device 51 is located below a point where phosphors of three colors in a delta arrangement are in contact with each other such that electrons are emitted at an angle of ±45° with respect to the row direction. The arrangement of these devices is not limited to this. For example, each device 51 may be arranged such that a line having as the start point the center of an electron-emitting portion 53 and perpendicular to a plane of the multi-electron beam source crosses a straight line connecting the centers of phosphors 24 on adjacent rows at a right angle.

A block diagram of a driving circuit in this embodiment is the same as that of FIG. 18 described in the seventh embodiment. A timing chart in the embodiment is also the same as that of FIG. 19 described in the seventh embodiment except that the polarities of all the signals are opposite to those in FIG. 19. That is, if positive luminance signals are always supplied to the column wiring layers 54, and negative scanning signals are supplied to the row wiring layers 55, electrons are emitted along the electron orbits indicated by the solid and dotted lines in FIG. 65, thereby irradiating a delta arrangement phosphors. In modified embodiment, electrons may be emitted from the devices 51 in the directions set by rotating the solid lines through 90° clockwise, and rotating the dotted lines through 90° counterclockwise. In this case, a timing chart identical to FIG. 19 is used. In any case, in this embodiment, a simple driving circuit can be used. In addition, since one picture element constituted by R, G, and B pixels in a delta arrangement can be realized as a triangular form, an ideal delta arrangement can be realized. Furthermore, in manufacturing an wide screen TV set having an aspect ratio of 9:16, since not many phosphors need to be stacked in the lateral direction, the manufacturing process is facilitated. In this embodiment, since the polarity of driving signal applied to the electron emitting device is not alter, the devices can be replaced with lateral FE type electron-emitting devices.

Twenty-seventh Embodiment

Figure 66:
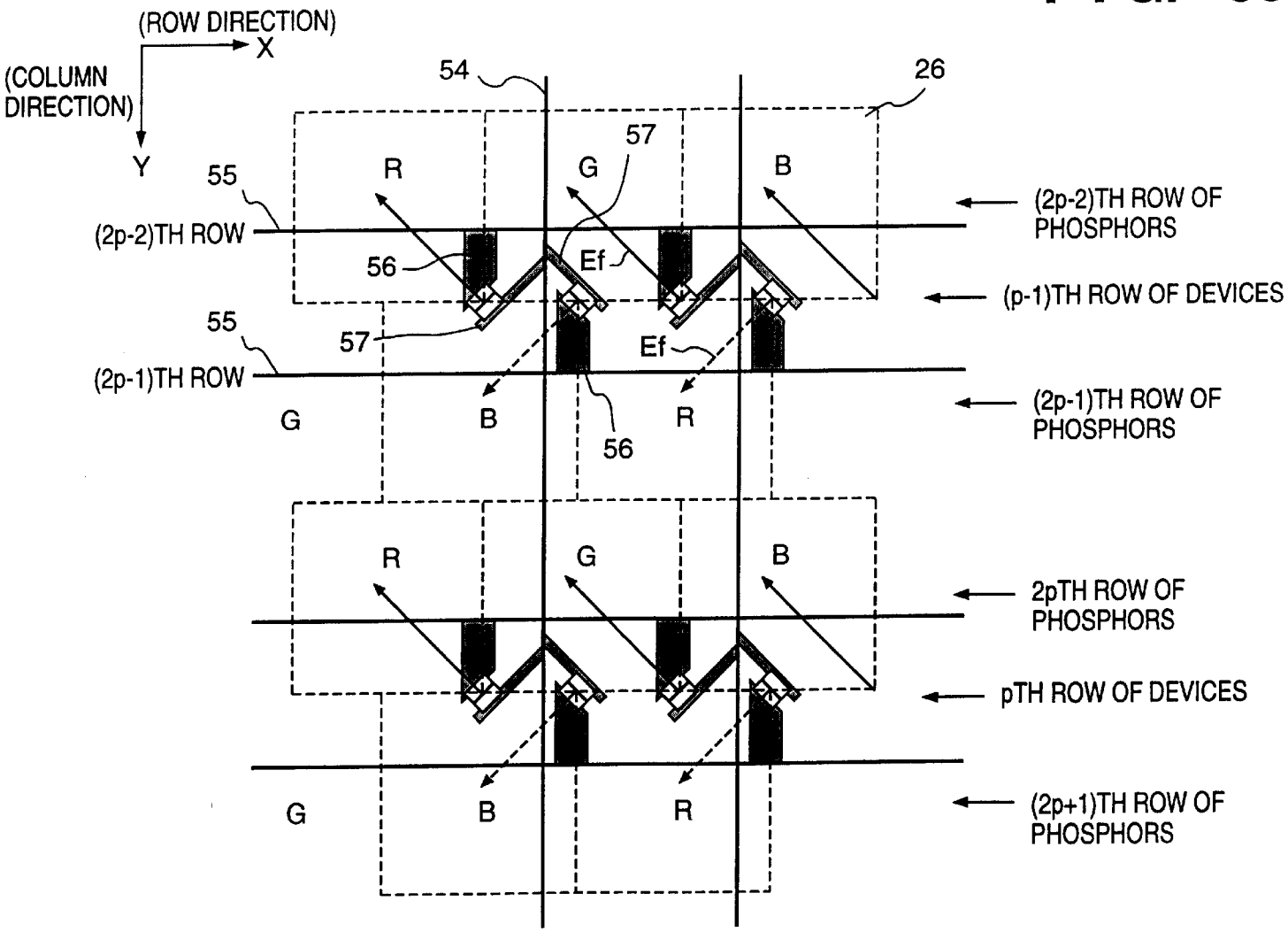
FIG. 66 is a plan view showing the positions of phosphors and a multi-electron beam source in the 27th embodiment of the present invention.

In the 27th embodiment, surface-conduction type electron-emitting devices are used as electron-emitting devices, and all the devices are caused to emit electrons obliquely to the row direction, thereby realizing a delta arrangement. FIG. 66 is a plan view showing phosphors and a multi-electron beam source in this embodiment. Similar to the 26th embodiment, each device 51 is located below a point where phosphors of three colors in a delta arrangement are in contact with each other such that electrons are emitted at an angle of ±45° with respect to the row direction. In this arrangement, similar to the 26th embodiment, each device 51 may be arranged such that a line having as the start point the center of an electron-emitting portion 53 and perpendicular to the plane of the multi-electron beam source crosses a straight line connecting the centers of phosphors 24 on adjacent rows at a right angle. In the 27th embodiment, the numbers of phosphors in the vertical and horizontal directions are respectively equal to the numbers of row and column wiring layers 55, 54 of the multi-electron beam source. A block diagram of a driving circuit in this embodiment is the same as that of FIG. 23 described in the ninth embodiment. In this embodiment, since luminance signals of different colors to be supplied to each column wiring layer are switched depending on whether an odd row is scanned (electrons propagate along the electron orbit indicated by each dotted line) or an even row is scanned (electrons propagate along the electron orbit indicated by each solid line), a circuit like a data array converter 27 is required. A timing chart in this embodiment is the same as that of FIG. 19 described in the seventh embodiment. That is, a positive scanning signal s6 is always supplied to each row wiring layer, and a negative luminance signal s4 is always supplied to each column wiring layer. In the embodiment, since the polarity of driving signal applied to the electron-emitting device is not alter, the devices can be replaced with lateral FE type electron-emitting devices.

Twenty-eighth Embodiment

Figure 67:
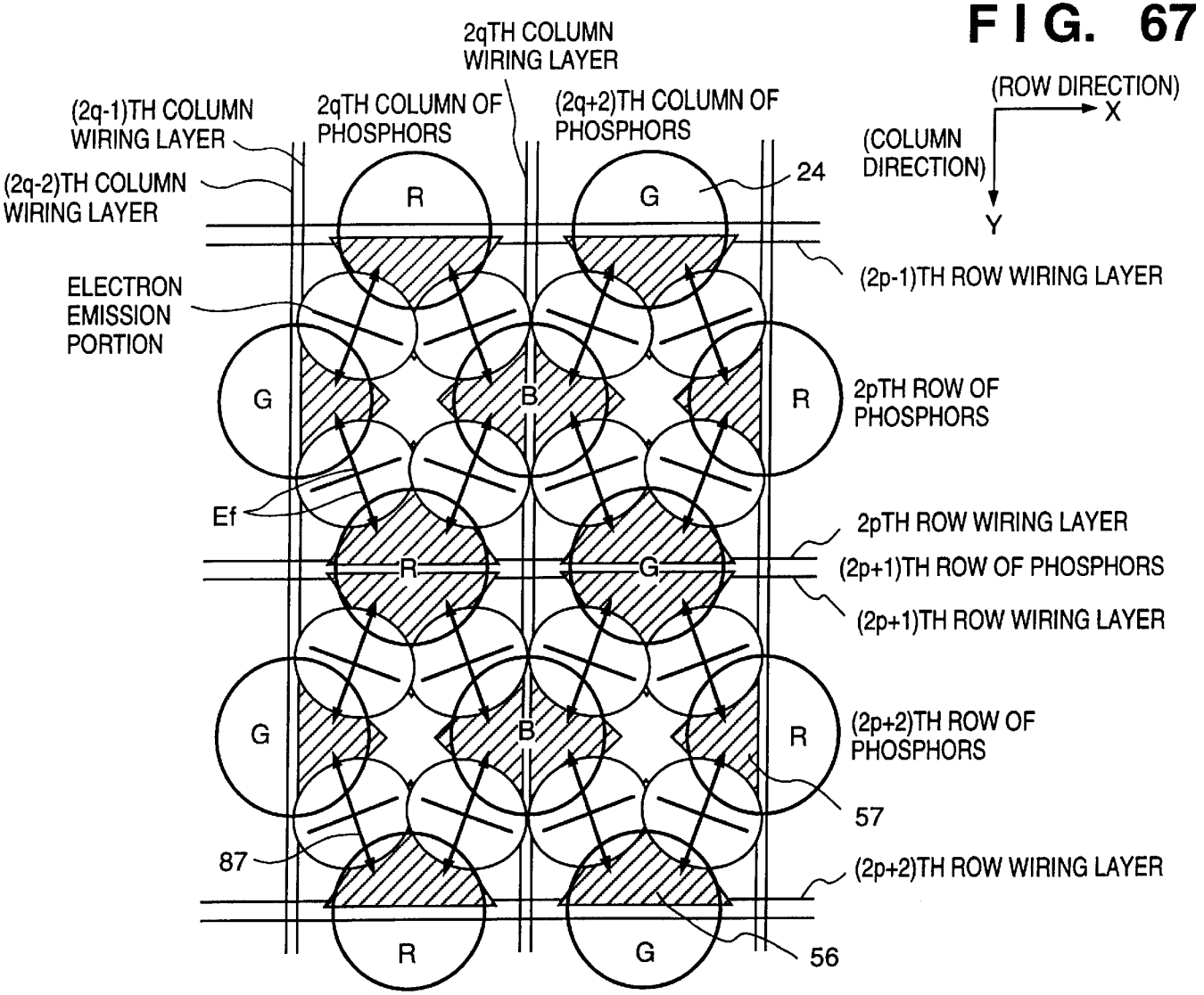
FIG. 67 is a plan view showing the positions of phosphors and a multi-electron beam source in the 28th and 29th embodiments of the present invention.

In the 28th embodiment, four devices (two rows×two columns) are used to irradiate electrons onto one phosphor to realize a display operated based on a delta arrangement, and surface-conduction type electron-emitting devices are used as electron-emitting devices. FIG. 67 is a plan view showing phosphors and a multi-electron beam source. In this embodiment, an R phosphor on the (2*p*+1)th row and the 2*qth* column is irradiated with electrons from the device connected to the 2*pth* row wiring layer and the 2*qth* column wiring layer, the device connected to the (2*p*+1)th row wiring layer and the 2*qth* column wiring layer, the device connected to the 2*pth* row wiring layer and the (2*q*−1)th column wiring layer, and the device connected to the (2*p*+1)th row wiring layer and the (2*q*−1)th column wiring layer. Similarly, each of the remaining phosphors is irradiated with electrons from four devices. For this reason, the number of column wiring layers of the multi-electron beam source is almost twice that of phosphors 24 in the horizontal direction, and the number of row wiring layers 55 is almost equal to that of phosphors in the vertical direction. The word "almost" used here indicates that the numbers of row wiring layers 55 and column wiring layers 54 increase because devices 51 must be additionally arranged to match the brightness of each of the phosphors 24 at the end portions with that of each of the phosphors inside the multi-electron beam source. These phosphors are preferably positioned at an angle of ±60° with respect to the row direction, but may be positioned at an angle of ±45°.

A driving circuit in this embodiment is almost the same as that in FIG. 3 described in the first embodiment except that a signal processing unit 1 switches luminance signals of different colors, and a scanning circuit 7 outputs scanning pulses to the row wiring layers 55, with an offset corresponding to one row, for every two rows at 1 H intervals.

Figure 68:
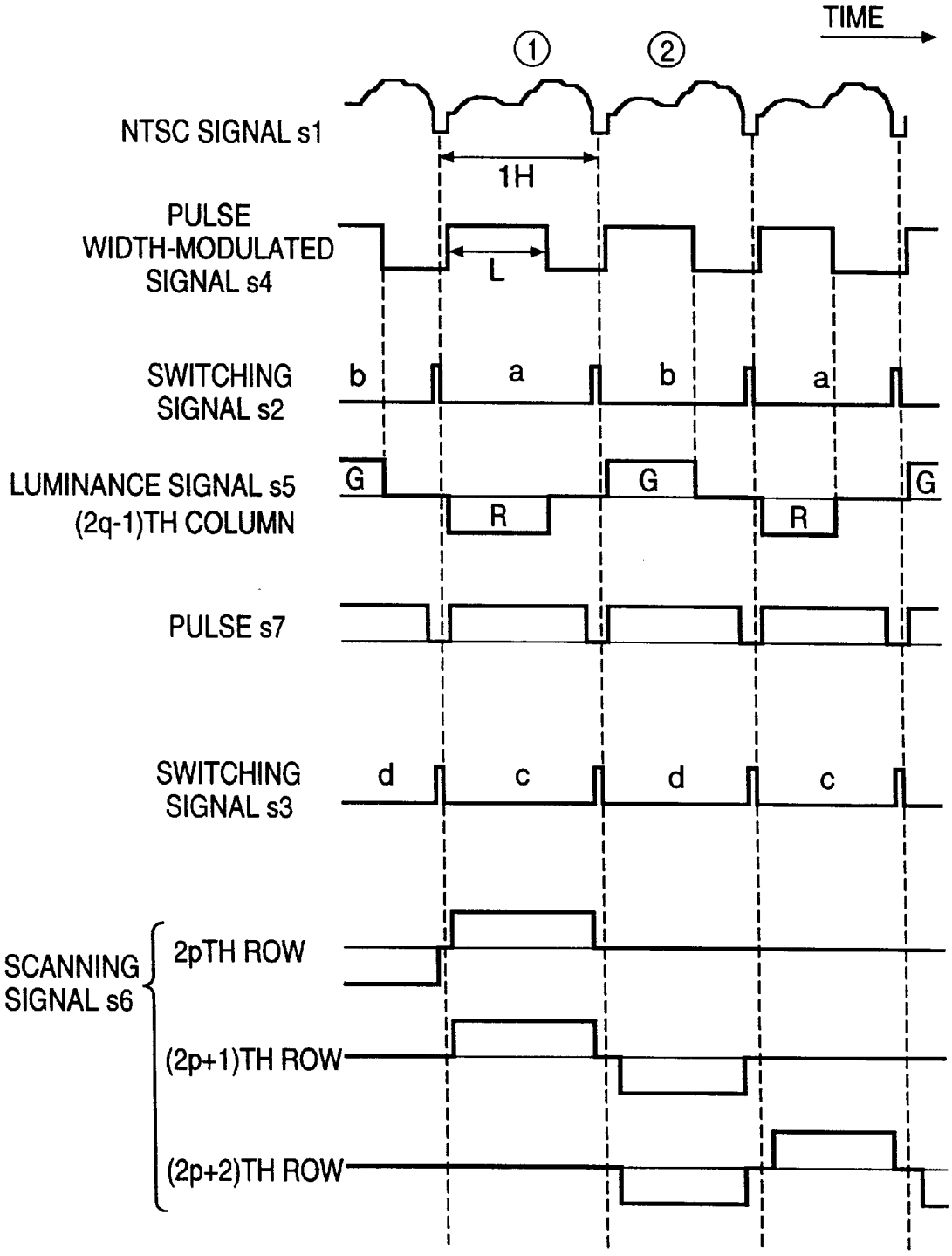
FIG. 68 is a timing chart in the 28th embodiment.

FIG. 68 is a timing chart for the (2*q*−1)th column wiring layer 54 in this embodiment. In the embodiment, a non-interlaced scanning operation is performed. With the same driving operation as that in the first embodiment, a luminance signal s5 whose polarities are switched at 1 H intervals is supplied to the (2*q*−1)th column wiring layer 54. The scanning circuit 7 simultaneously supplies scanning signals s6, which are offset from each other by one row and have polarities switched at 1 H intervals, to the row wiring layers 55. For example, in a 1 H interval indicated by "①" in FIG. 68, a negative R luminance signal s5 is supplied to the (2*q*−1)th column wiring layer 54, and positive scanning signals s6 are supplied to the 2*pth* and (2*p*+1)th row wiring layers. In this case, although not shown, a negative R luminance signal s5 is also supplied to the 2*qth* column wiring layer 54. As a result, electrons emitted from the four devices 51 connected to the 2*pth* and (2*p*+1)th row wiring layers and the (2*q*−1)th and 2*qth* column wiring layers are irradiated on the R phosphor on the (2*p*+1)th row. In a 1 H interval indicated by "②" in FIG. 68, a positive G luminance signal s5 is supplied to the (2*q*−1)th column wiring layer 54, and a negative scanning signal s6 is supplied to the (2*p*+1)th and (2*p*+2)th row wiring layers. In this case, although not shown, a positive B luminance signal s5 is also supplied to the 2*qth* column wiring layer. As a result, electrons emitted from the two devices 51 connected to the (2*q*−1)th column wiring layer and the (2*p*+1), (2*p*+2)th row wiring layers are irradiated onto the G phosphor on the (2*p*+2)th row (2*q*−1)th column, and electrons emitted from the two devices 51 connected to the (2*q*)th column wiring layer and the (2*p*+1)th and (2*p*+2)th row wiring layers are irradiated on the B phosphor on the (2*p*+2)th row (2*q*+1)th column. In this embodiment, since four devices are used to irradiate electrons simultaneously onto one phosphor, a bright display operation can be performed.

Twenty-ninth Embodiment

Figure 69:
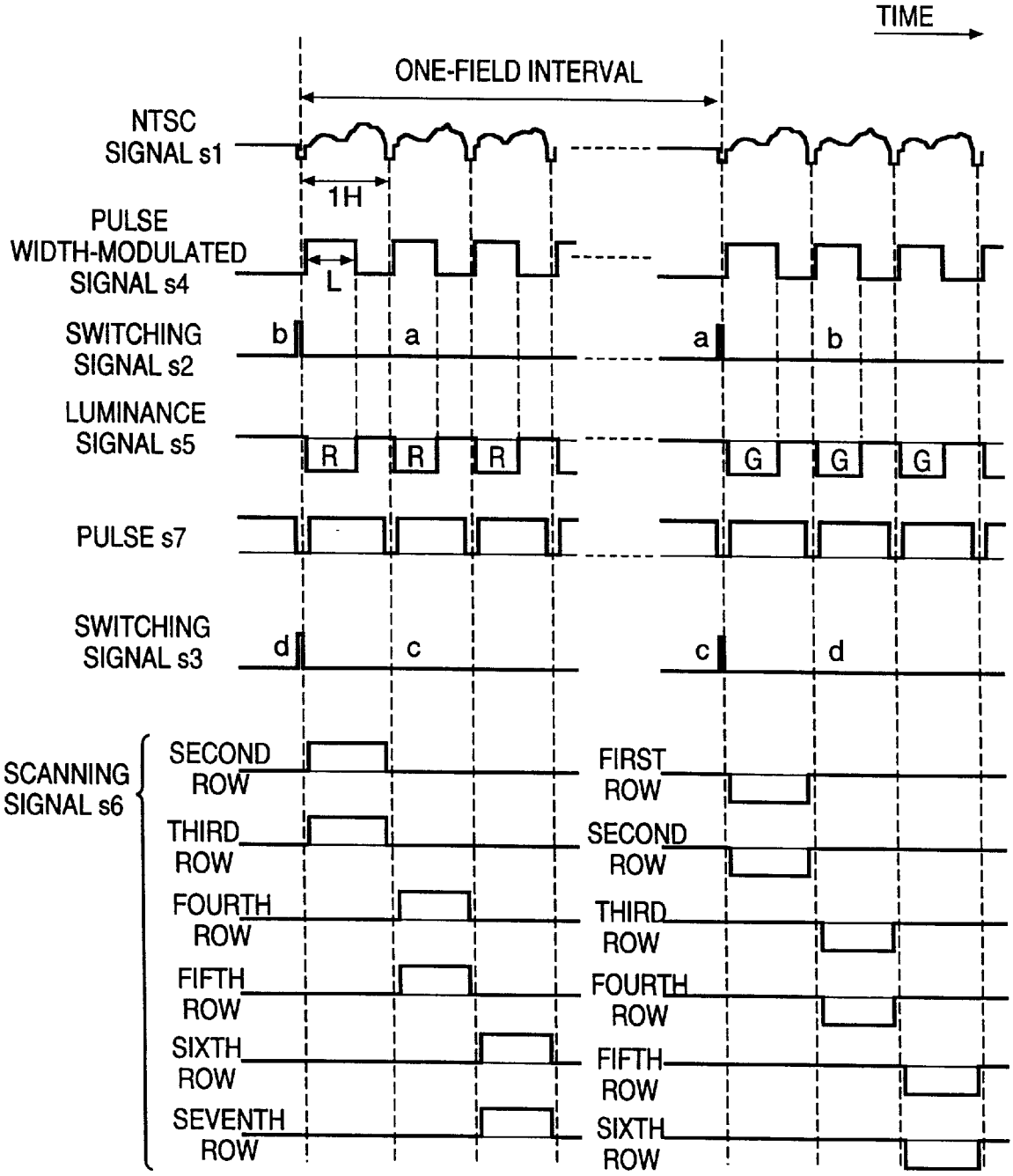
FIG. 69 is a timing chart in the 29th embodiment of the present invention.
Figure 70:
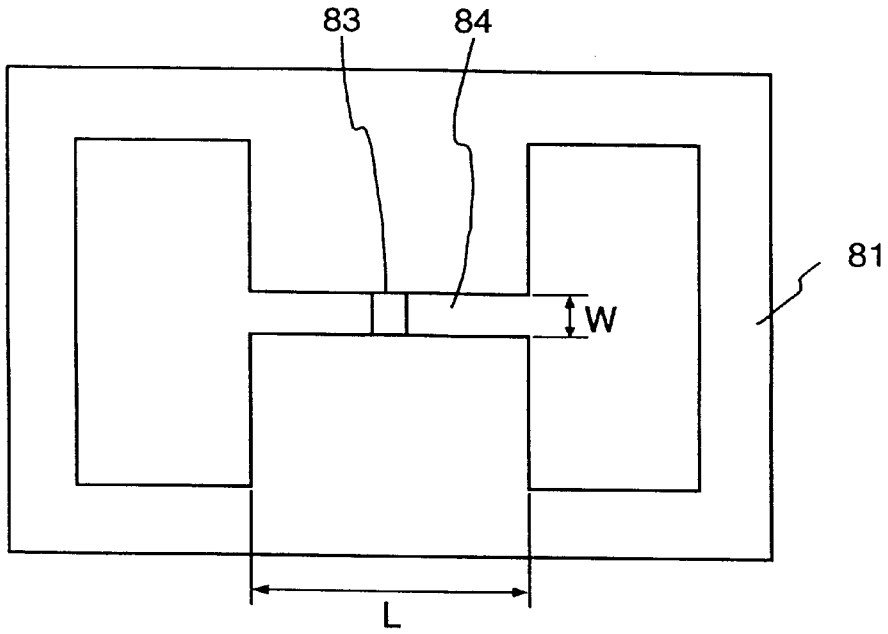
FIG. 70 is a plan view showing a surface-conduction type electron-emitting device disclosed by Hartwell et al.
Figure 71:
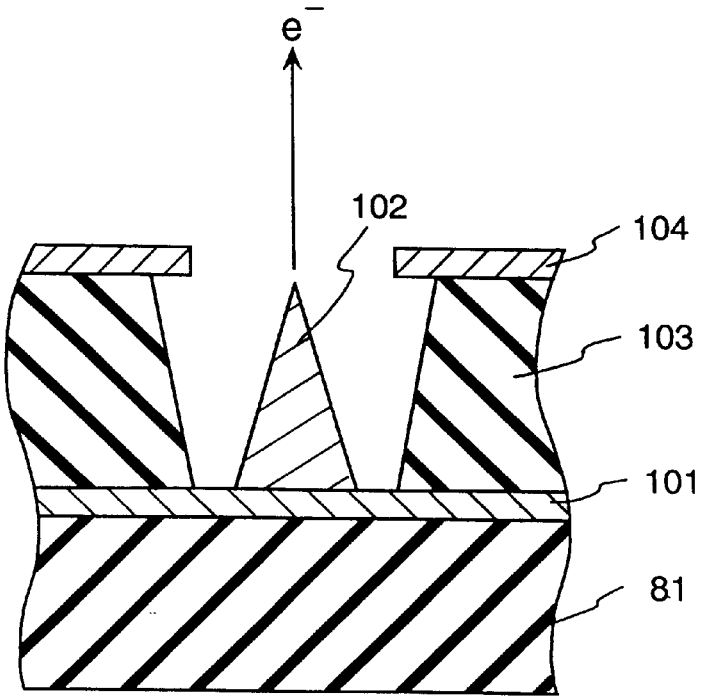
FIG. 71 is a sectional view showing an EF type electron-emitting device.
Figure 72:
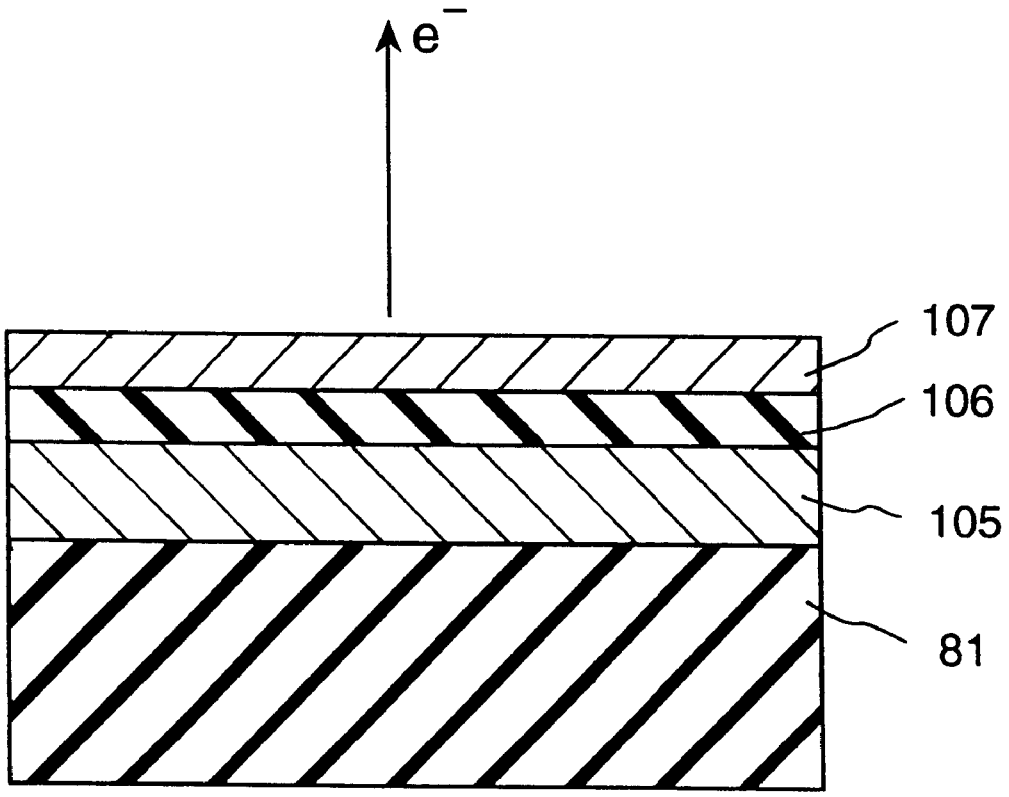
FIG. 72 is a sectional view showing an MIM type electron-emitting device.
Figure 73A:
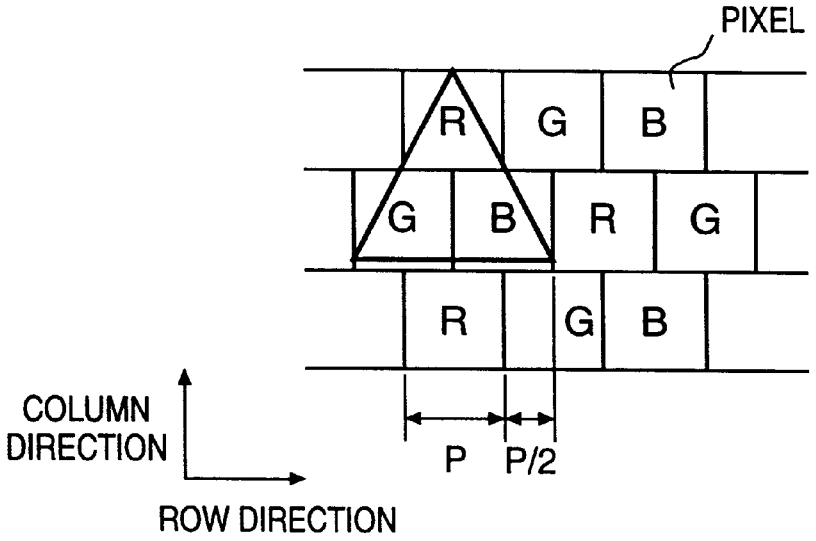
FIG. 73A (PRIOR ART)
FIGS. 73A and 73B are plan views respectively showing a delta arrangement and a corresponding conventional wiring pattern.
Figure 73B:
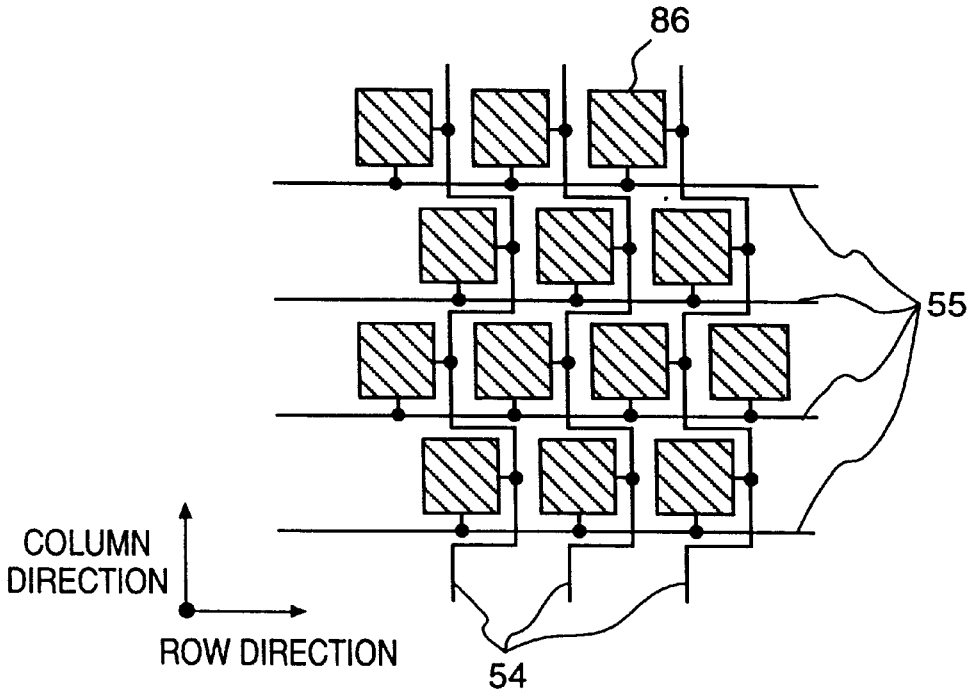
FIG. 73B (PRIOR ART)
Figure 74A:
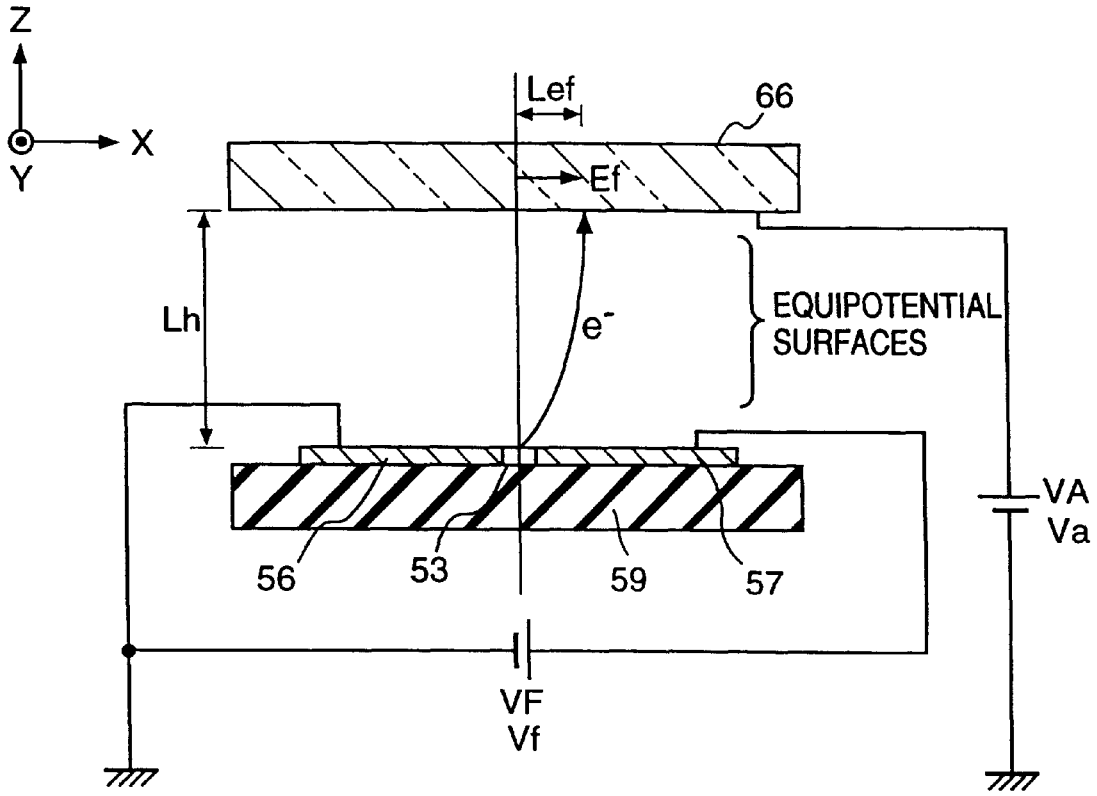
FIGS. 74A and 74B are a sectional view and a plan view showing a device having a potential distribution which is asymmetrical near an electron-emitting portion.
Figure 74B:
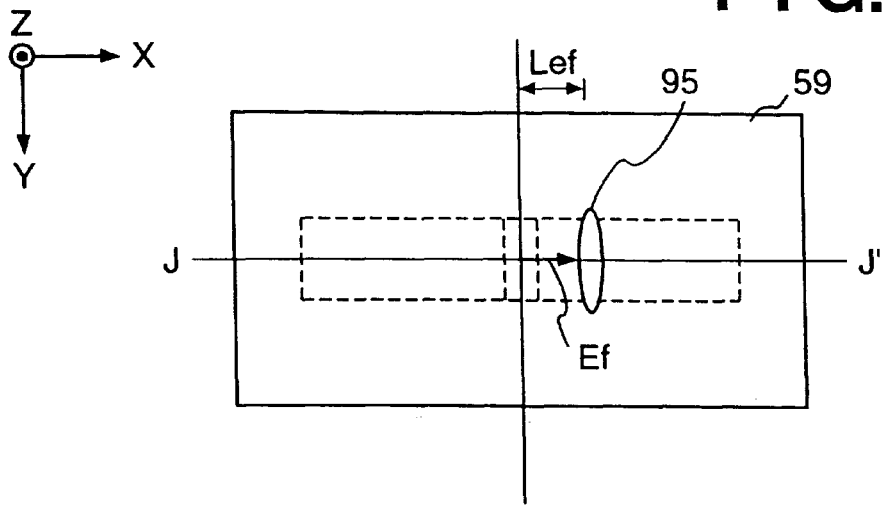
Figure 75A:
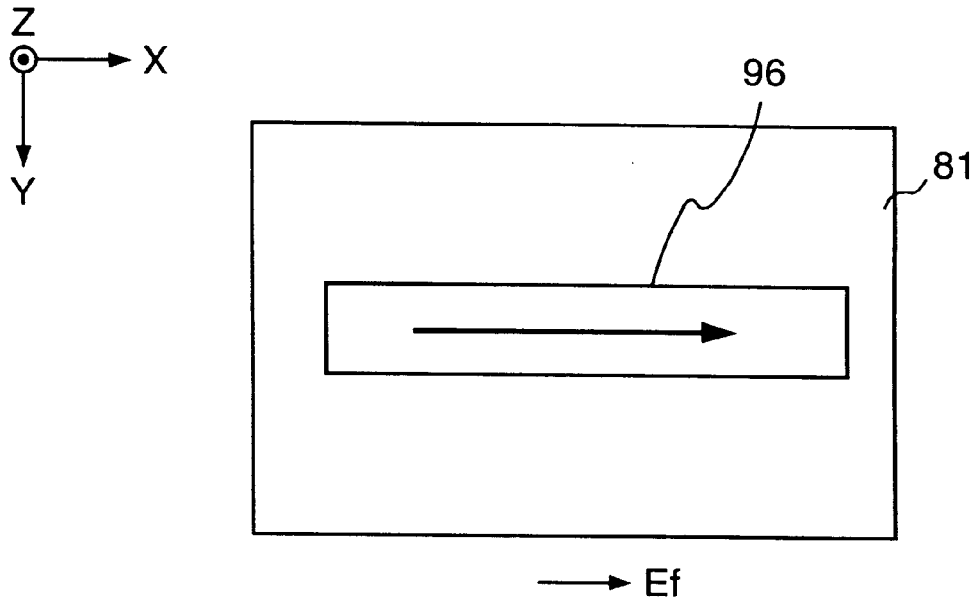
FIGS. 75A and 75B are plan views showing the electron orbits of electrons emitted from electron-emitting devices.
Figure 75B:
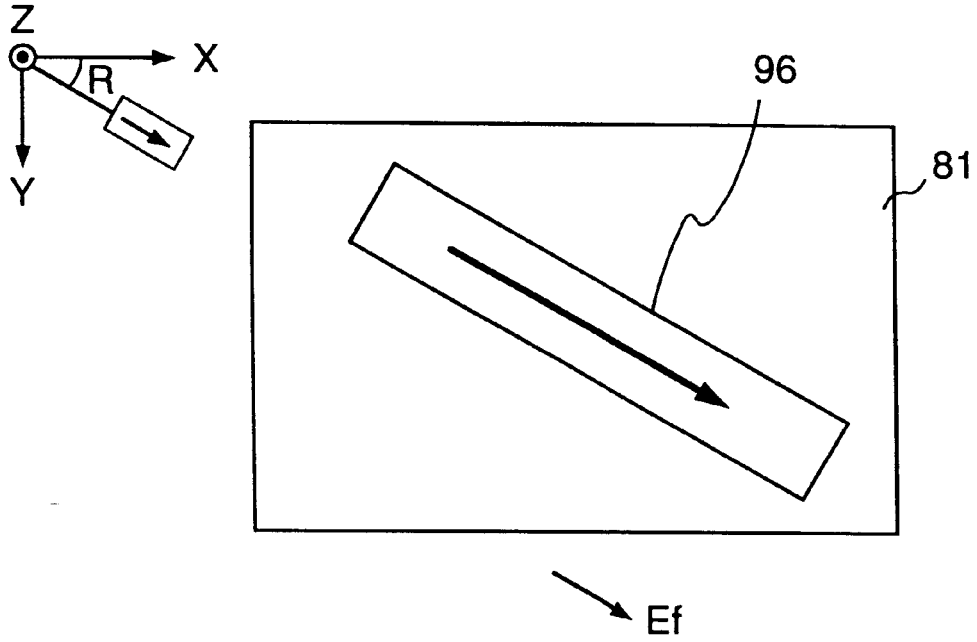
Figure 76A:
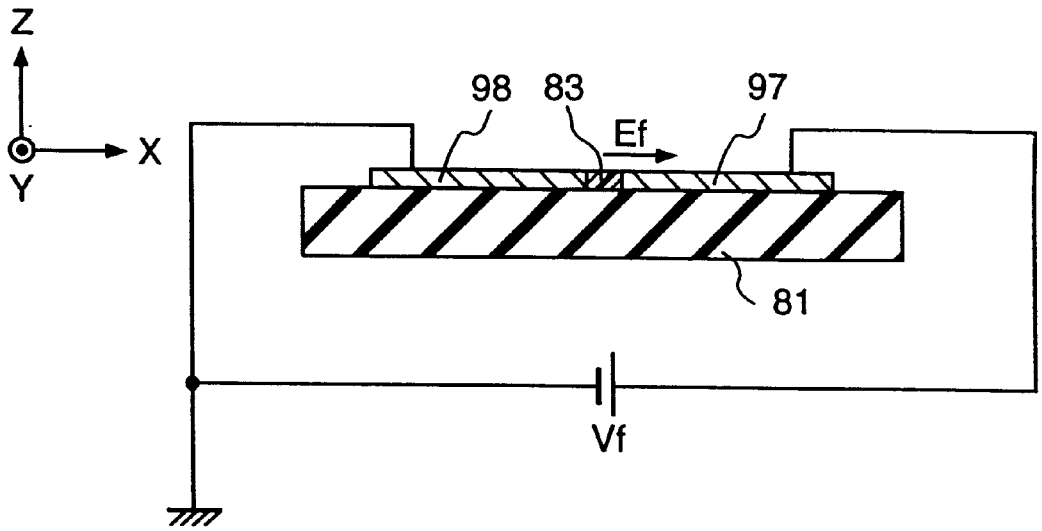
FIGS. 76A and 76B are a plan view and a sectional view, respectively, showing how a voltage is applied to a surface-conduction type electron-emitting device.
Figure 76B:
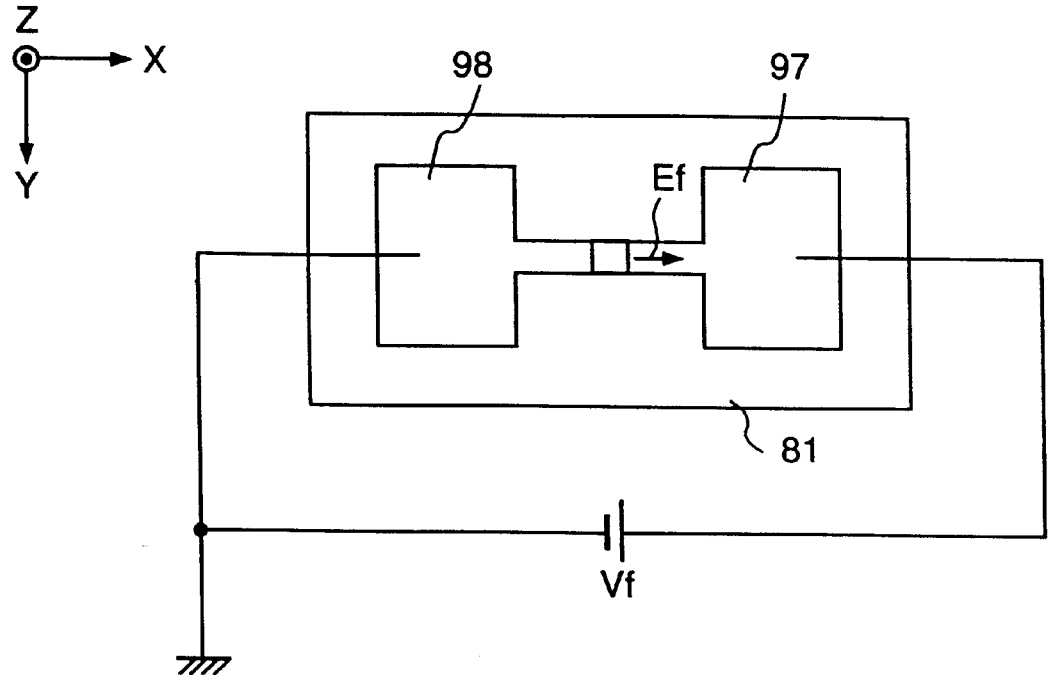
Figure 77A:
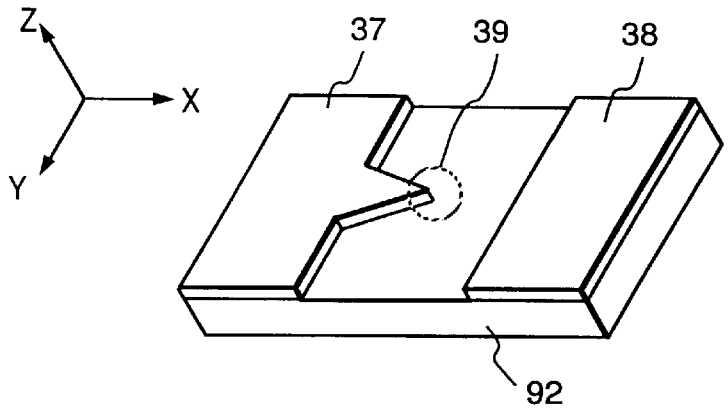
FIGS. 77A to 77C are perspective views showing lateral field emission type electron-emitting devices.
Figure 77B:
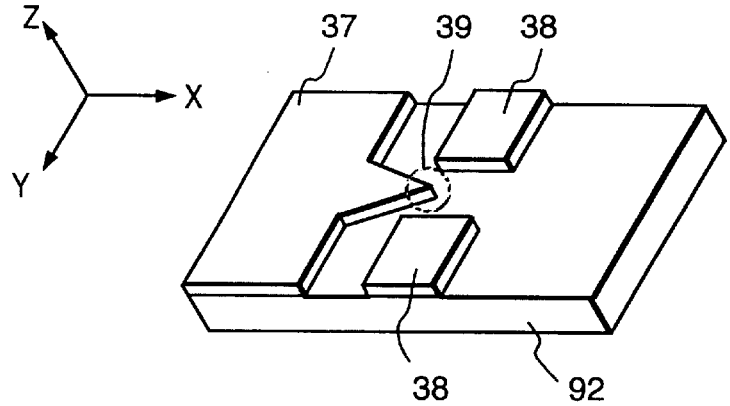
Figure 77C:
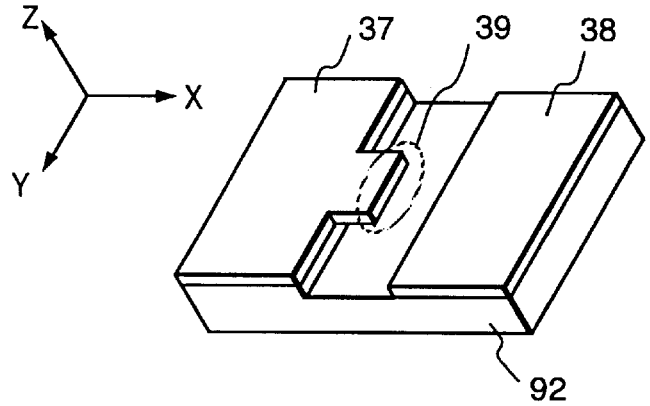
Figure 78A:
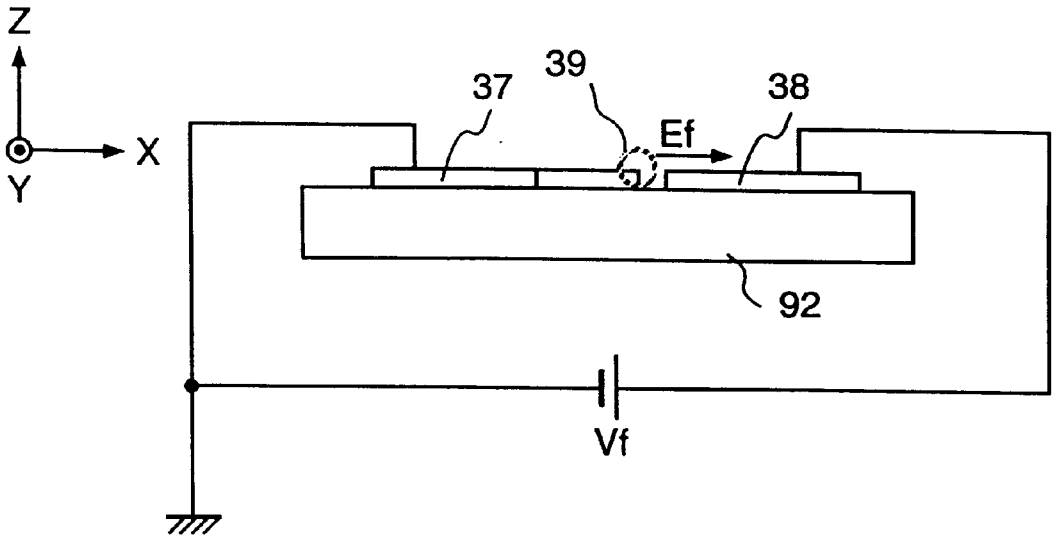
FIGS. 78A and 78B are a sectional view and a plan view, respectively, showing how a voltage is applied to a lateral field emission type electron-emitting device.
Figure 78B:
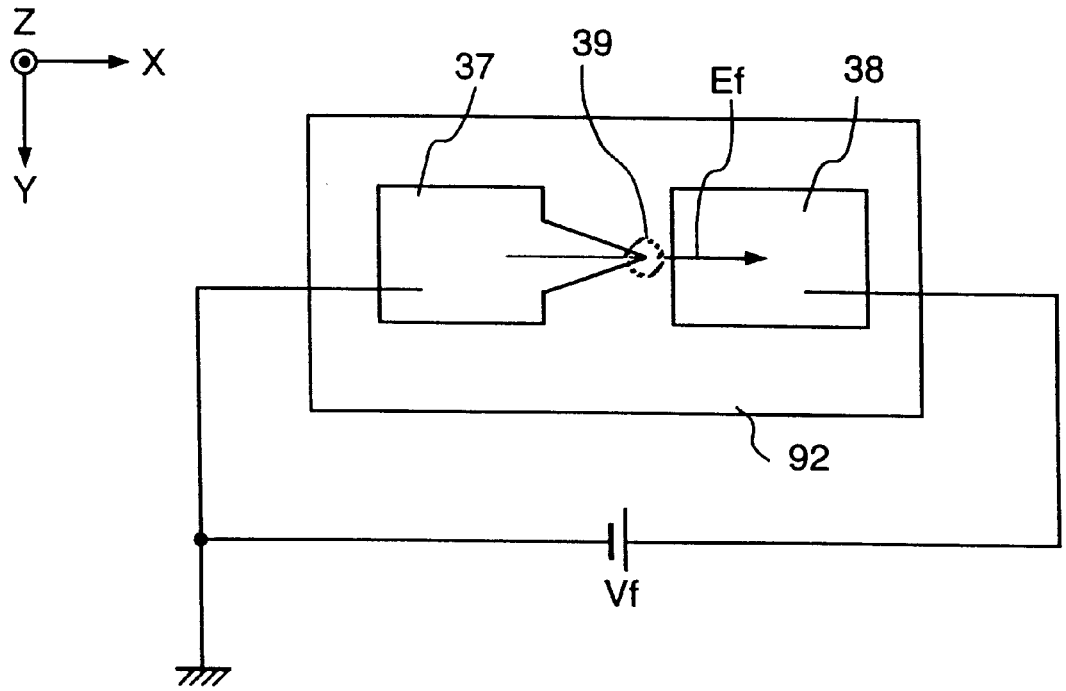

In the 29th embodiment, the apparatus of the 28th embodiment is operated in the interlaced scanning mode. The structures of phosphors and a multi-electron beam source constituting a display panel are therefore the same as those in FIG. 67 described in the 28th embodiment. A driving circuit in this embodiment is almost the same as that in the 28th embodiment except that a signal processing unit performs a color switching operation at one-field intervals in accordance with an interlaced scanning operation, and scanning signals s6 output from a scanning circuit 7 conform to the interlaced scanning mode. FIG. 69 is a timing chart in this embodiment. As shown in FIG. 69, scanning signals s6 are output for pairs of rows, and the pairs are switched in units of fields.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus comprising:

a multi-electron beam source having a plurality of electron-emitting devices wired in a matrix using a plurality of column wiring layers and a plurality of row wiring layers; and a plurality of phosphors which are excited to emit light upon irradiation of electron beams, wherein the column wiring layers and row wiring layers are linear, said plurality of phosphors are arranged in a plurality of rows, each position of the phosphors between adjacent rows is shifted in a row direction, and each of the rows is parallel to the row wiring layers, wherein an electron beam emitted to one of the phosphors from one of the electron-emitting devices is deflected in accordance with a relative distance between the one phosphor and the one electron-emitting device which emits the electron beam so that electron beams emitted therefrom reach said phosphors.

2. The apparatus according to claim 1, wherein a pulse width-modulated luminance signal is supplied to the column wiring layer, and a scanning signal is supplied to the row wiring layer to perform an image display operation.

3. The apparatus according to claim 2, wherein said plurality of electron-emitting devices are equal in number to intersections between the plurality of column wiring layers and the plurality of row wiring layers.

4. The apparatus according to claim 3, wherein each of said electron-emitting devices comprises a pair of electrodes and an electron-emitting portion arranged together on a substrate surface.

5. The apparatus according to claim 4, wherein the electron beam is deflected in a direction parallel to the rows of phosphors.

6. The apparatus according to claim 5, wherein said electron-emitting devices on odd and even rows are connected to the same column wiring layer in the same direction, and voltages having the same polarity are applied to said electron emitting devices.

7. The apparatus according to claim 6, wherein a position where the electron beam reaches is adjusted by changing a voltage of a luminance signal supplied to the column wiring layer depending on whether an odd or even row is to be scanned.

8. The apparatus according to claim 6, wherein a position where the electron beam reaches is adjusted by changing a voltage of a scanning signal depending on whether an odd or even row is to be scanned.

9. The apparatus according to claim 6, wherein a position where the electron beam reaches is adjusted by changing a voltage applied between said electron-emitting device and said phosphor depending on whether an odd or even row is to scanned.

10. The apparatus according to claim 6, further comprising means for correcting an intensity of light emitted from the phosphor by using a multiplier.

11. The apparatus according to claim 5, wherein a ratio of the number of electron-emitting portions to the number of phosphors is 1:1.

12. The apparatus according to claim 1, wherein each position of the phosphors between adjacent rows is shifted at a half pitch of adjacent phosphors in the row direction.

* * * * *

UNITED STATES PATENT AND TRADEMARK OFFICE

CERTIFICATE OF CORRECTION

PATENT NO. : 6,140,985
DATED : October 31, 2000
INVENTOR(S) : Izumi Kanai, et al.

It is certified that error appears in the above-identified patent and that said Letters Patent is hereby corrected as shown below:

Title page,
Item [30] FOREIGN APPLICATION PRIORITY DATA,
"Apr. 6, 1996" should read -- Jun. 4, 1996 --.

Item [56] REFERENCES CITED,
FOREIGN PATENT DOCUMENTS, "2257551" should read -- 2-257551 -- and "3-64046 10/1991 Japan" should be deleted.

Column 2,
Line 61, "73B (Japanese Patent Publication No." should read -- 73B. --
Line 62, "3-64046)." should be deleted.

Column 13,
Line 39, "IB-IB'." should read -- 1B-1B'. --.
Line 41, "IC-IC'," should read -- 1C-1C'. --.

Column 30,
Line 32, "Vnh" should read -- Vmh --.

Column 46,
Line 21, insert Claims 13, 14 and 15 as follows:

13. An image display apparatus according to Claim 1, wherein said electron-emitting devices are surface-conduction type electron-emitting devices.

14. An image display apparatus according to Claim 1, wherein each of said electron-emitting devices has a negative electrode serving as an electron-emitting portion.

UNITED STATES PATENT AND TRADEMARK OFFICE

CERTIFICATE OF CORRECTION

PATENT NO. : 6,140,985
DATED : October 31, 2000
INVENTOR(S) : Izumi Kanai, et al.

It is certified that error appears in the above-identified patent and that said Letters Patent is hereby corrected as shown below:

15. An image display apparatus according to Claim 1, wherein said electron-emitting devices are lateral field emission type electron-emitting devices.

Signed and Sealed this

Sixth Day of November, 2001

*Attest:*

Nicholas P. Godici

*Attesting Officer*

NICHOLAS P. GODICI
*Acting Director of the United States Patent and Trademark Office*